United States Patent [19]

Gottlieb

[11] Patent Number: 4,547,846

[45] Date of Patent: Oct. 15, 1985

[54] ACCESSORY INTERFACE CIRCUIT FOR UNIVERSAL MULTI-STATION DOCUMENT INSERTER

[75] Inventor: Robert K. Gottlieb, Bridgeport, Conn.

[73] Assignee: Pitney Bowes Inc., Stamford, Conn.

[21] Appl. No.: 482,731

[22] Filed: Apr. 6, 1983

[51] Int. Cl.[4] ..... B41L 43/00; B65B 57/04

[52] U.S. Cl. ..... 364/138; 364/478; 209/900; 271/2; 271/4

[58] Field of Search ..... 235/375; 364/130–139, 364/478, 200 MS File, 900 MS File; 209/900; 271/2, 3, 4

[56] References Cited

U.S. PATENT DOCUMENTS

| | | | |
|---|---|---|---|
| 3,606,728 | 9/1971 | Sather et al. | 53/54 |
| 3,934,867 | 1/1976 | Oeschger, Jr. | 270/32 |
| 4,253,148 | 2/1981 | Johnson et al. | 364/200 |

*Primary Examiner*—Jerry Smith
*Assistant Examiner*—Allen MacDonald
*Attorney, Agent, or Firm*—Michael J. DeSha; William D. Soltow, Jr.; Albert W. Scribner

[57] ABSTRACT

A method and associated apparatus for interfacing with envelope handling accessories for a universal multi-station document inserter for performing predetermined functions with envelopes having documents inserted therein by the multi-station document inserter, comprising the steps of providing an accessory interface microcomputer, arranging accessories responsive to output signals from the accessory interface microcomputer in an array, providing envelope sensing means in the array for providing clock signals to the accessory interface microcomputer, storing data words in the accessory interface microcomputer, certain of the data words indicating particular combinations of enelope sensing means for envelope jams and other data words indicating the type of accessory, its output location and providing clock data relating to the particular accessory, and indicating the accessories to be actuated by an envelope entering the array, storing envelope handling programs in the accessory interface microcomputer, and actuating the accessories of the accessory array under control of the accessory interface microcomputer in accordance with the data words stored therein in response to clock signals from the envelope sensing means.

25 Claims, 32 Drawing Figures

WIPPIT:

EJMARK:

SETBIT:

OUTPUT:

JMWORD:

OUTWRD:

OFFIT:
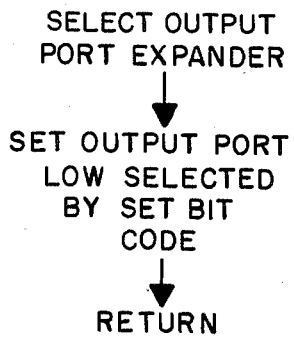
FIG. 4v
FIG. 4w
IBFEND:
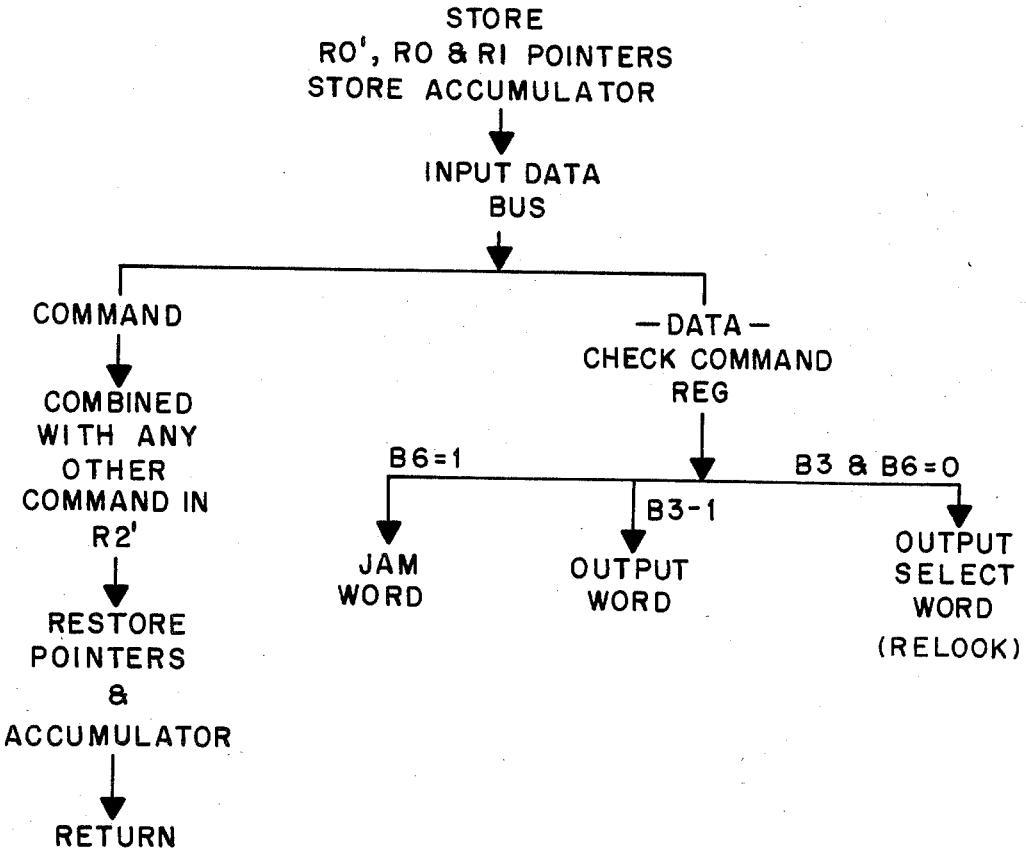

RELOOK:

ACCESSORY INTERFACE CIRCUIT FOR UNIVERSAL MULTI-STATION DOCUMENT INSERTER

CROSS-REFERENCE TO RELATED APPLICATIONS

This application is related to U.S. application Ser. No. 394,388 entitled "UNIVERSAL MULTI-STATION DOCUMENT INSERTER" filed July 1, 1982 in the names of Peter N. Piotroski and John M. Gomes, which is assigned to the same assignee as the present invention. The disclosure of the aforementioned patent application is incorporated herein by reference.

PROGRAM APPENDIX

A program listing for a supervisory control program of the type employed in the universal multi-station document inserter of the aforementioned related patent application is set forth as part of the specification at the end of the detailed description and before the claims as Appendix A. A program listing for the accessory interface circuit program is set forth as part of the specification at the end of the detailed description and before the claims as Appendix B.

BACKGROUND OF THE INVENTION

The present invention relates to document inserters, and more particularly to an accessory interface circuit for use in a multi-station document inserter.

Known multi-station document inserters employing document handling accessories such as mailing machines, stackers, zip code markers, envelope deflectors, and the like, generally employ discrete elements and are manufactured and wired for each specific customer application. Each such document inserter is manufactured as virtually a one-of-a kind machine with the attendant high costs associated therewith. Such apparatus typically require many weeks to design and manufacture, require substantial operator training time to operate, and are difficult and time consuming to service. One such multi-station document inserter document inserter is disclosed in U.S. Pat. No. 3,606,728 issued on Sept. 21, 1971 to Sather et al., and assigned to Bell & Howell Co., Phillipsburg, N.J. The accessories used with the known multi-station document inserters are hard wired to the inserter such that a change in the location or function of a particular accessory requires rewiring of the inserter and/or reprogramming thereof.

SUMMARY OF THE INVENTION

It is an object of the present invention to provide an accessory interface circuit for a universal multi-station document inserter.

It is a further object of the present invention to provide an accessory interface for a universal multi-station document inserter in which various document handling accessories may be employed to accommodate different customer applications without requiring reprogramming.

It is a further object of the present invention to provide an accessory interface for a multi-station document inserter which is capable of operating with a variety of different types of accessory document handling stations including, for example, no sealers, power stackers, vertical stackers, three-tier stackers, envelope deflectors, mailing machines, zip code markers and the like, without the need for rewiring or reprogramming the apparatus if changes are made in the location and/or function of the accessories.

Briefly, in accordance with the present invention, a method and associated apparatus is provided for interfacing with envelope handling accessories for a universal multi-station document inserter for performing predetermined functions with envelopes having documents inserted therein by the multi-station document inserter, comprising the steps of providing an accessory interface microcomputer, arranging accessories responsive to output signals from the accessory interface microcomputer in an array, providing envelope sensing means in the array for providing clock signals to the accessory interface microcomputer, storing data words in the accessory interface microcomputer, certain of the data words indicating particular combinations of envelope sensing means for envelope jams and other data words indicating the type of accessory, its output location and providing clock data relating to the particular accessory, and indicating the accessories to be actuated by an envelope entering the array, storing envelope handling programs in the accessory interface microcomputer, and actuating the accessories of the accessory array under control of the accessory interface microcomputer in accordance with the data words stored therein in response to clock signals from the envelope sensing means.

Other objects and advantages of the present invention will become apparent from the detailed description considered in conjunction with the preferred embodiment of the invention illustrated in the drawings as follows:

DETAILED DESCRIPTION OF THE INVENTION

Figure 1:
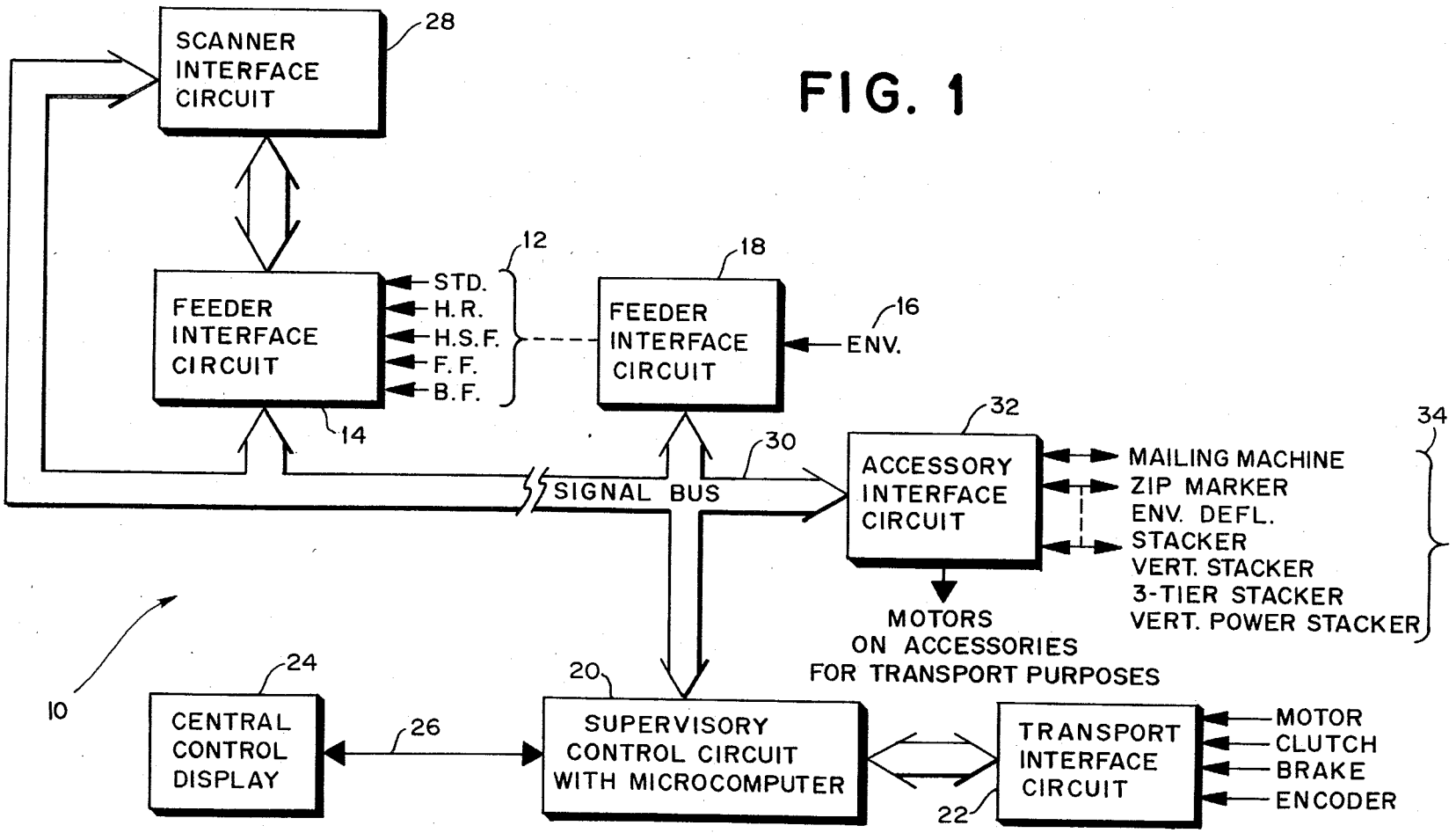
FIG. 1 is a block diagram showing a universal multi-station document inserter of the type within which the accessory interface circuit of the present invention may be utilized.

Referring to FIG. 1, a universal multi-station document inserter of the type disclosed in the aforementioned related patent application is designated as 10. As described in the aforementioned related patent application, the individual document feeder stations 12 may include a standard feeder (STD.), a high ratio feeder (H.R.), a high speed feeder (H.S.F.), a folder feeder (F.F.), and a bursterfolder feeder (B.F.), each of the document feeder stations 12 including a feeder interface circuit 14. An envelope feeder station 16 also includes a feeder interface circuit 18.

As described in detail in the aformentioned related patent application, a supervisory control circuit or central microcomputer 20 interacts directly with a transport interface circuit 22 to activate the transport motor, clutch and brake, and receives pulses from an encoder for control of a transport deck (not shown). The supervisory control circuit 20 also maintains interactive communication with a central control display 24 over a standard communication line 26. Advantageously the central control display 24 may be a finger touch display switch, such as FLUKE Model 1780A INFOTOUCH display. The supervisory control circuit 20 also communicates with a scanner interface circuit 28 through signal bus 30. The scanner interface circuit 28 communicates with feeder interface circuit 14. Communication between the supervisory control circuit 20 and the feeder interface circuit 14 (documents) and envelope feeder interface circuit 18 (envelopes) and an accessory interface circuit 32 in accordance with the present invention is maintained over the signal bus 30. Typical document handling accessories 34 which may be electrically connected to the accessory interface circuit 32 include conventional no sealers, mailing machines, zip code markers, vertical stackers, power stackers, envelope deflectors, vertical power stackers, three-tier stackers and the like. Communication with and control of the document handling accessories 34 is maintained through the accessory interface circuit 32.

As described in the aforementioned related patent application, the document inserter 10 includes a plurality of serially arranged modules including an envelope feeder station or module and document feeder stations including feeder modules and a burster folder station. A computer generated forms feeder feeds continuous form control documents having coded marks thereon to the burster folder for separating and folding. The coded marks on the control documents are sensed by a control scanner. Thereafter, the serially arranged feeder station sequentially feed the necessary documents onto a transport deck at each station as the control document arrives at the respective station to form a precisely collated stack of documents which is transported to the envelope feeder. The transport deck includes a ramp feed so that the control document always remains on the top of the stack of advancing documents. Such a transport deck is used in the INSERTAMAX III Mail Inserter available from Pitney Bowes Inc. of Stamford, Ct. However, it should be understood that the transport deck may be of other types such as that used in the INSERTAMAX II Mail Inserter available from Pitney Bowes Inc. of Stamford, Ct. or the transport deck disclosed in U.S. Pat. No. 3,934,867 issued on Jan. 27, 1976 and assigned to Pitney Bowes Inc.

The collated stack of documents is inserted in an envelope at the envelope station and transported to conventional accessory document handling stations 34 of the type previously described. First, envelope is sealed or not sealed as desired by a sealing unit. The necessary postage is then provided by a postage meter such as, for example, Pitney Bowes Inc. Model No. 4255 Postage Meter. The envelopes may then be transported to a single or multi-level stacker.

Referring to FIGS. *2a* through *2g* the accessory interface circuit is illustrated generally as 32. The accessory interface circuit 32 includes an accessory interface microcomputer 35, which may be a Model 8742 available from Intel Corporation. Address signals are received from the supervisory control circuit 20 over address lines 33 and inputted to the chip select port of the microcomputer 35 from the output of an OR gate 36. An address receive acknowledge signal is provided from the microcomputer 35 to the supervisory control circuit 20 over lead 38. Data signals are received from the supervisory control circuit 20 by the microcomputer 35 over input leads 39. A command signal is received from the supervisory control circuit 20 over lead 40.

Accessory interface circuit 32 includes a pair of port expanders 42 and 44. Port expander 42 is an input port expander which receives clock signals from the photocells (P.C.) and microswitches (MMTRP) of accessory document handling devices over input leads 46 after the clock signals are first applied to Schmitt trigger inverters 47. Port expander 44 is an output port expander 44 which provides output signals to the accessory document handling devices, see FIG. 1, over output leads 48. The input and output port expanders 42 and 44 may be Type 8243 available from Intel Corporation. Output leads 49 from the microcomputer 35 provide output signals to operate a relay for motor control and solenoids 50 for the belt stackers of the accessories 34, see FIG. 1. Leads 51 from the microprocessor 35 are coupled to the control ports of the input port expander 42 and the control ports of the output port expander 44 for the bidirectional transmission of data and the selection of input or output data control. An external timing circuit 52 provides start and stop timing signals to the microcomputer 35 over leads 54 for the zip code or envelope deflector, see FIG. 1.

Also connected to output lines 48 of the output port expander 44 are LED's actuated by drivers 57 to provide visual indication of the condition of individual accessory devices 34. Advantageously, the input lines 46 to the input port expander 42 includes LED's 58A and 58B and associated drivers 60A and 60B for field testing of the input ports of the input port expander 42. Likewise, the output leads 49 of the microprocessor 35 include LED's 62 and drivers 64 for field testing of the output ports of the microcomputer 35.

Figure 3:
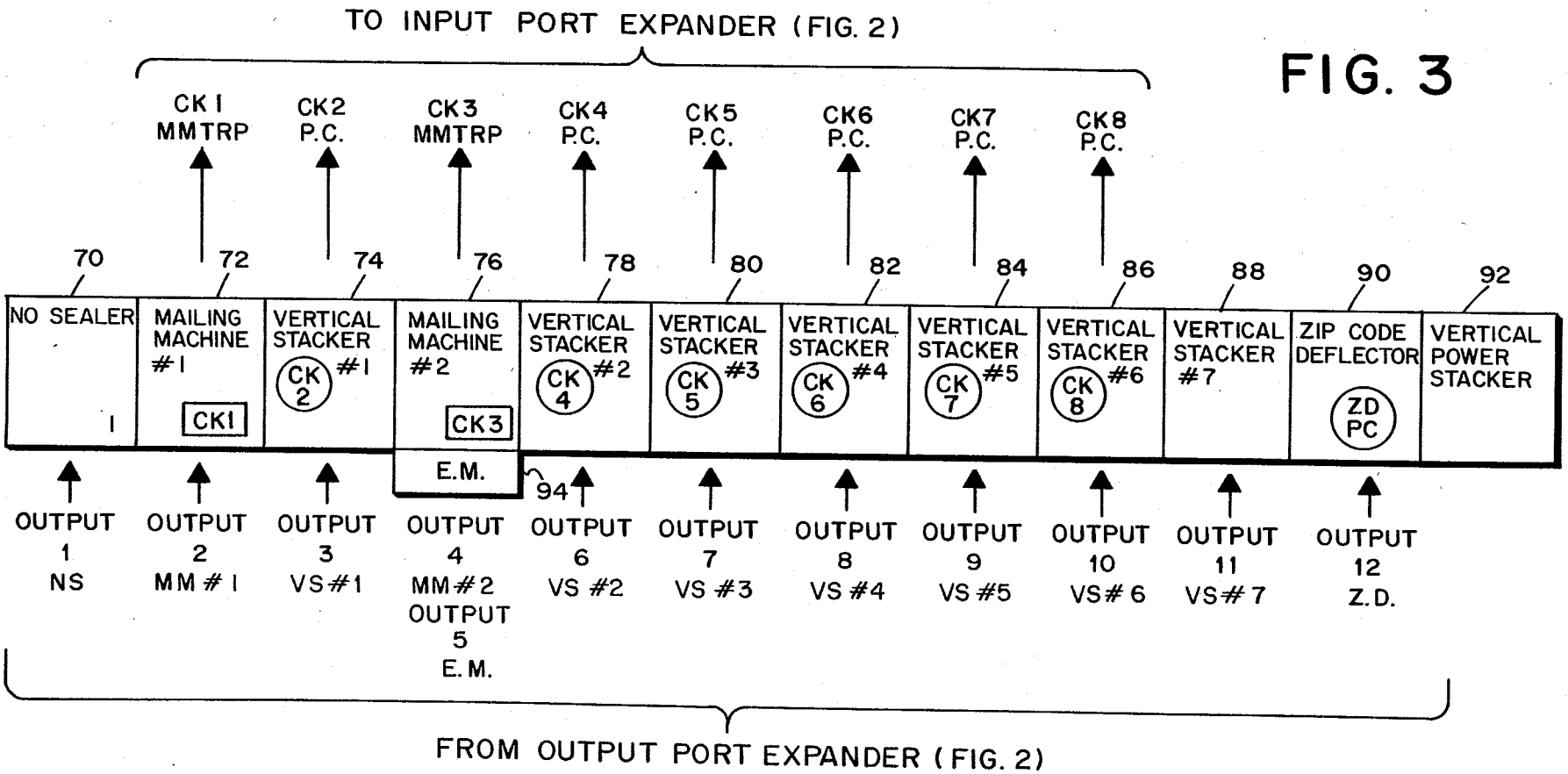
FIG. 3 is a block diagram showing one possible arrangement for the accessories to be used with the accessory interface circuit.

Referring to FIG. 3, a particular arrangement of accessory document handling devices 34 in accordance with the present invention is illustrated. However, it should be understood that any one of a variety of configurations of conventional accessory document handling devices can be used based on customer preference and in accordance with a data table entered into a configuration PROM in the supervisory control circuit 20. The array of accessory document handling devices includes a no sealer 70, a first mailing machine 72, a first verticle stacker 74, a second mailing machine 76 and second through seventh vertical stackers 78 through 88. A zip code or envelope deflector 90 and a vertical power stacker 92 are also included. Adjacent to the second mailing machine 76 is an edge marker 94. No sealer module 70 is employed to prevent or stop the sealing of evelopes received from the transport deck after passing through the array of feeder stations. Normally, stuffed envelopes containing inserted documents from the feeder modules are sealed, but on certain occasions, it is desirable not to seal the envelopes and the module 70 operates to prevent such sealing, for example, by using a solenoid driven deflection plate. As previously noted, the mailing machines 72 and 76 may be Models 4255 available from Pitney Bowes Inc. Multiple mailing machines facilitate the use of a postage break if the documents in an envelope exceed a predetermined number indicating additional postage is necessary. The various vertical stackers 78 through 88 may provide stacking by type, for example, zip sorting, overweight, for example over 3 ounces, sorting by mismatch, and sorting by control document code. Edge marking module 94 marks the edges of certain envelopes.

Zip deflector 90 is primarily employed with presorted mail to indicate the beginning or end of another batch of documents having a different zip code. This is also true for the edge marker unit 94.

Figure 4A:
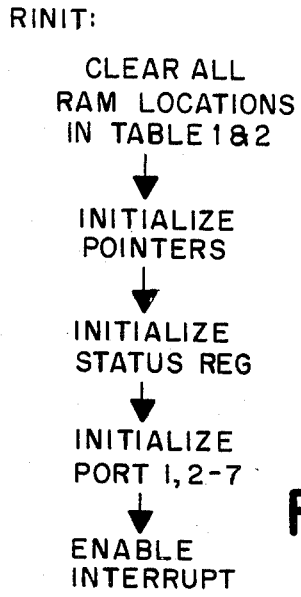
FIGS. 4*a* through 4*x* comprise is a flow chart of the routines and subroutines employed in the program for the accessory interface circuit of the present invention.
Figure 4B:
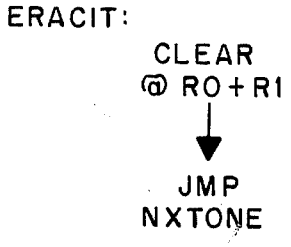
Figure 4C:
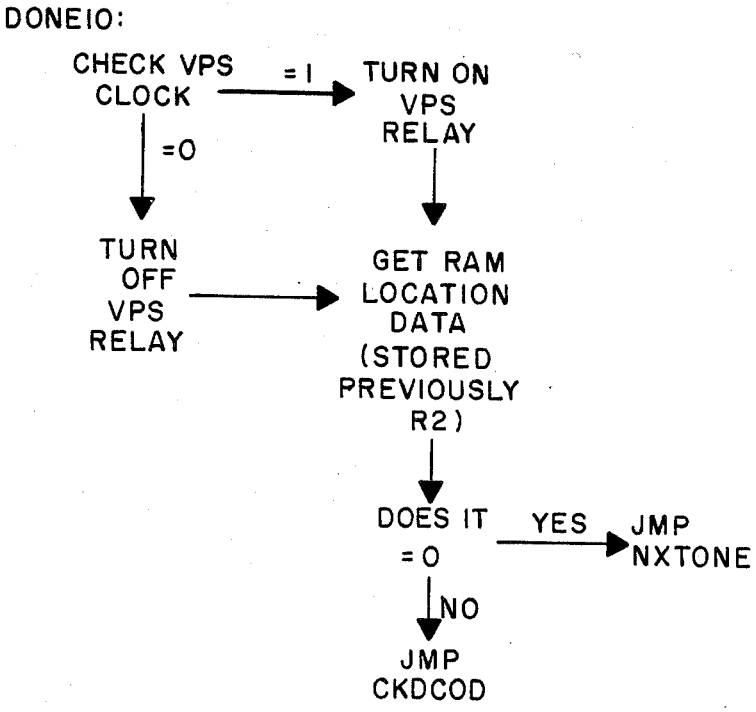
Figure 4D:
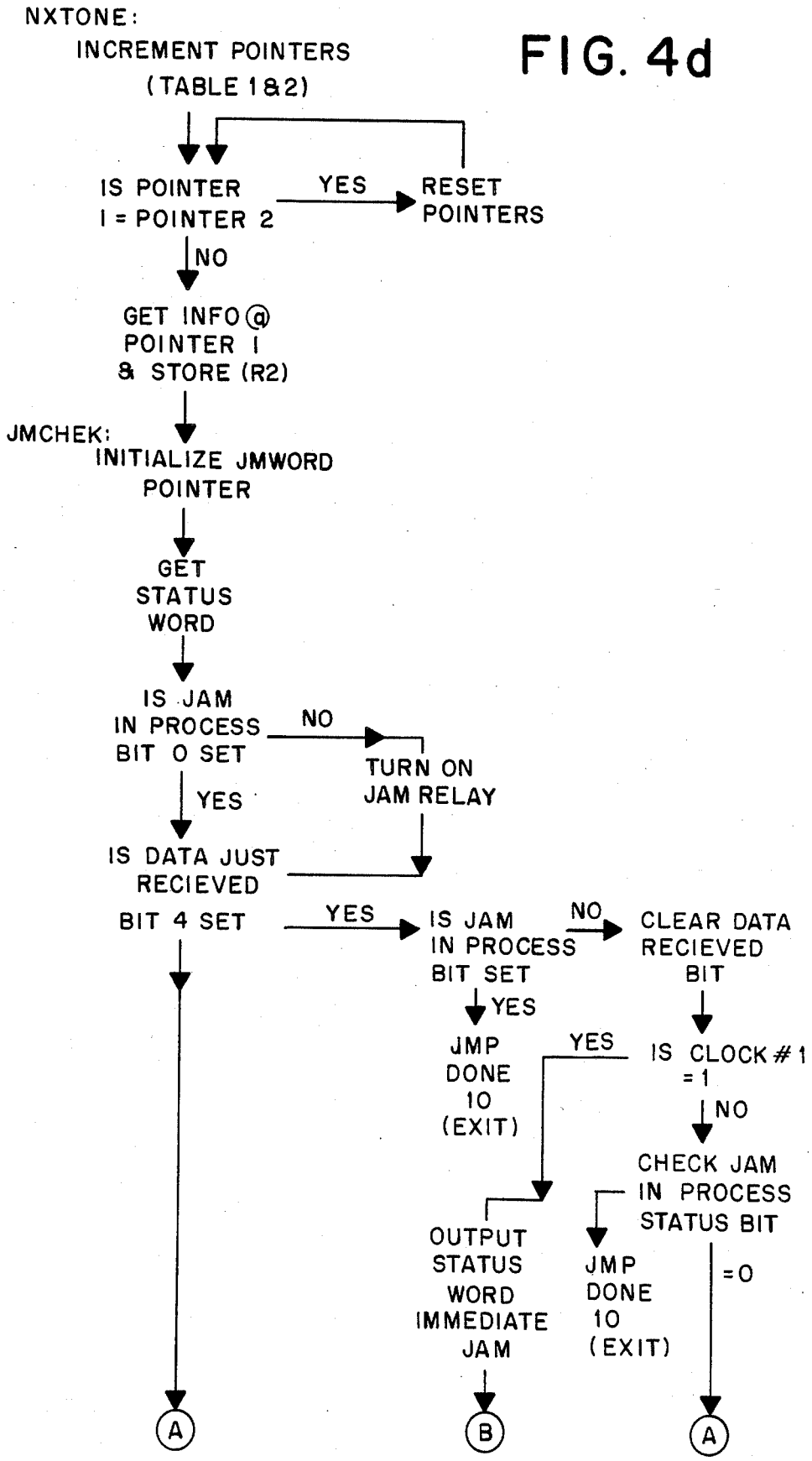
Figure 4E:
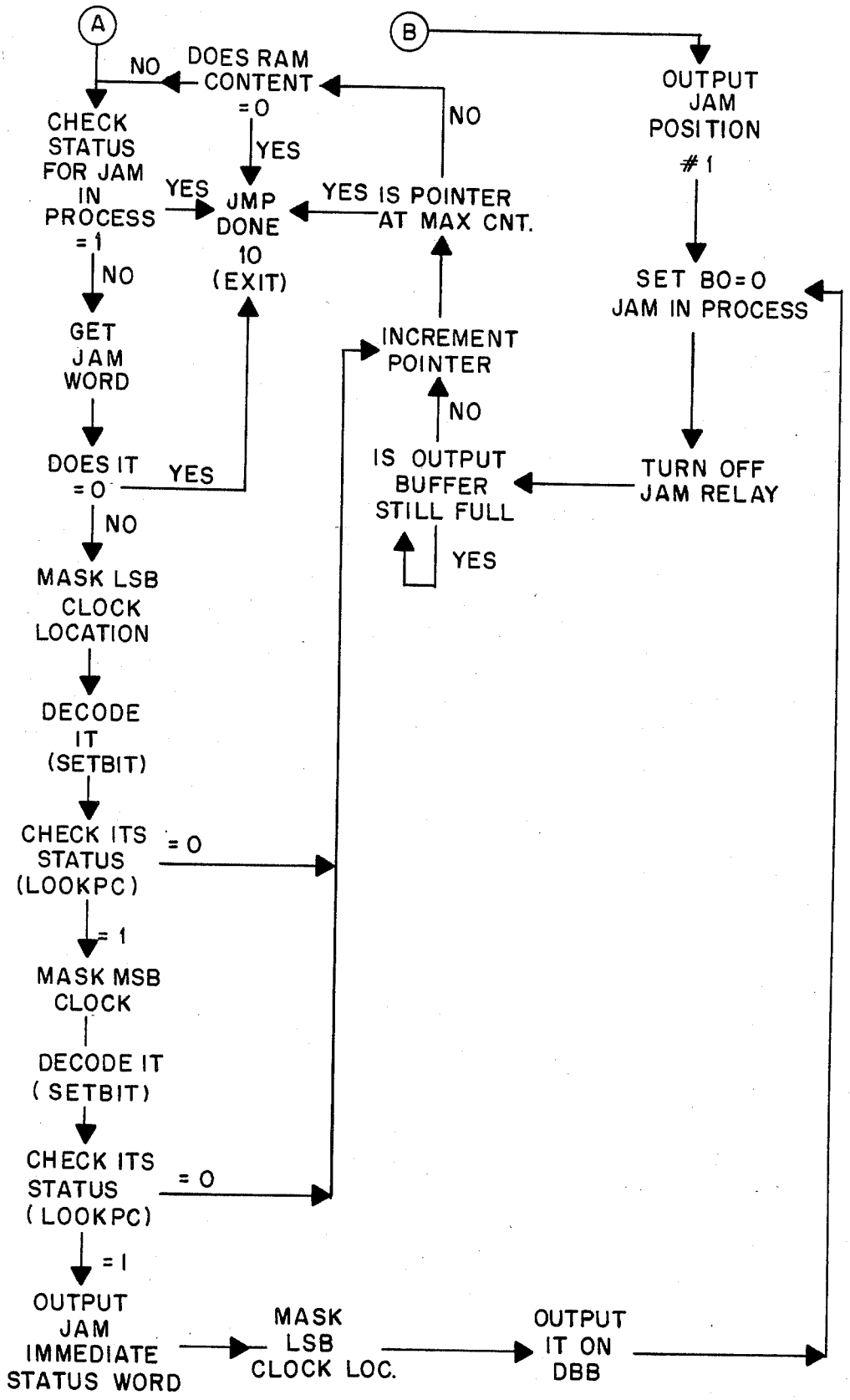
Figure 4F:
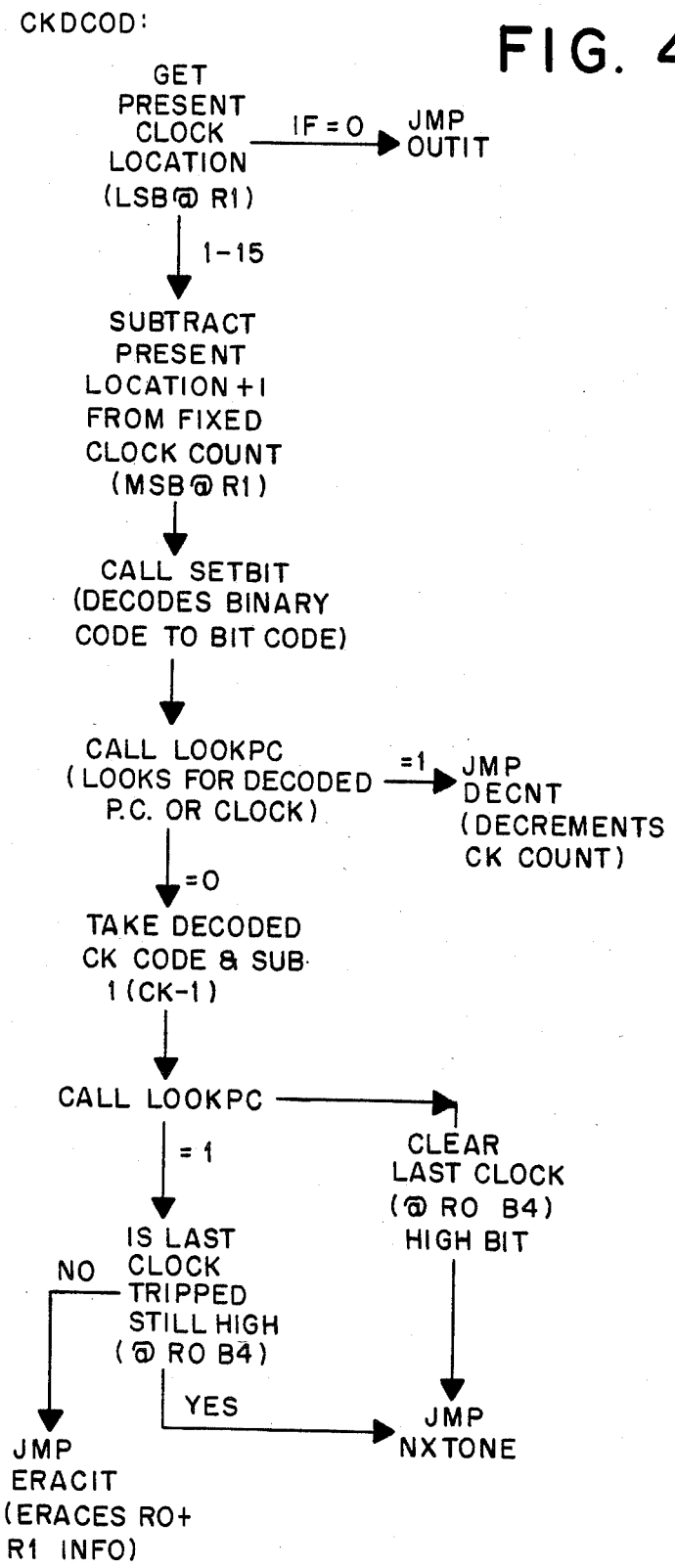
Figure 4G:
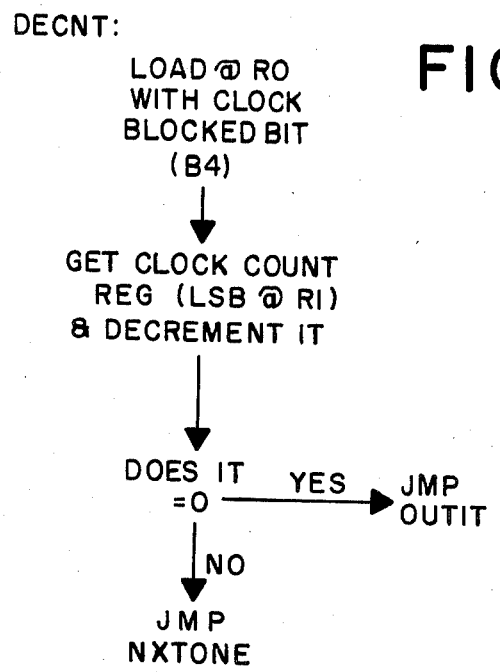
Figure 4H:
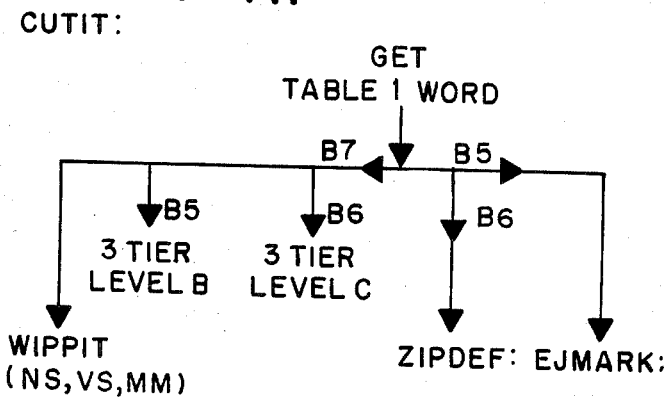
Figure 4J:
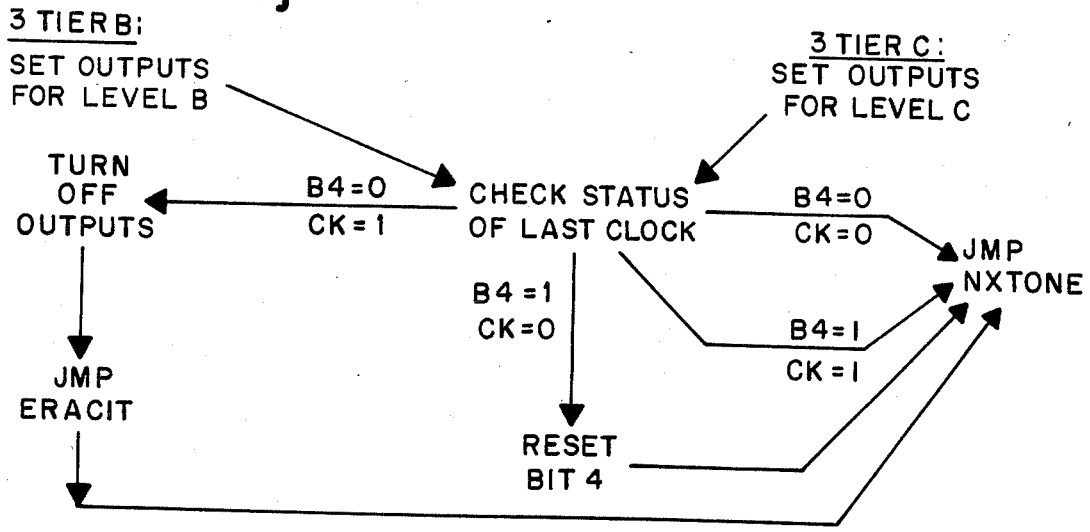
Figure 4K:
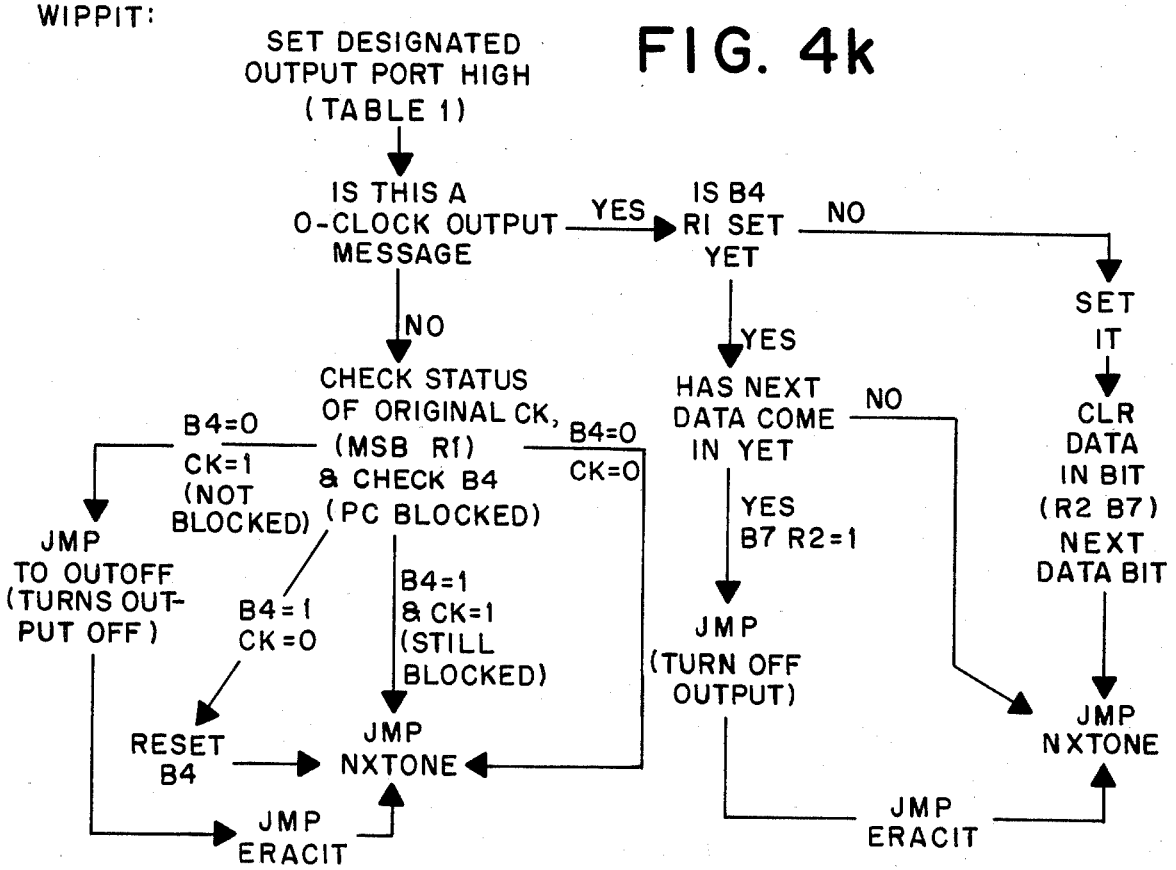
Figure 4L:
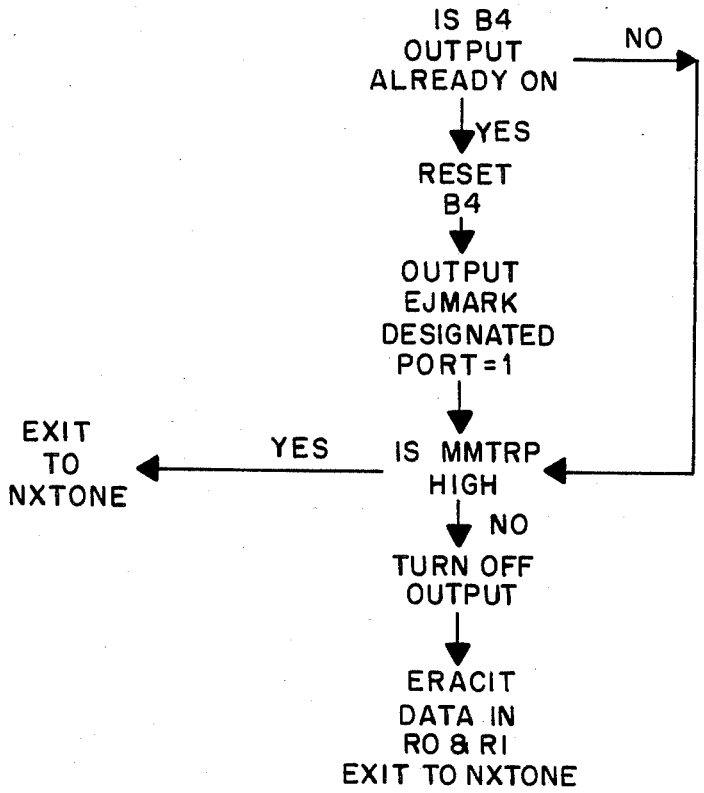
Figure 4M:
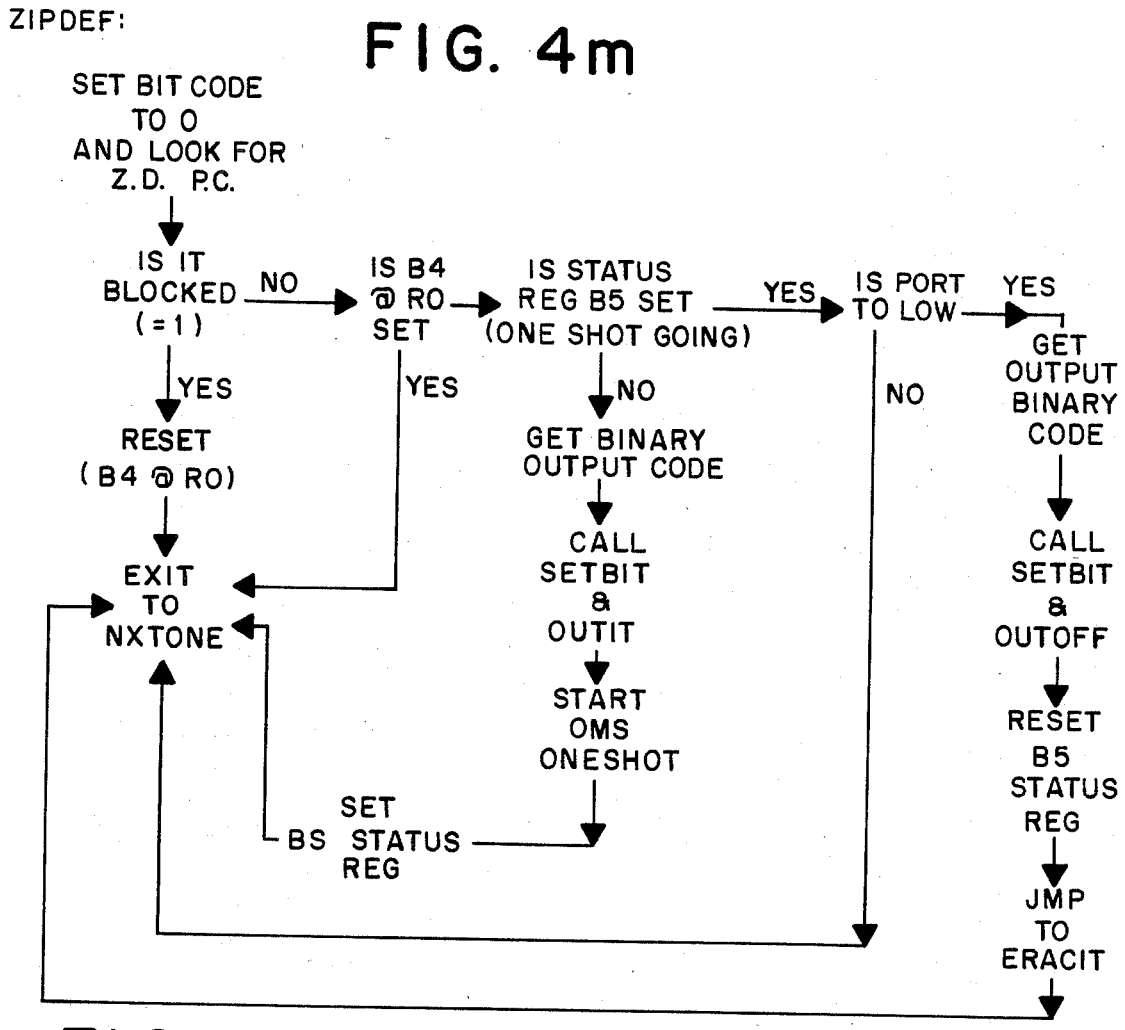
Figure 4N:
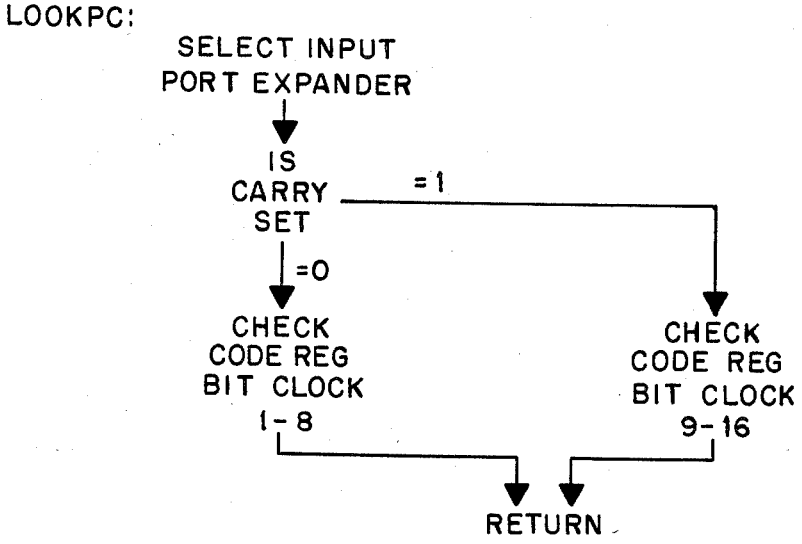
Figure 4P:
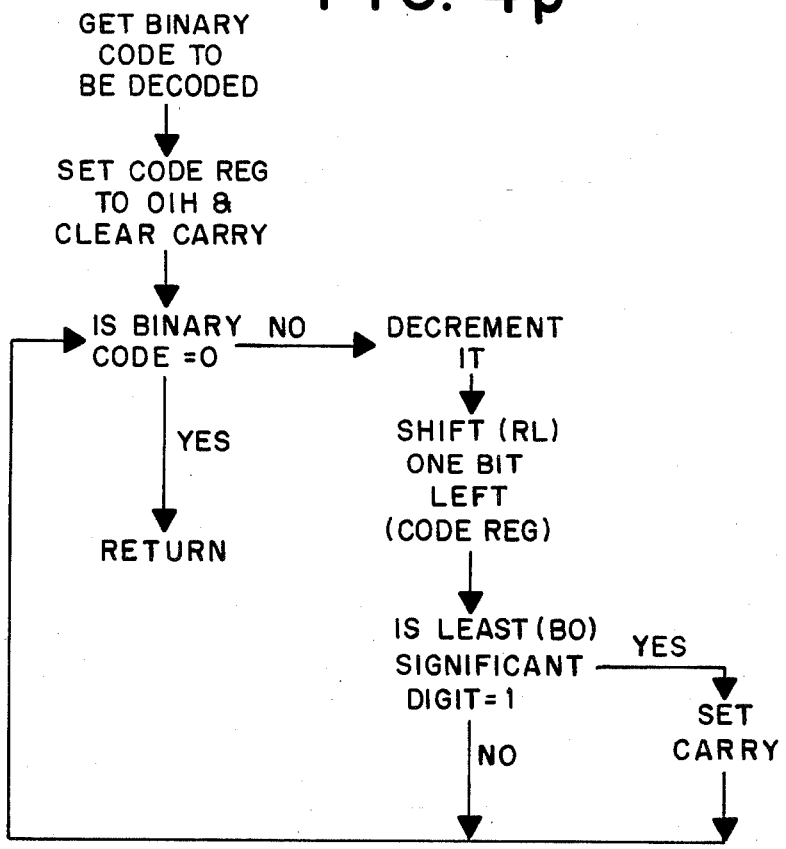
Figure 4P:
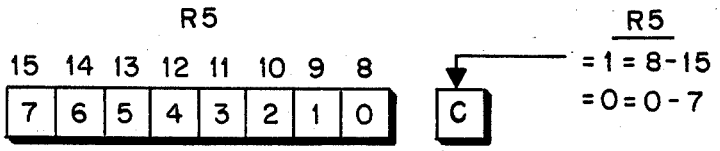
Figure 4Q:
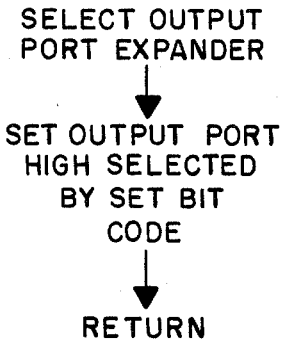
Figure 4R:
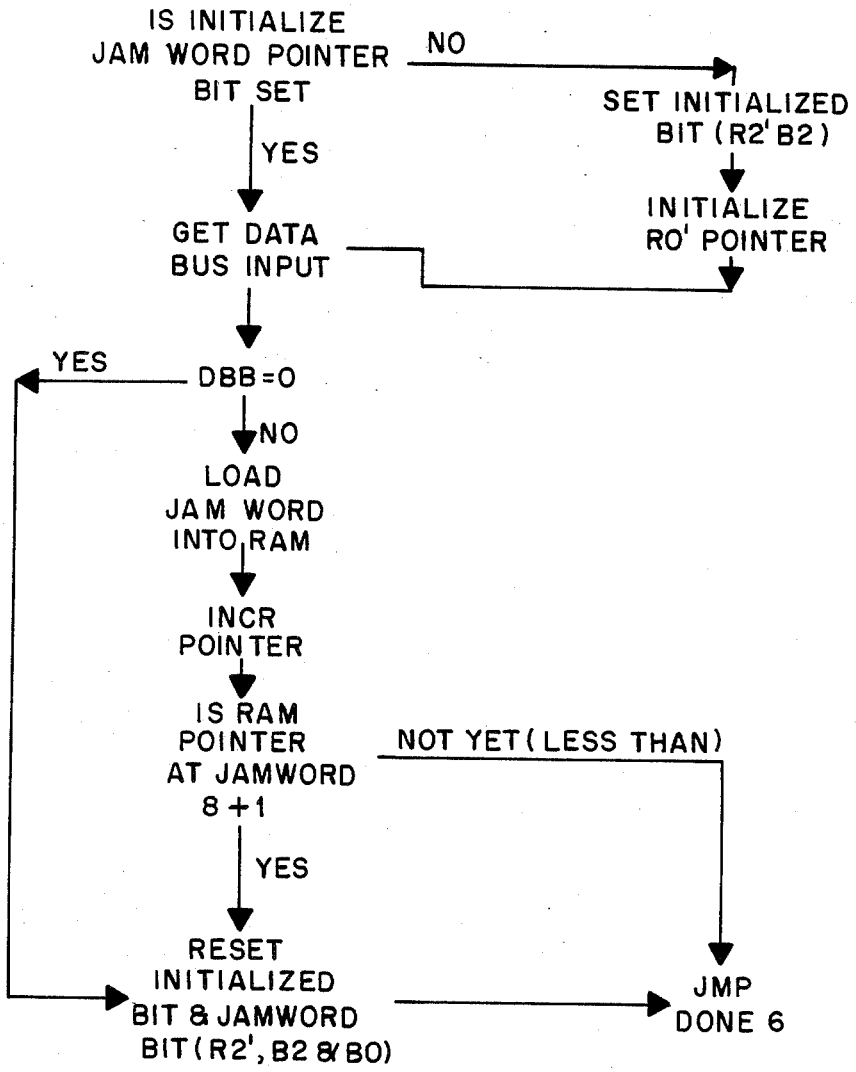
Figure 4S:
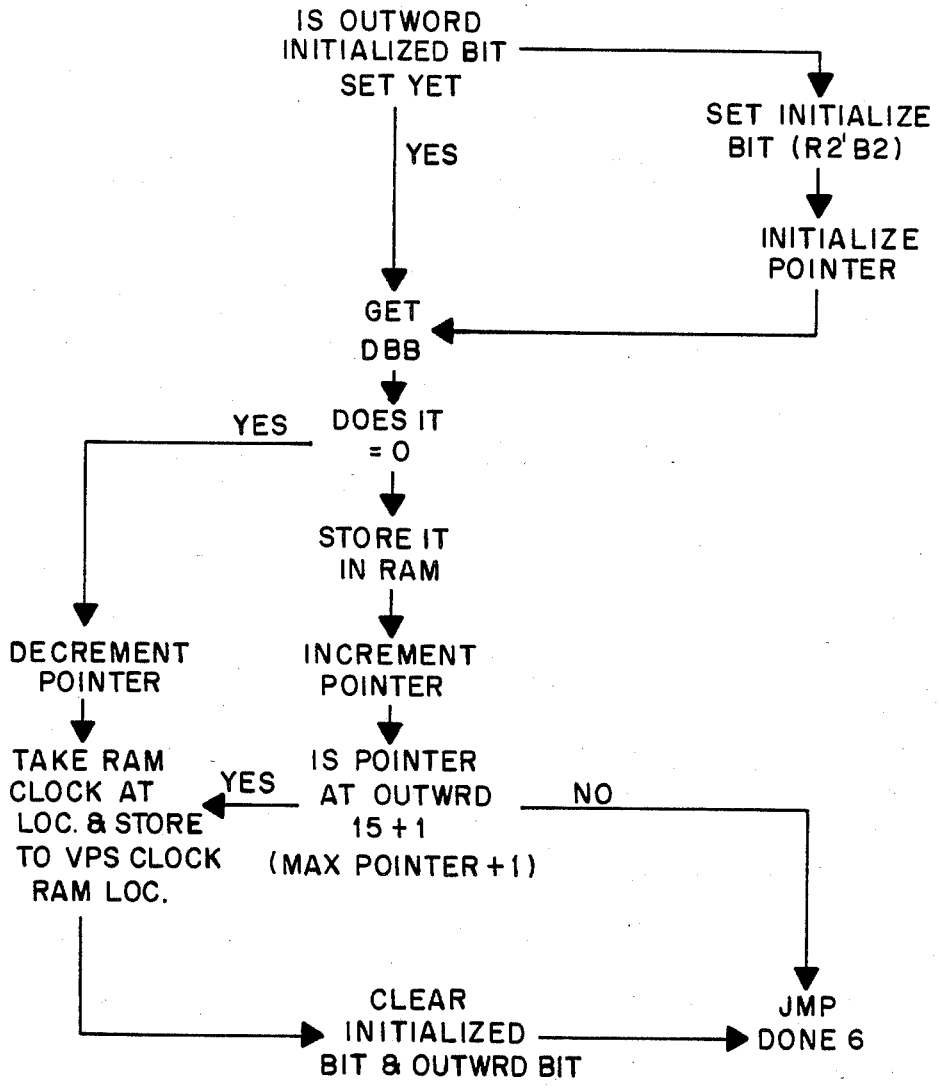
Figure 4T:
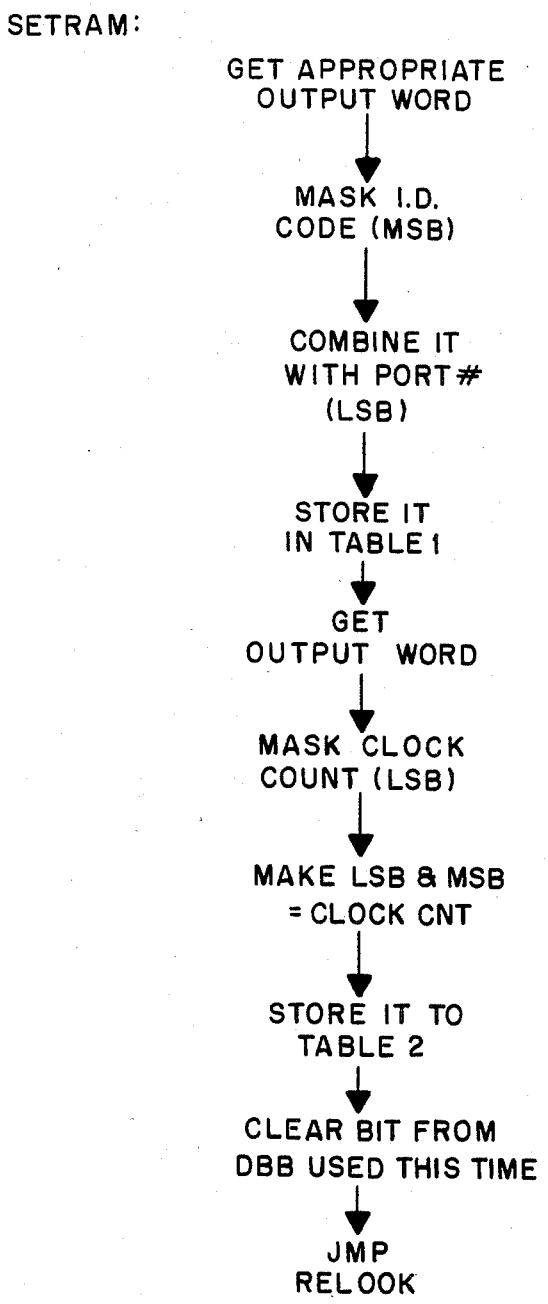
Figure 4U:
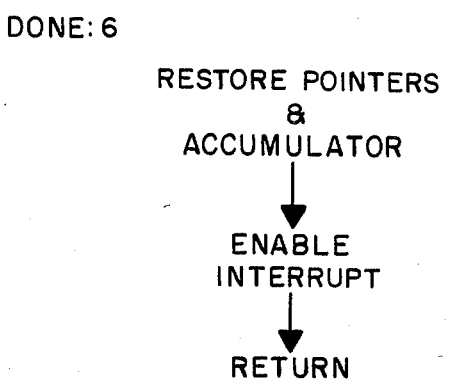
Figure 4X:
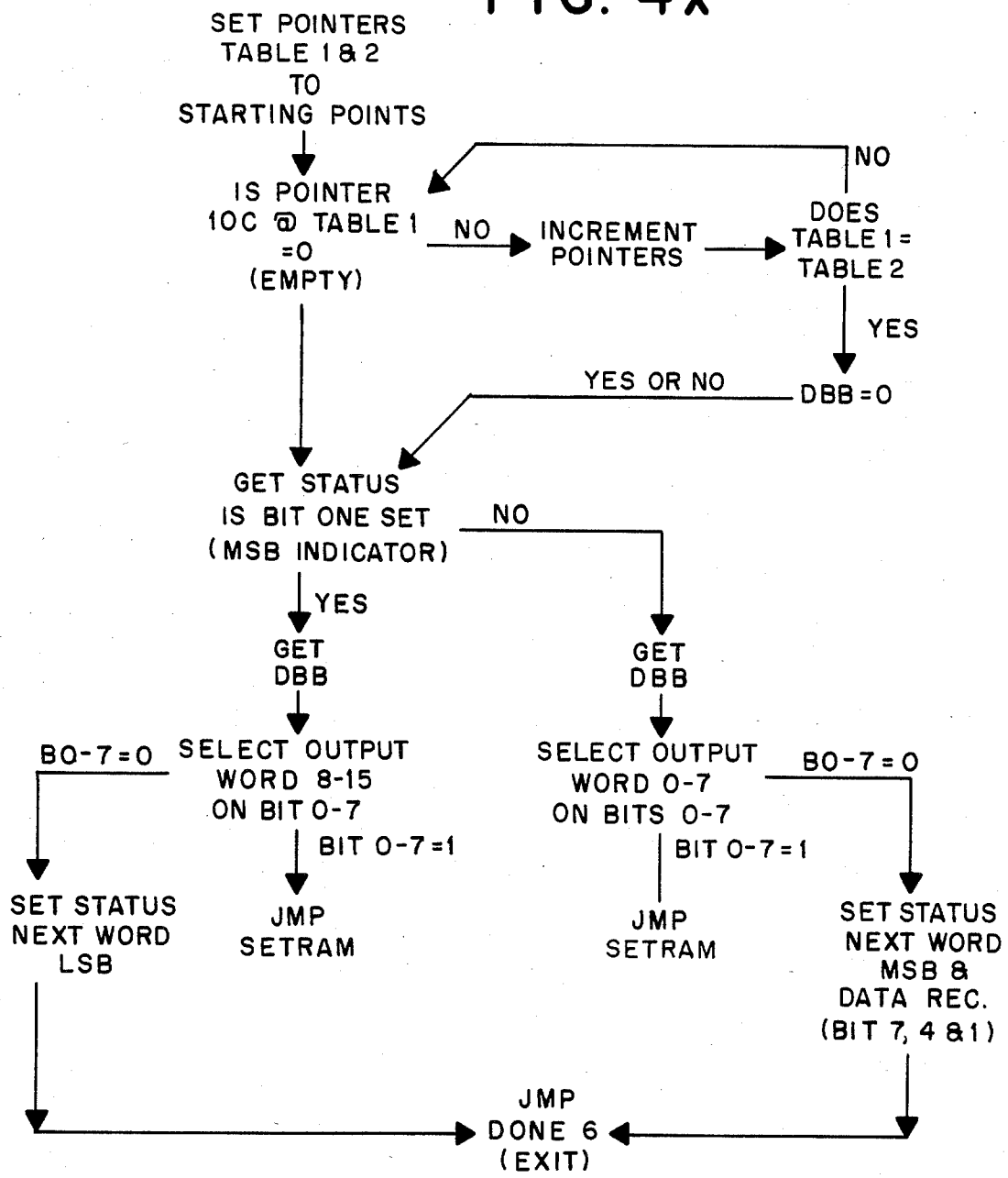

In FIGS. 4*a* through 4*x*, there is shown in flow chart form, the various routine and subroutines employed in the operation of the software resident in the ROM of the microcomputer 35 of the accessory interface circuit 32. When the document inserter is turned on (Power Up) the accessory interface circuit 32 enters into an initialization routine designated as RINIT (FIG. 4A) wherein the RAM of the microcomputer 35 is cleared of data and following this the RAM receives data from the supervisory control circuit 20 in the form of Jam Words and Output Words. The NXTONE Routine (FIG. 4D and E) increments through various RAM locations to determine if information exists at any RAM location. Incrementing proceeds through two tables containing Output Select Words from the supervisory control circuit 20. Each time a RAM location is checked for information, a check is also made of certain combination of photocells and microswitches (Jam Words) to determine if there is a jam, i.e., if a combination of two (2) photocells and/or microswitches as designated in the configuration PROM is occurring. The Done 10 Subroutine (FIG. 4C) is the end of the NXTONE Routine shown in FIGS. No. D and E. Further, within the NXTONE Routine are various other subroutines including SETBIT (FIG. 4P) which expands the Binary Code for the detection of photocell and microswitch status in the LOOKPC Routine (FIG. 4N) which looks for a particular photocell as set by the decoded Binary Code.

The CKDCOD (FIG. 4F) Routine decodes the words found in the tables in RAM, which pertain to the envelopes selected output functions or accessories, to interrogate the status of the next expected clock (P.C. or microswitch) employing the SETBIT and LOOKPC Subroutines. Also CKDCOD employs a DECNT Subroutine (FIG. 4G) which decrements the count of the expected clock stored with the coded information in the RAM tables and an ERACIT Subroutine (FIG. 4B) which erases the data in the RAM once the clock data has been decremented to zero and it is no longer needed. If the clock count is zero the CKDCOD Routine branches to an OUTIT Subroutine (FIG. 4H) which checks the various bits in the RAM table once the clock count is zero to determine the type of accessory device and therefore the next operation to be performed thereby. Specifically if a bit is present at location 7 of the 8 bit table 1 Word, the Routine WIPPIT (FIG. 4K) is commenced, indicating a no sealer, a vertical stacker or mailing machine accessory. If bits are present at both locations 6 and 7 of the 8 bit table 1 Word or at locations 7 and 5 of the 8 bit table 1 Word, the Routine 3 TIER B or 3 TIER C (FIG. 4J) is undergone to turn an accessory on or off. If a bit is only present at location 6, the Routine ZIPDEF (FIG. 4M) is commenced for the zip code deflector to deflect an envelope to indicate the end of one batch of zip codes or the beginning of another batch of zip codes. If a bit is only present at location 5, the Routine EJMARK (FIG. 4L) is commenced to mark the edge of an envelope.

The SETRAM Routine (FIG. 4T) takes the cyclic two (2) eight bit words of information, converts it into two words containing accessory identification information and clock count output port numbers and inserts this information into the table 1 and 2 portions of RAM for the microcomputer 35. The RELOCK Subroutine (FIG. 4X) is commenced to locate empty data locations in tables 1 and 2 of the RAM. If no more data is present for entry into the RAM tables 1 and 2, the DONE 6 Subroutine (FIG. 4V) is commenced to restore the pointer positions, the accumulator, and enable the interrupt.

The OUTWRD Routine (FIG. 4S) stores the Output Select Words sent from the supervisory control circuit 20 in RAM of the microcomputer 35 upon initialization. The JMWORD Routine (FIG. 4R) stores the Jam Words sent from the supervisory control circuit 20 in RAM of the microcomputer 35 upon initialization.

The JMCHEK Routine (FIG. 4D) is commenced during each reading of the RAM tables 1 and 2 for Jam Word and clock data (during NXTONE) to determine if there are any combination of clocks (photocells and/or microswitches) which are presently covered by an envelope thereby indicating a jam condition.

The OFFIT Subroutine (FIG. 4V) is used by the WIPPIT, 3TIER B, 3TIER C, ZIPDEF and EJMARK Rountines to turn off the outputs of the output port expander 44. The OUTPUT Routine (FIG. 4Q) is used by the WIPPIT, 3TIER B, 3TIER C, ZIPDEF and EJMARK Routines to turn on the outputs of the output port expander 44.

Finally, the IBFEND Routine (FIG. 4W) is commenced in response to information sent by the supervisory control circuit 20 to check the data input buffer for commands or data. If it is a command and bit 6 is high, JAM Word data will be sent. If it is a command and bit 3 is high Output Select Word data will be sent. The absence of a bit at either location results in commencement of the RELOOK Routine of FIG. 4X.

It should be understood that the particularly accessory configuration shown in FIG. 3, and the sequence of operaations has been stored in the data table of the configuration PROM contained in the supervisory control circuit 20. Upon initialization, this data is transmitted to the RAM in the microcomputer 35. The accessory interface circuit 32 actuates the specific document handling accessory in the proper sequence in accordance with the data received from the supervisory control circuit 20 during initialization and prior to an envelope entering the accessory array.

Data is received from the supervisory control circuit 20, see FIG. 1, in accordance with the data table stored in the configuration PROM. As previously noted and as discussed in the aforementioned related patent application, the data specifying the accessories to be used and their sequence of operation on specific coded documents, as well as jam data, are written into the data table of a configuration PROM, see U.S. Pat. No. 4,497,040, issued Jan. 29, 1985 in the names of Peter N. Piotroski and John M. Gomes entitled, METHOD AND APPARATUS FOR CUSTOMIZING A MULTI-STATION DOCUMENT INSERTER, assigned to the same assignee as the present invention.

Figure 2:
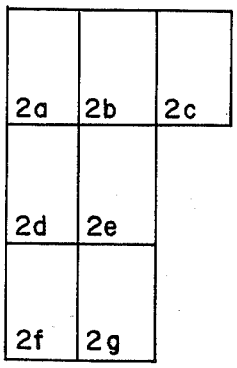
FIGS. 2 and 2*a* through 2*g* comprise a schematic diagram of an accessory interface circuit in accordance with the present invention.
Figure 2A:
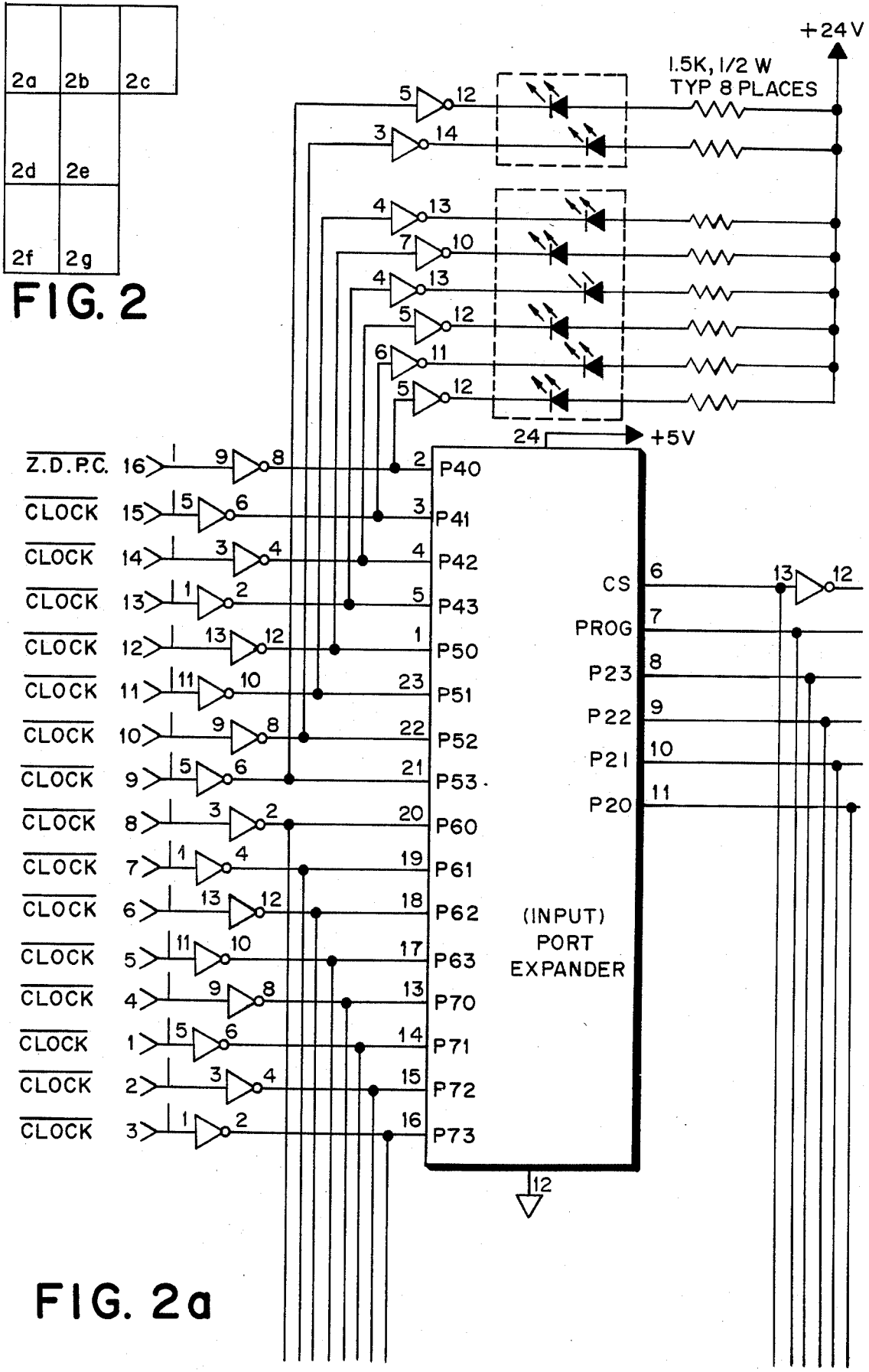
Figure 2B:
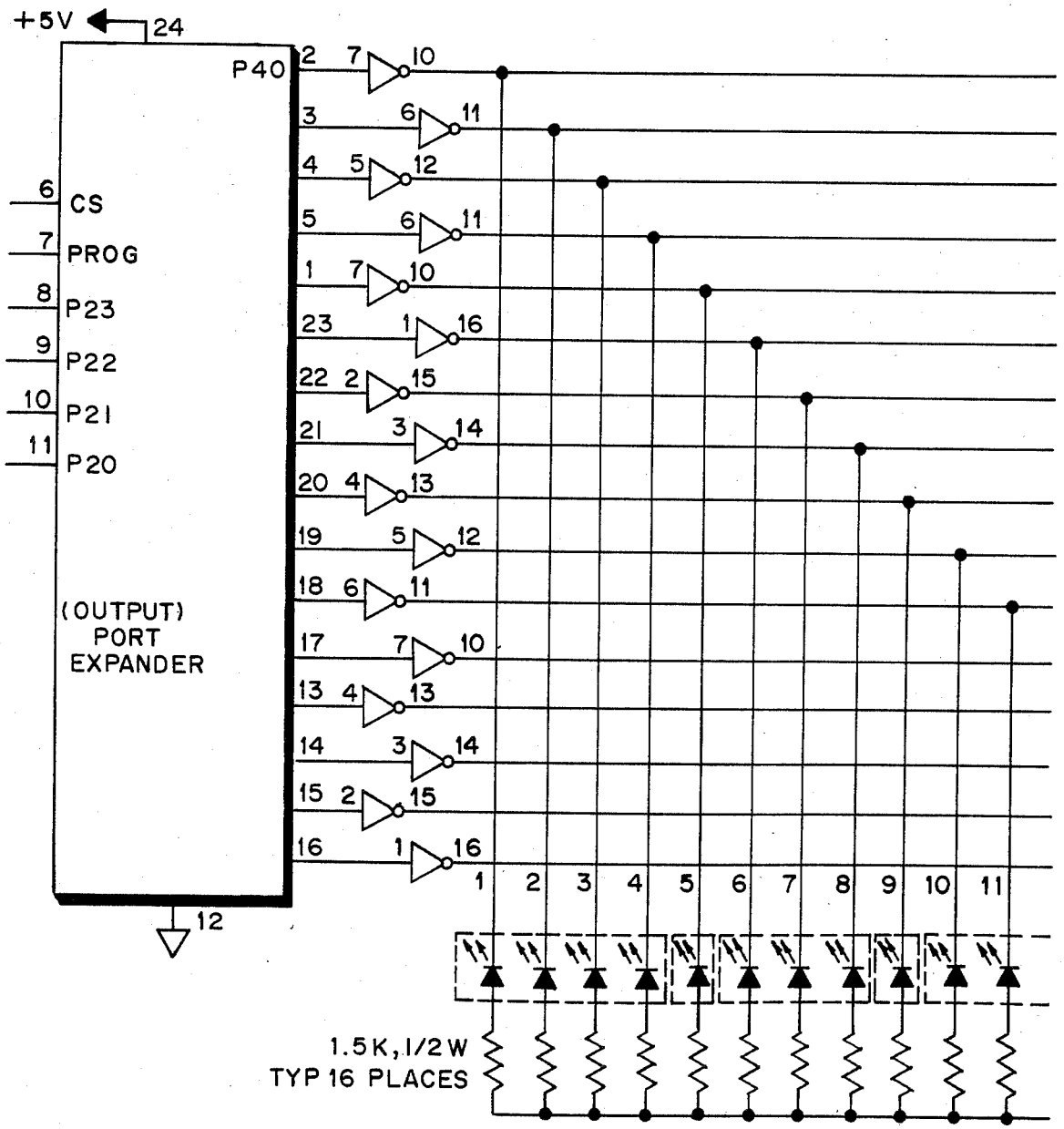
Figure 2C:
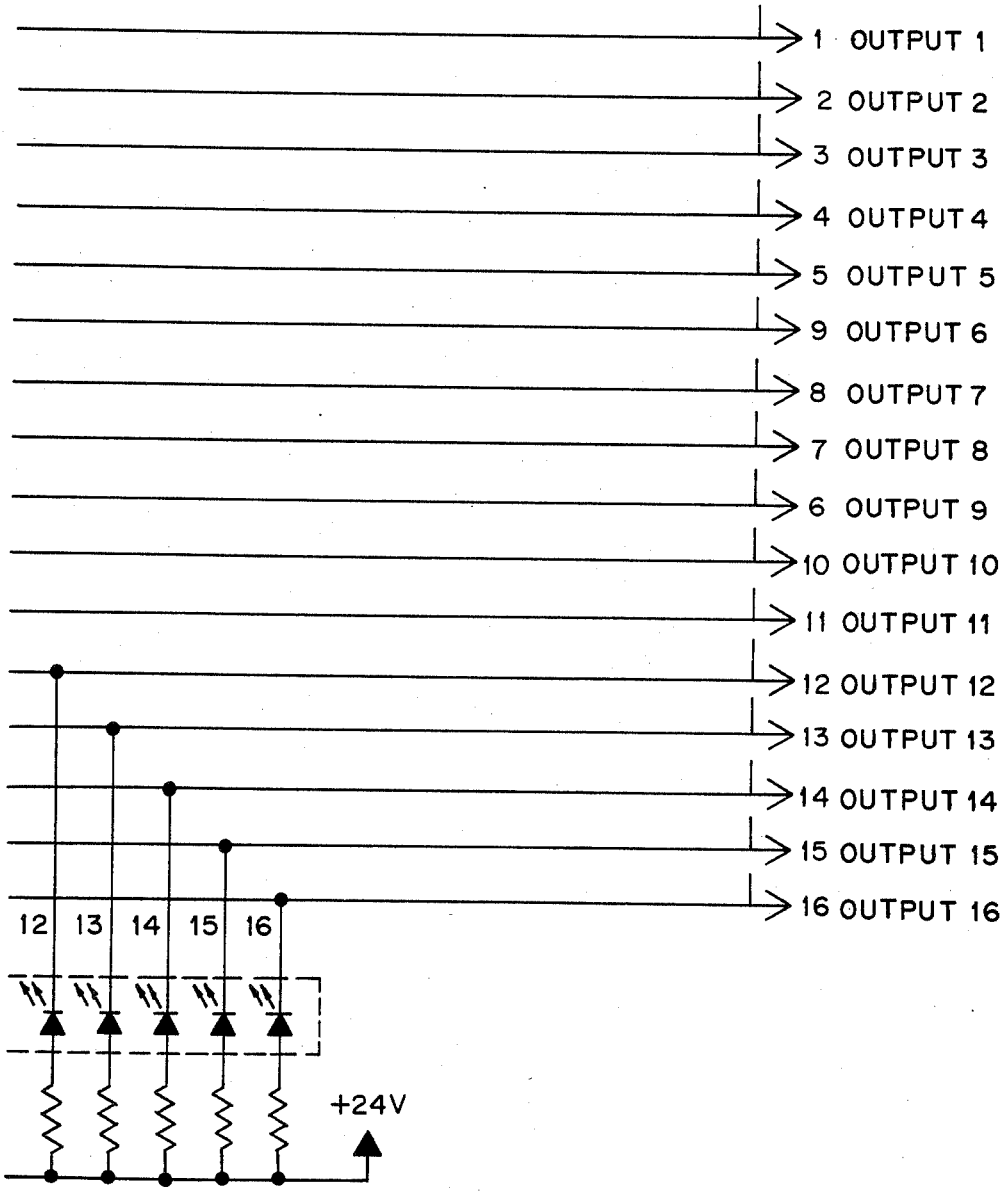
Figure 2D:
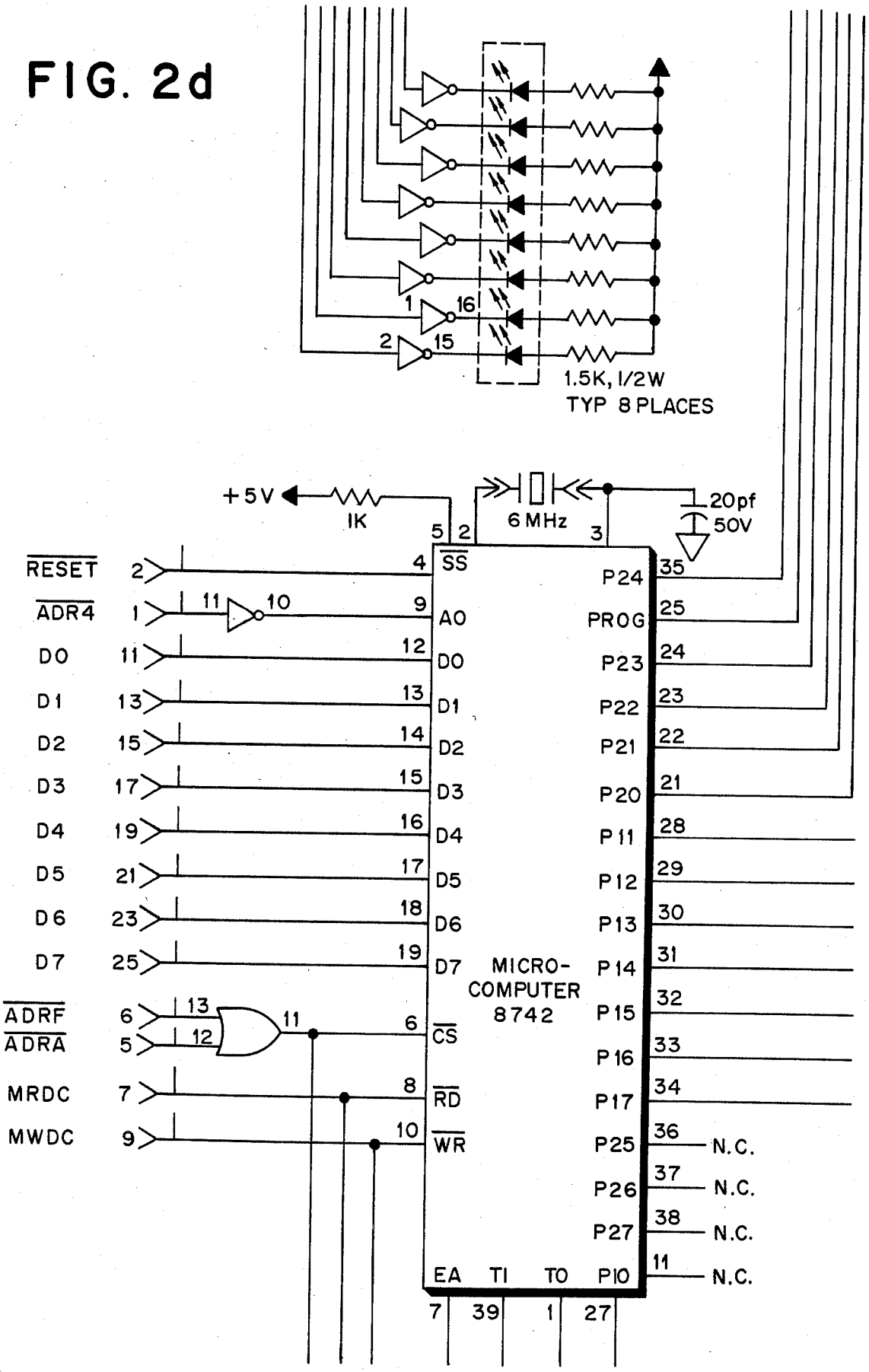
Figure 2E:
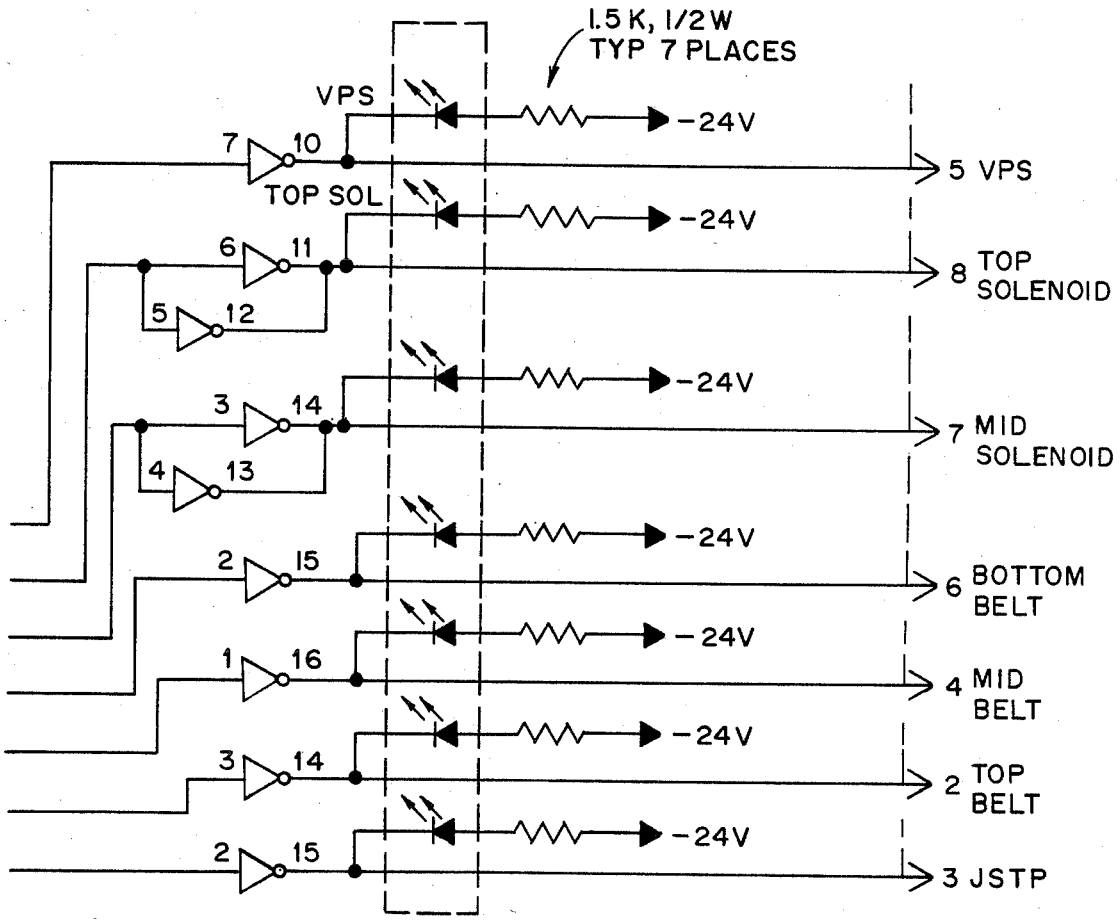
Figure 2F:
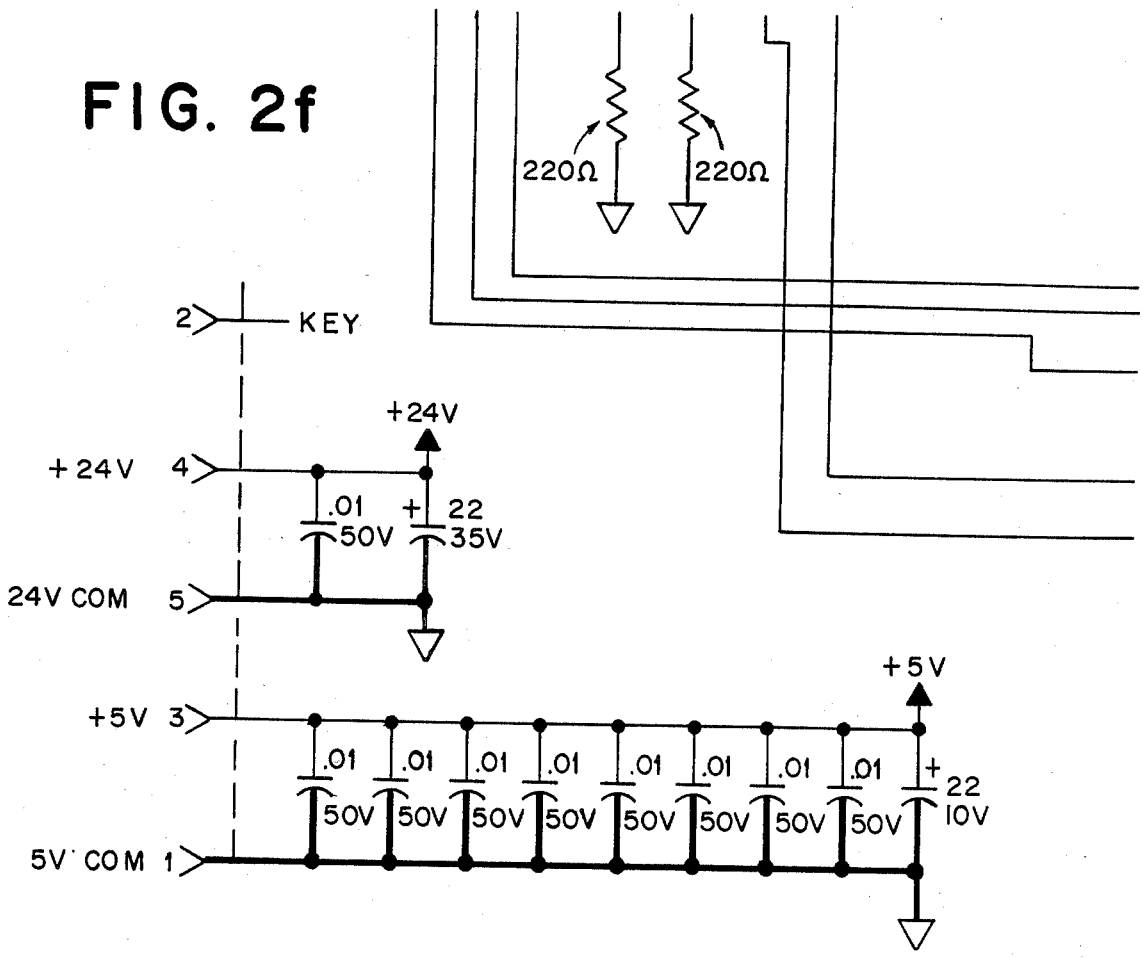
Figure 2G:
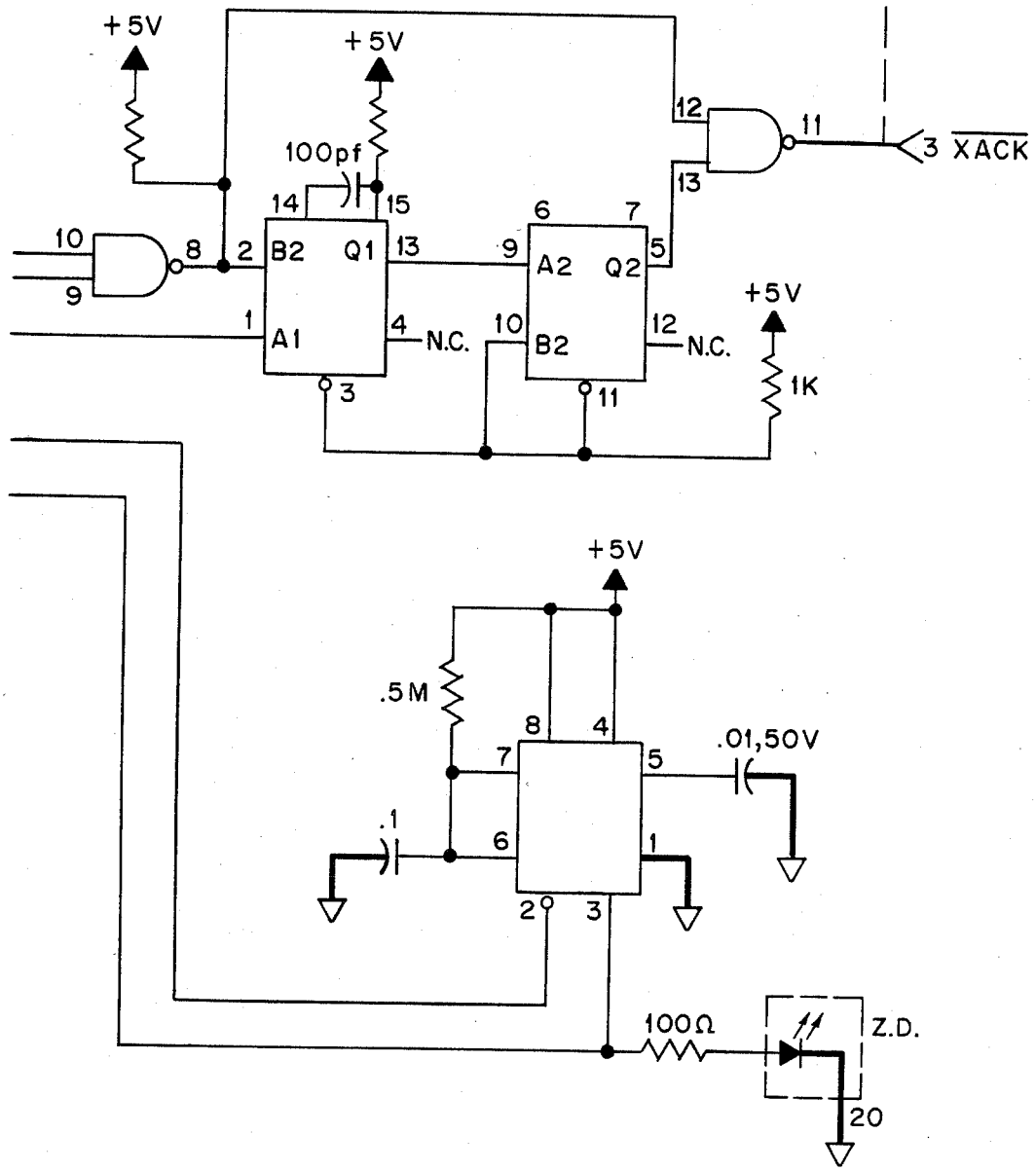

During Power Up, data in the form of JAM Words is sent to the accessory interface circuit 32, along with address bits ADRF and ADRA, which are decoded and loaded into the RAM of microcomputer 35. Thereafter, as an envelope with certain coded documents inserted therein leaves the inserter transport deck and is rotated for entry to the accessory array, e.g., by a turntable, the supervisory control program sends data, e.g., in the form of two eight bit words or two bytes, along with ADRF and ADRA bits to indentify the accessory interface circuit 32, to the microcomputer 35 over data leads 39, see FIG. 2.

Both or one of these two data words identifies the type of accessory or accessories to be actuated. From these 8 bit words, two more words are created and stored in RAM tables 1 and 2. The first word describes the specific output port location of the output port expander 44 and the type of accessory. The other word identifies the clock count associated with that particular accessory and a clock count to be decremented to zero for actuation of the particular accessory associated therewith. The clock inputs 1–15 and Z.D.P.C. as seen in FIG. 3 correspond to the photocells and microswitches of the accessories 34 and supply input signals to the input port expander 42 as shown in FIG. 3.

The output port expander 44 of FIG. 3 turns the accessories 70–92 on and off under control of the microcomputer 35 programmed in accordance with the accessory interface circuit program set forth in the Appendix B. Initially, two data words from the supervisory control circuit 20 are loaded into the RAM of the microcomputer 35 each time an envelope enters the accessory array, shown in FIG. 3. As long as the particular envelope is being transported through the accessory array its associated data words (Table 1 word—accessory identification and output port numbers and Table 2 word—(clock count) are retained in the tables in RAM. Upon completion of the functions on a particular envelope, the data words associated therewith, which were stored in tables in the RAM of the microcomputer 35, are erased by the ERACIT Routine of FIG. 4B. Additionally, the program stores data regarding the envelopes in the array and being processed in RAM. Parallel pointers scan the associated accessory and clock data words stored in the RAM Tables 1 and 2 and the proper output port of the output port expander 44 is energized when the clock count for a particular envelope has been decremented to zero. At this point, the accessory interface circuit program looks at the corresponding data stored in the table associated with the clock word to determine the type of accessory and output location to energize the proper output port.

The storage of the two data words in the data Tables 1 and 2 in the RAM is dynamic in that upon completion of the functions with respect to a particular envelope, its two identifying data words are erased. The clock signals are supplied from the photocells and microswitches of the accessories 70–92 as seen in FIG. 3 by the blockage of the photocells and the tripping of the microswitches by an envelope. Upon a particular clock data word being decremented to zero, its associated data word is read and the operation performed on the envelope in accordance with the outputs from the microcomputer 35 which result in an output at the desired output port of the output port expander 44 as seen in FIG. 3.

The specific Routines and Subroutines for accomplishing the aforementioned operation of the microcomputer 35 have been previously described with reference to the flow charts in FIG. 4.

It should be understood by those skilled in the art that various modifications may be made in the present invention without departing from the spirit and scope thereof as described in the description and defined in the appended claims.

ACCESSORY INTERFACE CIRCUIT FOR UNIVERSAL MULTI-STATION DOCUMENT INSERTER

APPENDIX A

Supervisory Control Program

```
LOC  OBJ        LINE        SOURCE STATEMENT

                  1 ; PITNEY BOWES COMPUTER OUTPUT MAILING SYSTEM
                  2
                  3
                  4
                  5
                  6
                  7 ;==============================================================
                  8 ;
                  9 ;                    * * * *   SECTION 1   * * * *
                 10 ;
                 11 ;        MEMORY LAYOUT
                 12 ;        CONFIGURATION FROM STORAGE ALLOCATION
                 13 ;        CONFIGURATION FROM DATA DEFINITIONS
                 14 ;
                 15 ;
                 16 ;==============================================================
                 17
```

```
                 18
                 19
                 20
                 21 ;------------------------- MEMORY LAYOUT
                 22
                 23
                 24 ;---- PROGRAM PROM
0000             25 PPBEG  EQU 0000H       ;BEGIN
                 26
                 27
                 28 ;---- CONFIGURATION PROM
5000             29 CP1BEG  EQU 5000H
5800             30 CP2BEG  EQU 5800H
6000             31 CP3BEG  EQU 6000H
6800             32 CP4BEG  EQU 6800H
                 33
                 34 ;---- RAM
7000             35 RAMBEG EQU 07000H
                 36
                 37
                 38 ;---- MEMORY MAPPED I/O
8000             39 MIOBEG EQU 8000H
                 40
                 41
                 42
                 43 ;---------------------------- CONFIGURATION PROM LAYOUT
                 44
                 45
0000             46         ORG 0
                 47
                 48 ;--------TIME TABLE
0000             49 TIMTAB: DS 6            ;CONTAINS EVENT TIMES IN CYCLE
                 50
                 51 ;------- NO. OF FEEDERS
0006             52 FDRCNT. DS 2            ;EXCLUDING CONTROL DOC. AND ENV. FEEDERS AND ACCESORY
                 53
                 54 ;-------- MULTIPLE STACKER BIT
0008             55 VSTK:   DS 2            ;VERTICAL STACKER COUNT
000A             56 TSTK:   DS 2            ;0 IF NO 3 TIER STACKER, NONZERO IF USED
                 57
                 58 ;-------- CONTROL DOCUMENT FEEDER PARAMETERS
                 59
0058             60 FBSIZE  EQU 88          ;FEEDER BLOCK SIZE
00D4             61 MPSIZE  EQU 212         ;MAP BLOCK SIZE
                 62
000C             63 PBF0:   DS FBSIZE       ;PARAMETER BLOCK -- FEEDER 0
0064             64 MAPS:   DS MPSIZE       ;SCAN MAP AREA -- FEEDER 0
                 65
                 66 ;------- FEEDERS 1 THRU 11 - PARAMETRS
                 67
0138             68 PBF1:   DS FBSIZE
0190             69 PBF2:   DS FBSIZE
01E8             70 PBF3:   DS FBSIZE
0240             71 PBF4:   DS FBSIZE
0298             72 PBF5:   DS FBSIZE
02F0             73 PBF6:   DS FBSIZE
0348             74 PBF7:   DS FBSIZE
03A0             75 PBF8:   DS FBSIZE
03F8             76 PBF9:   DS FBSIZE
0450             77 PBF10:  DS FBSIZE
04A8             78 PBF11:  DS FBSIZE
                 79
                 80
```

```
;*****************************************************************************
;
;NOTE:  FEEDER NUMBERING SCHEME USED IN ABOVE TABLE IS SHOWN BELOW FOR THE
;       A MACHINE USING SIX FEEDERS.
;
;NUMBER:     0          5       4       3     2       1      12     13
;DEVICE: CONTROL DOC=> FEEDER=>FEEDER=>FEEDER=>FEEDER=>FEEDER=>ENV=>ACCESSORY
;          FEEDER                                                FEEDER
;
;*****************************************************************************


;-------- ENVELOPE FEEDER
0500  PBENV:  DS 12

;--------- ACCESSORY
050C  MTRPOS: DS 2
050E  MT2POS: DS 2
0510  MKPOS:  DS 2          ;EACH OF THESE WORDS CONTAINS
0512  DFLPOS: DS 2          ;THE OUTPUT VALUE TO ACTIVATE THIS
0514  SLPOS:  DS 2          ;DEVICE ON THE CURRENT MACHINE
0516  STKAP:  DS 2
0518  STKBP:  DS 2
051A  STKCP:  DS 2
051C  STKPOS: DS 14
052A  OUTWDS: DS 18         ;ACCESSORY INITIALIZATION VALUES
053C  JMWDS:  DS 10         ;ACCESSORY JAM TIMES


;1.3  DEFINITIONS OF ITEMS IN ABOVE STORAGE AREAS==============================


;------------ FEEDER PARAMETERS

0000          ORG 0

0000  DEVTYP: DS 2   ;DEVICE TYPE -- STF,SCF,ENVF,ACCESSORY
0002  SLSTAT: DS 2   ;SELECTION STATUS

;-- PARAMETERS COPIED TO RAM STATION CONTROL BLOCK

0004  CFDTIM: DS 2   ;FEED TIME
0006  TSON:   DS 2   ;ENCLOSURE SENSE ON TIME
0008  TSOFF:  DS 2   ;ENCLOSURE SENSE OFF TIME
000A  COPCNT: DS 2   ;OPERATOR'S FEED COUNT
000C  CMMCNT: DS 2   ;MISMATCH COUNT
000E  CPBRK:  DS 2   ;POSTAGE BREAK OPTION
0010  CPBLOW: DS 2   ;POST BREAK COUNT -- LOWER LIMT
0012  CPBHI:  DS 2   ;POST BREAK COUNT -- UPPER LIMIT
0014  CFDSTP: DS 2   ;FEED STOP METHOD

;-- ACCESSORY CONTROL CODES FOR ERROR CONDITIONS

0016  ACCVE:  DS 2   ;COUNT VERIFICATION ERROR
0018  ACMCE:  DS 2   ;MATCH CODE ERROR
001A  ACBRK1: DS 2   ;COUNT BETWEEN POSTAGE BREAK LIMITS
001C  ACBRK2: DS 2   ;COUNT EXCEEDS UPPER POSTAGE BREAK LIMIT
001E  ACDBL:  DS 2   ;HARDWARE - DOUBLE ERROR
0020  ACFTF:  DS 2   ;          - FEED FAILURE
0022  ACLTF:  DS 2   ;          - FEED LATE

;--SCANNER INITIALIZATION DATA
```

```
                145
0024            146 CHNCNT: DS 2    ;CHANNEL COUNT (#BITS USED IN 1 SCAN BYTE
0026            147 SCNCNT: DS 2    ;NO  OF BYTES RETURNED BY SCANNER
0028            148 ZONCNT: DS 2    ;ZONE COUNTS
002A            149 DELAY1: DS 2    ;AREA 1 DELAY
002C            150 DELAY2: DS 2    ;AREA 2 DELAY
002E            151 BCHMRK: DS 2    ; BENCH MARK BIT
0030            152 SCNCOD: DS 2    ; CODE WORD GOVERNING MATCH AND EOC CODES
0032            153 EOCMAP: DS 8    ; BIT IMAGE OF END OF COLLATION CODE
003A            154 LINWD1: DS 2    ;LINE SPACING #1
003C            155 LINWD2: DS 2    ;LINE SPACING #2
003E            156 LINWD3: DS 2
0040            157 LINWD4: DS 2
0042            158 SFBIT1: DS 2    ;SAFETY MAP 1 USED
0044            159 SFMAP1: DS 8    ;SAFETY MAP 1
004C            160 SFBIT2: DS 2    ;SAFETY MAP 2 USED
004E            161 SFMAP2: DS 8    ;SAFETY MAP 2
0056            162 MCHBIT: DS 2    ;MATCH CODE USED
                163
                164
                165
                166 ;------------- STATION 0 SCANNER MAPS
0000            167         ORG 0
                168
0000            169 MCHMAP: DS 14   ;MAP FOR MATCH CODE
000E            170 FEEDMP: DS 11*12 ;FEEDER SELECT MAPS, 1/FEEDER
0092            171 STPMAP: DS 4    ;STOP CODE
0096            172 MTRMAP: DS 4    ;METER MAP
009A            173 MTR2MP: DS 4    ;METER 2 MAP
009E            174 SLRMAP: DS 4    ;SEALER MAP
00A2            175 MRKMAP: DS 4    ;MARK MAP
00A6            176 DFLMAP: DS 4    ;DEFLECTOR MAP
00AA            177 STKMAP: DS 10*4 ;STACKER MAPS
00D2            178 USEBCD: DS 2    ;BCD OR BINARY FLAG
                179
                180
                181
                182
                183
                184 ;=================================================================
                185 ;
                186 ;                        ***   SECTION 2 ***
                187 ;
                188 ;
                189 ;                  RAM STORAGE ALLOCATION AND DEFINITIONS
                190 ;
                191 ;
                192 ;=================================================================
                193
                194
                195
                196
                197
                198 ;-----------------------------------------------------------------
                199 ;2.1 SYSTEM STORAGE
7200            200         ORG RAMBEG+200H
                201
                202 ;-------- THE STACK
7200            203 STAK   EQU $
                204
                205 ;-------- SYSTEM STATUS
7200 00         206 RMODE:  DB 0    ;RUN MODE
7201 00         207 MSTATE: DB 0    ;MACHINE STATE
```

```
7202 0000   208 PCOUNT: DW 0    ;PIECE COUNT
            209
            210 ;------------------ EXCEPTION HANDLING AND RECOVERY
            211
            212 ;---- ERROR RECORD
7204 00     213 ERRNUM: DB 0    ;ERROR NUMBER
7205 00     214 ERRSTN: DB 0    ;OFFENDING STATION
            215
            216 ;---- ERROR FILE, CONTAINS UP TO 24 ERROR RECORDS
            217
7206        218 EFBEG:  DS 2*24 ;BEGIN OF ERROR FILE
7236 0000   219 EFEND:  DW 0    ;END OF ERROR FILE
7238 0000   220 EFLAST: DW 0    ;POINTS TO CURRENT END
723A 0000   221 EFPTR:  DW 0    ;FETCHING POINTER
            222
            223
            224 ;-------- COPY OF ERROR TABLE ENTRY CORRESPONDING TO ERRNUM
723C 00     225 ERRCW0: DB 0    ;CONTROL WORD
723D 00     226 ERRCW1: DB 0    ;ACCESSORY CODE ADDRESS
723E 00     227 HLTCOD: DB 0    ;REASON FOR HALT
723F 00     228 ERRCOD: DB 0    ;REASON FOR ERROR HALT
7240 00     229 ERRSTK: DB 0    ;ERROR STACKER FIELD
            230
            231 ;------ HALT AND RECOVERY
7241 00     232 HLTBIT: DB 0    ;HALT TRANSPORT
7242 00     233 ERRFLG: DB 0    ;INDICATES STATE OF ERROR PROCESSING
7243 00     234 RCVCOD: DB 0    ;RECOVERY CODE
            235
            236
            237
            238 ;----- MORE SYSTEM INDICATORS
7244 00     239 ENABIT: DB 0    ;SET TO 1 FOR START UP,0 FOR SHUT DOWN
7245 00     240 ENVSTN: DB 0    ;ENVELOPE FEEDER STATION
7246 00     241 ACSSTN: DB 0    ;ACCESSORY STATION
7247 00     242 FDACTR: DB 0    ;NO. OF ACTIVE FEEDERS
            243
7248 0000   244 PRMADR: DW 0    ;POINTER TO CURRENT PROM
724A 00     245 STATION:DB 0    ;CURRENTLY ACTIVE STATION
724B 0000   246 RAMPTR: DW 0    ;POINTER TO RAM STATION CONTROL BLOCK ORIGIN
724D 0000   247 PRMPTR: DW 0    ;POINTER TO CONFIG. PROM PARAMETER  BLOCK ORIGIN
            248
724F 00     249 OSTAT:  DB 0    ;ONSTAT FOR CURRENT STATION
7250 00     250 ESTAT:  DB 0    ;ENSTAT    "    "
7251 00     251 SSTAT:  DB 0    ;SELECTION STATUS    " "
7252 00     252 PSTAT:  DB 0    ;SELECTION STATUS FOR PREVIOUS STATION
            253
            254
            255 ;------------ TIME TABLE
            256
7253 01     257 TDELAY: DB 1    ;WAIT FOR FEEDERS TO FINISH UP
7254 01     258 TCSON:  DB 1    ; CYCLE STOP ON
7255 01     259 TCSOFF  DB 1    ; CYCLE STOP OFF
            260
            261 -
            262 ;----- STATION CONTROL BLOCKS
            263
0046        264 SCB     EQU 70      ;BLOCK SIZE
            265
7256        266 SCB0    DS SCB
729C        267 SCB1:   DS SCB
72E2        268 SCB2:   DS SCB
7329        269 SCB3    DS SCB
736E        270 SCB4:   DS SCB
73B4        271 SCB5:   DS SCB
```

```
73FA          SCB6:   DS SCB
7440          SCB7:   DS SCB
7486          SCB8:   DS SCB
74CC          SCB9:   DS SCB
7512          SCB10:  DS SCB
7558          SCB11:  DS SCB
759E          SCB12:  DS SCB
75E4          SCB13:  DS SCB
762A          SCB14:  DS SCB


;ENVELOPE FEEDER DEFINITIONS

7670 01       EFDTIM: DB 1    ;FEED TIME
7671 01       EFESON: DB 1    ;ENC SENSE ON - TIME
7672 01       EFESOF: DB 1    ;ENC SENSE OFF - "
7673 01       EFJSON: DB 1    ;JAM SENSE ON
7674 01       EFJSOF: DB 1    ;JAM SENSE OFF


;*****************************************************************************
;
;NOTE:  STATION NUMBERING SCHEME USED IN ABOVE TABLE IS SHOWN BELOW FOR
;       A MACHINE USING SIX FEEDERS.  THIS NUMBERING CORRESPONDS TO THE
;       STATION NUMBERING USED INTERNALLY BY THE PROGRAM
;
;NUMBER:     0           1       2       3       4       5       6    7
; DEVICE: CONTROL DOC=> FEEDER=>FEEDER=>FEEDER=>FEEDER=>FEEDER=>ENV=>ACCESSORY
;           FEEDER                                                FEEDER
;
;*****************************************************************************

;---- POINTERS TO CONFIGURATION PROM PARAMETER BLOCKS
7675          DEVTAB:         DS 2*14




;------------------------- WORKING STORAGE FOR SUBROUTINES


;-- SCAN SUBR.


;RE-ASSIGNMENT OF SELECT CODES
7691 0000     OLDSEL          DW 0    ;OLD SELECT CODE -- AS READ FROM CONTROL DOC.
7693 0000     NEWSEL:         DW 0    ;NEW SELECT CODE --TRANSLATED  VIA TABLE
7695          ASNTAB:         DS 16   ;BIT MAP TABLE -- F(OLDSEL) = NEWSEL


;MISCELLANEOUS
76A5 00       ACODE:          DB 0    ;ACCESSORY CODE
76A6 00       ACODE1:         DB 0    ;STACKER CODE
76A7 00       FEEDCT:         DB 0    ;NO OF PIECES ACTUALLY FED BY A FEEDER
76A8 00       CNTVAL:         DB 0    ;COUNT VALUE WHEN ERROR
76A9 0000     P1:             DW 0
76AB 0000     P2:             DW 0
76AD 0000     P3:             DW 0

76AF 0000     CHKWRD:         DW 0
76B1 00       COUNT:          DB 0
```

```
76B2 00          336 BNUM:          DB 0
76B3 0000        337 TEMP:          DW 0
76B5 0000        338 TEMP1:         DW 0
                 339
76B7 00          340 DGNCMD:        DB 0    ;DIAGNOSTIC COMMAND ENTERED BY OPERATOR
76B8 00          341 MAINTR:        DB 0    ;MAINTENANCE REMINDER FLAG
                 342
                 343
                 344
                 345
                 346 ;---------------------- WORKING STORAGE FOR I/O  SUBROUTINES
                 347
                 348 ;--------FEEDER SUBROUTINES
76B9             349 FDCMD:         DS 1    ;FEED COMMAND
76BA             350 FDSTAT:        DS 1    ;FEEDER STATUS
76BB             351 FDERR:         DS 1    ;FEEDER ERROR
76BC             352 FDDATA:        DS 1    ;FEEDER DATA - WRITTEN OR READ
                 353
                 354 ;-------- SCANNER SUBROUTINES
76BD 00          355 SCNCMD:        DB 0    ;SCANNER COMMAND
76BE 00          356 SCSTAT:        DB 0    ;SCANNER STATUS BYTE
                 357
                 358
                 359 ;-------- CURRENT MEMORY MAPPED I/O ADDRESSES
76BF 0000        360 FDPTR:         DW 0    ;FEED DATA POINTER
76C1 0000        361 FCPTR:         DW 0    ;FEEDER COMMAND POINTER
76C3 0000        362 SDPTR:         DW 0    ;SCANNER DATA POINTER
76C5 0000        363 SCPTR:         DW 0    ;SCANNER COMMAND POINTER
                 364
                 365 ;----- DISPLAY/KEYBOARD
                 366
0005             367 KBSIZE  EQU 5          ;KEYBOARD BUFFER SIZE
76C7             368 KBUF:   DS KBSIZE      ;KEYBOARD BUFFER
                 369
76CC 00          370 TABCTR: DB 0           ;CURRENT TAB STOP
76CD 0100        371 DPTR:   DW 1           ;POINTS TO CURRENT DISPLAY ELEMENT
76CF 00          372 XC:     DB 0           ;CURSOR X COORDINATE
76D0 00          373 YC:     DB 0           ;CURSOR Y COORDINATE
76D1 00          374 KDATA:  DB 0
76D2 00          375 DDATA:  DB 0
76D3 00          376 KTYPE:  DB 0
76D4 00          377 FLDSIZ: DB 0
76D5 00          378 KEYMOD: DB 0
76D6 00          379 ZBIT:   DB 0
                 380
                 381
                 382
                 383 ; 2.4  SCHEDULING AND EXECUTION OF TASKS ====================================
                 384
                 385 ;---- INTERRUPT DRIVEN CLOCK
76D7 00          386 CLKTME:        DB 0    ;CURRENT TIME
76D8 00          387 T0:            DB 0    ;CLKTME VALUE <=> 0 OF LOGICAL CLOCK
                 388
                 389 ;---- LOGICAL CLOCK
76D9 00          390 TIME:          DB 0    ;LOGICAL CLOCK
76DA 00          391 DLYTIM:        DB 0    ;DELAY TIME(LOGICAL CLOCK)
76DB 00          392 STPTIM:        DB 0    ;CYCLE STOP TIME (LOGICAL)
76DC 00          393 CYCTIM:        DB 0    ;CYCLE STATE COUNTER
                 394
                 395
                 396 ;-- USED BY ADDTSK
76DD 0000        397 PFETCH:        DW 0    ;FETCHING POINTER -- GENERAL PURPOSE
76DF 0000        398 PSTORE:        DW 0    ;STORING POINTER --
76E1 0000        399 PLIM:          DW 0    ;LIMIT POINTER --
```

```
                 400
                 401
                 402 ;-- TASK CONTROL BLOCK -- DEFINES CURRENT TASK
76E3 00          403 TSKTME:        DB 0    ;TIME AT WHICH TASK IS TO RUN
76E4 00          404 TSKSTN:        DB 0    ;STATION SERVICED
76E5 0000        405 TSKPTR:        DW 0    ;ADDRESS OF TASK SUBROUTINE
                 406
                 407
                 408
                 409 ;-- TASK TABLE -- CURRENT STATUS
76E7 0000        410 TTPTR:         DW 0    ;POINTS TO CURRENT TASK IN TASK TABLE
76E9 0000        411 TTEND:         DW 0    ;POINTS TO CURRENT END OF TASK TABLE
76EB 0000        412 TTLIM:         DW 0    ;POINTS TO ABSOLUTE END OF TASK TABLE
76ED 00          413 TSKBIT:        DB 0    ;INDICATES TASK IS READY TO RUN
                 414
                 415
                 416 ;-- TASK TABLE -- STORAGE
                 417
0198             418 TTSIZE         EQU 4*110        ;TASK TABLE SIZE
                 419
76EE             420 TSKTAB:        DS TTSIZE  ;TASK TABLE - EACH ENTRY IS A TASK CONTROL BLOCK
                 421                           ; 4 BYTES/ENTRY
                 422
                 423
                 424
                 425
                 426 ; 2.5  DATA DEFINITIONS ==========================================================
                 427
                 428
                 429 ;---------------STATION CONTROL BLOCK
0000             430        ORG 0
                 431
                 432 ;---- PARAMETERS COPIED FROM CPROM ( OPERATOR MODIFIABLE)
0000             433 FDTIME         DS 1    ;FEED TIME
0001             434 TESON          DS 1    ;END ON SENSE TIME
0002             435 TESOFF         DS 1    ;END OFF SENSE TIME
0003             436 OPCNT          DS 1    ;OPERATORS COUNT
0004             437 MMCNT          DS 1    ;MISMATCH COUNT
0005             438 PSTBRK         DS 1    ;POSTAGE BREAK OPTION
0006             439 PBLOW          DS 1    ;POST BREAK COUNT -- LOWER LIMT
0007             440 PBHIGH:        DS 1    ;POST BREAK COUNT -- UPPER LIMIT
0008             441 FDSTOP:        DS 1    ;FEED STOP METHOD
0009             442 SDELAY:        DS 2    ;CURRENT DELAY TIME
000B             443 CURLW:         DS 1    ;POINTER TO CURRENT LINE SPACING
000C             444 LNWD1:         DS 1    ;LINE SPACING #1
000D             445 LNWD2:         DS 1    ;LINE SPACING #2
000E             446 LNWD3:         DS 1
000F             447 LNWD4:         DS 1
                 448
                 449 ;---- STATUS BITS AND REGISTERS
0010             450 ONSTAT:        DS 1    ;INDICATES IF STATION OFF OR ON
0011             451 SFCMD:         DS 1    ;FEEDER COMMAND
0012             452 FDABIT:        DS 1    ;FEEDER ACTIVE BIT
0013             453 SCABIT:        DS 1    ;SCANNER ACTIVE BIT
0014             454 MMCTR:         DS 1    ;MISMATCH COUNTER
0015             455 SFDCNT:        DS 1    ;FEED COUNT FOR CURRENT STATION
0016             456 SMCODE:        DS 1    ;MATCH CODE SEEN BY CURRENT STATION
0017             457 CURERR:        DS 1    ;CURRENT NON-HALT ERROR
0018             458 PSTERR:        DS 1    ;PAST NON-HALT ERROR
0019             459 PSTCNT:        DS 1    ;COUNT OF PAST NON-HALT ERRORS
                 460
                 461
                 462 ;----- PIECE RECORD
001A             463 ENSTAT:        DS 1    ; STATION ENABLE STATUS/USED FOR SEQ. STARTS
```

```
001B   464 ERSTAT:        DS 1    ; ERROR STATUS
001C   465 FSCODE:        DS 2    ;FEED SELECT CODE FROM CONTROL DOC.
001E   466 ACSCOD:        DS 1    ;ACCESSORY  CONTROL CODE FROM CONTROL DOC.
001F   467 ACSSTK:        DS 1    ;STACKER CONTROL CODE
0020   468 CDCNT:         DS 11   ;VERIFICATION COUNT FROM CONTROL DOC.
002B   469 MCHCOD:        DS 1    ;MATCH CODE FROM CONTROL DOC.
002C   470 SCNDAT:        DS 13   ;SCANNER DATA FROM CONTROL DOC. -INTACT
       471
0039   472 SCNBUF:        DS 13   ;SCANNER DATA FOR CURRENT STATION
       473
       474 ;-------- BYTE COUNTS FOR RAM SCB ELEMENTS
0011   475 PMTCNT         EQU 17  ;PARAMETER COUNT
000A   476 VARCNT         EQU 10  ;VARIABLE COUNT
002C   477 RECCNT         EQU 44  ;PIECE RECORD COUNT
       478
       479
       480
       481
       482
       483 ;==========================================================================
       484 ;
       485 ;
       486 ;                        *** SECTION 3 ***
       487 ;   ...
       488 ;                         SYSTEM DEFINITIONS
       489 ;
       490 ;
       491 ;
       492 ;=========================================================================
       493
       494
       495 ;-------------------- INTERFACES
       496
       497 ;---------- 8251 INTERFACE
       498 ;---- PORTS
00ED   499 PRTC51          EQU 0EDH        ;COMMAND PORT
00EC   500 PRTD51          EQU 0ECH        ;DATA PORT
       501
       502 ;---- CONTROL WORDS
004E   503 MOD51           EQU 4EH         ;MODE
0037   504 CMD51           EQU 37H         ;COMMAND
       505
       506
       507
       508
       509 ;---------- 8253 INTERFACE
       510
       511 ;----  PORTS
00DF   512 PORT53          EQU 0DFH        ;COMMAND PORT
00DC   513 PRT053          EQU 0DCH        ;COUNTER#0 PORT
00DE   514 PRT253          EQU 0DEH        ;COUNTER#2 PORT
       515
       516 ;---- COMMANDS
00B6   517 MOD253          EQU 0B6H        ;INIT COUNTER#2
0030   518 MOD053          EQU 030H        ;INIT COUNTER#0
       519
       520
       521
       522 ;---------- 8259 INTERRUPT HANDLER
       523 ;-- PORTS
00DA   524 PORT59          EQU 0DAH        ;PORT
       525
       526 ;-- CONTROL WORDS
0056   527 ICW1            EQU 56H         ;CONTROL WORD#1
```

```
0000          ICW2          EQU 0          ;CONTROL WORD#2
0020          EOI           EQU 20H        ;END OF INTERRUPT
              ;---------- TRANSPORT HANDLER
00E7          PORTXP        EQU 0E7H       ;INITIALIZATION PORT
00E5          PRTXPI        EQU 0E5H       ;TRANSPORT INPUT
00E4          PRTXPO        EQU 0E4H       ;TRANSPORT OUTPUT
              ;---- END OF TABLE CODE
00FF          ENDLST        EQU 0FFH                ; END OF TABLE CODE
FFFF          ENDTBL        EQU 0FFFFH
              ;ASCII CONTROL CODES
              ;
001B          ESC     EQU     1BH     ;ASCII ESCAPE
              ;----  DEVICE TYPES
0000          NODEV         EQU 0   ;NO DEVICE PRESENT
0001          STFDR         EQU 1   ;STANDARD FEEDER
0002          SCFDR         EQU 2   ;SCANNING  FEEDER
0003          ENVFDR        EQU 3   ;ENVELOPE FEEDER
0004          ACSORY        EQU 4   ;ACCESSORY
              ;---- FEED STOP CODES - USED IN SCB FEEDSTOP ENTRY (FDSTOP)
0000          FSECNV  EQU 0   ; STOP ON END OF COLLATION CODE,NO VERIFY
0001          FSECVR  EQU 1   ; STOP ON EOC,VERIFY COUNT AGAINST CTRL DOC COUNT
0002          FSOPCT  EQU 2   ;STOP ON COUNT SPECIFIED BY OPERATOR
0003          FSCDCT  EQU 3   ;STOP ON COUNT SPECIFIED BY CONTROL DOCUMENT
              ;---- STATION STATUS
0000          OFF           EQU 0   ; STATION OFF THE AIR
0001          ON            EQU 1   ; STATION ON
0002          SELABL        EQU 2   ;SELECTABLE
              ;---- ACCESSORY  CONTROL CODES
0001          SLRBIT  EQU 1H          ;SEAL
0002          MKRBIT  EQU 2           ;MARK
0004          DFLBIT  EQU 4           ;DEFLECT
0008          MTRBIT  EQU 8           ;METER 1
0010          MT2BIT  EQU 10H         ;METER 2
0007          STKMSK  EQU 7           ;MASK FOR STACKER FIELD
0010          STKABT  EQU 10H         ;STACKER A
0020          STKBBT  EQU 20H
0040          STKCBT  EQU 40H
0080          EHBIT   EQU 80H         ;ERROR HALT BIT
              ;----  FEEDER COMMANDS
```

```
0001          592 FCRSET  EQU 01H        ;RESET FEEDER FOR FIRST TIME OR RESTART
0004          593 FCSTFD  EQU 04H        ;START FEEDER
              594
0002          595 FCSLON  EQU 02H        ; SELECT FEEDER (TURN MOTOR ON)
00FD          596 FCSLOFF EQU 0FDH       ; DESELECT FEEDER (TURN MOTOR OFF)
              597
0008          598 FCJSON  EQU 08H        ;JAM SENSE ON
00F7          599 FCJSOFF EQU 0F7H       ;JAM SENSE OFF
              600
0010          601 FCESON  EQU 10H        ;ENC  SENSE ON
00EF          602 FCESOFF EQU 0EFH       ; ENCLOSURE SENSE OFF
              603
0020          604 FCRDCT  EQU 20H        ;READ COUNT FROM  FEEDER
0040          605 FCWRCT  EQU 40H        ;WRITE COUNT TO FEEDER
              606
0080          607 FCDIAG  EQU 80H        ;DIAGNOSTIC COMMAND
              608
              609
              610
              611 ;---- FEEDER STATUS BITS
0001          612 OUTBIT  EQU 1H  ;OUTPUT BUFFER (0=EMPTY,1=FULL)
0002          613 INBIT   EQU 2H  ;INPUT BUFFER (0=EMPTY,1=FULL
0004          614 RDYBIT  EQU 4H  ;FEEDER READY
0010          615 CSEBIT  EQU 10H ;FEEDER ERROR -- CYCLE STOP TIME
0020          616 CNTBIT  EQU 20H ;COUNT READY
0040          617 IMEBIT  EQU 40H ;FEEDER ERROR -- IMMEDIATE HALT
              618
              619
              620 ;---- FEEDER ERROR BITS
0001          621 JAMBIT  EQU 1H  ;PAPER JAM
0002          622 DBLBIT  EQU 2H  ;DOUBLE
0004          623 FTFBIT  EQU 4H  ;FAIL TO FEED
0008          624 LTFBIT  EQU 8H  ;LATE FEED
              625
              626
              627 ;---- SCANNER COMMANDS
0001          628 SCRSET  EQU 1H  ;RESET
0002          629 SCCNFG  EQU 2H  ;CONFIGURE
0004          630 SCRDLY  EQU 4H  ;READ DELAY
0010          631 SCDIAG  EQU 10H ;DIAGNOSTIC
              632
              633 ;----  SCANNER STATUS BITS
0010          634 BMEBIT  EQU 10H ; BENCH MARK ERROR
              635
              636 ;----  ACCESSORY COMMANDS
0008          637 ACCON   EQU 8   ; CONFIGURE COMMAND
0040          638 ACJTM   EQU 40H ; SET JAM TIMES
              639
              640
              641
              642
              643 ;=================================================================
              644 ;
              645 ;
              646 ;
              647 ;            * * *   PROGRAM PROM BEGINS HERE  * * *
              648 ;
              649 ;
              650 ;                    INTERRUPT SERVICE VECTORS
              651 ;
              652 ;
              653 ;=================================================================
              654
              655
```

```
                656
                657
0000            658         ORG 0
0000 C36000     659         JMP BEGIN              ;JUMP TO START OF EXECUTABLE CODE
                660
                661
                662
0040            663         ORG 40H
0040 C37616     664 INVEC0: JMP INTSRV      ;SERVICE CLOCK INTERRUPTS
0043            665         DS 1
                666
0044 C9         667 INVEC1: RET             ;SPARES
0045            668         DS 3
                669
0048 C9         670 INVEC2: RET
0049            671         DS 3
                672
004C C9         673 INVEC3: RET
004D            674         DS 3
                675
0050 C9         676 INVEC4: RET
0051            677         DS 3
                678
0054 C9         679 INVEC5: RET
0055            680         DS 3
                681
0058 C9         682 INVEC6: RET
0059            683         DS 3
                684
005C C9         685 INVEC7: RET
005D            686         DS 3
                687
                688
                689 ;==================================================================
                690 ;
                691 ;                    SYSTEM INITIALIZATION
                692 ;
                693 ;==================================================================
                694
                695
0060 210072     696 BEGIN:  LXI SP,STAK     ;INITIALIZE THE STACK
                697
0062 3E4E       698         MVI A,MOD51     ;INITIALIZE THE 8251/TERMINAL INTERFACE
0065 D3ED       699         OUT PRTC51
0067 3E37       700         MVI A,CMD51
0069 D3ED       701         OUT PRTC51
                702
006B 3E30       703         MVI A,MOD053    ;INITIALIZE THE 8253 COUNTER/TIMER
006D D3DF       704         OUT PORT53
006F 3EB6       705         MVI A,MOD253
0071 D3DF       706         OUT PORT53
                707
0073 3E0E       708         MVI A,0EH       ;SET BAUD RATE TO 4800
0075 D3DE       709         OUT PRT253
0077 3E00       710         MVI A,0
0079 D3DE       711         OUT PRT253
007B 21E803     712         LXI H,1000      ;ONE SECOND DELAY
007E CDCF2B     713         CALL WAIT
                714
0081 CD4527     715         CALL MODLD      ;SUPPRESS CURSOR
0084 3E32       716         MVI A,'2'
0086 CD2526     717         CALL DCH
0089 3E78       718         MVI A,'X'
008B CD2526     719         CALL DCH
```

```
008E CD4527      720        CALL MODLD
0091 3E76        721        MVI A,'V'
0093 CD2526      722        CALL DCH        ;SETUP MODE
0096 CD4527      723        CALL MODLD
0099 3E77        724        MVI A,'W'
009B CD2526      725        CALL DCH
009E CD4527      726        CALL MODLD
00A1 3E32        727        MVI A,'2'
00A3 CD2526      728        CALL DCH
00A6 3E7A        729        MVI A,'Z'
00A8 CD2526      730        CALL DCH
                 731
                 732
00AB 3E8A        733        MVI A,8AH       ;INITIALIZE TRANSPORT
00AD D3E7        734        OUT 0E7H
00AF 3EFF        735        MVI A,0FFH
00B1 D3E4        736        OUT 0E4H
                 737
00B3 3E56        738        MVI A,ICW1      ;INITIALIZE THE 8259 INTERRUPT HANDLER
00B5 D3DA        739        OUT PORT59
00B7 3E00        740        MVI A,ICW2
00B9 D3DB        741        OUT PORT59+1
00BB FB          742        EI
                 743
00BC 1155AA      744        LXI D,0AA55H    ;CHECK IF SHOULD RESET PROM SELECTION
00BF 2AAF76      745        LHLD CHKWRD
00C2 CDC124      746        CALL CMDEHL
00C5 CACE00      747        JZ BEG2
00C8 210050      748        LXI H,CP1BEG
00CB 224872      749        SHLD PRMADR
00CE 310072      750 BEG2:  LXI SP,STAK
00D1 CD1001      751        CALL SETPRM
                 752
00D4 1155AA      753        LXI D,0AA55H    ;TEST FOR POWER FAIL, OR FIRST TIME START UP
00D7 2AAF76      754        LHLD CHKWRD
00DA CDC124      755        CALL CMDEHL     ;COMPARE [DE] AND [HL]
00DD CAE700      756        JZ BEG1         ; CHANGE TO BEG1 AFTER DEBUGGING
                 757
00E0 EB          758        XCHG            ;RESET ALL PARAMETERS FROM CPROM
00E1 22AF76      759        SHLD CHKWRD
00E4 CD3E01      760        CALL RESET
00E7 CDF300      761 BEG1:  CALL TINIT
00EA CD9602      762        CALL INISCN     ;INITIALIZE SCANNERS
00ED CD620E      763        CALL INIACS     ;INITIALIZE ACCESSORIES
00F0 C3A303      764        JMP RUNMCN      ;GOTO MAIN MENU
                 765
                 766
                 767 ;INITIALIZE MACHINE TIMES
00F3 3A5372      768 TINIT: LDA TCSOFF      ;---- INITIALIZE TIMES
00F5 210876      769        LXI H,T0            ;TIME 0 FOR LOGICAL CLOCK
00F9 77          770        MOV M,A
00FA 34          771        INR M
                 772
00FB CDBE16      773        CALL CNVTIM         ;LOGICAL CYCLE STOP TIME
00FE 32DB76      774        STA STPTIM
                 775
0101 3A5372      776        LDA TDELAY      ;LOGICAL DELAY TIME
0104 CDBE16      777        CALL CNVTIM
0107 32DA76      778        STA DLYTIM
                 779
010A 3E00        780        MVI A,0
010C 32DC76      781        STA CYCTIM          ;CLEAR CYCLE STATE INDICATOR
010F C9          782        RET
                 783
```

```
                784
                785 ;  ROUTINE TO SET VALUES DEPENDANT ON PROM
0110 11AB2C     786 SETPRM: LXI D,DVTB      ;PLACE POINTER TO STATION 0 IN DEVTAB
0113 217576     787         LXI H,DEVTAB
0116 0E1C       788         MVI C,2*14
0118 CD1E25     789         CALL COPY
                790
011B CD3101     791         CALL FDGET      ;GET # OF FEEDERS
011E 3C         792         INR A
011F 324572     793         STA ENVSTN
0122 3C         794         INR A
0123 3C         795         INR A
0124 324672     796         STA ACSSTN
                797
0127 3D         798         DCR A
0128 3D         799         DCR A
0129 07         800         RLC
012A 4F         801         MOV C,A
012B 110C00     802         LXI D,FBF0
012E C30125     803         JMP STOREPTR
                804
                805
                806 ;--ROUTINE TO GET FEEDER COUNT
0131 E5         807 FDGET:  PUSH H
0132 C5         808         PUSH B
0133 010600     809         LXI B,FDRCNT
0136 2A4872     810         LHLD PRMADR
0139 09         811         DAD B
013A 7E         812         MOV A,M
013B C1         813         POP B
013C E1         814         POP H
013D C9         815         RET
                816
                817
                818 ;---- RESET EVERYTHING
013E CD5C01     819 RESET:  CALL RSTPMT
0141 CD4E02     820         CALL RSTSEL
0144 CD7225     821         CALL CLSCRN
0147 116B2E     822         LXI D,SET2X
014A CD5B26     823         CALL DISPLAY
014D 119301     824         LXI D,BATOUT    ;DISPLAY BATTERY BACKUP FAILED MESSAGE
0150 CD5B26     825         CALL DISPLAY
0153 CD4226     826         CALL GCH1B
0156 11782E     827         LXI D,END2X
0159 C35B26     828         JMP DISPLAY
                829
                830 ;---- RESET PARAMETERS
015C 3E00       831 RSTPMT: MVI A,0
015E 324A72     832         STA STATION
                833
0161 CD3203     834 RSTPM0: CALL SETSTN
0164 CD0C02     835         CALL RSP        ;RESET PARAMS FOR SINGLE STATION
0167 CD1E03     836         CALL NXTSTN     ;STEP TO NEXT STATION
016A C26101     837         JNZ RSTPM0
016D CD7301     838         CALL RSTPM1     ;RESET ENV TIMES
0170 C38301     839         JMP RSTPM2      ;AND MACHINE TIMES
                840
0173 110205     841 RSTPM1: LXI D,PBENV+2   ;RESET ENV TIMES
0176 2A4872     842         LHLD PRMADR
0179 19         843         DAD D
017A EB         844         XCHG
017B 217076     845         LXI H,EFDTIM
017E 0E05       846         MVI C,5
0180 C34402     847         JMP RSP0
```

```
                848
0183 110000     849 RSTPM2: LXI D,TIMTAB    ;AND MACHINE TIMES
0186 2A4872     850         LHLD PRMADR
0189 19         851         DAD D
018A EB         852         XCHG
018B 215372     853         LXI H,TDELAY
018E 0E03       854         MVI C,3
0190 C34402     855         JMP RSP0
                856
                857
0193 00         858 BATOUT: DB 0,2
0194 02
0195 00         859         DB CPY.TEXT
0196 00
0197 2A2A2A29   860         DB '***    LOSS OF POWER HAS OCCURED     ***',XX,XX
019B 2020204C
019F 4F535320
01A3 4F462050
01A7 4F574552
01AB 20484153
01AF 204F4343
01B3 55524544
01B7 20202020
01BB 202A2A2A
01BF 0D
01C0 0D
01C1 2A2A2A20   861         DB '*** RE-ENTER ANY SET UP CHANGES MADE ***',XX,XX,XX
01C5 52452D45
01C9 4E544552
01CD 20414E59
01D1 20534554
01D5 20555020
01D9 4348414E
01DD 47455320
01E1 4D414445
01E5 202A2A2A
01E9 0D
01EA 0D
01EB 0D
01EC 20202020   862         DB '       TOUCH SCREEN TO CONTINUE'
01F0 20202054
01F4 4F554348
01F8 20534352
01FC 45454E20
0200 544F2043
0204 4F4E5449
0208 4E5545
020B FF         863         DB ENDTXT
                864
                865
                866 ;---- RESET PARAMETERS FOR CURRENT STATION
020C 0E0A       867 RSP:    MVI C,PMTCNT-7  ;PARAMETER COUNT
020E 2A4072     868         LHLD PRMPTR
0211 110400     869         LXI D,4
0214 19         870         DAD D
0215 EB         871         XCHG            ; [DE] POINTS TO C-PROM PARAMETER AREA
0216 2A4872     872         LHLD RAMPTR     ; [HL] POINTS TO RAM PARAMETER AREA
0219 CD4402     873 RSP01:  CALL RSP0       ;MOVE VALUES
                874
021C 2A4072     875         LHLD PRMPTR     ;TRANSFER DELAY TIME
021F 112A00     876         LXI D,DELAY1    ;FOR SCANNER
0222 19         877         DAD D
0223 5E         878         MOV E,M
0224 23         879         INX H
```

```
0225 56          880          MOV D,M
0226 2A4B72      881          LHLD RAMPTR
0229 010900      882          LXI B,SDELAY
022C 09          883          DAD B
022D 73          884          MOV M,E
022E 23          885          INX H
022F 72          886          MOV M,D
                 887
0230 2A4D72      888          LHLD FRMPTR      ;TRANSFER LINES/INCH PARAMETERS
0233 112A00      889          LXI D,LINWD1
0236 19          890          DAD D
0237 EB          891          XCHG
0238 2A4B72      892          LHLD RAMPTR
023B 010B00      893          LXI B,CURLW
023E 09          894          DAD B            ;POINT AT RAM
023F 3600        895          MVI M,0          ;SET POINTER TO FIRST VALUE
0241 23          896          INX H            ;POINT AT FIRST SPACE VALUE
0242 0E04        897          MVI C,4
                 898
0244 1A          899 RSP0:    LDAX D           ;COPY PARAMETERS OVER
0245 77          900          MOV M,A
0246 13          901          INX D
0247 13          902          INX D
0248 23          903          INX H
0249 0D          904          DCR C
024A C24402      905          JNZ RSP0
024D C9          906          RET
                 907
                 908 ;---- RESET STATION STATUS AND SELECTION ASSIGNMENT TABLE
                 909
024E 3E00        910 RSTSEL: MVI A,0
0250 324A72      911          STA STATION
                 912
0253 CD3203      913 RSL0:    CALL SETSTN
0256 3A4A72      914          LDA STATION
0259 A7          915          ANA A
025A CA6902      916          JZ RSL2
025D CDBC13      917          CALL GETFDM      ;CHECK IF FEED SELECT USED
0260 CD0C25      918          CALL FETCH
0263 A7          919          ANA A
0264 3E02        920          MVI A,SELABL
0266 C26B02      921          JNZ RSL3
                 922
0269 3E01        923 RSL2:    MVI A,ON         ;SET ALL NON SELECTABLE STATIONS TO ON STATUS
026B 2A4B72      924 RSL3:    LHLD RAMPTR
026E 0E10        925          MVI C,ONSTAT
0270 CD1525      926          CALL STORE
                 927
0273 CD1E03      928          CALL NXTSTN
0276 C25302      929          JNZ RSL0
                 930
0279 219576      931          LXI H,ASNTAB     ;RESET SELECTION ASSIGNMENT TABLE TO IDENTITY MAP
027C AF          932          XRA A
027D 77          933 PSL1:    MOV M,A
027E 23          934          INX H
027F 3C          935          INR A
0280 FE10        936          CPI 16
0282 C27D02      937          JNZ RSL1
0285 C9          938          RET
                 939
                 940
                 941
                 942 ;---- INITIALIZE SCANNERS
                 943
```

```
0286 3E00        944 INISCN: MVI A,0
0288 324A72      945         STA STATION
                 946
028B CD3203      947 INISC0: CALL SETSTN
028E CD0803      948         CALL CHKSCF     ;CHECK FOR SCANNING FEEDER
0291 C49802      949         CNZ CONFIG      ;IF YES, CONFIGURE SCANNER
0294 CD1E03      950         CALL NXTSTN
0297 C28802      951         JNZ INISC0
029A C9          952         RET
                 953
                 954
                 955 ;---- CONFIGURE SCANNER FOR CURRENT STATION
                 956
029B 2A4072      957 CONFIG: LHLD PRMPTR
029E 112300      958         LXI D,ZONCNT
02A1 19          959         DAD D
02A2 EB          960         XCHG
                 961
02A3 0E02        962         MVI C,SCCNFG    ;WRITE CONFIGURE COMMAND TO SCANNER
02A5 CD3816      963         CALL WRSCMD
                 964
02A8 1A          965         LDAX D          ;FETCH ZONE COUNT
02A9 CDED02      966         CALL CNFG0
02AC 2A4872      967         LHLD RAMPTR     ;GET LINE SPACING VALUE
02AF E5          968         PUSH H
02B0 010B00      969         LXI B,CURLW
02B3 09          970         DAD B
02B4 4E          971         MOV C,M
02B5 09          972         DAD B
02B6 23          973         INX H
02B7 7E          974         MOV A,M
02B8 CDED02      975         CALL CNFG0
02BB E1          976         POP H
02BC 010A00      977         LXI B,SDELAY+1
02BF 09          978         DAD B           ;GET CURRENT DELAY TIME
02C0 7E          979         MOV A,M
02C1 E5          980         PUSH H
02C2 CDED02      981         CALL CNFG0
02C5 E1          982         POP H
02C6 2B          983         DCX H
02C7 7E          984         MOV A,M
02C8 CDED02      985         CALL CNFG0
02CB 13          986         INX D
02CC 1A          987         LDAX D
02CD CDED02      988         CALL CNFG0
02D0 1B          989         DCX D
02D1 1B          990         DCX D
                 991
02D2 1A          992         LDAX D
02D3 CDED02      993         CALL CNFG0
                 994
02D6 13          995         INX D
02D7 1A          996         LDAX D
02D8 CDED02      997         CALL CNFG0
                 998
02DB 13          999         INX D
02DC 1A         1000         LDAX D
02DD CDED02     1001         CALL CNFG0
02E0 13         1002         INX D
02E1 1A         1003         LDAX D
                1004
02E2 FEFF       1005 CNL2:   CPI ENDLST
02E4 CAED02     1006         JZ CNFG0
02E7 CDED02     1007         CALL CNFG0
```

```
02EA C3E202     1008        JMP CNL2
                1009
02ED CDF302     1010 CNFG0: CALL WESB       ;WAIT FOR EMPTY SCAN BUFFER
02F0 2AC076     1011        LHLD SDPTR
02F3 2F         1012        CMA
02F4 77         1013        MOV M,A         ;WRITE PARAM TO SCANNER
02F5 13         1014        INX D
02F6 1A         1015        LDAX D
02F7 C9         1016        RET
                1017
                1018
                1019 ;---- WAIT FOR EMPTY SCANNER BUFFER
                1020
02F8 F5         1021 WESB:  PUSH PSW
02F9 2AC576     1022        LHLD SCPTR
                1023
02FC 7E         1024 WESB0: MOV A,M
02FD 2F         1025        CMA
02FE 32BE76     1026        STA SCSTAT      ;GET SCANNER STATUS
0301 E602       1027        ANI INBIT
0303 C2FC02     1028        JNZ WESB0
                1029
0306 F1         1030        POP PSW
0307 C9         1031        RET
                1032
                1033
                1034
                1035
                1036 ;-----------------------------------------------------------
                1037 ;
                1038 ;  CHKSCF = CHECK FOR SCANNING FEEDER ON CURRENT STATION
                1039 ;
                1040 ;      OUTPUT:  [Z] IF IT IS NOT A SCANNING FEEDER
                1041 ;               [NZ] IF IT IS A SCANNING FEEDER
                1042 ;
                1043 ; [Z]  MEANS THE JZ INSTRUCTION WILL EXECUTE
                1044 ; [NZ] MEANS THE JNZ INSTRUCTION WILL EXECUTE
                1045 ;-----------------------------------------------------------
                1046
                1047
0308 CD1703     1048 CHKSCF: CALL NODVCK    ;GET DEVICE TYPE
030B FE02       1049        CPI SCFDR
030D 3EFF       1050        MVI A,0FFH
030F CA1403     1051        JZ CHK0
0312 3E00       1052        MVI A,0
                1053
0314 E6FF       1054 CHK0:  ANI 0FFH
0316 C9         1055        RET
                1056
                1057
                1058 ;
                1059 ;CHECK DEVICE TYPE IF CURRENT STATION
                1060 ;
                1061 ;OUTPUT:  ZERO IF NO DEVICE PRESENT, ELSE NONZERO
                1062 ;
0317 2A4D72     1063 NODVCK: LHLD PRMPTR
031A 7E         1064        MOV A,M
031B FE00       1065        CPI NODEV
031D C9         1066        RET
                1067
                1068 ;-----------------------------------------------------------
                1069 ; NXTSTN  = NEXT STATION.   STEPS STATION TO NEXT FEEDER
                1070 ;  OUTPUT:  [Z]   IF AT LAST FEEDER, STATION IS UNCHANGED
                1071 ;           [NZ]  IF STATION INCREMENTED
```

```
                1072 ;
                1073 ;-----------------------------------------------------------
                1074
031E CD3101     1075 NXTSTN: CALL FDGET
0321 6F         1076 NXTST0: MOV L,A
0322 3A4A72     1077         LDA STATION
0325 BD         1078         CMP L
0326 C8         1079         RZ
                1080
0327 3C         1081         INR A
0328 324A72     1082         STA STATION
032B C9         1083         RET
                1084
032C 3A4572     1085 NXTSTA: LDA ENVSTN
032F C32103     1086         JMP NXTST0
                1087
                1088
                1089
                1090
                1091 ;-----------------------------------------------------------
                1092 ; SUBROUTINE TO SET ALL RELEVANT POINTERS FOR A GIVEN STATION
                1093 ;  INPUT:  [A] HAS STATION NUMBER
                1094 ;  OUTPUT: RAMPTR POINTS TO STATION CONTROL BLOCK CORRESPONDING TO STATION
                1095 ;   --    PRMPTR POINTS TO C-PROM PARAMETER BLOCK
                1096 ;
                1097 ;-----------------------------------------------------------
                1098
                1099 SETSTN:
0332 F5         1100         PUSH PSW
0333 C5         1101         PUSH B
0334 E5         1102         PUSH H
0335 47         1103         MOV B,A
                1104
0336 07         1105         RLC
0337 4F         1106         MOV C,A
0338 21802C     1107         LXI H,RAMTAB
033B CDF724     1108         CALL FETCHPTR
033E 224B72     1109         SHLD RAMPTR
                1110
0341 78         1111         MOV A,B
0342 CD5E03     1112         CALL CNVISX      ;CONVERT INTERNAL STATION NO. TO EXTERNAL NO.
0345 47         1113         MOV B,A          ; [B] NOW HAS EXTERNAL STATION NO
                1114
0346 07         1115         RLC              ;FETCH PRMPTR FROM TABLE
0347 4F         1116         MOV C,A
0348 217576     1117         LXI H,DEVTAB
034B CDF724     1118         CALL FETCHPTR
034E EB         1119         XCHG
034F 2A4872     1120         LHLD PRMADR      ;GET PROM BASE ADDRESS
0352 19         1121         DAD D
0353 224072     1122         SHLD PRMPTR
                1123
0356 78         1124         MOV A,B          ;SET MEMORY MAPPED I/O POINTERS FOR STATION
0357 CD6F03     1125         CALL SETIOP
                1126
035A E1         1127         POP H
035B C1         1128         POP B
035C F1         1129         POP PSW
035D C9         1130         RET
                1131
                1132
                1133 ;-----------------------------------------------------------
                1134 ;
                1135 ;    CNVISX = CONVERT INTERNAL STATION NO. TO EXTERNAL NO.
```

```
                1136 ;
                1137 ;        INPUT:   [A] CONTAINS INTERNAL NO.
                1138 ;        OUTPUT:  [A] CONTAINS EXTERNAL NO.
                1139 ;-----------------------------------------------------------------
                1140
035E C5         1141 CNVISX: PUSH B
035F 47         1142         MOV B,A
0360 CD3101     1143         CALL FDGET
0363 3C         1144         INR A
0364 90         1145         SUB B
0365 FA6A03     1146         JM CNVSX2
0368 C1         1147 CNVSX1: POP B
0369 C9         1148         RET
                1149
036A 3E0D       1150 CNVSX2: MVI A,13
036C C36803     1151         JMP CNVSX1
                1152
                1153
                1154
                1155
                1156
                1157
                1158 ;-----------------------------------------------------------------
                1159 ; SETIOP = SET MEMORY MAPPED I/O POINTERS FOR GIVEN DEVICE
                1160 ;
                1161 ;   INPUT:  [A] CONTAINS EXTERNAL STATION NUMBER
                1162 ;
                1163 ;   OUTPUT: FCPTR = FEEDER CMD/STATUS POINTER
                1164 ;           FDPTR = FEEDER DATA POINTER
                1165 ;           SCPTR = SCANNER CMD/STATUS POINTER
                1166 ;           SDPTR = SCANNER DATA POINTER
                1167 ;
                1168 ;-----------------------------------------------------------------
                1169
                1170
036F 07         1171 SETIOP: RLC     ;LOCATE TABLE ENTRY
0370 07         1172         RLC
0371 07         1173         RLC
0372 4F         1174         MOV C,A
                1175
0373 21C72C     1176         LXI H,MMIOTB    ;COPY TABLE ENTRY TO POINTERS
0375 0600       1177         MVI B,0
0378 09         1178         DAD  B
0379 EB         1179         XCHG
037A 21BF76     1180         LXI H,FDPTR
037D 0E08       1181         MVI C,8
037F C31E25     1182         JMP COPY
                1183
                1184
                1185 ;ROUTINE TO SETUP MACHINE TO RUN
                1186
                1187
0382 210000     1188 RUNMC0: LXI H,0         ;INITIALIZE MACHINE STATE INDICATORS
0385 220272     1189         SHLD PCOUNT
                1190
                1191
                1192 ;------- INITIALIZE MACHINE
0388 CDE60D     1193 RMA:    CALL INIMCN
                1194
038B CDF10D     1195         CALL RSTFDR     ;RESET FEEDERS
038E 3A4172     1196         LDA HLTBIT      ;TEST FOR FEEDERS READY
0391 A7         1197         ANA A
0392 C8         1198         RZ              ;AOK
                1199
```

```
0393 CD150A     1200 RMA0:   CALL RECOVR     ;FEEDER NOT READY.DISPLAY HALT SCREEN
                1201
0396 FE00       1202         CPI 0           ;NO KEYBOARD INPUT
0398 CA9303     1203         JZ RMA0
                1204
039B FE01       1205         CPI 1           ;CONTINUE COMMAND GIVEN. SO TRY AGAIN
039D CA8203     1206         JZ RUNMC0
                1207
03A0 C39303     1208         JMP RMA0
                1209
                1210
                1211
                1212
                1213 ;==========================================================================
                1214 ;
                1215 ;                                RUN MACHINE
                1216 ;
                1217 ;==============================================================================
                1218
                1219
                1220
03A3 CDE708     1221 RUNMCN: CALL INIERR     ;INITIALIZE ERROR HANDLING
03A6 CD8203     1222         CALL RUNMC0     ;SETUP MACHINE
03A9 3E00       1223 RUNMC1: MVI A,0
03AB 320072     1224         STA RMODE
03AE 320172     1225         STA MSTATE
                1226
03B1 CD010C     1227         CALL S1G0       ;DISPLAY SCREEN TITLE AND OTHER FIXED TEXT
                1228
                1229
                1230
                1231 ;-------- HALT ON ALL CLEAR CONDITION
03B4 3E10       1232 RMB:    MVI A,HLTACL
03B6 CDF808     1233         CALL ERRSET
03B9 CDAD08     1234         CALL XPTOFF
03BC CD150A     1235 RMB0:   CALL RECOVR
                1236
03BF FE00       1237         CPI 0
03C1 CABC03     1238         JZ RMB0         ;AWAIT COMMAND
                1239
                1240
                1241
03C4 CD9A03     1242 RMB1:   CALL XPTON      ;TURN ON TRANSPORT
03C7 3A4172     1243         LDA HLTBIT      ;CHECK FOR NOT READY
03CA A7         1244         ANA A
03CB CAD903     1245         JZ RMB12
03CE CD150A     1246 RMB11:  CALL RECOVR
03D1 FE00       1247         CPI 0
03D3 CACE03     1248         JZ RMB11
03D6 C3C403     1249         JMP RMB1
                1250
03D9 CD1305     1251 RMB12:  CALL MTRSON     ;TURN ON FEEDER MOTORS
                1252
03DC 3E64       1253         MVI A,100       ;INITIALIZE CLOCK
03DE 32D776     1254         STA CLKTME
03E1 32D976     1255         STA TIME
                1256
03E4 3AD976     1257 RMB2:   LDA TIME        ;SYNCHRONIZE YOUR SUNDIALS
03E7 FE00       1258         CPI 0
03E9 C2E403     1259         JNZ RMB2
03EC 32DC76     1260         STA CYCTIM
03EF 32ED76     1261         STA TSKBIT
                1262
                1263
```

```
                1264
                1265
                1266 ;------ EXECUTE CYCLE
03F2 CDFF05     1267 RMC:    CALL INICYC     ;INITIALIZE CYCLE
03F5 CD7607     1268         CALL CHKMCN     ;CHECK MACHINE STATE
03F8 CAF004     1269         JZ RMX          ;SHUT DOWN COMPLETED
                1270
03FB 3E00       1271         MVI A,0
03FD 324772     1272         STA FDACTR      ;CLEAR ACTIVE FEEDER COUNTER
                1273
0400 3A4772     1274 RMC0:   LDA FDACTR      ;POLL SCANNERS WHILE FEEDERS ACTIVE
0403 A7         1275         ANA A
0404 C41B12     1276         CNZ POLSCN
                1277
0407 CD0605     1278         CALL DTASK
                1279
040A CD5405     1280         CALL POLHLT     ;CHECK FOR HALT CONDITIONS
040D 3ADC76     1281         LDA CYCTIM      ;CHECK FOR DELAY TIME
0410 FE01       1282         CPI 1
0412 CA3404     1283         JZ RMD
                1284
                1285
0415 3A4172     1286         LDA HLTBIT      ;CHECK FOR HALT CONDITION
0418 A7         1287         ANA A
0419 CA0004     1288         JZ RMC0
                1289
041C CDAD08     1290         CALL XPTOFF     ;ERROR DETECTED, SO STOP TRANSPORT
041F CD150A     1291 RMC1:   CALL RECOVR     ;PERFORM ERROR RECOVERY
                1292
0422 FE00       1293         CPI 0
0424 CA0004     1294         JZ RMC0         ;CONTINUE PROCESSING WHILE AWAITING RESPONSE
                1295
                1296
0427 3A4172     1297 RMC2:   LDA HLTBIT      ;MORE ERRORS?
042A A7         1298         ANA A
042B C20004     1299         JNZ RMC0
042E CD8A08     1300         CALL XPTON      ;RESTART TRANSPORT AND CONTINUE PROCESSING
0431 C30004     1301         JMP RMC0
                1302
                1303
                1304
                1305
                1306 ;------ DELAY TIME IS UPON US
0434 3A4772     1307 RMD:    LDA FDACTR      ;CHECK FOR FEEDERS STILL ACTIVE
0437 A7         1308         ANA A
0438 CA7904     1309         JZ RME          ;SKIP DELAY TIME IF FEEDERS ALL FINISHED
                1310
043B CDE208     1311 RMD0:   CALL XPTDLY     ;ENTER DELAY MODE IF FEEDERS STILL BUSY
043E C34A04     1312         JMP RMD2
                1313
0441 CD1B12     1314 RMD1:   CALL POLSCN     ;POLL SCANNERS
                1315
0444 CD0605     1316         CALL DTASK      ;RUN TASKS WHOSE TIME HAS COME
                1317
0447 CD5405     1318         CALL POLHLT     ;CHECK FOR HALT CONDITIONS
                1319
044A 3A4172     1320 RMD2:   LDA HLTBIT
044D A7         1321         ANA A
044E CA5E04     1322         JZ RMD4
0451 3A3E72     1323         LDA HLTCOD      ;IGNORE SINGLE STEP HALT
0454 FE03       1324         CPI 3
0456 CA5E04     1325         JZ RMD4
0459 FE04       1326         CPI 4           ;IGNORE KEYBOARD REQUEST
045B C26B04     1327         JNZ RMD41
```

```
                1328
045E 3A4772     1329 RMD4:   LDA FDACTR
0461 A7         1330         ANA A
0462 C24104     1331         JNZ RMD1        ;STAY IN DELAY MODE UNTIL FEEDERS FINISHED
                1332
0465 CD9F08     1333         CALL XPTCTN     ;FEEDERS ALL FINISHED, RESTART XPORT
0468 C37904     1334         JMP RME         ;END OF DELAY TIME
                1335
046B CDAD08     1336 RMD41:  CALL XPTOFF     ;TURN OFF XPORT
046E CD150A     1337 RMD3:   CALL RECOVR     ;RECOVER FROM ERROR
                1338
0471 FE00       1339         CPI 0           ;AWAIT OPERATOR COMMAND IMPATIENTLY
0473 CA6E04     1340         JZ RMD3
                1341
0476 C33804     1342         JMP RMD0        ;ERROR CLEARED,SO CONTINUE POLLING
                1343
                1344
                1345
                1346
                1347 ;----- CLEAR OUT ANY HALT CONDITIONS STILL PENDING
                1348
0479 3A4172     1349 RME:    LDA HLTBIT
047C FE00       1350         CPI 0
047E CAA204     1351         JZ RMF          ;THERE ARE NONE
                1352
0481 CDAD08     1353         CALL XPTOFF
0484 CD150A     1354 RME0:   CALL RECOVR
                1355
0487 FE00       1356         CPI 0           ;AWAITING RESPONSE
0489 C29504     1357         JNZ RME2
                1358
                1359
048C CD0B05     1360 RME1:   CALL DTASK      ;RUN TASKS WHOSE TIME HAS COME
                1361
048F CD5405     1362         CALL POLHLT
0492 C38404     1363         JMP RME0
                1364
0495 3A4172     1365 RME2:   LDA HLTBIT
0498 A7         1366         ANA A
0499 C28404     1367         JNZ RME0
049C CD8A08     1368         CALL XPTON
049F CD1805     1369         CALL MTRSON
                1370
                1371
                1372
                1373
                1374 ;----- WRAP UP CYCLE
                1375
04A2 CD1313     1376 RMF:    CALL LODREC     ;CONTROL DOC DATA => PIECE RECORD
04A5 CDBD07     1377         CALL CHKCNT     ;CHECK COUNTS
                1378
04A8 CD5405     1379 RMF0:   CALL POLHLT
                1380
04AB CD0B05     1381         CALL DTASK      ;RUN TASKS WHOSE TIME HAS COME
                1382
04AE 3A4172     1383 RMF1:   LDA HLTBIT
04B1 A7         1384         ANA A
04B2 C2CF04     1385         JNZ RMF3
                1386
04B5 3ADC76     1387 RMF2:   LDA CYCTIM
04B8 FE02       1388         CPI 2
04BA C2A804     1389         JNZ RMF0
                1390
04BD CD0B05     1391         CALL DTASK
```

```
04C8 3A4172     1392          LDA HLTBIT
04CB A7         1393          ANA A
04C4 C2CF04     1394          JNZ RMF3        ;STOP IF HALTBIT SET
                1395
04C7 3E00       1396          MVI A,0         ;END OF CYCLE
04C9 32DC76     1397          STA CYCTIM
04CC C3F203     1398          JMP RMC
                1399
04CF CDAD08     1400 RMF3:    CALL XPTOFF     ;ERROR DETECTED, SO STOP TRANSPORT
04D2 CD150A     1401 RMF4:    CALL RECOVR     ;PERFORM ERROR RECOVERY
                1402
04D5 FE00       1403          CPI 0
04D7 C2E004     1404          JNZ RMF5        ;CONTINUE PROCESSING WHILE AWAITING RESPONSE
04DA CD0B05     1405          CALL DTASK      ;RUN TASKS WHOSE TIME HAS COME
04DD C3D204     1406          JMP RMF4
                1407
                1408
04E0 3A4172     1409 RMF5:    LDA HLTBIT
04E3 A7         1410          ANA A
04E4 C2D204     1411          JNZ RMF4
04E7 CD8A08     1412          CALL XPTON      ;RESTART TRANSPORT AND CONTINUE PROCESSING
04EA CD1805     1413          CALL MTRSON
04ED C3B504     1414          JMP RMF2
                1415
                1416
                1417
04F0 3AD976     1418 RMX:     LDA TIME        ;FINAL CYCLE TO CLEAR TRANSPORT
04F3 A7         1419          ANA A
04F4 C2F004     1420          JNZ RMX
04F7 32DC76     1421          STA CYCTIM
04FA 3ADC76     1422 RMX1:    LDA CYCTIM
04FD FE02       1423          CPI 2
04FF C2FA04     1424          JNZ RMX1
                1425
0502 CD2905     1426          CALL MTRSOFF    ;SHUT OFF FEEDER MOTORS
0505 CDD208     1427          CALL XOFF       ;SHUT OFF TRANSPORT
0508 C3A903     1428          JMP RUNMC1
                1429
                1430
                1431 ;ROUTINE TO RUN A TASK
050B 21ED76     1432 DTASK:   LXI H,TSKBIT    ;RUN TASKS WHOSE TIME HAS COME
050E F3         1433          DI
050F 7E         1434          MOV A,M
0510 3600       1435          MVI M,0
0512 A7         1436          ANA A
0513 FB         1437          EI
0514 C29106     1438          JNZ RUNTSK
0517 C9         1439          RET
                1440
                1441 ;------ TURN ON MDF MOTORS
0518 3E00       1442 MTRSON:  MVI A,0
051A 324A72     1443          STA STATION
                1444
051D CD3203     1445 MTRSN0:  CALL SETSTN
                1446
0520 3A4B72     1447          LHLD RAMPTR          ;SEE IF FEEDER ON
0523 0E10       1448          MVI C,ONSTAT
0525 CD0C25     1449          CALL FETCH
0528 FE01       1450          CPI ON
052A C23305     1451          JNZ MTRSN1           ; NOT ON, SO SKIP IT
                1452
052D 3A4A72     1453          LDA STATION          ; WRITE SELECT COMMAND
0530 C37010     1454          JMP SCFON
                1455
```

```
0533 3A4A72   1456 MTRSN1: LDA STATION          ;TURN MOTOR OFF
0536 C37E10   1457         JMP SCFOFF
              1458
              1459 ;------ TURN OFF MOF MOTORS
              1460 MTRSOFF:
0539 3E00     1461         MVI A,0
053B 324A72   1462         STA STATION
              1463
053E CD3203   1464 MTOF0:  CALL SETSTN
0541 CD0803   1465         CALL CHKSCF
0544 CA4D05   1466         JZ MTOF1
              1467
0547 3A4A72   1468         LDA STATION     ;SHUT OFF MOTORS ON SCANNING FEEDERS
054A CD7E10   1469         CALL SCFOFF
              1470
054D CD1E03   1471 MTOF1:  CALL NXTSTN
0550 C23E05   1472         JNZ MTOF0
0553 C9       1473         RET
              1474
              1475
              1476
              1477 ;---------- POLLING FOR HALT CONDITIONS
              1478
              1479 ;--- POLL FOR IMMEDIATE ERRORS/HALTS
0554 0640     1480 POLHLT: MVI B,IMEBIT    ;FEEDER ERRORS CAUSING IMMEDIATE HALTS
0556 CD6705   1481         CALL POLFDR
0559 C36705   1482         JMP EMHCHK      ;POLL EMERGENCY HALT BUTTON
              1483
              1484
              1485 ;--- POLL FOR CYCLE STOP ERRORS/HALTS
055C 0610     1486 POLCSH: MVI B,CSEBIT    ;FEEDER ERRORS RECOGNIZED AT CYCLE STOP TIME
055E CD6705   1487         CALL POLFDR
0561 CD6705   1488         CALL EMHCHK     ;POLL EMERGENCY HALT SWITCH
0564 C39805   1489         JMP KBHCHK      ;POLL HALTS INITIATED FROM KEYBOARD
              1490
              1491
              1492 ;-- CHECK EMERGENCY HALT SWITCH
0567 3A0072   1493 EMHCHK: LDA RMODE       ;OMIT IF IN MANUAL MODE
056A FE02     1494         CPI 2
056C CA7805   1495         JZ EMCH1
056F CDD708   1496         CALL EHCHK      ;CHECK SWITCH
0572 C8       1497         RZ              ;NOT PRESSED
              1498
0573 3E13     1499 EMCH0:  MVI A,HLTEHS    ;REGISTER ERROR IF SWITCH WAS PRESSED
0575 C3F808   1500         JMP ERRSET
0578 DBE5     1501 EMCH1:  IN 0E5H         ;CHECK IF OFF
057A E604     1502         ANI 4
057C CA8F05   1503         JZ EMCH2
057F 11832E   1504         LXI D,S1EERR
0582 CD5B26   1505         CALL DISPLAY    ;CLEAR COUNT FROM SCREEN
0585 CD2126   1506         CALL GCH        ;FLUSH INPUT
0588 AF       1507         XRA A
0589 320072   1508         STA RMODE
058C C37305   1509         JMP EMCH0
              1510
058F 3AD776   1511 EMCH2:  LDA CLKTME
0592 11862C   1512         LXI D,TXT2
0595 C35B26   1513         JMP DISPLAY
              1514
              1515
              1516 ;--- CHECK FOR KEYBOARD OR SINGLE STEP HALT
0598 3A0072   1517 KBHCHK: LDA RMODE       ;SINGLE STEP MODE
059B FE02     1518         CPI 2
059D C8       1519         RZ
```

```
059E FE01        1520          CPI 1
05A0 C2AB05      1521          JNZ KBHCH1
05A3 CD3126      1522          CALL GCH        ;FLUSH INPUT
05A6 3E11        1523          MVI A,HLTSSM
05A8 C2B405      1524          JMP KBHCKX
                 1525
05AB CD3126      1526 KBHCH1:  CALL GCH        ;HALT REQUESTED FROM KEYBOARD
05AE C8          1527          RZ
05AF CD4526      1528          CALL BELL
05B2 3E12        1529          MVI A,HLTKBD
                 1530
05B4 C3F808      1531 KBHCKX:  JMP ERRSET
                 1532
                 1533
                 1534
                 1535
                 1536 ;----- POLL FEEDERS FOR ERROR CONDITIONS
                 1537 ;
                 1538 ;    INPUT:  [B] CONTAINS ERROR BITS TO BE CHECKED
                 1539
                 1540
05B7 3A4572      1541 POLFDR:  LDA ENVSTN      ;START WITH ENVELOPE FEEDER
05BA 4F          1542          MOV C,A
05BB 211081      1543          LXI H,8110H
                 1544
05BE 7E          1545 PF0:     MOV A,M         ;READ STATUS OF EACH FEEDER
05BF 2F          1546          CMA
05C0 A0          1547          ANA B
05C1 C2E605      1548          JNZ PF2         ;ERROR DETECTED
                 1549
05C4 23          1550 PF1:     INX H
05C5 0D          1551          DCR C
05C6 F2BE05      1552          JP PF0
05C9 2A312D      1553          LHLD ACCMND     ;CHECK ACCESSORY STATION
05CC 7E          1554          MOV A,M
05CD 2F          1555          CMA
05CE 4F          1556          MOV C,A
05CF A0          1557          ANA B
05D0 C8          1558          RZ
05D1 2A2F2D      1559          LHLD ACDATA
05D4 7E          1560          MOV A,M
05D5 2F          1561          CMA
05D6 E60F        1562          ANI 0FH
05D8 32BB76      1563          STA FDERR
05DB 3A4672      1564          LDA ACSSTN
05DE 324A72      1565          STA STATION
05E1 3E16        1566          MVI A,ERRACC
05E3 C3F808      1567          JMP ERRSET      ;SET ACCESSORY ERROR
                 1568
05E6 E5          1569 PF2:     PUSH H
05E7 C5          1570          PUSH B
                 1571
05E8 79          1572          MOV A,C         ;SET POINTERS FOR OFFENDING STATION
05E9 324A72      1573          STA STATION
05EC CD3203      1574          CALL SETSTN
                 1575
05EF 2ABF76      1576          LHLD FDPTR      ;READ ERROR DATA
05F2 7E          1577          MOV A,M
05F3 2F          1578          CMA
05F4 32BB76      1579          STA FDERR
05F7 CDFF09      1580          CALL FDESET     ;REGISTER ERRORS
                 1581
05FA C1          1582          POP B
05FB E1          1583          POP H
```

```
05FC C3C405     1584        JMP PF1
                1585
                1586
                1587
                1588 ;-------- INITIALIZE CYCLE
05FF CD0806     1589 INICYC: CALL ADVREC     ;SHIFT PIECE RECORDS TO NEXT STATION
0602 CDB206     1590        CALL INITSK     ;INITIALIZE TASK TABLE AND TASKS TO RUN
0605 C3E708     1591        JMP INIERR      ;INITIALIZE ERROR HANDLER
                1592
                1593
                1594
                1595
                1596
                1597 ;----- SHIFT PIECE RECORDS TO NEXT STATION IN LINE
0608 3A4672     1598 ADVREC: LDA ACSSTN
060B 324A72     1599        STA STATION
060E CD3203     1600        CALL SETSTN
0611 2A4872     1601        LHLD RAMPTR
0614 111A00     1602        LXI D,ENSTAT
0617 19         1603        DAD D
                1604
0618 22DF76     1605 AR0:   SHLD PSTORE
061B 3A4A72     1606        LDA STATION
061E 3D         1607        DCR A
061F FA6A06     1608        JM AR1          ;ALL RECORDS SHIFTED
                1609
0622 324A72     1610        STA STATION
0625 CD3203     1611        CALL SETSTN
0628 2A4872     1612        LHLD RAMPTR
062B 011700     1613        LXI B,CURERR
062E 09         1614        DAD B
062F 7E         1615        MOV A,M         ;GET CURRENT ERROR
0630 A7         1616        ANA A
0631 CA4006     1617        JZ AR3          ;JUMP IF NONE
0634 23         1618        INX H
0635 BE         1619        CMP M           ;COMPARE TO PAST ERROR
0636 C24206     1620        JNZ AR4         ;JUMP IF DIFFERENT
0639 23         1621        INX H
063A 34         1622        INR M           ;INCREMENT ERROR COUNT
063B 2B         1623        DCX H
063C 2B         1624        DCX H
063D 3600       1625        MVI M,0         ;SET CURRENT ERROR TO 0
063F C35106     1626        JMP AR5
0642 77         1627 AR4:   MOV M,A         ;SET NEW ERROR
0643 2B         1628        DCX H
0644 3600       1629        MVI M,0         ;CLEAR CURRENT ERROR
0646 23         1630        INX H
0647 23         1631        INX H
0648 3601       1632        MVI M,1         ;AND SET ERROR COUNT
064A C35106     1633        JMP AR5
064D 23         1634 AR3:   INX H
064E 77         1635        MOV M,A         ;CLEAR PAST ERROR
064F 23         1636        INX H
0650 77         1637        MOV M,A         ;AND ERROR COUNT
0651 2A4872     1638 AR5    LHLD RAMPTR
0654 111A00     1639        LXI D,ENSTAT
0657 19         1640        DAD D
0658 22D076     1641        SHLD PFETCH
                1642
065B EB         1643        XCHG
065C 2ADF76     1644        LHLD PSTORE
065F 0E2C       1645        MVI C,RECONT
0661 CD1E25     1646        CALL COPY
0664 2AD076     1647        LHLD PFETCH
```

```
0667 C21806      1648          JMP AR0
                 1649
066A 0E2C        1650 AR1:     MVI C,RECCNT
066C 3600        1651 AR2:     MVI M,0
066E 23          1652          INX H
066F 0D          1653          DCR C
0670 C26C06      1654          JNZ AR2
                 1655
0673 2A4872      1656          LHLD PAMPTR
0676 0E1A        1657          MVI C,ENSTAT
0678 3A4472      1658          LDA ENABIT
067B CD1525      1659          CALL STORE
067E 0E1E        1660          MVI C,ACSCOD
0680 AF          1661          XRA A
0681 CD1525      1662          CALL STORE
0684 0C          1663          INR C
0685 CD1525      1664          CALL STORE
0688 DBE5        1665          IN 0E5H          ;CHECK IF MAINT REMINDER ON
068A E608        1666          ANI 8
068C C8          1667          RZ
068D 32B876      1668          STA MAINTR
0690 C9          1669          RET
                 1670
                 1671
                 1672
                 1673 ;---- RUN TASKS WHOSE TIME HAS COME
                 1674
0691 2AE776      1675 RUNTSK: LHLD TTPTR
                 1676
0694 7E          1677          MOV A,M          ;CHECK FOR END OF TABLE
0695 FEFF        1678          CPI ENDLST
0697 CAAF06      1679          JZ RUNTS1        ;DO NOTHING IF NO TASKS LEFT
                 1680
069A 23          1681 RUNTS0: INX H            ;FETCH STATION
069B 7E          1682          MOV A,M
069C 23          1683          INX H            ;FETCH TASK ADDRESS
069D 5E          1684          MOV E,M
069E 23          1685          INX H
069F 56          1686          MOV D,M
06A0 23          1687          INX H
                 1688
06A1 E5          1689          PUSH H
06A2 EB          1690          XCHG
06A3 CDC024      1691          CALL SUBRTN      ;RUN THE TASK
                 1692
06A6 2AE776      1693          LHLD TTPTR       ;CHECK TIME OF NEXT TASK
06A9 7E          1694          MOV A,M
06AA E1          1695          POP H
06AB BE          1696          CMP M
06AC CA9A06      1697          JZ RUNTS0        ;RUN ALL TASKS WHOSE TIME IS THE SAME
                 1698
06AF 22E776      1699 RUNTS1: SHLD TTPTR
06B2 C9          1700          RET
                 1701
                 1702
                 1703
                 1704
                 1705 ;------ SUBR TO INITIALIZE TASK TABLE AND SPECIFY TASKS TO RUN
                 1706
06B3 21EE76      1707 INITSK: LXI H,TSKTAB     ;INITIALIZE TASK TABLE
06B6 22E776      1708          SHLD TTPTR
                 1709
06B9 3E00        1710          MVI A,0          ;COMPUTE FEED SELECT AND START FEEDS
06BB 324A72      1711          STA STATION
```

```
06BE 325272     1712          STA PSTAT
                1713
06C1 CD3203     1714 INTSK0:  CALL SETSTN
                1715
06C4 CDC606     1716          CALL INTSK1     ;INITIALIZE ONE STATION
                1717
06C7 2A4872     1718          LHLD RAMPTR
06CA 0E12       1719          MVI C,FDABIT
06CC CD1525     1720          CALL STORE
                1721
06CF CD1E03     1722          CALL NXTSTN
06D2 C2C106     1723          JNZ INTSK0
06D5 C9         1724          RET
                1725
06D6 2A4872     1726 INTSK1:  LHLD RAMPTR
06D9 0E10       1727          MVI C,ONSTAT
06DB CD0C25     1728          CALL FETCH
06DE 324F72     1729          STA OSTAT
                1730
06E1 3A0072     1731          LDA RMODE       ;MANUAL MODE?
06E4 FE02       1732          CPI 2
06E6 C2F506     1733          JNZ INTSK4
06E9 E5         1734          PUSH H
06EA CD0803     1735          CALL CHKSCF     ;IF MANUAL, SET SCANNING FEEDERS OFF
06ED E1         1736          POP H
06EE CAF506     1737          JZ INTSK4
06F1 AF         1738          XRA A
06F2 324F72     1739          STA OSTAT
06F5 0E1A       1740 INTSK4:  MVI C,ENSTAT
06F7 CD0C25     1741          CALL FETCH
06FA 325072     1742          STA ESTAT
                1743
06FD CD0803     1744          CALL CHKSCF
0700 CA2107     1745          JZ INTSK5       ;JUMP IF STD FEEDER
0703 3A4F72     1746          LDA OSTAT
0706 A7         1747          ANA A           ;JUMP IF OFF
0707 CA2F07     1748          JZ INTSK6
070A 0E08       1749          MVI C,FDSTOP
070C 2A4872     1750          LHLD RAMPTR
070F CD0C25     1751          CALL FETCH
0712 FE03       1752          CPI FSCDCT      ;ONLY CHECK SELECT IF COUNT FROM CNTL DOC
0714 CA2107     1753          JZ INTSK5
0717 3E02       1754          MVI A,SELABL
0719 324F72     1755          STA OSTAT       ;ELSE ALWAYS SELECTED
071C 3E01       1756          MVI A,1
071E C32F07     1757          JMP INTSK6
                1758
0721 0E1C       1759 INTSK5:  MVI C,FSCODE
0723 CDF724     1760          CALL FETCHPTR
                1761
0726 3A4A72     1762          LDA STATION
0729 CD0024     1763          CALL SRHL
072C 7D         1764          MOV A,L
072D E601       1765          ANI 1B
072F 325172     1766 INTSK6:  STA SSTAT
                1767
0732 0E00       1768          MVI C,0         ;COLLECTS OUTCOME
                1769
0734 3A5072     1770          LDA ESTAT
0737 47         1771          MOV B,A
0738 3A4F72     1772          LDA OSTAT
073B FE00       1773          CPI OFF
073D CA6E07     1774          JZ FA00         ;STATION IS OFF
                1775
```

```
0740 FE01      1776          CPI ON
0742 C24D07    1777          JNZ INTSK2
0745 78        1778          MOV A,B
0746 A7        1779          ANA A
0747 C26D07    1780          JNZ FA01        ;STATION IS ON AND ENABLED
074A CA6E07    1781          JZ FA00         ;           ON     NOT ENABLED
               1782
074D 78        1783 INTSK2:  MOV A,B         ;STATION IS SELECTABLE
074E FE01      1784          CPI ON
0750 C25B07    1785          JNZ INTSK3
0753 3A5172    1786          LDA SSTAT
0756 FE01      1787          CPI ON
0758 CA6B07    1788          JZ FA11         ;STATION IS ENABLED AND SELECTED
               1789
075B 3A5172    1790 INTSK3:  LDA SSTAT       ;STATION IS NOT ENABLED OR NOT SELECTED
075E 47        1791          MOV B,A
075F 3A5272    1792          LDA PSTAT
0762 B0        1793          ORA B
0763 FE01      1794          CPI ON          ;SELECT IF SELECTED AT CURRENT OR PREVIOUS STATION
0765 CA6C07    1795          JZ FA10         ;BUT DO NOT START
0768 C26E07    1796          JNZ FA00
               1797
076B 0C        1798 FA11:    INR C           ; 11
076C 0C        1799 FA10:    INR C           ; 10
076D 0C        1800 FA01:    INR C           ; 01
076E 3A5172    1801 FA00:    LDA SSTAT       ; 00  -- CURRENT SELECTION STATUS => PREVIOUS
0771 325272    1802          STA PSTAT
0774 79        1803          MOV A,C
0775 C9        1804          RET
               1805
               1806
               1807
               1808
               1809 ;----- CHECK MACHINE STATE
0776 3E00      1810 CHKMCN:  MVI A,0
0778 CD2203    1811          CALL SETSTN
077B 2A4B72    1812          LHLD RAMPTR
077E 011A00    1813          LXI B,ENSTAT
0781 09        1814          DAD B
0782 46        1815          MOV B,M         ;GET STATION 0 ENABLE STATUS
0783 3A4572    1816          LDA ENVSTN
0786 4F        1817          MOV C,A         ;STATION COUNT
0787 114500    1818          LXI D,50B
078A 19        1819 CHKM1:   DAD D
078B 7E        1820          MOV A,M         ;CHECK NEXT STATION
078C B3        1821          ORA E
078D 47        1822          MOV B,A
078E 0D        1823          DCR C
078F C28A07    1824          JNZ CHKM1
0792 7B        1825          MOV A,E
0793 07        1826          RLC
0794 47        1827          MOV B,A
               1828
0795 3A4572    1829          LDA ADDSTN
0798 CD2203    1830          CALL SETSTN
079B 2A4B72    1831          LHLD RAMPTR
079E 0E1A      1832          MVI C,ENSTAT
07A0 CD0C05    1833          CALL FETCH
               1834
07A3 A7        1835          ANA A           ;COUNT PIECES SELL EPEC TO ADDSTN
07A4 C4E107    1836          CNZ PCEONT
               1837
07A7 B0        1838          ORA B
               1839
```

```
07A8 FE00        1840 CKMCN0: CPI 0
07AA C0          1841         RNZ
07AB 3E10        1842         MVI A,HLTACL
07AD 323E72      1843         STA HLTCOD
07B0 C9          1844         RET
                 1845
                 1846
                 1847
                 1848 ;---- COUNT PIECES DELIVERED TO ACCESSORY
07B1 F5          1849 PCECNT: PUSH PSW
07B2 C5          1850         PUSH B
                 1851
07B3 210272      1852         LXI H,PCOUNT
07B6 34          1853         INR M
07B7 CD690C      1854         CALL S1A00
                 1855
07BA C1          1856         POP B
07BB F1          1857         POP PSW
07BC C9          1858         RET
                 1859
                 1860
                 1861
                 1862 ;---------- CHECK COUNTS ON ALL MULTIDOC FEEDERS
07BD 3E00        1863 CHKCNT: MVI A,0
07BF 324A72      1864         STA STATION
                 1865
07C2 CD3202      1866 CHKCT0: CALL SETSTN     ;ONLY LOOK AT MULTIDOC FEEDERS
07C5 CD0903      1867         CALL CHKSCF
07C8 C40207      1868         CNZ CHKCT2
                 1869
07CB CD1502      1870 CHKCT1: CALL NXTSTN
07CE C2C207      1871         JNZ CHKCT0
07D1 C9          1872         RET
                 1873
07D2 2A4872      1874 CHKCT2: LHLD RAMPTR     ;EXECUTE READ COUNT
07D5 CD1112      1875         CALL CHKON      ;SEE IF USED
07D8 C8          1876         RZ
07D9 0E11        1877         MVI C,SFCMD
07DB CD0C25      1878         CALL FETCH
07DE F620        1879         ORI FCRDCT
07E0 4F          1880         MOV C,A
07E1 CDC115      1881         CALL WRFCMD
                 1882
07E4 CDE415      1883 CHKCT3: CALL RFSTAT     ;WAIT FOR COUNT READY
07E7 E620        1884         ANI CNTBIT
07E9 CAE407      1885         JZ CHKCT3
                 1886
07EC CD4216      1887         CALL RDFDATA    ;READ THE COUNT
07EF 47          1888         MOV B,A
                 1889
07F0 2A4872      1890         LHLD RAMPTR     ;SAVE COUNT IN PIECE RECORD
07F3 0E15        1891         MVI C,SFDCNT
07F5 CD1525      1892         CALL STORE
                 1893
07F8 0E08        1894         MVI C,FDSTOP    ;FETCH FEEDSTOP METHOD
07FA CD0C25      1895         CALL FETCH
07FD 07          1896         RLC
07FE 4F          1897         MOV C,A
07FF 211608      1898         LXI H,CKCTAB
0802 CDF724      1899         CALL FETCHPTR   ;FETCH PTR TO APPROPRIATE COUNT CHECKING METHOD
                 1900
0805 CDC024      1901         CALL SUBRTN     ;CHECK THE COUNT
                 1902
0808 2A4872      1903         LHLD RAMPTR     ;CHECK FOR POSTAGE BREAK
```

```
080B 0E05        1904          MVI C,PSTBRK
080D CD0C25      1905          CALL FETCH
0810 FE01        1906          CPI ON
0812 CC5808      1907          CZ CHKPBK
0815 C9          1908          RET
                 1909
                 1910
                 1911
0816 1E08        1912 CKCTAB:  DW CKOVCT       ;CHECK OVERCOUNT
0818 2D08        1913          DW CKCDCT       ;CHECK CONTROL DOC COUNT
081A 4508        1914          DW CKOPCT       ;CHECK COUNT SPECIFIED BY OPERATOR
081C 2D08        1915          DW CKCDCT       ;CHECK CONTROL DOC COUNT
                 1916
                 1917
                 1918 ;------- CHECK FOR OVERCOUNT
                 1919
081E 2A4B72      1920 CKOVCT.  LHLD RAMPTR
0821 0E03        1921          MVI C,OPCNT
0823 CD0C25      1922          CALL FETCH
0826 90          1923          SUB B
0827 160D        1924          MVI D,ERRCOV
0829 FC5108      1925          CM CNTERR
082C C9          1926          RET
                 1927
                 1928
                 1929 ;------ VERIFY PIECE COUNT AGAINST CONTROL DOC. COUNT
                 1930
082D 2A4B72      1931 CKCDCT:  LHLD RAMPTR
0830 0E20        1932          MVI C,CDCNT
0832 2A4A72      1933          LDA STATION     ;POINT AT CORRECT STATION
0835 CD5E03      1934          CALL CNVISX
0838 91          1935          ADD C
0839 3D          1936          DCR A
083A 4F          1937          MOV C,A
083B CD0C25      1938          CALL FETCH
083E 160C        1939          MVI D,ERRCVF
0840 B8          1940          CMP B
0841 C45108      1941          CNZ CNTERR
0844 C9          1942          RET
                 1943
                 1944 ;-------- VERIFY PIECE COUNT AGAINST OPERATOR COUNT
                 1945
0845 2A4B72      1946 CKOPCT:  LHLD RAMPTR
0848 0E02        1947          MVI C,OPCNT
084A CD0C25      1948          CALL FETCH
084D 160E        1949          MVI D,ERRFCT
084F B8          1950          CMP B
0850 C8          1951          RZ
                 1952
                 1953
0851 32A876      1954 CNTERR:  STA CNTVAL      ;STORE BAD COUNT
0854 7A          1955 CNTER1:  MOV A,D
0855 C3F808      1956          JMP ERRSET
                 1957
                 1958
                 1959
                 1960
                 1961 ;-------- CHECK FOR POSTAGE BREAKS AND SET ACCESSORY CODE ACCORDINGLY
                 1962
0858 2A4B72      1963 CHKPBK:  LHLD RAMPTR
085B 0E15        1964          MVI C,SFDCNT
085D CD0C25      1965          CALL FETCH
                 1966
0860 47          1967          MOV B,A
```

```
0861 0E06        1968          MVI C,FBLOW
0863 CD0C25      1969          CALL FETCH
0866 90          1970          SUB B
0867 F8          1971          RM
                 1972
0868 0E07        1973          MVI C,FBHIGH
086A CD0C25      1974          CALL FETCH
086D 90          1975          SUB B
086E 0E1A        1976          MVI C,ACBRK1
0870 1614        1977          MVI D,HLTPB1
0872 F27908      1978          JP CPB1
0875 0E1C        1979          MVI C,ACBRK2
0877 1615        1980          MVI D,HLTPB2
                 1981
0879 2A4072      1982 CPB1:    LHLD FRMPTR
087C CD0C25      1983          CALL FETCH
087F 2A4B72      1984          LHLD RAMPTR
0882 0E1E        1985          MVI C,ACSCOD
0884 CD1525      1986          CALL STORE
0887 C35408      1987          JMP CNTER1
                 1988
                 1989
                 1990
                 1991
                 1992
                 1993
                 1994 ;==========================================================================;
                 1995 ;
                 1996 ;                    * * * * TRANSPORT HANDLER * * * *
                 1997 ;
                 1998 ;
                 1999 ;==========================================================================
                 2000
                 2001
                 2002
                 2003 ;---- START TRANSPORT
088A 3A0072      2004 XPTON:   LDA RMODE              ;CHECK FOR MANUAL MODE
088D FE02        2005          CPI 2
088F C29608      2006          JNZ XPTON0
0892 CDDD08      2007          CALL XPTMM             ;SET TRANSPORT NOT MAUAL MODE
0895 C9          2008          RET
                 2009
0896 CDB608      2010 XPTON0:  CALL XON               ;HARDWARE LEVEL TURNON
0899 C8          2011          RZ
                 2012
089A 3E0F        2013          MVI A,ERRTNR    ;TELL OPERATOR ABOUT STALLED TRANSPORT
089C C3F808      2014          JMP ERRSET
                 2015
                 2016
                 2017 ;---- CONTINUE TRANSPORT AFTER DELAY TIME
089F 3A0072      2018 XPTCTN:  LDA RMODE
08A2 FE02        2019          CPI 2
08A4 C4BF08      2020 XPTCN0:  CNZ XON0
08A7 C8          2021          RZ
                 2022
08A8 3E0F        2023          MVI A,ERRTNR
08AA C3F808      2024          JMP ERRSET
                 2025
                 2026
                 2027
                 2028 ;---- STOP TRANSPORT
08AD 3A0072      2029 XPTOFF:  LDA RMODE       ;BYPASS IF IN MANUAL MODE
08B0 FE02        2030          CPI 2
08B2 C4D208      2031          CNZ XOFF
```

```
0085 C9          2032        RET
                 2033
                 2034
                 2035
                 2036
                 2037
                 2038 ;---------- TURN TRANSPORT ON
                 2039 ;
                 2040 ;        OUTPUT: [Z] - IF AOK
                 2041 ;                [NZ] - IF NOT READY
                 2042
0086 CDC808      2043 XON     CALL XPTRST     ;CLEAR RESET LEVEL
0089 216400      2044         LXI H,100
008C CDCF2B      2045         CALL WAIT
008F CDC708      2046 XON0:   CALL EHCHK      ;CHECK FOR TRANSPORT READY
0092 C0          2047         RNZ             ;NOT READY
                 2048
0093 3EFC        2049         MVI A,0FCH      ;ENGAGE CLUTCH AND START MOTOR
0095 D3E4        2050         OUT 0E4H
0097 C9          2051         RET
                 2052
                 2053
                 2054
                 2055
                 2056 ;---- RESET AFTER EMERGENCY HALT
0098 3EF9        2057 XPTRST  MVI A,0F9H
009A D3E4        2058         OUT 0E4H        OUTPUT RESET LEVEL
                 2059
009C 216400      2060         LXI H,100       ;WAIT 100 MILLESECONDS
009F CDCF2B      2061         CALL WAIT
00A2 3EFF        2062 XOFF:   MVI A,0FFH      ;TURN TRANSPORT OFF
00A4 D3E4        2063 XPTX:   OUT 0E4H        ;CLEAR RESET LEVEL
00A6 C9          2064         RET
                 2065
                 2066
                 2067 ;---------- EMERGENCY HALT CHECK
                 2068 ;
                 2069 ;      OUTPUT:  [Z]   IF BUTTON WAS NOT PRESSED
                 2070 ;               [NZ]  IF IT WAS PRESSED
                 2071 ;-----------------------------------------------------------
00A7 DBE5        2072 EHCHK:  IN 0E5H         ;BIT=0 => NOT READY => BUTTON WAS PRESSED
00A9 2F          2073         CMA
00AA E601        2074         ANI 1B
00AC C9          2075         RET
                 2076
                 2077
                 2078 ;-------- SET TO MANUAL MODE
00AD 3EFD        2079 XPTMM:  MVI A,0FDH
00AF C3D408      2080         JMP XPTX
                 2081
                 2082 ;-------- SET TO DELAY MODE
00B2 3EFE        2083 XPTDLY: MVI A,0FEH
00B4 C3D408      2084         JMP XPTX
                 2085
                 2086
                 2087 ;=========================================================================
                 2088 ;
                 2089 ;                    * * * * ERROR HANDLING * * * *
                 2090 ;
                 2091 ;=========================================================================
                 2092
                 2093
                 2094 ;---- SUBR TO INITIALIZE ERROR HANDLING
                 2095
```

```
08E7 3E00        2096 INIERR: MVI A,0        ;CLEAR HALT/ERROR INDICATORS
08E9 324172      2097         STA HLTBIT
08EC 324272      2098         STA ERRFLG
                 2099
08EF 210672      2100         LXI H,EFBEG    ;CLEAR ERROR POINTERS
08F2 223A72      2101         SHLD EFPTR
08F5 C37209      2102         JMP ERRST2
                 2103
                 2104
                 2105 ;---- SUBR. TO REGISTER ERRORS
                 2106 ;
                 2107 ;     INPUT: [A] CONTAINS ERROR NUMBER CORRESPONDING TO ERRTAB ENTRY
                 2109 ;
08F8 320472      2109 ERRSET: STA ERRNUM     ;SAVE ERROR NUMBER
08FB 3A4A72      2110         LDA STATION
08FE 320572      2111         STA ERRSTN     ;SAVE ERROR STATION
                 2112
0901 CD8A09      2113         CALL FCHEDR    ;FETCH ERROR DESCRIPTION RECORD
                 2114
0904 3A3C72      2115         LDA ERRCW0     ;CHECK FOR HALT CONDITION
0907 E680        2116         ANI HB
0909 C24409      2117         JNZ ERRST1
090C 3A3D72      2118         LDA ERRCW1     ;CHECK FOR ACC CODE
090F A7          2119         ANA A
0910 CA1B09      2120         JZ ERRST6
0913 CD7909      2121         CALL GTACER    ;IF ACC CODE, GET IT FROM PROM
0916 E680        2122         ANI HB
0918 C24409      2123         JNZ ERRST1
091B 3A0472      2124 ERRST6: LDA ERRNUM
091E FE14        2125         CPI HLTPB1     ;DON'T STOP ON POSTAGE BREAK
0920 CA9F09      2126         JZ ERRST5      ;IF NOT CALLED FOR IN PROM
0923 FE15        2127         CPI HLTPB2
0925 CA9F09      2128         JZ ERRST5
0928 5F          2129         MOV E,A
0929 2A4B72      2130         LHLD RAMPTR    ;CHECK IF SAME AS LAST ERROR
092C 0E18        2131         MVI C,PSTERR
092E CD0C25      2132         CALL FETCH
0931 B8          2133         CMP E
0932 C29F09      2134         JNZ ERRST5     ;JUMP IF NOT
0935 0E19        2135         MVI C,PSTCNT   ;CHECK COUNT
0937 CD0C25      2136         CALL FETCH
093A FE02        2137         CPI 2
093C C29F09      2138         JNZ ERRST5
093F 3A3C72      2139         LDA ERRCW0
0942 F680        2140         ORI HB         ;ADD HALT BIT TO ERROR
                 2141
                 2142
0944 324172      2143 ERRST1: STA HLTBIT     ;HALTING ERROR
0947 113672      2144         LXI D,EFEND    ;---- STORE ERROR RECORD
094A 2A3872      2145         LHLD EFLAST    ;FIRST SEE IF THERE IS ROOM FOR IT
094D CDC124      2146         CALL CMDEHL
0950 CA7209      2147         JZ ERRST2      ;NO ROOM
                 2148
0953 3A0572      2149         LDA ERRSTN     ;CHECK IF STATION ALREADY HAS
0956 47          2150         MOV B,A        ;ERROR REGISTERED
0957 210672      2151         LXI H,EFBEG    ;IF IT DOES, IGNORE THIS ERROR
095A 7E          2152 ERRS4:  MOV A,M        ;CHECK FOR END
095B FEFF        2153         CPI ENDLST
095D CA6809      2154         JZ ERRS3       ;IF END, WE'RE DONE
0960 23          2155         INX H
0961 7E          2156         MOV A,M
0962 B8          2157         CMP B
0963 C8          2158         RZ
0964 23          2159         INX H
```

```
0965 C35A09      2160          JMP ERPS4
                 2161
0968 3A0472      2162 ERPS3:   LDA ERPNUM       ;STORE THE RECORD
0968 77          2163          MOV M,A
096C 23          2164          INX H
096D 3A0572      2165          LDA ERRSTN
0970 77          2166          MOV M,A
0971 23          2167          INX H
                 2168
0972 36FF        2169 ERRST2:  MVI M,ENDLST     ;ESTABLISH NEW END OF TABLE
0974 223872      2170          SHLD EFLAST
0977 C9          2171          RET
                 2172
                 2173
                 2174
                 2175 ;GET ACCESSORY CODE FROM PROM IF USED
                 2176
0978 2A4072      2177 STACER:  LHLD FRMPTR
0978 4F          2178          MOV C,A          ;DISPLACEMENT TO CODE
097C 0C          2179          INR C
097D 0600        2180          MVI B,0
097F 09          2181          DAD B
0980 7E          2182          MOV A,M
0981 324072      2183          STA ERRSTK       ;SET ERROR STACKER
0984 2B          2184          DCX H
0985 7E          2185          MOV A,M          ;AND ACCESSORY CODE
0986 320072      2186          STA ERROW1
0989 C9          2187          RET
                 2188
                 2189
                 2190 ;---- FETCH ERROR DESCRIPTION RECORD CORRESPONDING TO ERPNUM
                 2191
098A 3A0472      2192 FCHEDR:  LDA ERPNUM
098D 07          2193          RLC              ;COMPUTE ADDRESS OF TABLE ENTRY
098E 07          2194          RLC
098F 0600        2195          MVI B,0
0991 4F          2196          MOV C,A
0992 21C72D      2197          LXI H,ERRTAB
0995 09          2198          DAD B
                 2199
0996 EB          2200          XCHG             ;FETCH TABLE ENTRY
0997 110072      2201          LXI H,ERROW0
099A 0E04        2202          MVI C,4
099C C31E05      2203          JMP COPY
                 2204
099F 7E          2205 ERPST5:  MOV A,E
09A0 3617        2206          MVI M,CLRERR     ;SET NEW CURRENT ERROR
09A2 CD1E05      2207          CALL STORE
                 2208
                 2209
                 2210
                 2211 ;---- CLEAR ERROR
09A5 3A0072      2212 CLERR:   LDA ERROW0       ;CHECK FOR FEEDER ERROR
09A9 E6F0        2213          ANI FB
09AA C9          2214          RZ               ;NOTHING TO DO IF NOT A FEEDER ERROR
                 2215
09AB 3A0072      2216          LDA ERROW0       ;SEE IF RESET REQUIRED
09AE E61A        2217          ANI FB
09B0 CA0109      2218          JZ CLERR0        ;NOT REQUIRED
                 2219
09B3 3A0572      2220          LDA ERRSTN       ;RESET FEEDER
09B6 CD1102      2221          CALL SETSTN
09B9 0601        2222          MVI C,FCRSET
```

```
09B8 CDC115      2223        CALL WRFCMD
09BE 0E00        2224        MVI C,0
09C0 CDC115      2225        CALL WRFCMD
                 2226
09C3 3A0572      2227        LDA ERRSTN
09C6 47          2228        MOV B,A          ;SEE IF ACCESSORY
09C7 3A4672      2229        LDA ACSSTN
09CA B8          2230        CMP B
09CB C2D409      2231        JNZ CLRER0
09CE 210400      2232        LXI H,900
09D1 CDCF2B      2233        CALL WAIT        ;WAIT IF ACC
                 2234
09D4 3A3072      2235 CLRER0 LDA ERRCW0       ;REGISTER ERROR IN PIECE RECORD
09D7 E60F        2236        ANI 0FH
09D9 47          2237        MOV B,A          ;NEW ERROR LEVEL => [B]
                 2238
09DA 2A4872      2239        LHLD RAMPTR
09DD 0E18        2240        MVI C,ERSTAT
09DF CD0C25      2241        CALL FETCH       ;OLD ERROR LEVEL => [A]
09E2 90          2242        SUB B
09E3 F0          2243        RP
                 2244
09E4 78          2245        MOV A,B          ;STORE NEW LEVEL IF > OLD LEVEL
09E5 CD1525      2246        CALL STORE
                 2247
09E8 3A3072      2248        LDA ERRCW1       ;ALSO STORE ACCESSORY CODE, IF PRESENT AND NON-HALT
09EB A7          2249        ANA A
09EC C8          2250        RZ
09ED E680        2251        ANI H8
09EF C0          2252        RNZ
                 2253
09F0 0E1E        2254        MVI C,ACSCOD
09F2 3A3072      2255        LDA ERRCW1
09F5 CD1525      2256        CALL STORE
09F8 0C          2257        INR C
09F9 3A4072      2258        LDA ERRSTK
09FC C21525      2259        JMP STORE
                 2260
                 2261
                 2262
                 2263
                 2264 ;--- REGISTER FEEDER ERRORS
09FF 0E00        2265 FDESET MVI C,0
                 2266
0A01 3A8E76      2267 FDE0:  LDA FDERR
0A04 CDE724      2268        CALL CHKBIT
                 2269
0A07 79          2270        MOV A,C
0A08 F5          2271        PUSH PSW
0A09 C4F909      2272        CNZ ERRSET
0A0C F1          2273        POP PSW
                 2274
0A0D 0C          2275        INR A
0A0E 4F          2276        MOV C,A
0A0F FE08        2277        CPI 8
0A11 C201A      2278        JNZ FDE0
                 2279
0A14 C9          2280        RET
                 2281
                 2282
                 2283
                 2284
                 2285
                 2286 ;---------- RECOVER FROM ERROR HALT
```

```
                 ;
                 ;     OUTPUT:  [A]   0 = NO INPUT FROM KEYBOARD
                 ;                    1 = CONTINUE COMMAND GIVEN
                 ;-----------------------------------------------------------------
0A15 3E00        RECOVR: MVI A,0
0A17 324372              STA RCVCOD
0A1A 210672              LXI H,EFBEG
0A1D 223A72              SHLD EFPTR
0A20 3A4272              LDA ERRFLG       ;SEE IF ERROR SCREEN UP
0A23 FE00                CPI 0
0A25 C2550A              JNZ RECOV4       ;IT IS ALREADY UP
0A28 CD190B              CALL FCHERR      ;FETCH ERROR RECORD
0A2B 324272              STA ERRFLG
0A2E FE01                CPI 1            ;NOT LAST ERROR
0A30 CA400A              JZ RECOV2
0A33 FE02                CPI 2            ;LAST ERROR -- FEEDER
0A35 CA400A              JZ RECOV2
0A38 FE03                CPI 3            ;LAST ERROR -- NON FEEDER
0A3A C2610A              JNZ RECOVX
0A3D C35E0A      RECOV1: JMP RECOV3
0A40 11362E      RECOV2: LXI D,S1T4
0A43 CD5B26              CALL DISPLAY
0A46 3A3F72              LDA ERRCOD
0A49 FE12                CPI 12H          ;ACC ERROR?
0A4B CA050A              JZ RECV12
0A4E FE13                CPI 13H
0A50 CAED0A              JZ RECV13        ;TRANSPORT NOT READY
0A53 FE14                CPI 14H
0A55 CA0F0B              JZ RECV14        ;OTHER NONFEEDER ERROR
0A58 11532E              LXI D,S1T5
0A5B CD5B26              CALL DISPLAY
0A5E CD740C      RECOV3: CALL S1A1        ;DISPLAY ERROR DATA
0A61 3A4272      RECOVX: LDA RCVCOD
0A64 C9                  RET
0A65 DBE5        RECOV4: IN 0E5H
0A67 47                  MOV B,A
0A68 E604                ANI 4
0A6A CA760A              JZ RECV41
0A6D 78                  MOV A,B
0A6E E601                ANI 1
0A70 C27E0A              JNZ RECOV5
0A73 C2F30A              JMP RECV15
0A76 3A0072      RECV41: LDA RMODE
0A79 FE02                CPI 2
0A7B C2B50A              JNZ RECV10
0A7E DBED        RECOV5: IN 0EDH          ;EXIT IF OPERATOR HAS NOT RESPONDED
0A80 E602                ANI 2
0A82 C8                  RZ               ;STILL WAITING
0A83 3A4272              LDA ERRFLG
```

```
0A86 FE01        2351          CPI 1          ;NOT LAST ERROR
0A88 CA990A      2352          JZ RECOV7
                 2353
0A8B FE02        2354          CPI 2          ;LAST ERROR --  FEEDER
0A8D CAAC0A      2355          JZ RECOV9
                 2356
0A90 FE03        2357          CPI 3          ;LAST ERROR -- NON FEEDER
0A92 CAB50A      2358          JZ RECV10
0A95 C3610A      2359          JMP RECOVX
                 2360
                 2361                         ;-- LAST ERROR -- FEEDER
0A98 CDA509      2362 RECOV7:  CALL CLRERR    ;-- NOT LAST ERROR
                 2363
0A9B CD190B      2364          CALL FCHERR    ;FETCH NEXT ERROR
0A9E 324272      2365          STA ERRFLG
0AA1 CD740C      2366          CALL S1A1      ;DISPLAY IT
                 2367
0AA4 3A4272      2368          LDA ERRFLG
0AA7 FE01        2369          CPI 1
0AA9 CA990A      2370          JZ RECOV7      ;STILL MORE ERRORS
0AAC CDA509      2371 RECOV9:  CALL CLRERR
0AAF 11832E      2372          LXI D,S1EERR
0AB2 CD5B26      2373          CALL DISPLAY   ;DISPLAY MAIN SCREEN
                 2374
0AB5 CDE703      2375 RECV10:  CALL INIERR    ;RE-INITIALIZE ERROR HANDLING
0AB8 CD560B      2376          CALL XMC       ;EXECUTE OPERATORS MENU CHOICE
0ABB 324372      2377          STA RCVCOD     ;STORE RECOVERY CODE
                 2378
0ABE FE01        2379          CPI 1
0AC0 CC3F0C      2380          CZ S1G2        ;RESTORE RUN SCREEN
0AC3 CDC303      2381          CALL XPTRST    ;RESET TRANSPORT READY LEVEL
0AC6 CD5405      2382          CALL POLHLT    ;CHECK IF MORE ERRORS
0AC9 C3610A      2383          JMP RECOVX     ;ALL DONE WITH THIS PROGRAMMING TOUR DE FORCE
                 2384
0ACC 11732E      2385 RECV11:  LXI D,END2X
0ACF CD5B26      2386          CALL DISPLAY
0AD2 C3010C      2387          JMP S1G0
                 2388
                 2389
0AD5 11A82E      2390 RECV12:  LXI D,S1A1X2
0AD8 CD5B26      2391          CALL DISPLAY
0ADB 11DF2F      2392          LXI D,S1A1X6
0ADE CD5B26      2393          CALL DISPLAY
0AE1 3A8876      2394          LDA FDERR      ;CONTAINS POSITION
0AE4 11D52F      2395          LXI D,S1A1X4
0AE7 CD5B26      2396          CALL DISPLAY
0AEA C3610A      2397          JMP RECOVX
                 2398
0AED 11A82E      2399 RECV13:  LXI D,S1A1X2
0AF0 CD5B26      2400          CALL DISPLAY
0AF3 CDC303      2401 RECV15:  CALL XPTRST
0AF6 CD3126      2402          CALL GCH       ;FLUSH INPUT
0AF9 216400      2403          LXI H,100
0AFC CDCF2B      2404          CALL WAIT
0AFF DBE5        2405          IN 0E5H
0B01 E604        2406          ANI 4
0B03 CA760A      2407          JZ RECV41      ;JUMP IF NOW MANUAL MODE
0B06 CD0708      2408          CALL EHCHK
0B09 C2F30A      2409          JNZ RECV15     ;WAIT FOR READY
0B0C C3610A      2410          JMP RECOVX
                 2411
0B0F 11A82E      2412 RECV14:  LXI D,S1A1X2
0B12 CD5B26      2413          CALL DISPLAY
0B15 C3610A      2414          JMP RECOVX
```

```
                2415
                2416
                2417
                2418
                2419 ;---- FETCH ERROR RECORD
                2420 ;
                2421 ;   OUTPUTS.  [A] = 1  -- NOT LAST ERROR
                2422 ;               = 2  -- LAST ERROR -- FEEDER
                2423 ;               = 3  -- LAST ERROR -- NON FEEDER
                2424
0B18 2A3A72     2425 FCHERR: LHLD EFPTR      ;CHECK FOR END OF FILE
0B1B 7E         2426         MOV A,M
0B1C FEFF       2427         CPI ENDLST
0B1E CA4E0B     2428         JZ FCHERX       ;SHOULD NEVER HAPPEN,BUT WE HANDLE IT ANYWAY
                2429
0B21 320472     2430         STA ERRNUM      ;FETCH THE ERROR RECORD
0B24 23         2431         INX H
0B25 7E         2432         MOV A,M
0B26 320572     2433         STA ERRSTN
0B29 23         2434         INX H
0B2A 223A72     2435         SHLD EFPTR
                2436
0B2D CD7203     2437         CALL SETSTN
0B30 CD9A09     2438         CALL FCHEDR     ;GET ERROR DESCRIPTION
0B33 3A3D72     2439         LDA ERRCW1      ;SEE IF ACCESSORY CODE PRESENT
0B36 A7         2440         ANA A
0B37 C47909     2441         CNZ GTACER
                2442
0B3A 2A3A72     2443 FCHER1: LHLD EFPTR      ;CHECK FOR LAST ERROR
0B3D 7E         2444         MOV A,M
0B3E FEFF       2445         CPI ENDLST
0B40 3E01       2446         MVI A,1
0B42 C8         2447         RNZ             ;RETURN IF NOT LAST ERROR
                2448
0B43 3A3C72     2449         LDA ERRCW0      ;LAST ERROR
0B46 E620       2450         ANI FB
0B48 3E02       2451         MVI A,2
0B4A C8         2452         RNZ
0B4B 3E03       2453         MVI A,3
0B4D C9         2454         RET
                2455
0B4E 3E13       2456 FCHERX: MVI A,HLTEHS    ;WE HOPE IT CAN'T HAPPEN
0B50 320472     2457         STA ERRNUM
0B53 C33A0B     2458         JMP FCHER1
                2459
                2460
                2461
                2462
                2463
                2464
                2465
                2466
                2467
                2468 ;---- EXECUTE MENU CHOICE
0B56 211400     2469 XMC:    LXI H,20        ;DEBOUNCE WAIT
0B59 CDCF3B     2470         CALL WAIT
                2471
0B5C DBE5       2472         IN 0E5H
0B5E E604       2473         ANI 4           ;CHECK FOR HAND CRANK
0B60 CAE40B     2474         JZ M6
0B63 3A0072     2475         LDA RMODE
0B66 FE02       2476         CPI 2           ;IN HAND CRANK MODE?
0B68 CAD40B     2477         JZ M4
                2478
```

```
0B6B CD3126     2479 XMC1:   CALL GCH        ;CHECK FOR CHAR READY
0B6E CA560B     2480         JZ XMC
                2481
0B71 217B0B     2482         LXI H,XMCT      ;VALID ENTRY TABLE
0B74 CD811E     2483         CALL FINDET
0B77 C2560B     2484         JNZ XMC         ;JUMP IF NONE
0B7A E9         2485         PCHL            ;GO TO ROUTINE
                2486
                2487
0B7B 930B       2488 XMCT:   DW STRTT        ;ADDRESS OF VALID START ENTRIES
0B7D DA0B       2489         DW M4           ;ADDRESS OF START ROUTINE
0B7F 990B       2490         DW ONECT
0B81 DF0B       2491         DW M5
0B83 9D0B       2492         DW STUPCK
0B85 D11C       2493         DW MSP
0B87 FFFF       2494         DW ENDTBL
                2495
0B89 09         2496 ONECT:  DB 9,30,31,32,40,41
0B8A 1E
0B8B 1F
0B8C 20
0B8D 28
0B8E 29
0B8F 2A         2497         DB 42,50,51,52
0B90 32
0B91 33
0B92 34
                2498
0B93 09         2499 STRTT:  DB 9,37,38,39,47,48
0B94 25
0B95 26
0B96 27
0B97 2F
0B98 30
0B99 31         2500         DB 49,57,58,59
0B9A 39
0B9B 3A
0B9C 3B
                2501
0B9D 04         2502 STUPCK: DB 4,44,45,54,55
0B9E 2C
0B9F 2D
0BA0 36
0BA1 37
                2503
                2504
                2505
                2506 ;---- CONTINUE FROM HALT
0BA2 3A0172     2507 M1:     LDA MSTATE
0BA5 A7         2508         ANA A
0BA6 CCAF0B     2509         CZ M2
                2510
0BA9 3E01       2511 M1A:    MVI A,1
0BAB 324372     2512 XMCX:   STA RCVCOD
0BAE C9         2513         RET
                2514
                2515
                2516 ;----- COLD START
0BAF 210000     2517 M2:     LXI H,0
0BB2 220272     2518         SHLD PCOUNT
0BB5 CDE60D     2519         CALL INIMCN     ;SETUP MACHINE
0BB8 3E01       2520         MVI A,ON
0BBA 324472     2521         STA ENABIT
0BBD 3E01       2522         MVI A,1
```

```
0BBF 320172     2523          STA MSTATE
0BC2 C9         2524          RET
                2525
                2526
                2527 ;----- SHUT DOWN
0BC3 3A0172     2528 M3:      LDA MSTATE
0BC6 A7         2529          ANA A
0BC7 CAF41A     2530          JZ MSGCH        ;IGNORE IF IN ALL CLEAR STATE
                2531
0BCA 3E00       2532          MVI A,OFF       ;INITIATE SHUT DOWN
0BCC 324472     2533          STA ENABIT
0BCF 3E03       2534          MVI A,3
0BD1 320172     2535 M3A:     STA MSTATE
0BD4 CDA90B     2536          CALL M1A
0BD7 C3F41A     2537          JMP MSGCH
                2538
                2539
                2540 ;---- SET TO RUN MODE
0BDA 3E00       2541 M4:      MVI A,0
0BDC C3F40B     2542          JMP M6A
                2543
                2544
                2545
                2546 ;---- SET TO SINGLE STEP MODE
0BDF 3E01       2547 M5:      MVI A,1
0BE1 C3F40B     2548          JMP M6A
                2549
                2550
                2551
                2552 ;---- SET TO MANUAL MODE
0BE4 3A0072     2553 M6:      LDA RMODE
0BE7 FE02       2554          CPI 2
0BE9 C2FA0B     2555          JNZ M6B
0BEC CD3126     2556          CALL GCH
0BEF C3A90B     2557          JMP M1A
0BF2 3E02       2558 M60:     MVI A,2
0BF4 320072     2559 M6A:     STA RMODE
                2560
0BF7 C2A20B     2561          JMP M1
                2562
0BFA AF         2563 M6B:     XRA A
0BFB 324772     2564          STA FDACTR
0BFE C3F20B     2565          JMP M60
                2566
                2567
                2568
                2569 ;=================================================================
                2570 ;
                2571 ;
                2572 ;                    * * * * SCREEN DISPLAYS * * * *
                2573 ;
                2574 ;
                2575 ;=====================================================================
                2576
                2577
                2578
                2579 ;------------  SCREEN INITIALIZATION
                2580
0C01 CD7225     2581 S1G0:    CALL CLSCRN     ;CLEAR SCREEN
0C04 CD100C     2582          CALL S1G1
0C07 11922E     2583          LXI D,S1F0      ;DISPLAY MACHINE STATE FIELDS
0C0A CD5826     2584          CALL DISPLAY
0C0D C3690C     2585          JMP S1A00
                2586
                2587
```

```
                2588 ;------------- HALT SCREEN
0C10 11882E     2589 S1G1:   LXI D,S1ET1     ;ERASE STUFF FROM RUN SCREEN
0C13 CD5B26     2590         CALL DISPLAY
0C16 118D2E     2591         LXI D,S1EP1
0C19 CD5B26     2592         CALL DISPLAY
                2593
0C1C 11BD2D     2594         LXI D,S1B1
0C1F CD5B26     2595         CALL DISPLAY
0C22 11CB2D     2596         LXI D,S1B2
0C25 CD5B26     2597         CALL DISPLAY
0C28 11D22D     2598         LXI D,S1B3
0C2B CD5B26     2599         CALL DISPLAY
0C2E 11972D     2600         LXI D,S1P0
0C31 CD5B26     2601         CALL DISPLAY
                2602
0C34 11E82D     2603         LXI D,S1REM
0C37 3A8876     2604         LDA MAINTR      ;CHECK FOR MAINTENANCE REMINDER
0C3A A7         2605         ANA A
0C3B C45B26     2606         CNZ DISPLAY
                2607
0C3E C9         2608         RET
                2609
                2610
                2611
                2612 ;----- RUN SCREEN
0C3F 111D2E     2613 S1G2:   LXI D,S1P1      ;HALT PROMPT
0C42 C35B26     2614         JMP DISPLAY
                2615
                2616
                2617 ;----- DISPLAY ERROR SCREEN
0C45 11362E     2618 S1G4:   LXI D,S1T4
0C48 C35B26     2619         JMP DISPLAY
                2620
                2621
                2622
                2623 ;------- DISPLAY MACHINE STATUS
0C4B CD7225     2624 S1G5:   CALL CLSCRN     ;ERASE MENU
                2625
0C4E 11EC2F     2626         LXI D,S1F2      ;DISPLAY STATION DATA
0C51 CD5B26     2627         CALL DISPLAY
                2628
0C54 116730     2629         LXI D,S1F3
0C57 CD5B26     2630         CALL DISPLAY
                2631
0C5A 11D530     2632         LXI D,S1F4
0C5D CD5B26     2633         CALL DISPLAY
                2634
0C60 CDBF0C     2635         CALL S1A2
0C63 CD190D     2636         CALL S1A3
0C66 C3790D     2637         JMP S1A4
                2638
                2639
                2640
                2641 ;-------------- ARRAY DISPLAYS
                2642
                2643 ;---- MACHINE STATUS
                2644
0C69 2A0272     2645 S1A00:  LHLD PCOUNT     ;DISPLAY PIECE COUNT
0C6C E5         2646         PUSH H
0C6D C1         2647         POP B
0C6E 119E2E     2648         LXI D,S1A0X2
0C71 C35B26     2649         JMP DISPLAY
                2650
                2651
```

```
                2652
                2653
                2654 ;---- DISPLAY HALT/ERROR DATA
                2655
0C74 3A3E72     2656 S1A1:   LDA HLTCOD      ;DISPLAY HALT CODE
                2657
0C77 FE01       2658         CPI 1           ;SEE IF ERROR DATA TO FOLLOW
0C79 C0         2659         RNZ
                2660
0C7A 3A3F72     2661         LDA ERRCOD      ;DISPLAY ERROR DATA
0C7D FE0D       2662         CPI 0DH
0C7F CC990C     2663         CZ S1DA1        ;DISPLAY COUNT ERRORS
0C82 FE0F       2664         CPI 0FH
0C84 CC990C     2665         CZ S1DA1
0C87 11A82E     2666         LXI D,S1A1X2
0C8A CD5B26     2667         CALL DISPLAY
                2668
0C8D 3A0572     2669         LDA ERRSTN      ;DISPLAY ERROR STATION
0C90 CD5E03     2670         CALL CNVISX
0C93 11A32E     2671         LXI D,S1A1X1
0C96 C35B26     2672         JMP DISPLAY
                2673
                2674
                2675
                2676
                2677 ;DISPLAY COUNT VALUES IF COUNT ERROR
                2678
0C99 F5         2679 S1DA1:  PUSH PSW        ;SAVE ERROR TYPE
0C9A 11B52F     2680         LXI D,S1A1X3
0C9D CD5B26     2681         CALL DISPLAY
0CA0 3A0572     2682         LDA ERRSTN
0CA2 CD2203     2683         CALL SETSTN
0CA6 2A4872     2684         LHLD RAMPTR
0CA9 0E15       2685         MVI C,SFDCNT
0CAB CD0C25     2686         CALL FETCH
0CAE 11D52F     2687         LXI D,S1A1X4
0CB1 CD5B26     2688         CALL DISPLAY
0CB4 3AA876     2689         LDA CNTVAL      ;VALUE IN ERROR
0CB7 11DA2F     2690         LXI D,S1A1X5
0CBA CD5B26     2691         CALL DISPLAY
0CBD F1         2692         POP PSW
0CBE C9         2693         RET
                2694
                2695
                2696
                2697 ;--- DISPLAY STATION SELECTION DATA FOR ALL FEEDER STATIONS
0CBF 3E01       2698 S1A2:   MVI A,1
0CC1 32CC76     2699         STA TABCTR
0CC4 3E00       2700         MVI A,0
0CC6 324A72     2701         STA STATION
                2702
0CC9 CD3203     2703 S1A20:  CALL SETSTN
0CCC CDDA0C     2704         CALL S1DA2
0CCF CD1E03     2705         CALL NXTSTN
0CD2 C8         2706         RZ
                2707
0CD3 21CC76     2708         LXI H,TABCTR
0CD6 34         2709         INR M
0CD7 C3C90C     2710         JMP S1A20
                2711
                2712 ;---- DISPLAY STATION SELECTION DATA FOR SINGLE STATION
0CDA CD5E03     2713 S1DA2:  CALL CNVISX     ;CONVERT INTERNAL STATION NO. TO EXTERNAL
0CDD 112330     2714         LXI D,S1A2X0
0CE0 CD5B26     2715         CALL DISPLAY    ;DISPLAY STATION NO.
```

```
                2716
0CE3 CD1703     2717        CALL NODVCK     ;CHECK IF NO DEVICE
0CE6 C8         2718        RZ              ;DONE IF NONE, ELSE DISPLAY IT
0CE7 112930     2719        LXI D,S1A2X1
0CEA CD5B26     2720        CALL DISPLAY
                2721
0CED 0E02       2722        MVI C,SLSTAT    ;DISPLAY IF SELECTABLE OR NOT
0CEF CD0C25     2723        CALL FETCH
0CF2 113030     2724        LXI D,S1A2X2
0CF5 CD5B26     2725        CALL DISPLAY
                2726
0CF8 2A4B72     2727        LHLD RAMPTR     ;DISPLAY STATUS -/OFF/ON/SELECTABLE
0CFB 0E10       2728        MVI C,ONSTAT
0CFD CD0C25     2729        CALL FETCH
0D00 114030     2730        LXI D,S1A2X3
0D03 CD5B26     2731        CALL DISPLAY
                2732
0D06 219576     2733        LXI H,ASNTAB    ;DISPLAY ASSIGNED STATION
0D09 3A4A72     2734        LDA STATION
0D0C 4F         2735        MOV C,A
0D0D CD0C25     2736        CALL FETCH
                2737
0D10 CD5E03     2738        CALL CNVISX
0D13 116220     2739        LXI D,S1A2X4
0D16 CD5B26     2740        JMP DISPLAY
                2741
                2742
                2743
                2744
                2745 ;------- DISPLAY SCANNER/CONTROL DATA FOR ALL STATIONS
0D19 3E01       2746 S1A3:  MVI A,1
0D1B 32CC76     2747        STA TABCTR
0D1E 3E00       2748        MVI A,0
0D20 324A72     2749        STA STATION
                2750
0D22 CD3303     2751 S1A30: CALL SETSTN
0D25 CD2400     2752        CALL S1DA3
0D29 CD1E03     2753        CALL NXTSTN
0D2C C8         2754        RZ
                2755
0D2D 21CC76     2756        LXI H,TABCTR
0D30 34         2757        INR M
0D31 C32300     2758        JMP S1A30
                2759
                2760
                2761 ;----- DISPLAY SCANNER/CONTROL DATA FOR 1 STATION
                2762
                2763 S1DA3:                 ;SCREEN 1 - DISPLAY ARRAY 3
0D34 2A4B72     2764        LHLD RAMPTR     ;DISPLAY ENABLE STATUS
0D37 0E1A       2765        MVI C,ENSTAT
0D39 CD0C25     2766        CALL FETCH
0D3C 118030     2767        LXI D,S1A3X0
0D3F CD5B26     2768        CALL DISPLAY
                2769
0D42 0E1C       2770        MVI C,FSCODE    ;DISPLAY IF STATION SELECTED OR NOT
0D44 CDF724     2771        CALL FETCHPTR
0D47 3A4A72     2772        LDA STATION
0D4A CDD024     2773        CALL SPHL
                2774
0D4D 7D         2775        MOV A,L
0D4E E601       2776        ANI 1B
0D50 110930     2777        LXI D,S1A3X1
0D53 CD5B26     2778        CALL DISPLAY
                2779
```

```
0056 CD0303   2780        CALL CHKSCF     ;CHECK FOR SCANNING FEEDER
0059 C8       2781        RZ              ;NOT A SCANNING FEEDER
              2782
005A 2A4872   2783        LHLD RAMPTR     ;DISPLAY FEED COUNT
005D 0E15     2784        MVI C,SFDCNT
005F CD0025   2785        CALL FETCH
0062 116230   2786        LXI D,S1A2X4
0065 CD5B26   2787        CALL DISPLAY
              2788
0068 0E16     2789        MVI C,SMCODE    ;DISPLAY MATCH CODE
006A CD0025   2790        CALL FETCH
006D 4F       2791        MOV C,A
006E 0600     2792        MVI B,0
0070 110030   2793        LXI D,S1A3X3
0073 CD5B26   2794        JMP DISPLAY
              2795
              2796
              2797
              2798 ;---- DISPLAY PIECE RECORDS FOR ALL STATIONS
0076 AF       2799 S1A4:  XRA A
0077 324872   2800        STA STATION
007A CD2303   2801        CALL SETSTN     ;SEE IF STATION 0 USED YET
007D 0E1A     2802        MVI C,ENSTAT
007F A7       2803        ANA A
0080 CA8C0D   2804        JZ S1A41        ;IF NOT, DON'T GET LAST RECORD
0083 CD5913   2805        CALL LCDSEL     ;MAKE SURE CURRENT DOCUMENT IS LOADED
0086 CD0014   2806        CALL LCDACS
0089 CD9014   2807        CALL LDDCNT
008C 3E01     2808 S1A41: MVI A,1
008E 32CC76   2809        STA TABCTR
0091 AF       2810        XRA A
              2811
0092 CD2303   2812 S1A40: CALL SETSTN
0095 CDA30D   2813        CALL S1DA4
0098 CD1E02   2814        CALL NXTSTN
009B C8       2815        RZ
              2816
009C 21CC76   2817        LXI H,TABCTR
009F 34       2818        INR M
00A0 C3920D   2819        JMP S1A40
              2820
              2821
              2822 ;---- DISPLAY PIECE RECORD FOR SINGLE STATION
              2823
00A3 2A4872   2824 S1DA4: LHLD RAMPTR     ;DISPLAY ERROR CONDITION CODE
00A6 0E19     2825        MVI C,ERSTAT
00A8 CD0025   2826        CALL FETCH
00AB 116201   2827        LXI D,S1A4X0
00AE CD5B26   2828        CALL DISPLAY
              2829
              2830
00B1 0E20     2831        MVI C,CDCNT     ;DISPLAY CONTROL DOC. COUNT
00B3 CD0025   2832        CALL FETCH
00B6 116230   2833        LXI D,S1A2X4
00B9 CD5B26   2834        CALL DISPLAY
              2835
00BC 0E1B     2836        MVI C,MCHCOD    ;DISPLAY MATCH CODE
00BE CD0025   2837        CALL FETCH
00C1 4F       2838        MOV C,A
00C2 0600     2839        MVI B,0
00C4 110030   2840        LXI D,S1A3X3
00C7 CD5B26   2841        CALL DISPLAY
              2842
00CA E5       2843        PUSH H
```

```
0CC9 0E10      2844        MVI C,FSCODE          ;DISPLAY FEED SELECT CODE
0CCD CDF724    2845        CALL FETCHPTR
0CD0 4D        2846        MOV C,L
0CD1 44        2847        MOV B,H
0CD2 110030    2848        LXI D,51A3X3
0CD5 CD5826    2849        CALL DISPLAY
               2850
0CD9 E1        2851        POP H
0CDA 0E1E      2852        MVI C,ACSCOD          ;DISPLAY ACCESSORY CONTROL CODE
0CDB CDF724    2853        CALL FETCHPTR
0CDE 4D        2854        MOV C,L
0CDF 44        2855        MOV B,H
0CE0 110030    2856        LXI D,51A3X3
0CE3 C35826    2857        JMP DISPLAY
               2858
               2859
               2860
               2861 ;==========================================================================
               2862 ;
               2863 ;
               2864 ;            * * * *   MACHINE INITIALIZATION ROUTINE * * * *
               2865 ;
               2866 ;
               2867 ;==========================================================================
               2868
               2869
0CE6 CD520E    2870 INIMCN: CALL INIENV     ;INITIALIZE ENVELOPE STUFFER
0CE9 CD2A0E    2871        CALL INISCB     ;INIYIALIZE STATION CONTROL BLOCKS
               2872
0CEC CD980E    2873        CALL TSKSCD     ;BUILD TASK TABLE FOR TASK SCHEDULER
0CEF FB        2874        EI              ;ENABLE INTERRUPT
0CF0 C9        2875        RET             ;GOOD LUCK !
               2876
               2877
               2878
               2879 ;----- RESET FEEDERS
0CF1 3E00      2880 RSTFDR: MVI A,0
0CF3 324A72    2881        STA STATION
               2882
0CF6 CD2203    2883 RSTFD0: CALL SETSTN
               2884
0CF9 2A4072    2885        LHLD RAMPTR     ;CLEAR COMMAND IN SCB
0CFC 0E11      2886        MVI C,SFCMD
0CFE 3E00      2887        MVI A,0
0E00 CD1525    2888        CALL STORE
               2889
0E03 CD1A0E    2890        CALL FDRRT      ;ISSUE RESET COMMAND
               2891
0E06 CDE415    2892        CALL RFSTAT     ;SEE IF FEEDER READY
0E09 E604      2893        ANI RDYBIT
0E0B CA150E    2894        JZ RSTFD1       ;NOT READY -- TOO BAD
               2895
0E0E CD2C03    2896        CALL NXTSTA
0E11 C2F80D    2897        JNZ RSTFD0
0E14 C9        2898        RET
               2899
0E15 3E09      2900 RSTFD1: MVI A,ERRFNR    ;REGISTER "FEEDERS NOT READY" ERROR
0E17 C3F908    2901        JMP ERRSET
               2902
0E1A 0E01      2903 FDRRT:  MVI C,FCRSET    ;RESET FEEDER
0E1C CDC115    2904        CALL WRFCMD
               2905
0E1F 210A00    2906        LXI H,10
0E22 CDCF2B    2907        CALL WAIT       ;WAIT 10 MILSEC FOR FEEDER TO SETTLE
```

```
                2908
0E25 0E00       2909        MVI C,0
0E27 C3C115     2910        JMP WRFCMD      ;CLEAR RESET LEVEL
                2911
                2912
                2912 ;------- INITIALIZE STATION CONTROL BLOCKS
0E2A 3A4672     2914 INISCB: LDA ACSSTN
0E2D 47         2915        MOV B,A
0E2E 3E00       2916        MVI A,0
0E30 324A72     2917        STA STATION
                2918
0E33 CD3203     2919 INIT2:  CALL SETSTN
0E36 2A4B72     2920        LHLD RAMPTR
0E39 111100     2921        LXI D,SFCMD
0E3C 19         2922        DAD D
0E3D 0E35       2923        MVI C,VARCNT+RECCNT-1
                2924
0E3F 3600       2925 INIT3:  MVI M,0
0E41 23         2926        INX H
0E42 0D         2927        DCR C
0E43 C23F0E     2928        JNZ INIT3
                2929
0E46 3A4A72     2930        LDA STATION
0E49 B8         2931        CMP B
0E4A C8         2932        RZ
                2933
0E4B 3C         2934        INR A
0E4C 324A72     2935        STA STATION
0E4F C3330E     2936        JMP INIT2
                2937
                2938
                2939
                2940
                2941
                2942 ;----INITIALIZE ENVELOPE FEEDER
                2943
0E52 3A4572     2944 INIENV: LDA ENVSTN
0E55 CD3203     2945        CALL SETSTN
                2946
0E58 2A4B72     2947        LHLD RAMPTR
0E5B 0E10       2948        MVI C,ONSTAT
0E5D 3E01       2949        MVI A,ON
0E5F C31525     2950        JMP STORE
                2951
                2952
                2953
                2954
                2955 ;------ INITIALIZE ACCESSORY
0E62 CD9E0E     2956 INIACS: CALL ASET
0E65 0E08       2957        MVI C,ACCON
0E67 CD3816     2958        CALL WRSCMD
0E6A 2A4872     2959        LHLD PRMADR
0E6D 112A05     2960        LXI D,OUTWDS    ;OUTPUT DEVICE TYPES
0E70 19         2961        DAD D
0E71 EB         2962        XCHG
0E72 CD820E     2963        CALL ACOUT
0E75 0E40       2964        MVI C,ACJTM
0E77 CD3816     2965        CALL WRSCMD
0E7A 2A4872     2966        LHLD PRMADR
0E7D 113D05     2967        LXI D,JMWDS     ;OUTPUT JAM TIMES
0E80 19         2968        DAD D
0E81 EB         2969        XCHG
                2970
```

```
0E82 1A          2971 ACOUT:  LDAX D
0E83 CDED02      2972 ACOUT1: CALL CNFG0      ;OUTPUT BYTE
LOC  OBJ         LINE        SOURCE STATEMENT

0E86 FE00        2973         CPI 0
0E88 C2830E      2974         JNZ ACOUT1
0E8B C3ED02      2975         JMP CNFG0
                 2976
                 2977
0E8E 2A2F2D      2978 ASET:   LHLD ACDATA     ;SET DEVICE LOCATION
0E91 22C376      2979         SHLD SDPTR
0E94 2A312D      2980         LHLD ACCMND
0E97 22C576      2981         SHLD SCPTR
0E9A C9          2982         RET
                 2983
                 2984
                 2985
                 2986 ;---- TASK SCHEDULER -- LOADS TASK TABLE
                 2987
0E9B 21EE76      2988 TSKSCD: LXI H,TSKTAB    ;CLEAR TASK TABLE
0E9E 22E976      2989         SHLD TTEND
0EA1 22E776      2990         SHLD TTPTR
0EA4 36FF        2991         MVI M,ENDLST
                 2992
0EA6 3E00        2993         MVI A,0         ;SCHEDULE FEEDERS
0EA8 32A472      2994         STA STATION
0EAB CD2203      2995 TSK0:   CALL SETSTN
0EAE CDC00E      2996         CALL SCDFDR
0EB1 CD1E03      2997         CALL NXTSTN
0EB4 C2AB0E      2998         JNZ TSK0
                 2999
0EB7 CD480F      3000         CALL SCENVF     ;SCHEDULE ENVELOPE STUFFER
0EBA CD990F      3001         CALL SCACSR     ;SCHEDULE ACCESSORY
0EBD C39D0F      3002         JMP SCDHLT      ;SCHEDULE OPERATOR HALTS
                 3003
                 3004
                 3005 ;----- SCHEDULE TASKS FOR ONE FEEDER
0EC0 3A4A72      3006 SCDFDR: LDA STATION
0EC3 32E476      3007         STA TSKSTN
                 3008
0EC6 CD1703      3009         CALL NODVCK     ;IF NO DEVICE, EXIT
0EC9 C8          3010         RZ
0ECA 2A4B72      3011         LHLD RAMPTR     ;IF STATION IS OFF,SCHEDULE ENC. SENSE ONLY
0ECD 0E10        3012         MVI C,ONSTAT
0ECF CD0C25      3013         CALL FETCH
                 3014
0ED2 5F          3015         MOV E,A         ;CHECK FOR MULTIDOC FEEDER
0ED3 CD0803      3016         CALL CHKSCF
0ED6 CA0B0F      3017         JZ SCF3         ;THIS IS A STANDARD FEEDER
                 3018
0ED9 3E02        3019         MVI A,2         ;---- SCHEDULE SET COUNTS AND SELECTS FOR MDFS
0EDB 32E376      3020         STA TSKTME
                 3021
0EDE 3A4A72      3022         LDA STATION     ;OMIT SELECT IF STATION 0 OR 1
0EE1 0602        3023         MVI B,2
0EE3 90          3024         SUB B
0EE4 FAED0E      3025         JM SCF0
                 3026
0EE7 115010      3027         LXI D,SELCHK    ;SCHEDULE SELECT
0EEA CDA90F      3028         CALL ADDTSK
                 3029
0EED 3A4A72      3030 SCF0:   LDA STATION     ;SCHEDULE SET COUNT
0EF0 FE00        3031         CPI 0
0EF2 CA050F      3032         JZ SCF1         ;ALWAYS USE OPERATOR COUNT FOR STATION 0
```

```
                3033
0EF5 2A4B72     3034        LHLD RAMPTR
0EF8 0E08       3035        MVI C,FDSTOP
0EFA CD0C25     3036        CALL FETCH
                3037
0EFD FE03       3038        CPI FSCDCT      ;STOP ON COUNT SPECIFIED CONTROL DOC
0EFF 112410     3039        LXI D,SETCDC    ;SET CONTROL DOC COUNT
0F02 CA080F     3040        JZ SCF2
0F05 113B10     3041 SCF1:  LXI D,SETOPC    ;SET OPERATOR'S COUNT
0F08 CDA90F     3042 SCF2:  CALL ADDTSK
                3043
0F0B 2A4B72     3044 SCF3:  LHLD RAMPTR
0F0E 0E00       3045        MVI C,FDTIME    ;---- SCHEDULE START FEEDS
0F10 CD3E0F     3046        CALL GETTIM
                3047
0F13 CD0803     3048        CALL CHKSCF
0F16 119D10     3049        LXI D,INISCF    ;START MULTIDOC FEEDER
0F19 C21F0F     3050        JNZ SCF4
0F1C 118C10     3051        LXI D,INISTF    ;START STANDARD FEEDER
0F1F CDA90F     3052 SCF4:  CALL ADDTSK
                3053
                3054
0F22 2A4B72     3055 SCF5:  LHLD RAMPTR     ;------- ENCLOSURE SENSE ON
0F25 0E01       3056        MVI C,TESON
0F27 CD3E0F     3057        CALL GETTIM
0F2A 11BF11     3058        LXI D,ENSON
0F2D CDA90F     3059        CALL ADDTSK
                3060
0F30 2A4B72     3061        LHLD RAMPTR
0F33 0E02       3062        MVI C,TESOFF     ; ENCLOSURE SENSE OFF
0F35 CD3E0F     3063        CALL GETTIM
0F38 11B211     2064        LXI D,ENSOFF
0F3B C3A90F     3065        JMP ADDTSK
                3066
                3067
0F3E CD0C25     3068 GETTIM: CALL FETCH
0F41 CDBE16     3069        CALL CNVTIM
0F44 32E376     3070        STA TSKTME
0F47 C9         3071        RET
                3072
                3073
                3074
                3075
                3076 ;-----------------------------------------------------------
                3077 ; SCHEDULE ENVELOPE STUFFER
                3078 ;
                3079 ;-----------------------------------------------------------
                3080
0F48 3A4572     3081 SCENVF: LDA ENVSTN
0F4B 32E476     3082        STA TSKSTN
0F4E 3A7076     3083        LDA EFDTIM      ;SCHEDULE START FEED
0F51 CD410F     3084        CALL GETTIM+3
0F54 11B910     3085        LXI D,STEFDR
0F57 CDA90F     3086        CALL ADDTSK
                3087
0F5A 3A7176     3088 EF0:   LDA EFESON      ;SCHEDULE ENCLOSURE SENSE ON
0F5D CD410F     3089        CALL GETTIM+3
0F60 11BF11     3090        LXI D,ENSON
0F63 CDA90F     3091        CALL ADDTSK
                3092
0F66 3A7276     3093        LDA EFESOFF     ;SCHEDULE ENCLOSURE SENSE OFF
0F69 CD410F     3094        CALL GETTIM+3
0F6C 11B211     3095        LXI D,ENSOFF
0F6F CDA90F     3096        CALL ADDTSK
```

```
                3097
0F72 3A7376     3098        LDA EFJSON      ;SCHEDULE JAM SENSE ON
0F75 CD410F     3099        CALL GETTIM+3
0F78 110F11     3100        LXI D,JMSON
0F7B CDA90F     3101        CALL ADDTSK
                3102
0F7E 3A7476     3103        LDA EFJSOFF     ;SCHEDULE JAM SENSE OFF
0F81 CD410F     3104        CALL GETTIM+3
0F84 11F011     3105        LXI D,JMSOFF
0F87 C3A90F     3106        JMP ADDTSK
                3107
                3108
                3109
                3110
                3111
                3112
                3113 ;-----------------------------------------------------------
                3114 ; SCHEDULE TASKS TO OPERATE ACCESSORY --
                3115 ;          INCLUDING  METER STACKER, SEALER, MARKER
                3116 ;
                3117 ;-----------------------------------------------------------
                3118
0F8A 3A4672     3119 SCACSR: LDA ACSSTN
0F8D 32E476     3120        STA TSKSTN
0F90 3A9C0F     3121        LDA ACFDTM      ;SET TIME
0F93 CD410F     3122        CALL GETTIM+3
0F96 110C11     3123        LXI D,ACSET     ;TASK ADDRESS
0F99 C3A90F     3124        JMP ADDTSK
                3125
0F9C 32         3126 ACFDTM: DB 50
                3127
                3128 ;--------- SCHEDULE CHECK FOR OPERATOR HALTS
0F9D 3A5572     3129 SCDHLT: LDA TCSOFF
0FA0 CD410F     3130        CALL GETTIM+3
0FA3 115C05     3131        LXI D,POLCSH    ;POLL FOR CYCLE STOP HALTS
0FA6 C3A90F     3132        JMP ADDTSK
                3133
                3134
                3135
                3136
                3137 ;-----------------------------------------------------------
                3138 ; SUBR TO ADD 1 TASK TO TASKTABLE
                3139 ;  INPUT:  [A] CONTAINS TASK TIME (0-99)
                3140 ;          [DE] CONTAINS ADDRESS OF TASK SUBROUTINE
                3141 ;
                3142 ;-----------------------------------------------------------
                3143
                3144 ADDTSK:
0FA9 EB         3145        XCHG
0FAA 22E576     3146        SHLD TSKPTR
                3147
0FAD 11EE76     3148        LXI D,TSKTAB    ; SEE IF TABLE EMPTY
0FB0 2AE976     3149        LHLD TTEND
0FB3 CDC124     3150        CALL CMDEHL     ;COMPARE [DE] WITH [HL]
0FB6 CAC50F     3151        JZ AT0          ;TABLE IS EMPTY
                3152
0FB9 11FCFF     3153        LXI D,-4        ; SEE IF WE ADD TASK TO END OF TABLE
0FBC 19         3154        DAD D
0FBD 46         3155        MOV B,M
0FBE 3AE376     3156        LDA TSKTME
0FC1 90         3157        SUB B
0FC2 FAD10F     3158        JM AT1          ; NO -- TASK MUST BE INSERTED IN TABLE
                3159
0FC5 2AE976     3160 AT0:   LHLD TTEND              ; ADD TASK TO END OF TABLE
```

```
0FC8 CD1610     3161        CALL CPYTSK          ;COPY TASK INTO TABLE
0FCB 22E976     3162        SHLD TTEND
0FCE 36FF       3163        MVI M,ENDLST
0FD0 C9         3164        RET
                3165
0FD1 11EE76     3166 AT1:   LXI D,TSKTAB    ; SEE IF WE ARE AT BEGINNING OF TABLE
0FD4 CDC124     3167        CALL CMDEHL     ;COMPARE [DE] WITH [HL]
0FD7 CAEA0F     3168        JZ AT2          ; YES, SO MAKE ROOM AT TOP FOR TASK
                3169
0FDA 11FCFF     3170        LXI D,-4
0FDD 19         3171        DAD D
0FDE 46         3172        MOV B,M
0FDF 3AE376     3173        LDA TSKTME
0FE2 90         3174        SUB B
0FE3 FAD10F     3175        JM AT1  ; LOCATE TASK POSITION IN TABLE,ORDERED BY TASK TIME
                3176
0FE6 110400     3177        LXI D,4         ;LOCATION ESTABLISHED
0FE9 19         3178        DAD D
0FEA 22E176     3179 AT2:   SHLD PLIM       ;SET POINTERS TO SHIFT TABLE CONTENTS
0FED 2AE976     3180        LHLD TTEND
0FF0 22DD76     3181        SHLD PFETCH
                3182
0FF3 110400     3183        LXI D,4         ;ADVANCE BOTTOM OF TABLE BY ONE ENTRY
0FF6 19         3184        DAD D
0FF7 22E976     3185        SHLD TTEND
0FFA 22DF76     3186        SHLD PSTORE
                3187
0FFD 2ADD76     3188        LHLD PFETCH
1000 EB         3189        XCHG
1001 2ADF76     3190        LHLD PSTORE
1004 E5         3191        PUSH H
1005 C1         3192        POP B
1006 2AE176     3193        LHLD PLIM
                3194
1009 1A         3195 AT3:   LDAX D          ; MAKE ROOM FOR TASK TO BE INSERTED
100A 02         3196        STAX B
100B CDC124     3197        CALL CMDEHL     ;COMPARE [DE] WITH [HL]
100E CA1610     3198        JZ CPYTSK
1011 0B         3199        DCX B
1012 1B         3200        DCX D
1013 C30910     3201        JMP AT3
                3202
                3203
                3204
                3205 ; SUBR. TO COPY TASK INTO TASK TABLE
                3206 ;   INPUT:  [HL] POINTS TO TABLE LOCATION FOR INSERTION
                3207
                3208
                3209 CPYTSK:                    ;COPY TASK INTO TABLE
1016 0E04       3210        MVI C,4
1018 11E376     3211        LXI D,TSKTME
101B 1A         3212 CPT0:  LDAX D
101C 77         3213        MOV M,A
101D 23         3214        INX H
101E 13         3215        INX D
101F 0D         3216        DCR C
1020 C21B10     3217        JNZ CPT0
1023 C9         3218        RET
                3219
                3220
                3221
                3222
                3223
                3224
```

```
                3225
                3226
                3227
                3228 ;=================================================================
                3229 ;
                3230 ;
                3231 ;                    TASK SUBROUTINES
                3232 ;
                3233 ;
                3234 ;==============================================================
                3235
                3236
                3237 ;------ SET FEED COUNT SPECIFIED BY CONTROL DOCUMENT
                3238
1024 CD0112     3239 SETCDC: CALL RAMST
1027 CD1112     3240         CALL CHKON
102A C8         3241         RZ
                3242
102B 012900     3243         LXI B,CDCNT
102E 3A4A72     3244         LDA STATION      ;POINT AT CORRECT STATION
1031 CD5E03     3245         CALL CNVISX
1034 81         3246         ADD C
1035 3D         3247         DCR A
1036 4F         3248         MOV C,A
1037 E5         3249         PUSH H
1038 C34610     3250         JMP SETCT0
                3251
                3252 ;---- SET FEED COUNT SPECIFIED BY OPERATOR
                3253
103B CD0112     3254 SETOPC: CALL RAMST
103E CD1112     3255         CALL CHKON
1041 C8         3256         RZ
                3257
1042 010300     3258         LXI B,OPCNT
1045 E5         3259         PUSH H
1046 09         3260 SETCT0: DAD B            ;POINT AT COUNT
                3261
1047 E5         3262         PUSH H           ;SET I/O POINTERS
1048 3A4A72     3263         LDA STATION
104B CD5E03     3264         CALL CNVISX
104E CD6F03     3265         CALL SETIOP
1051 E1         3266         POP H            ;COUNT POINTER
                3267
1052 5E         3268         MOV E,M
1053 E1         3269         POP H            ;RAM POINTER
1054 011100     3270         LXI B,SFCMD
1057 09         3271         DAD B
1058 7E         3272         MOV A,M
1059 F640       3273         ORI FCWRCT
105B 4F         3274         MOV C,A
105C 7B         3275         MOV A,E
105D C30716     3276         JMP WRFDATA
                3277
                3278
                3279
                3280 ;------ TASK TO SELECT OR DESELECT MULTIDOC FEEDER
1060 CD0112     3281 SELCHK: CALL RAMST
1063 011300     3282         LXI B,FDABIT
1066 09         3283         DAD B
1067 7E         3284         MOV A,M
1068 E602       3285         ANI 10B          ;THIS BIT SAYS FEED SELECT(SEE INITSK)
106A 3A4A72     3286         LDA STATION
106D CA7E10     3287         JZ SCFOFF
                3288
```

```
                3299
                3290 ;--- SELECT FEEDER
1070 CD0112     3291 SCFON:  CALL RAMST
1073 011100     3292         LXI B,SFCMD
1076 09         3293         DAD B
1077 7E         3294         MOV A,M
1078 F602       3295         ORI FCSLON
107A 77         3296         MOV M,A
107B C3CE11     3297         JMP ENS02
                3298
                3299 ;----- DESELECT FEEDER
107E CD0112     3300 SCFOFF: CALL RAMST
1081 011100     3301         LXI B,SFCMD
1084 09         3302         DAD B
1085 7E         3303         MOV A,M
1086 E6FD       3304         ANI FCSLOFF
1088 77         3305         MOV M,A
1089 C3CE11     3306         JMP ENS02
                3307
                3308
                3309
                3310 ;------ TASKS TO START FEEDERS
                3311
                3312 ;--- TASK TO START STANDARD FEEDER
108C CD0112     3313 INISTF: CALL RAMST
108F CD1112     3314         CALL CHKON
1092 C8         3315         RZ
                3316
1093 E5         3317         PUSH H          ;SAVE RAM POINTER
1094 0E11       3318         MVI C,SFCMD     ;OFFSET TO SFCMD IN SCB
1096 3E04       3319         MVI A,FCSTFD    ;START FEED COMMAND
1098 CDCA11     3320         CALL ENS01      ;DO COMMAND
109B E1         3321         POP H
109C C9         3322         RET
                3323
                3324
                3325 ;---- TASK TO START MULTIDOC FEEDER
109D CD0112     3326 INISCF: CALL RAMST
10A0 CD1112     3327         CALL CHKON
10A3 C8         3328         RZ
                3329
10A4 E5         3330         PUSH H          ;SAVE RAM POINTER
10A5 0E11       3331         MVI C,SFCMD     ;OFFSET TO SFCMD IN SCB
10A7 3E04       3332         MVI A,FCSTFD    ;START FEED COMMAND
10A9 CDCA11     3333         CALL ENS01      ;DO COMMAND
10AC E1         3334         POP H
                3335
10AD 011300     3336         LXI B,SCABIT    ;SET SCANNER ACTIVE BIT
10B0 09         3337         DAD B
10B1 3E01       3338         MVI A,ON
10B3 77         3339         MOV M,A
                3340
10B4 214772     3341         LXI H,FDACTR
10B7 34         3342         INR M
10B8 C9         3343         RET
                3344
                3345
                3346
                3347
                3348 ;----TASK TO START ENVELOPE FEEDER
10B9 3A4572     3349 STEFDR: LDA ENVSTN
10BC 4F         3350         MOV C,A
10BD 3D         3351         DCR A
10BE 3D         3352         DCR A
```

```
10BF CD0112     3353          CALL RAMST       ;TASK EXECUTED WHEN 2 STATIONS PREVIOUS ENABLED
                3354
10C2 111A00     3355          LXI D,ENSTAT
10C5 19         3356          DAD D
10C6 3E00       3357          MVI A,OFF
10C8 BE         3358          CMP M
10C9 C2D810     3359          JNZ STEFD4
                3360
10CC 79         3361          MOV A,C
10CD 3D         3362          DCR A
10CE CD0112     3363          CALL RAMST       ;IF PREVIOUS STATION ON, MEANS WE'RE CLEARING
10D1 111A00     3364          LXI D,ENSTAT     ;DECK, SO GIVE IT ONE MORE FEED
10D4 19         3365          DAD D
10D5 3E00       3366          MVI A,OFF
10D7 BE         3367          CMP M
10D8 CA0111     3368          JZ STEFD1
                3369
10DB 79         3370 STEFD4:  MOV A,C          ;ENYSTN AGAIN
10DC CD0112     3371          CALL RAMST
10DF 111000     3372          LXI D,ONSTAT     ;CHECK IF STATION DISABLED
10E2 19         3373          DAD D
10E3 3E00       3374          MVI A,OFF
10E5 BE         3375          CMP M
10E6 C8         3376          RZ
                3377
10E7 23         3378          INX H            ;POINT AT COMMAND
10E8 23         3379          INX H
10E9 7E         3380          MOV A,M
10EA A7         3381          ANA A            ;SET FEEDER ACTIVE BIT
10EB C2F310     3382          JNZ STEFD2       ;SO SENSE WORKS CORRECTLY
10EE 3602       3383          MVI M,2
10F0 C3FA10     3384          JMP STEFD3
10F3 FE02       3385 STEFD2:  CPI 2
10F5 C2FA10     3386          JNZ STEFD3
10F8 3601       3387          MVI M,1
10FA 2B         3388 STEFD3:  DCX H
10FB 7E         3389          MOV A,M
10FC F604       3390          ORI FCSTFD
10FE C3CE11     3391          JMP ENS02
                3392
1101 79         3393 STEFD1:  MOV A,C
1102 CD0112     3394          CALL RAMST
1105 111200     3395          LXI D,FDABIT
1108 19         3396          DAD D
1109 3600       3397          MVI M,0
110B C9         3398          RET
                3399
                3400
                3401
                3402 ;TASK TO SET ACCESSORY
110C 2A312D     3403 ACSET:   LHLD ACCMND
110F 22C576     3404          SHLD SCPTR
1112 3A4672     3405          LDA ACSSTN
1115 07         3406          RLC
1116 4F         3407          MOV C,A
1117 212D2C     3408          LXI H,RAMTAB     ;FIND ACCESSORY CODE
111A CDF724     3409          CALL FETCHPTR
111D 5D         3410          MOV E,L
111E 54         3411          MOV D,H
111F 011A00     3412          LXI B,ENSTAT
1122 09         3413          DAD B
1123 7E         3414          MOV A,M
1124 A7         3415          ANA A
1125 C8         3416          RZ               ;WAIT FOR ENABLED
```

```
1126 211F00      3417          LXI H,ACSSTK
1129 19          3418          DAD D
112A 7E          3419          MOV A,M
112B F5          3420          PUSH PSW        ;SAVE STACKER CODE
112C 2B          3421          DCX H
112D 7E          3422          MOV A,M
112E 210000      3423          LXI H,0         ;NOW MUST TRANSLATE TO ACC CODE
1131 4F          3424          MOV C,A
1132 E601        3425          ANI SLRBIT      ;CHECK SEALER
1134 111405      3426          LXI D,SLPOS     ;GET SEALER POSITION
1137 C4A611      3427          CNZ ACSET1
113A 79          3428          MOV A,C
113B E602        3429          ANI MKRBIT      ;CHECK FOR MARKER
113D 111005      3430          LXI D,MKPOS
1140 C4A611      3431          CNZ ACSET1
1143 79          3432          MOV A,C
1144 E604        3433          ANI DFLBIT      ;CHECK FOR DEFLECTOR
1146 111205      3434          LXI D,DFLPOS
1149 C4A611      3435          CNZ ACSET1
114C 79          3436          MOV A,C
114D E608        3437          ANI MTRBIT      ;CHECK FOR METER 1
114F 110C05      3438          LXI D,MTRPOS
1152 C4A611      3439          CNZ ACSET1
1155 79          3440          MOV A,C
1156 E610        3441          ANI MT2BIT      ;CHECK FOR METER 2
1158 110E05      3442          LXI D,MT2POS
115B C4A611      3443          CNZ ACSET1
115E F1          3444          POP PSW         ;NOW GET BACK STACKER FIELD
115F A7          3445          ANA A
1160 CA9611      3446          JZ ACSET5       ;JUMP IF NONE
1163 4F          3447          MOV C,A
1164 E610        3448          ANI STKABT      ;CHECK FOR 3 TIER STACKER VALUES
1166 111605      3449          LXI D,STKAP
1169 C4A611      3450          CNZ ACSET1
116C 79          3451          MOV A,C
116D E620        3452          ANI STKBBT
116F 111805      3453          LXI D,STKBP
1172 C4A611      3454          CNZ ACSET1
1175 79          3455          MOV A,C
1176 E640        3456          ANI STKCBT
1178 111A05      3457          LXI D,STKCP
117B C4A611      3458          CNZ ACSET1
117E 79          3459          MOV A,C
117F E607        3460          ANI STKMSK      ;CHECK FOR VERTICAL STACKERS
1181 CA9611      3461          JZ ACSET5
1184 3D          3462          DCR A
1185 07          3463          RLC
1186 4F          3464          MOV C,A
1187 E5          3465          PUSH H
1188 2A4872      3466          LHLD PRMADR
118B 111C05      3467          LXI D,STKPOS    ;GET STACKER POSITION
118E 19          3468          DAD D
118F CDF724      3469          CALL FETCHPTR
1192 D1          3470          POP D
1193 CDC724      3471          CALL ORDEHL
1196 EB          3472 ACSET5:  XCHG
1197 2A2F2D      3473          LHLD ACDATA     ;NOW SET VALUE
119A 7B          3474          MOV A,E
119B 2F          3475          CMA
119C 77          3476          MOV M,A
119D E5          3477          PUSH H
119E CDF802      3478          CALL WESB       ;WAIT FOR EMPTY BUFFER
11A1 E1          3479          POP H
11A2 7A          3480          MOV A,D
```

```
11A3 2F          3481          CMA
11A4 77          3482          MOV M,A
11A5 C9          3483          RET
                 3484
11A6 E5          3485 ACSET1:  PUSH H
11A7 2A4872      3486          LHLD PRMADR     ;POINT AT DEVICE OUTPUT VALUE
11AA 19          3487          DAD D
11AB 5E          3488          MOV E,M
11AC 23          3489          INX H
11AD 56          3490          MOV D,M
11AE E1          3491          POP H
11AF C3C724      3492          JMP ORDEHL
                 3493
                 3494
                 3495
                 3496
                 3497 ;------ ENCLOSURE SENSE OFF
                 3498
11B2 CD0112      3499 ENSOFF:  CALL RAMST
11B5 111100      3500          LXI D,SFCMD
11B8 19          3501          DAD D
11B9 3EEF        3502          MVI A,FCESOFF
11BB A6          3503          ANA M
11BC C3CE11      3504          JMP ENSO2
                 3505
                 3506
                 3507 ;------- ENCLOSURE SENSE ON
                 3508
11BF CD0112      3509 ENSON:   CALL RAMST
11C2 CD1112      3510          CALL CHKON
11C5 C8          3511          RZ
11C6 0E11        3512          MVI C,SFCMD
11C8 3E10        3513          MVI A,FCESON
                 3514
11CA 0600        3515 ENSO1:   MVI B,0
11CC 09          3516          DAD B
11CD B6          3517          ORA M
                 3518
11CE 2F          3519 ENSO2:   CMA
11CF 4F          3520          MOV C,A
11D0 2A4A72      3521          LDA STATION
11D3 47          3522          MOV B,A
11D4 3A4572      3523          LDA ENVSTN
11D7 90          3524          SUB B
                 3525
11D8 2AC92C      3526          LHLD MMIOT1     ;MM/IO BASE ADDRESS
11DB B5          3527          ORA L
11DC 6F          3528          MOV L,A
                 3529
11DD 71          3530          MOV M,C
11DE C9          3531          RET
                 3532
                 3533
                 3534
                 3535
                 3536 ;------ JAM SENSE ON
                 3537
11DF CD0112      3538 JMSON:   CALL RAMST
11E2 CD1112      3539          CALL CHKON
11E5 C8          3540          RZ
                 3541
11E6 011100      3542          LXI B,SFCMD
11E9 09          3543          DAD B
11EA F608        3544          ORI FCJSON
```

```
11EC 77          3545        MOV M,A
11ED C3CE11      3546        JMP ENS02
                 3547
                 3548 ;----- JAM SENSE OFF
                 3549
11F0 CD0112      3550 JMSOFF: CALL RAMST
11F3 CD1112      3551        CALL CHKON
11F6 C8          3552        RZ
                 3553
11F7 011100      3554        LXI B,SFCMD
11FA 09          3555        DAD B
11FB E6F7        3556        ANI FCJSOFF
11FD 77          3557        MOV M,A
11FE C3CE11      3558        JMP ENS02
                 3559
                 3560
                 3561 ;----- SET RAM POINTER, [A] HAS STATION NUMBER
1201 324A72      3562 RAMST:  STA STATION
1204 07          3563        RLC
1205 21BD2C      3564        LXI H,RAMTAB
1208 1600        3565        MVI D,0
120A 5F          3566        MOV E,A
120B 19          3567        DAD D
120C 5E          3568        MOV E,M
120D 23          3569        INX H
120E 56          3570        MOV D,M
120F EB          3571        XCHG
1210 C9          3572        RET
                 3573
                 3574
                 3575 ;----- SEE IF STATION ENABLED
1211 E5          3576 CHKON:  PUSH H
1212 011200      3577        LXI B,FDABIT
1215 09          3578        DAD B
1216 7E          3579        MOV A,M
1217 E601        3580        ANI 1B          ;THIS BIT SAYS STATION CAN BE STARTED(SEE INITSK)
1219 E1          3581        POP H
121A C9          3582        RET
                 3583
                 3584
                 3585
                 3586 ;==================================================================
                 3587 ;
                 3588 ;
                 3589 ;
                 3590 ;                SCANNER HANDLING ROUTINES
                 3591 ;
                 3592 ;
                 3593 ;=================================================================
                 3594
                 3595
                 3596 ;-----  SUBR TO POLL FEEDERS FOR --
                 3597 ;                FEEDER READY,SCANNER DATA READY,BENCH MARK ERROR
                 3598
121B CD3101      3599 POLSCN: CALL FDGET
121E 4F          3600        MOV C,A
121F 2E11        3601        MVI L,11H
                 3602
1221 2681        3603 POLSC0: MVI H,81H       ;GET FEEDER READY BIT
1223 7E          3604        MOV A,M
1224 2F          3605        CMA
1225 0F          3606        RRC
1226 E602        3607        ANI 2
1228 47          3608        MOV B,A
```

```
                3609
1229 2682       3610        MVI H,82H       ;GET SCANNER STATUS
122B 7E         3611        MOV A,M
122C 2F         3612        CMA
122D E614       3613        ANI 14H         ;ISOLATE BENCH MARK AND READY BITS
                3614
122F B0         3615        ORA B
1230 C42912     3616        CNZ SCAN        ;THIS SCANNER WANTS ATTENTION
                3617
1233 23         3618        INX H
1234 0D         3619        DCR C
1235 F22112     3620        JP POLSC0
1238 C9         3621        RET
                3622
                3623
                3624
                3625
                3626
                3627 ;---- SUBROUTINE TO UNLOAD SCANNER DATA
1239 E5         3628 SCAN:  PUSH H
123A C5         3629        PUSH B
123B 32BA76     3630        STA FDSTAT
                3631
123E 79         3632        MOV A,C                 ;SET STATION POINTERS
123F 324A72     3633        STA STATION
1242 CD3203     3634        CALL SETSTN
                3635
1245 2A4B72     3636        LHLD RAMPTR
1248 0E13       3637        MVI C,SCABIT            ;IGNORE INACTIVE STATIONS
124A CD0C25     3638        CALL FETCH
124D FE00       3639        CPI OFF
124F CA9512     3640        JZ SCANX
                3641
1252 3ABA76     3642        LDA FDSTAT      ;CHECK FOR BENCH MARK ERROR
1255 E610       3643        ANI BMEBIT
1257 C29812     3644        JNZ SCAN4       ;FOUND ONE
                3645
125A 3ABA76     3646        LDA FDSTAT      ;CHECK FOR DATA READY
125D E604       3647        ANI RDYBIT
125F CA7F12     3648        JZ SCAN2        ;NOT READY
                3649
1262 CDAA12     3650        CALL LSB        ;LOAD SCAN BUFFER
1265 CDC312     3651        CALL CHKSAF     ;CHECK FOR SAFETY ERROR
1268 C29D12     3652        JNZ SCAN5       ;FOUND ONE
                3653
126B 3A4A72     3654        LDA STATION
126E FE00       3655        CPI 0
1270 CA7C12     3656        JZ SCAN1        ;UNLOAD DATA FROM CONTROL DOC.
                3657
1273 CD4015     3658        CALL CHKMCH     ;CHECK MATCH CODES FOR OTHER STATIONS
1276 C2A212     3659        JNZ SCAN6       ;MATCH CODE ERROR
1279 C37F12     3660        JMP SCAN2
                3661
127C CD3E13     3662 SCAN1: CALL LODSCD
                3663
127F 3ABA76     3664 SCAN2: LDA FDSTAT
1282 E602       3665        ANI 2           ;CHECK FEEDER READY BIT
1284 CA9512     3666        JZ SCANX        ;NOT READY
                3667
1287 2A4B72     3668 SCAN3: LHLD RAMPTR     ;READY, SO SHUT OFF STATION
128A 0E13       3669        MVI C,SCABIT
128C 3E00       3670        MVI A,OFF
128E CD1525     3671        CALL STORE
                3672
```

```
1291 214772   3673          LXI H,FDRCTR    ;ONE LESS FEEDER TO DEAL WITH
1294 35       3674          DCR M
              3675
1295 C1       3676 SCANX:   POP B
1296 E1       3677          POP H
1297 C9       3678          RET
              3679
1298 3E09     3680 SCAN4:   MVI A,ERRBMK    ;BENCH MARK ERROR
129A C3A412   3681          JMP SCAN7
              3682
129D 3E0A     3683 SCAN5:   MVI A,ERRSAF
129F C3A412   3684          JMP SCAN7       ;SAFETY ERROR
              3685
12A2 3E0B     3686 SCAN6:   MVI A,ERRMCH    ;MATCH CODE ERROR
              3687
12A4 CDF808   3688 SCAN7:   CALL ERRSET
12A7 C38712   3689          JMP SCAN3       ;SHUT OFF STATION IF ERROR DEVELOPS
              3690
              3691
              3692
              3693
              3694
              3695
              3696 ;---- LOAD SCAN BUFFER
              3697
12AA 2A4D72   3698 LSB:     LHLD PRMPTR     ; FETCH NO. OF WORDS TO RETRIEVE
12AD 0E26     3699          MVI C,SCNCNT    ;NO. BYTES RETURNED BY SCANNER
12AF CD0C25   3700          CALL FETCH
12B2 4F       3701          MOV C,A
12B3 A7       3702          ANA A
12B4 C8       3703          RZ              ; SHOULD NEVER OCCUR
              3704
12B5 2A4B72   3705          LHLD RAMPTR
12B8 113900   3706          LXI D,SCNBUF
12BB 19       3707          DAD D
12BC CD6116   3708 LSB1:    CALL RSDATA     ;READ 1 BYTE OF SCANNER DATA
12BF 77       3709          MOV M,A         ;STORE IT IN SCAN BUFFER
12C0 23       3710          INX H
12C1 0D       3711          DCR C
12C2 C2BC12   3712          JNZ LSB1
12C5 36FF     3713          MVI M,ENDLST
12C7 C9       3714          RET
              3715
              3716
              3717
              3718 ;-----------------------------------------------------------------
              3719 ;
              3720 ;  CHKSAF = CHECK SAFETY BITS
              3721 ;
              3722 ; OUTPUT:    [Z] = 1 IF SAFETY BIT FAILURE
              3723 ;            [Z] = 0 IF AOK
              3724 ; ---------------------------------------------------
              3725
12C8 2A4D72   3726 CHKSAF: LHLD PRMPTR      ;SEE IF MAP - 1 USED
12CB 0E42     3727          MVI C,SFBIT1
12CD CD0C25   3728          CALL FETCH
12D0 A7       3729          ANA A
12D1 CAE012   3730          JZ CHKSF0       ;NOT USED
              3731
12D4 0E28     3732          MVI C,ZONCNT    ;GET ZONE COUNT FOR MAP
12D6 CD0C25   3733          CALL FETCH
12D9 014400   3734          LXI B,SFMAP1
12DC CDF612   3735          CALL CHKSF1     ;CHECK SAFETY MAP AGAINST SCAN DATA
12DF C0       3736          RNZ             ;IT FLUNKS
```

```
                3737
12E0 2A4D72     3738 CHKSF0: LHLD FRMPTR     ;SEE IF MAP-2 USED
12E3 0E4C       3739         MVI C,SFBIT2
12E5 CD0C25     3740         CALL FETCH
12E8 A7         3741         ANA A
12E9 C8         3742         RZ                      ;NOT USED
                3743
12EA 0E28       3744         MVI C,ZONCNT
12EC CD0C25     3745         CALL FETCH
12EF 0F         3746         RRC
12F0 0F         3747         RRC
12F1 0F         3748         RRC
12F2 0F         3749         RRC
                3750
12F3 014E00     3751         LXI B,SFMAP2
                3752
                3753 ;------- CHECK SAFETY MAP
                3754
12F6 09         3755 CHKSF1: DAD B
12F7 E5         3756         PUSH H
12F8 2A4B72     3757         LHLD RAMPTR
12FB 113900     3758         LXI D,SCNBUF
12FE 19         3759         DAD D
12FF EB         3760         XCHG
1300 E1         3761         POP H
1301 E607       3762         ANI 07H
1303 4F         3763         MOV C,A
                3764
1304 7E         3765 CHKSF2: MOV A,M
1305 FEFF       3766         CPI ENDLST      ;CHECK FOR END
1307 C8         3767         RZ
1308 1A         3768         LDAX D
1309 AE         3769         XRA M
130A A6         3770         ANA M
130B C8         3771         RNZ             ;MISMATCH
                3772
130C 23         3773         INX H
130D 13         3774         INX D
130E 0D         3775         DCR C
130F C20413     3776         JNZ CHKSF2
1312 C9         3777         RET
                3778
                3779
                3780
                3781
                3782 ;-----------------------------------------------------------------
                3783 ;
                3784 ;   LODREC =  LOAD PIECE RECORD AT STATION 0 WITH SCANNER DATA FROM
                3785 ;             CONTROL DOCUMENT
                3786 ;
                3787 ;
                3788 ; ------------------------------------------------------
                3789
1313 3E00       3790 LODREC: MVI A,0
1315 CD3203     3791         CALL SETSTN
1318 2A4B72     3792         LHLD RAMPTR     ;DON'T LOAD IF NOT ENABLED
131B 0E1A       3793         MVI C,ENSTAT
131D CD0C25     3794         CALL FETCH
1320 A7         3795         ANA A
1321 C8         3796         RZ
1322 CD5913     3797         CALL LODSEL     ;LOAD FEEDER SELECT CODES
1325 CD0C14     3798         CALL LODACS     ;LOAD ACCESORY CODE
1328 CD9D14     3799         CALL LODCNT     ;LOAD COUNT
132B 016400     3800         LXI B,MAPS
```

```
132E 2A4872     3801          LHLD PRMADR
1331 09         3802          DAD B
1332 0E92       3803          MVI C,STPMAP     ;CHECK IF STOP BIT SET
1334 CD2B15     3804          CALL FCHSCI
1337 A7         3805          ANA A
1338 C8         3806          RZ
1339 3E17       3807          MVI A,HLTDCD
133B C3F808     3808          JMP ERRSET
                3809
                3810
                3811 ;--------- LOAD SCAN DATA
                3812
133E 112C00     3813 LODSCD: LXI D,SCNDAT
1341 2A4B72     3814          LHLD RAMPTR
1344 19         3815          DAD D
1345 E5         3816          PUSH H
1346 2A4B72     3817          LHLD RAMPTR
1349 113900     3818          LXI D,SCNBUF
134C 19         3819          DAD D
134D EB         3820          XCHG
134E E1         3821          POP H
                3822
134F 1A         3823 LODSC0: LDAX D
1350 77         3824          MOV M,A
1351 13         3825          INX D
1352 23         3826          INX H
1353 FEFF       3827          CPI ENDLST
1355 C24F13     3828          JNZ LODSC0
1358 C9         3829          RET
                3830
                3831
                3832 ;---------- LOAD FEED SELECT CODES INTO PIECE RECORD
                3833
1359 210000     3834 LODSEL: LXI H,0
135C 229176     3835          SHLD OLDSEL
135F 3E01       3836          MVI A,1
1361 324A72     3837          STA STATION
                3838
1364 CDA913     3839 LODSL0: CALL G1BIT       ;GET 1 BIT INTO [HL]
1367 3A4A72     3840          LDA STATION
136A CDE024     3841          CALL SLHL       ;SHIFT LEFT [HL]
136D EB         3842          XCHG
                3843
136E 2A9176     3844          LHLD OLDSEL
1371 CDC724     3845          CALL ORDEHL     ;INCLUSIVE "OR" [DE] WITH [HL]
1374 229176     3846          SHLD OLDSEL
                3847
1377 CD1E03     3848          CALL NXTSTN
137A C26413     3849          JNZ LODSL0
                3850
137D CDD113     3851          CALL XLTSEL     ;TRANSLATE SELECTION CODE VIA REASSIGN TABLE
                3852
1380 EB         3853          XCHG            ;STORE SELECTION CODE IN PIECE RECORD
1381 2A4B72     3854          LHLD RAMPTR
1384 0E1C       3855          MVI C,FSCODE
1386 CD0125     3856          CALL STOREPTR
                3857
1389 3E01       3858          MVI A,1         ;SELECT STATION 1 IF IT IS SELECTABLE
138B 324A72     3859          STA STATION
138E CD3203     3860          CALL SETSTN
                3861
1391 2A4B72     3862          LHLD RAMPTR
1394 0E10       3863          MVI C,ONSTAT
1396 CD0C25     3864          CALL FETCH
```

```
1399 FE02        3865        CPI SELABL
139B 3A4A72      3866        LDA STATION
139E C46010      3867        CNZ SELCHK
                 3868
13A1 3E00        3869        MVI A,0
13A3 324A72      3870        STA STATION
13A6 C33203      3871        JMP SETSTN
                 3872
                 3873
                 3874
                 3875
                 3876 ;---------- GET 1 BIT FROM SCAN BUFFER
                 3877
13A9 CD0C13      3878 G1BIT:  CALL GETFDM     ;POINT AT CORRECT FEED MAP
13AC CD0C25      3879        CALL FETCH
13AF A7          3880        ANA A
13B0 CAB813      3881        JZ G1BIT1       ;JUMP IF NOT USED
13B3 0C          3882        INR C
13B4 0C          3883        INR C
13B5 CD2B15      3884        CALL FCHSCI     ;FETCH SCAN ITEM
13B8 2E00        3885 G1BIT1: MVI H,0
13BA 6F          3886        MOV L,A
13BB C9          3887        RET
                 3888
13BC 017200      3889 GETFDM: LXI B,MAPS+FEEDMP
13BF 2A4872      3890        LHLD PRMADR
13C2 09          3891        DAD B
                 3892
13C3 3A4A72      3893        LDA STATION
13C6 CD5E03      3894        CALL CNVISX     ;CONVERT STATION NO. TO EXTERNAL NOTATION
13C9 3D          3895        DCR A
13CA 07          3896        RLC
13CB 07          3897        RLC
13CC 47          3898        MOV B,A
13CD 07          3899        RLC
13CE 80          3900        ADD B
13CF 4F          3901        MOV C,A
13D0 C9          3902        RET
                 3903
                 3904
                 3905
                 3906 ;---------- TRANSLATE SELECT CODE FROM SCANNER TO SELECT CODE
                 3907 ;          TO SELECT CODE SPECIFIED BY ASSIGNMENT TABLE
                 3908 ;    INPUTS:
                 3909 ;        [HL] CONTAINS OLD SELECT CODE
                 3910 ;         ASNTAB CONTAINS BIT MAP
                 3911 ;
                 3912 ;    OUTPUTS:
                 3913 ;        [HL] CONTAINS NEW SELECT CODE
                 3914 ;-----------------------------------------------------------
                 3915
                 3916
13D1 0E00        3917 XLTSEL: MVI C,0
13D3 210000      3918        LXI H,0
13D6 229376      3919        SHLD NEWSEL
                 3920
13D9 2A9176      3921 XS0:    LHLD OLDSEL
13DC 45          3922        MOV B,L
13DD 3E01        3923        MVI A,1
13DF CD0024      3924        CALL SRHL       ; SHIFT [HL] RIGHT,BIT COUNT IN [A]
13E2 229176      3925        SHLD OLDSEL
                 3926
13E5 78          3927        MOV A,B
13E6 E601        3928        ANI 1B
```

```
13E8 CA0114     3929        JZ XS1
                3930
13EB 219576     3931        LXI H,ASNTAB
13EE CD0C25     3932        CALL FETCH
13F1 210100     3933        LXI H,1
13F4 CDE024     3934        CALL SLHL
13F7 EB         3935        XCHG
13F8 2A9376     3936        LHLD NEWSEL
13FB CDC724     3937        CALL ORDEHL     ;INCLUSIVE OR [DE] WITH [HL]
13FE 229376     3938        SHLD NEWSEL
                3939
1401 0C         3940 XS1:   INR C
1402 79         3941        MOV A,C
1403 FE0C       3942        CPI 12
1405 C2D913     3943        JNZ XS0
                3944
1408 2A9376     3945        LHLD NEWSEL
140B C9         3946        RET
                3947
                3948
                3949
                3950
                3951 ;------------ LOAD ACCESSORY CODE
                3952
140C 211000     3953 LODACS: LXI H,010H     ;CLEAR VALUES
140F 22A576     3954        SHLD ACODE
1412 016400     3955        LXI B,MAPS
1415 2A4872     3956        LHLD PRMADR
1418 09         3957        DAD B
                3958
1419 0E96       3959        MVI C,MTRMAP    ;FETCH METER BIT FROM SCANNER BUFFER
141B CD2B15     3960        CALL FCHSCI
141E 07         3961        RLC
141F 07         3962        RLC
1420 07         3963        RLC
1421 C49414     3964        CNZ SETAC       ;STORE IT IN ACCESSORY CODE
                3965
1424 0E9A       3966        MVI C,MTR2MP
1426 CD2B15     3967        CALL FCHSCI
1429 07         3968        RLC
142A 07         3969        RLC
142B 07         3970        RLC
142C 07         3971        RLC
142D CA3914     3972        JZ LODAC3
1430 2F         3973        CMA
1431 47         3974        MOV B,A
1432 3AA576     3975        LDA ACODE
1435 A0         3976        ANA B
1436 32A576     3977        STA ACODE
                3978
1439 0E9E       3979 LODAC3: MVI C,SLRMAP   ;SET SEALER BIT
143B CD2B15     3980        CALL FCHSCI
143E C49414     3981        CNZ SETAC
                3982
1441 0EA2       3983        MVI C,MRKMAP    ;SET MARK BIT
1443 CD2B15     3984        CALL FCHSCI
1446 07         3985        RLC
1447 C49414     3986        CNZ SETAC
                3987
144A 0EA6       3988        MVI C,DFLMAP    ;SET DEFLECTOR BIT
144C CD2B15     3989        CALL FCHSCI
144F 07         3990        RLC
1450 07         3991        RLC
1451 C49414     3992        CNZ SETAC
```

```
                3993
1454 E5         3994        PUSH H
1455 010000     3995        LXI B,VSTK      ;SET STACKER SELECTION FIELD
1458 2A4872     3996        LHLD PRMADR
145B 09         3997        DAD B
145C 7E         3998        MOV A,M
145D E1         3999        POP H
145E E607       4000        ANI 7
1460 CA8214     4001        JZ LODAC2       ;SINGLE STACKER ONLY, SO SKIP THIS EXERCISE
                4002
1463 3C         4003        INR A
1464 0EAA       4004        MVI C,STKMAP
1466 1601       4005        MVI D,1         ; [D] CONTAINS STACKER NUMBER
                4006
1468 F5         4007 LODAC0: PUSH PSW
1469 CD2B15     4008        CALL FCHSCI     ;CHECK EACH STACKER SELECTION BIT
146C A7         4009        ANA A
146D C27D14     4010        JNZ LODAC1      ;UNTIL WE FIND ONE SET
                4011
1470 3E04       4012        MVI A,4          ;STEP TO NEXT STACKER MAP
1472 81         4013        ADD C
1473 4F         4014        MOV C,A
                4015
1474 F1         4016        POP PSW         ;CHECK FOR LAST STACKER MAP
1475 14         4017        INR D
1476 BA         4018        CMP D
1477 C26814     4019        JNZ LODAC0
147A CA8214     4020        JZ LODAC2       ;NO BIT SET, SO USE DEFAULT STACKER
                4021
147D F1         4022 LODAC1: POP PSW
147E 7A         4023        MOV A,D         ;INSERT NO. OF SELECTED STACKER IN ACCESSORY CODE
147F 32A676     4024        STA ACODE1
                4025
1482 2A4872     4026 LODAC2: LHLD RAMPTR    ;STORE ACCESSORY CODE IN PIECE RECORD
1485 0E1E       4027        MVI C,ACSCOD
1487 3AA576     4028        LDA ACODE
148A CD1525     4029        CALL STORE
148D 0C         4030        INR C
148E 3AA676     4031        LDA ACODE1
1491 C31525     4032        JMP STORE
                4033
                4034
                4035
                4036 ;---- SET ACCESSORY CODE
                4037 ;
                4038
1494 47         4039 SETAC:  MOV B,A
1495 3AA576     4040        LDA ACODE
1498 B0         4041        ORA B
1499 32A576     4042        STA ACODE
149C C9         4043        RET
                4044
                4045
                4046 ;---------- LODCNT = LOAD COUNT FROM SCANNER INTO PIECE RECORD
1490 013601     4047 LODCNT: LXI B,MAPS+USEBCD      ;CHECK IF BCD OR BINARY
14A0 2A4872     4048        LHLD PRMADR
14A3 09         4049        DAD B
14A4 7E         4050        MOV A,M
14A5 211C15     4051        LXI H,BCDTAB
14A8 A7         4052        ANA A
14A9 C2AF14     4053        JNZ $+6
14AC 212415     4054        LXI H,BINTAB
14AF 3E01       4055        MVI A,1
```

```
14B1 324A72      4056          STA STATION
14B4 22A976      4057          SHLD P1
14B7 3E00        4058 LODCN2:  MVI A,0          ;INITIALIZE BCD CONVERSION
14B9 32B176      4059          STA COUNT
                 4060
14BC CDBC13      4061          CALL GETFDM      ;POINT AT CORRECT SELECT MAP
14BF CD0C25      4062          CALL FETCH
14C2 A7          4063          ANA A
14C3 C20815      4064          JNZ LODCN3       ;JUMP IF NOT COUNT
14C6 0C          4065          INR C
14C7 0C          4066          INR C
14C8 CD0C25      4067          CALL FETCH
14CB A7          4068          ANA A
14CC CA0815      4069          JZ LODCN3        ;JUMP IF NOT USED
14CF 0C          4070          INR C
14D0 0C          4071          INR C            ;POINT AT MAP START
14D1 C5          4072 LODCN0:  PUSH B
14D2 017200      4073          LXI B,MAPS+FEEDMP
14D5 2A4872      4074          LHLD PRMADR
14D8 09          4075          DAD B
14D9 C1          4076          POP B
14DA CD0C25      4077          CALL FETCH       ;FETCH BIT POINTER
14DD FEFF        4078          CPI ENDLST
14DF CAF414      4079          JZ LODCN1         ;ALL DONE
                 4080
14E2 CD9915      4081          CALL FCHBIT      ;FETCH BIT FROM SCANNER BUFFER
14E5 A7          4082          ANA A
14E6 C40F15      4083          CNZ CNVBCD       ;CONVERT TO BINARY-CODED DECIMAL
                 4084
14E9 2AA976      4085          LHLD P1
14EC 23          4086          INX H
14ED 22A976      4087          SHLD P1
14F0 0C          4088          INR C
14F1 C3D114      4089          JMP LODCN0
                 4090
14F4 3A4A72      4091 LODCN1:  LDA STATION      ;STORE CONTROL DOC. COUNT IN PIECE RECORD
14F7 CD5E03      4092          CALL CNVISX
14FA 2A4B72      4093          LHLD RAMPTR
14FD 0E20        4094          MVI C,CDCNT
14FF 81          4095          ADD C
1500 3D          4096          DCR A
1501 4F          4097          MOV C,A
1502 3AB176      4098          LDA COUNT
1505 CD1525      4099          CALL STORE
1508 CD1E03      4100 LODCN3:  CALL NXTSTN
150B C2B714      4101          JNZ LODCN2
150E C9          4102          RET
                 4103
150F E5          4104 CNVBCD:  PUSH H
                 4105
1510 2AA976      4106          LHLD P1
1513 3AB176      4107          LDA COUNT
1516 86          4108          ADD M
1517 32B176      4109          STA COUNT
                 4110
151A E1          4111          POP H
151B C9          4112          RET
                 4113
151C 01          4114 BCDTAB:  DB 1,2,4,8,10,20,40,ENDLST
151D 02
151E 04
151F 08
1520 0A
```

```
1521 14
1522 28
1523 FF
1524 01          4115 BINTAB: DB 1,2,4,8,16,32,ENDLST
1525 02
1526 04
1527 08
1528 10
1529 20
152A FF
                 4116
                 4117
                 4118
                 4119 ;-------- FCHSCI = FETCH SCAN ITEM
                 4120 ;
                 4121 ;    INPUT: [HL] => MAPS BLOCK FOR STATION 0
                 4122 ;           [C]  => MAP ITEM
                 4123 ;
                 4124 ;    OUTPUT: [Z] =0   IF MAP SPECIFIES ITEM NOT USED
                 4125 ;            [A] =0
                 4126
                 4127 ;            [Z]=1    IF ITEM IS USED
                 4128 ;            [A]=0    IF BIT IN SCANBUFFER IS 0, [A]=1  IF BIT IS 1
                 4129 ;
                 4130
                 4131
                 4132
152B CD0C25      4133 FCHSCI: CALL FETCH              ; FETCH USE BIT
152E A7          4134         ANA A                   ; 0 INDICATES NOT USED
152F C8          4135         RZ
                 4136
1530 0C          4137         INR C
1531 0C          4138         INR C
1532 CD0C25      4139         CALL FETCH              ; FETCH POINTER TO BIT IN SCAN BUFFER
1535 CD9915      4140         CALL FCHBIT              ;FETCH BIT FROM SCAN BUFFER
                 4141
1538 0D          4142         DCR C
1539 0D          4143         DCR C
153A 47          4144         MOV B,A
153B 3EFF        4145         MVI A,0FFH
153D B7          4146         ORA A
153E 78          4147         MOV A,B
153F C9          4148         RET
                 4149
                 4150
                 4151
                 4152
                 4153
                 4154 ;-----------------------------------------------------
                 4155 ; SUBR TO CHECK MATCH CODE
                 4156 ;
                 4157 ;-----------------------------------------------------
                 4158
1540 2A4D72      4159 CHKMCH: LHLD PRMPTR     ;SEE IF MATCH CHECK REQUIRED
1543 0E56        4160         MVI C,MCHBIT
1545 CD0C25      4161         CALL FETCH
1548 A7          4162         ANA A
1549 C8          4163         RZ              ;NO
                 4164
154A 2A4B72      4165         LHLD RAMPTR
154D 112C00      4166         LXI D,SCNDAT
1550 19          4167         DAD D
1551 E5          4168         PUSH H
                 4169
```

```
1552 016400     4170          LXI B,MAPS+MCHMAP
1555 2A4872     4171          LHLD PRMADR
1558 09         4172          DAD B
1559 E5         4173          PUSH H
155A 2A4B72     4174          LHLD RAMPTR
155D 013900     4175          LXI B,SCNBUF
1560 09         4176          DAD B
1561 4D         4177          MOV C,L
1562 44         4178          MOV B,H
1563 E1         4179          POP H
1564 D1         4180          POP D
                4181
1565 0A         4182 CKM0:    LDAX B
1566 FEFF       4183          CPI ENDLST
1568 C8         4184          RZ
                4185
1569 03         4186          INX B
156A C5         4187          PUSH B
156B 47         4188          MOV B,A
                4189
156C 1A         4190          LDAX D
156D 13         4191          INX D
156E A8         4192          XRA B
156F C1         4193          POP B
                4194
1570 A6         4195          ANA M
1571 23         4196          INX H
1572 CA6515     4197          JZ CKM0
                4198
1575 0600       4199          MVI B,0         ;A MISMATCH OCCURED
1577 2A4B72     4200          LHLD RAMPTR
157A 0E14       4201          MVI C,MMCTR     ;SEE IF MISMATCH LIMIT EXCEEDED
157C CD0C25     4202          CALL FETCH
157F 3D         4203          DCR A
1580 CA8915     4204          JZ CKM2         ;NO
                4205
1583 CD1525     4206 CKM1:    CALL STORE
1586 78         4207          MOV A,B
1587 A7         4208          ANA A
1588 C9         4209          RET
                4210
1589 2A4D72     4211 CKM2:    LHLD PRMPTR     ;YES, SO RESET COUNTER
158C 0E04       4212          MVI C,MMCNT
158E CD0C25     4213          CALL FETCH
1591 06FF       4214          MVI B,0FFH
1593 2A4B72     4215          LHLD RAMPTR
1596 C38315     4216          JMP CKM1
                4217
                4218
                4219
                4220 ;-----------------------------------------------------------
                4221 ; SUBR  TO EXTRACT 1 BIT FROM SCAN BUFFER
                4222 ;-----------------------------------------------------
                4223
                4224 FCHBIT:
LOC  OBJ        LINE        SOURCE STATEMENT

1599 C5         4225          PUSH B
159A D5         4226          PUSH D
159B E5         4227          PUSH H
                4228
159C 4F         4229          MOV C,A
159D 0F         4230          RRC
159E 0F         4231          RRC
```

```
159F 0F        4232        RRC
15A0 0F        4233        RRC
15A1 E60F      4234        ANI 0FH
15A3 1600      4235        MVI D,0
15A5 5F        4236        MOV E,A
               4237
15A6 79        4238        MOV A,C
15A7 E60F      4239        ANI 0FH
15A9 4F        4240        MOV C,A
               4241
15AA 2A4B72    4242        LHLD RAMPTR
15AD 19        4243        DAD D
15AE 113900    4244        LXI D,SCNBUF    ;SCANNER BUFFER
15B1 19        4245        DAD D
15B2 7E        4246        MOV A,M         ; EXTRACT BIT FROM SCAN BUFFER
               4247
15B3 0D        4248 FB0:   DCR C
15B4 CABB15    4249        JZ FB1
15B7 0F        4250        RRC
15B8 C3B315    4251        JMP FB0
               4252
15BB E601      4253 FB1:   ANI 1B
15BD E1        4254        POP H
15BE D1        4255        POP D
15BF C1        4256        POP B
15C0 C9        4257        RET
               4258
               4259
               4260
               4261
               4262 ;==========================================================
               4263 ;
               4264 ;
               4265 ;          * * * *        SECTION 12       * * * *
               4266 ;
               4267 ;    I/O  SUBROUTINES FOR FEEDERS,SCANNERS, AND TRANSPORT
               4268 ;
               4269 ;
               4270 ;==========================================================
               4271
               4272
               4273
               4274
               4275 ;----------------------------------------------------------
               4276 ; WRFCMD = WRITE FEED COMMAND
               4277 ;
               4278 ;   INPUT:  [C] CONTAINS A VALID COMMAND
               4279 ;
               4280 ;   OUTPUT: [Z]  — NO ERROR
               4281 ;           [NZ] — ERROR, [A] CONTAINS ERROR CODE
               4282 ;----------------------------------------------------------
               4283
               4284 WRFCMD:
15C1 79        4285        MOV A,C
15C2 32B976    4286        STA FDCMD
15C5 FE01      4287        CPI FCRSET
15C7 CAD015    4288        JZ WFC0
               4289
15CA CDE415    4290        CALL RFSTAT     ;CHECK FEEDER STATUS
15CD E650      4291        ANI IMEBIT+CSEBIT
15CF C0        4292        RNZ             ;OMIT WRITE IF ERROR DEVELOPED
               4293
15D0 CDE415    4294 WFC0:  CALL RFSTAT
15D3 3A8A76    4295        LDA FDSTAT
```

```
15D6 E602        4296          ANI INBIT
15D8 C2D015      4297          JNZ WFC0        ;WAIT FOR EMPTY BUFFER
                 4298
15DB 3AB976      4299          LDA FDCMD
15DE 2F          4300          CMA
15DF 2AC176      4301          LHLD FCPTR
15E2 77          4302          MOV M,A         ;WRITE COMMAND
15E3 C9          4303          RET
                 4304
                 4305
                 4306 ;-----------------------------------------------------------
                 4307 ; RFSTAT = READ FEEDER STATUS
                 4308 ;
                 4309 ;        OUTPUT:  [Z] IF NO ERROR, [NZ] IF ERROR
                 4310 ;-----------------------------------------------------------
                 4311
15E4 E5          4312 RFSTAT: PUSH H
15E5 3E00        4313          MVI A,0
15E7 32BB76      4314          STA FDERR
                 4315
15EA 2AC176      4316          LHLD FCPTR      ;READ STATUS
15ED 7E          4317          MOV A,M
15EE 2F          4318          CMA
                 4319
15EF 32BA76      4320          STA FDSTAT
15F2 E650        4321          ANI IMEBIT+CSEBIT       ;FEED ERROR BITS
15F4 C2FC15      4322          JNZ RSF1        ;DEAL WITH ERROR
                 4323
15F7 3ABA76      4324 RSF0:    LDA FDSTAT
15FA E1          4325          POP H
15FB C9          4326          RET
                 4327
15FC 2ABF76      4328 RSF1:    LHLD FDPTR      ;READ ERROR BYTE
15FF 7E          4329          MOV A,M
1600 2F          4330          CMA
                 4331
1601 32B876      4332          STA FDERR
1604 C3F715      4333          JMP RSF0
                 4334
                 4335
                 4336
                 4337
                 4338
                 4339 ;-----------------------------------------------------------
                 4340 ; WRFDATA = WRITE FEED DATA
                 4341 ;
                 4342 ;  INPUT:  [C] CONTAINS COMMAND
                 4343 ;          [A] CONTAINS DATA
                 4344 ;
                 4345 ;-----------------------------------------------------------
                 4346
                 4347 WRFDATA:
1607 32BC76      4348          STA FDDATA
160A 79          4349          MOV A,C
160B 32B976      4350          STA FDCMD
160E 3E00        4351          MVI A,0
1610 32BB76      4352          STA FDERR
                 4353
1613 2AC176      4354          LHLD FCPTR
1616 7E          4355 WFD0:    MOV A,M         ;WAIT FOR INPUT BUFFER TO EMPTY
1617 2F          4356          CMA
                 4357
1618 32BA76      4358          STA FDSTAT
161B E602        4359          ANI INBIT
```

```
161D C21616     4360        JNZ WFD0
                4361
1620 3AB976     4362        LDA FDCMD
1623 2F         4363        CMA
1624 77         4364        MOV M,A         ;WRITE COMMAND
                4365
1625 7E         4366 WFD1:  MOV A,M         ;WAIT FOR INPUT BUFFER TO EMPTY
1626 2F         4367        CMA
                4368
1627 32BA76     4369        STA FDSTAT
162A E602       4370        ANI INBIT
162C C22516     4371        JNZ WFD1
                4372
162F 2ABF76     4373        LHLD FDPTR      ;WRITE DATA
1632 3ABC76     4374        LDA FDDATA
1635 2F         4375        CMA
1636 77         4376        MOV M,A
1637 C9         4377        RET
                4378
                4379
                4380 ;
                4381 ; WRSCMD = WRITE SCANNER COMMAND
                4382 ;
                4383 ;   INPUT:  [C] CONTAINS COMMAND
                4384 ;
                4385
1638 CDF802     4386 WRSCMD: CALL WESB      ;WAIT FOR EMPTY BUFFER
163B 2AC576     4387        LHLD SCPTR
163E 79         4388        MOV A,C
163F 2F         4389        CMA
1640 77         4390        MOV M,A
1641 C9         4391        RET
                4392
                4393
                4394 ;-----------------------------------------------------
                4395 ;
                4396 ;  RDFDATA = READ FEEDER DATA
                4397 ;
                4398 ;   INPUT:   ASSUMES COMMAND HAS BEEN GIVEN PREVIOUSLY
                4399 ;   OUTPUT:  [A] HAS DATA
                4400 ;
                4401 ;-----------------------------------------------------
                4402
                4403 RDFDATA:
1642 2AC176     4404        LHLD FCPTR      ;WAIT FOR EMPTY INPUT BUFFER
                4405
1645 7E         4406 RFD1:  MOV A,M         ;READ FEEDER STATUS
1646 2F         4407        CMA
1647 32BA76     4408        STA FDSTAT
164A E601       4409        ANI OUTBIT
164C CA4516     4410        JZ RFD1         ;WAIT FOR DATA READY
                4411
164F 2ABF76     4412        LHLD FDPTR      ;READ DATA
1652 7E         4413        MOV A,M
1653 2F         4414        CMA
1654 32BC76     4415        STA FDDATA
1657 C9         4416        RET
                4417
                4418
                4419
                4420
                4421
                4422 ;-----------------------------------------------------
                4423 ; RSSTAT = READ SCANNER STATUS
```

```
                4424 ;
                4425 ;    OUTPUT:  [A] CONTAINS STATUS WORD
                4426 ;
                4427 ;-----------------------------------------------------
                4428
                4429 RSSTAT:
1658 2AC576     4430        LHLD SCPTR
1658 7E         4431        MOV A,M
165C 2F         4432        CMA
165D 32BE76     4433        STA SCSTAT      ;SCANNER STATUS
1660 C9         4434        RET
                4435
                4436
                4437
                4438 ;-----------------------------------------------------
                4439 ;
                4440 ;  RSDATA = READ SCANNER DATA
                4441 ;
                4442 ;     OUTPUT:  [A] CONTIANS SCANNER DATA
                4443 ;
                4444 ;-----------------------------------------------------
                4445
1661 E5         4446 RSDATA: PUSH H
1662 2AC576     4447        LHLD SCPTR
                4448
1665 7E         4449 RSD0:  MOV A,M         ;WAIT FOR BUFFER TO BECOME FULL
1666 2F         4450        CMA
1667 32BE76     4451        STA SCSTAT
166A E601       4452        ANI OUTBIT
166C CA6516     4453        JZ RSD0
                4454
166F 2AC376     4455        LHLD SDPTR      ;PICKUP DATA
1672 7E         4456        MOV A,M
1673 2F         4457        CMA
                4458
1674 E1         4459        POP H
1675 C9         4460        RET
                4461
                4462 ;-----------------------------------------------------
                4463 ; INTERRUPT SERVICE ROUTINE
                4464 ;
                4465 ;-----------------------------------------------------
                4466
1676 F5         4467 INTSRV: PUSH PSW
1677 E5         4468        PUSH H
1678 C5         4469        PUSH B
                4470
1679 21D776     4471        LXI H,CLKTME      ;TICK THE CLOCK
167C 34         4472        INR M
                4473
167D DBE5       4474        IN 0E5H         ;CHECK FOR ZERO PULSE
167F E602       4475        ANI 10B
1681 C28616     4476        JNZ INTSV0
1684 3600       4477        MVI M,0
                4478
1686 7E         4479 INTSV0: MOV A,M        ;CONVERT HARDWARE CLOCK TIME TO INTERNAL TIME
1687 CDBE16     4480        CALL CNVTIM
168A 32D976     4481        STA TIME
                4482
168D 21DA76     4483        LXI H,DLYTIM    ;CHECK FOR MAJOR CYCLE STATES
1690 46         4484        MOV B,M         ;DELAY TIME
1691 B8         4485        CMP B
1692 CA9016     4486        JZ INTSV1
                4487
```

```
1695 21D876     4488          LXI H,STPTIM    ;CYCLE STOP TIME
1698 46         4489          MOV B,M
1699 B8         4490          CMP B
169A C2A116     4491          JNZ INTSV2
                4492
169D 21DC76     4493 INTSV1:  LXI H,CYCTIM
16A0 34         4494          INR M
                4495
16A1 47         4496 INTSV2:  MOV B,A         ;SEE IF A TASKS TIME HAS COME TO RUN
16A2 2AE776     4497          LHLD TTPTR
16A5 7E         4498          MOV A,M
16A6 FEFF       4499          CPI ENDLST
16A8 CAB516     4500          JZ INTSV3
                4501
16AB 90         4502          SUB B
16AC 3D         4503          DCR A
16AD F2B516     4504          JP INTSV3       ;NO
16B0 3E01       4505          MVI A,1
16B2 32ED76     4506          STA TSKBIT
                4507
16B5 3E20       4508 INTSV3:  MVI A,EOI       ;DISMISS INTERRUPT
16B7 D3DA       4509          OUT PORT59
                4510
16B9 C1         4511          POP B
16BA E1         4512          POP H
16BB F1         4513          POP PSW
16BC FB         4514          EI
16BD C9         4515          RET
                4516
                4517
                4518 ;---- CONVERT TIME WITH DELAY TIME AS ZERO
16BE 21D876     4519 CNVTIM:  LXI H,T0
16C1 46         4520          MOV B,M                 ;FETCH DELAY TIME
16C2 90         4521          SUB B
16C3 F0         4522          RP
16C4 C664       4523          ADI 100
16C6 C9         4524          RET
                4525
                4526
                4527
                4528
                4529
                4530
                4531
                4532 ;=================================================================
                4533 ;
                4534 ;
                4535 ;                    * * * *     SECTION 13     * * * *
                4536 ;
                4537 ;                      SYSTEM MAINTENANCE FUNCTIONS
                4538 ;
                4539 ;
                4540 ;=====================================================================
                4541
                4542
                4543
                4544
                4545
                4546
                4547 ;--------------- SCREEN 2 --  SYSTEM MAINTENANCE MENU
16C7 CD4526     4548 SYSMN0:  CALL BELL
16CA CD7225     4549 SYSMNT:  CALL CLSCRN     ;CLEAR SCREEN
                4550
16CD CD411E     4551          CALL GDECM
```

```
16D0 CD3B26    G1S2T0: CALL GCH1      ;GET ACCESS CODE
16D3 FE07              CPI 7
16D5 C2F11A            JNZ MSP0       ;WRONG-BAIL OUT
16D8 CD4526            CALL BELL
16DB CD3B26    G2S2T0: CALL GCH1
16DE FE25              CPI 37
16E0 C2F11A            JNZ MSP0       ;WRONG-BAIL OUT
16E3 CD4526            CALL BELL
16E6 116D31    SYSM1:  LXI D,S2P0
16E9 CD5B26            CALL DISPLAY   ;PAINT SCREEN

16EC CD3B26    SM0:    CALL GCH1      ;GET MENU CHOICE

16EF 21F916            LXI H,SYSTBL   ;CHECK ENTRY
16F2 CD811E            CALL FINDET
16F5 C2EC16            JNZ SM0        ;JUMP IF NOT VALID
16F8 E9                PCHL           ;ELSE GO TO ROUTINE

16F9 1B17      SYSTBL: DW SYST1       ;CHECK ENTRIES FOR DIAGNOSTICS
16FB 2F18              DW MFT
16FD 1D17              DW SYST2
16FF 5222              DW DIAG
1701 1F17              DW SYST3
1703 FA17              DW DSTAT
1705 2117              DW SYST4
1707 E421              DW CALIB2      ;VERIFY ENCODE
1709 2317              DW SYST5
170B A221              DW CALIB       ;SCANNER DIAG
170D 2517              DW SYST6
170F 1318              DW DCOD        ;DISPLAY LAST DASH CODE
1711 2717              DW SYST7
1713 2917              DW ACCDG       ;ACC DIAG
1715 4C1B              DW CH39
1717 0918              DW RETMCN      ;EXIT
1719 FFFF              DW ENDTBL

171B 01        SYST1:  DB 1,7
171C 07
171D 01        SYST2:  DB 1,8
171E 08
171F 01        SYST3:  DB 1,9
1720 09
1721 01        SYST4:  DB 1,27
1722 1B
1723 01        SYST5:  DB 1,28
1724 1C
1725 01        SYST6:  DB 1,29
1726 1D
1727 01        SYST7:  DB 1,37
1728 25


1729 CD7225    ACCDG:  CALL CLSCRN
172C 112A32            LXI D,S2AC1    ;DISPLAY SCREEN
172F CD5717            CALL ACSCN
1732 CD8E0E            CALL ASET      ;SET POINTERS
1735 CD3B26    ACCDG1: CALL GCH1
1738 214217            LXI H,ACENTB
173B CD811E            CALL FINDET    ;GET ENTRY
173E C23517            JNZ ACCDG1
1741 E9                PCHL
```

```
1742 401B      4609 ACENTB: DW CH35
1744 5417      4610         DW INACC
1746 681B      4611         DW CH47
1748 6B17      4612         DW OUTACC
174A 491B      4613         DW CH38
174C 0018      4614         DW DSTAT1
174E 4F1B      4615         DW CH40
1750 0918      4616         DW RETMCN
1752 FFFF      4617         DW ENDTBL
               4618
1754 C33517    4619 INACC:  JMP ACCDG1
               4620
1757 D5        4621 ACSCN:  PUSH D          ;SAVE MESSAGE POINTER
1758 0616      4622         MVI B,22
175A 0E08      4623         MVI C,8
175C CD5F20    4624         CALL X2BOX
175F 062E      4625         MVI B,46
1761 CD5F20    4626         CALL X2BOX
1764 D1        4627         POP D
1765 CD5B26    4628         CALL DISPLAY
1768 C36F1E    4629         JMP STDLN
               4630
176B 0E10      4631 OUTACC: MVI C,10H       ;OUTPUT DIAG COMMAND
176D CD3816    4632         CALL WRSCMD
1770 CD7225    4633         CALL CLSCRN
1773 112332    4634         LXI D,S2BOX
1776 CD5B26    4635         CALL DISPLAY
1779 113C32    4636         LXI D,S2AC2
177C CD5B26    4637         CALL DISPLAY
177F 115732    4638         LXI D,S2AC21
1782 CD5B26    4639         CALL DISPLAY
1785 117932    4640         LXI D,S2AC3
1788 CD5717    4641         CALL ACSCN
178B CDDC17    4642 OUTAC1: CALL ACSTGT     ;LOOK FOR #
178E CA9B17    4643         JZ OUTAC2
1791 21B517    4644         LXI H,ACENT2    ;LOOK FOR OTHER ENTRY
1794 CD811E    4645         CALL FINDET
1797 C28B17    4646         JNZ OUTAC1
179A E9        4647         PCHL
179B C5        4648 OUTAC2: PUSH B          ;POSITION #
179C CDDC17    4649 OUTAC3: CALL ACSTGT
179F CA9C17    4650         JZ OUTAC3
17A2 21AD17    4651         LXI H,ACENT1    ;CHECK FOR ENTRY
17A5 CD811E    4652         CALL FINDET
17A8 C29C17    4653         JNZ OUTAC3
17AB C1        4654         POP B
17AC E9        4655         PCHL
               4656
17AD 401B      4657 ACENT1: DW CH35
17AF BF17      4658         DW ACON1
17B1 681B      4659         DW CH47
17B3 C817      4660         DW ACOFF1
17B5 491B      4661 ACENT2: DW CH38
17B7 CC17      4662         DW ACCDG2
17B9 4F1B      4663         DW CH40
17BB D417      4664         DW CLRAC
17BD FFFF      4665         DW ENDTBL
               4666
17BF 78        4667 ACON1:  MOV A,B
17C0 F680      4668         ORI 80H         ;TURN ON POSITION
17C2 CDED02    4669 ACON11: CALL CNFG0
17C5 C38B17    4670         JMP OUTAC1
               4671
17C8 78        4672 ACOFF1: MOV A,B
```

```
17C9 C3C217   4673          JMP ACON11      ;TURN OFF POSITION
              4674
17CC 0E02     4675 ACCDG2:  MVI C,2         ;DO RESET
17CE CD3816   4676          CALL WRSCMD
17D1 C32917   4677          JMP ACCDG
              4678
17D4 0E02     4679 CLRAC:   MVI C,2         ;DO RESET
17D6 CD3816   4680          CALL WRSCMD
17D9 C30918   4681          JMP RETMCN      ;AND EXIT
              4682
17DC CD3B26   4683 ACSTGT:  CALL GCH1
17DF 11E917   4684          LXI D,ACVLS
17E2 CDBF1E   4685          CALL ENCHK      ;CHECK IF # ENTRY
17E5 C0       4686          RNZ
17E6 05       4687          DCR B
17E7 AF       4688          XRA A
17E8 C9       4689          RET
              4690
17E9 10       4691 ACVLS:   DB 16
17EA 12       4692          DB 18,17,16,15,14,13
17EB 11
17EC 10
17ED 0F
17EE 0E
17EF 0D
17F0 0C       4693          DB 12,11,8,7,6,5
17F1 0B
17F2 08
17F3 07
17F4 06
17F5 05
17F6 04       4694          DB 4,3,2,1
17F7 03
17F8 02
17F9 01
              4695
              4696
17FA CD4B0C   4697 DSTAT:   CALL S1G5       ;DISPLAY STATUS
17FD CD4226   4698          CALL GCH1B
1800 CD7225   4699 DSTAT1:  CALL CLSCRN
1803 CD411E   4700          CALL GDECM
1806 C3E616   4701          JMP SYSM1
              4702
1809 CD010C   4703 RETMCN:  CALL S1G0
180C AF       4704          XRA A
180D 324272   4705          STA ERRFLG      ;SET FLAGS FOR RETURN
1810 C3560B   4706          JMP XMC
              4707
              4708
              4709 ;DISPLAY LAST DASH CODE FOR SELECTED STATION
              4710
1813 CD051E   4711 DCOD:    CALL GETSTN
1816 C22918   4712          JNZ DCOD1
1819 F5       4713          PUSH PSW
181A CD7225   4714          CALL CLSCRN
181D F1       4715          POP PSW
181E 0600     4716          MVI B,13        ;SET X COORDINATE
1820 213900   4717          LXI H,SCNBUF    ;SCANNER DATA
1823 CDDC2B   4718          CALL DPYSC
1826 C44226   4719          CNZ GCH1B       ;IF CODE DISPLAYED, WAIT FOR KEY
1829 CD411E   4720 DCOD1:   CALL GDECM
182C C3E616   4721          JMP SYSM1
              4722
              4723
```

```
                 ;DISPLAY AND MODIFY TIMING VALUES
182F CD151A      MFT:    CALL S7G0
1832 CD241A              CALL S7G2
1835 CD3B26      MFT1:   CALL GCH1
1838 214218              LXI H,MFTTBL
183B CD811E              CALL FINDET
183E C23518              JNZ MFT1
1841 E9                  PCHL

                 ;OPTION TABLE FOR MODIFYING TIMES
1842 431B        MFTTBL: DW CH36
1844 8D18                DW MFTFD
1846 681B                DW CH47
1848 1619                DW MFTEN
184A 4C1B                DW CH39
184C 6E18                DW RSTTIM
184E 651B                DW CH46
1850 AA19                DW MFTMN
1852 4F1B                DW CH40
1854 6518                DW MFT3
1856 521B                DW CH41
1858 5C18                DW MFT2
185A FFFF                DW ENDTBL

185C CDF300      MFT2:   CALL TINIT       ;INIT MACHINE TIMES
185F CD980E              CALL TSKSCD     ;REINIT TASK TABLE
1862 C30918              JMP RETMCN

1865 CDF300      MFT3:   CALL TINIT
1868 CD980E              CALL TSKSCD
186B C30018              JMP DSTAT1


186E 3E00        RSTTIM: MVI A,0
1870 324A72              STA STATION
1873 CD3203      RSTT1:  CALL SETSTN
1876 CD8818              CALL RST1       ;RESET ONE STATION
1879 CD1E03              CALL NXTSTN
187C C27318              JNZ RSTT1
187F CD7301              CALL RSTPM1     ;RESET ENV FEEDER
1882 CD8301              CALL RSTPM2     ;AND MACHINE TIMING
1885 C32F18              JMP MFT

1888 0E03        RST1:   MVI C,3
188A C30E02              JMP RSP+2       ;RESET JUST TIMES

188D CD051E      MFTFD:  CALL GETSTN     ;GET STATION #
1890 C22F18              JNZ MFT
1893 CD1703              CALL NODYCK     ;CHECK IF PRESENT
1896 CA2F18              JZ MFT
1899 CD151A      MFTFD1: CALL S7G0       ;SET SCREEN
189C 3E01                MVI A,1
189E 32CC76              STA TABCTR
18A1 3A4A72              LDA STATION
18A4 CD4B1A              CALL S7G4       ;DISPLAY INFORMATION
18A7 CD561E              CALL KEYDPY
18AA 060B                MVI B,11
18AC 0E08                MVI C,8
18AE CD7120              CALL S3BOX
18B1 0E0C                MVI C,12
18B3 CD7120              CALL S3BOX
18B6 115A37              LXI D,S7F8
18B9 CD5B26              CALL DISPLAY
```

```
18BC 117937   4788          LXI D,S7F81
18BF CD5B26   4789          CALL DISPLAY
18C2 119133   4790          LXI D,S3P12
18C5 CD5B26   4791          CALL DISPLAY
18C8 CD3B26   4792 MFTFD3:  CALL GCH1
18CB 21D518   4793          LXI H,FDTTB     ;CHECK FOR VALID ENTRIES
18CE CD811E   4794          CALL FINDET
18D1 C2C818   4795          JNZ MFTFD3      ;JUMP IF NOT
18D4 E9       4796          PCHL
              4797
              4798 ;VALID ENTRY TABLE FOR MODIFYING FEEDER TIMES
18D5 3D1B     4799 FDTTB:   DW CH34
18D7 F518     4800          DW MFENC        ;ENC ON
18D9 401B     4801          DW CH35
18DB FF18     4802          DW MFENO        ;ENC OFF
18DD 431B     4803          DW CH36
18DF EF18     4804          DW MFFT         ;FEED TIME
18E1 461B     4805          DW CH37
18E3 1019     4806          DW MFTFDR       ;RESET TIMES
18E5 491B     4807          DW CH38
18E7 8D18     4808          DW MFTFD        ;BACK ONE
18E9 4C1B     4809          DW CH39
18EB 5C18     4810          DW MFT2         ;EXIT
18ED FFFF     4811          DW ENDTBL
              4812
18EF 2A4B72   4813 MFFT:    LHLD RAMPTR
18F2 C3F918   4814          JMP MFENC2
18F5 2A4B72   4815 MFENC:   LHLD RAMPTR
18F8 23       4816 MFENC1:  INX H
18F9 CD0619   4817 MFENC2:  CALL MFTD4
18FC C39918   4818          JMP MFTFD1
18FF 2A4B72   4819 MFENO:   LHLD RAMPTR
1902 23       4820          INX H
1903 C3F818   4821          JMP MFENC1
              4822
1906 E5       4823 MFTD4:   PUSH H          ;SAVE POINTER TO VALUE IN RAM
1907 110038   4824          LXI D,S7K0
190A CDF128   4825          CALL KEYIN
190D E1       4826          POP H
190E 77       4827          MOV M,A         ;SAVE VALUE
190F C9       4828          RET
              4829
              4830
1910 CD8818   4831 MFTFDR:  CALL RST1
1913 C39918   4832          JMP MFTFD1
              4833
1916 CD7225   4834 MFTEN:   CALL CLSCRN
1919 3E01     4835          MVI A,1
191B 32CF76   4836          STA XC          ;SET COORDINATES
191E 32D076   4837          STA YC
1921 3E02     4838          MVI A,2
1923 CDAA1A   4839          CALL S7G6       ;DISPLAY ENV TIMES
1926 CD561E   4840          CALL KEYDPY
1929 119137   4841          LXI D,S7F91
192C CD5B26   4842          CALL DISPLAY
192F 11AC37   4843          LXI D,S7F92
1932 CD5B26   4844          CALL DISPLAY
1935 11B337   4845          LXI D,S7F93
1938 CD5B26   4846          CALL DISPLAY
193B 11BA37   4847          LXI D,S7F94
193E CD5B26   4848          CALL DISPLAY
1941 060A     4849          MVI B,10
1943 0E0C     4850          MVI C,12
1945 CD7120   4851          CALL S3BOX
```

```
1948 118537      4852          LXI D,S7F9
194B CD5B26      4853          CALL DISPLAY
194E 119133      4854          LXI D,S3P12
1951 CD5B26      4855          CALL DISPLAY
1954 CD3B26      4856 MFTEN2:  CALL GCH1
1957 216119      4857          LXI H,ENVTBL
195A CD811E      4858          CALL FINDET
195D C25419      4859          JNZ MFTEN2      ;JUMP IF NO VALID ENTRY
1960 E9          4860          PCHL
                 4861
                 4862 ;TABLE OF ENTRIES FOR ENV TIMES
1961 3D1B        4863 ENVTBL:  DW CH34
1963 8319        4864          DW ENFC
1965 781B        4865          DW CH54
1967 8919        4866          DW ENEOC
1969 7A1B        4867          DW CH55
196B 8F19        4868          DW ENEFC
196D 741B        4869          DW CH52
196F 9519        4870          DW ENJOC
1971 761B        4871          DW CH53
1973 9B19        4872          DW ENJFC
1975 461B        4873          DW CH37
1977 A419        4874          DW MFTENR
1979 491B        4875          DW CH38
197B 2F18        4876          DW MFT
197D 4C1B        4877          DW CH39
197F 5C18        4878          DW MFT2
1981 FFFF        4879          DW ENDTBL
                 4880
1983 217076      4881 ENFC:    LXI H,EFDTIM
1986 C39E19      4882          JMP ENFC1
1989 217176      4883 ENEOC:   LXI H,EFESON
198C C39E19      4884          JMP ENFC1
198F 217276      4885 ENEFC:   LXI H,EFESOF
1992 C39E19      4886          JMP ENFC1
1995 217376      4887 ENJOC:   LXI H,EFJSON
1998 C39E19      4888          JMP ENFC1
199B 217476      4889 ENJFC:   LXI H,EFJSOF
199E CD0619      4890 ENFC1:   CALL MFTD4
19A1 C31619      4891          JMP MFTEN
                 4892
                 4893
19A4 CD7301      4894 MFTENR:  CALL RSTPM1     ;RESET ENV TIMES
19A7 C31619      4895          JMP MFTEN
                 4896
19AA CD7225      4897 MFTMN:   CALL CLSCRN
19AD 3E01        4898          MVI A,1
19AF 32CF76      4899          STA XC
19B2 32D076      4900          STA YC
19B5 47          4901          MOV B,A
19B6 3E02        4902          MVI A,2
19B8 CD071A      4903          CALL S7G7       ;DISPLAY MACHINE TIMES
19BB CD561E      4904          CALL KEYDPY
19BE 113A37      4905          LXI D,S7F71     ;AND OPTIONS
19C1 CD5B26      4906          CALL DISPLAY
19C4 0608        4907          MVI B,11
19C6 0E0C        4908          MVI C,12
19C8 CD7120      4909          CALL S3BOX
19CB 114137      4910          LXI D,S7F72
19CE CD5B26      4911          CALL DISPLAY
19D1 111B37      4912          LXI D,S7F7
19D4 CD5B26      4913          CALL DISPLAY
19D7 CD3B26      4914 MFTMN1:  CALL GCH1
19DA 21E419      4915          LXI H,MTTBL     ;CHECK FOR VALID ENTRY
```

```
19DD CD811E     4916          CALL FINDET
19E0 C2D719     4917          JNZ MFTMN1
19E3 E9         4918          PCHL
                4919
                4920 ;TABLE FOR MACHINE TIMING ENTRIES
19E4 741B       4921 MTTBL:   DW CH52
19E6 001A       4922          DW CCSON
19E8 761B       4923          DW CH53
19EA 061A       4924          DW CCSOF
19EC 461B       4925          DW CH37
19EE FA19       4926          DW CDLEN
19F0 491B       4927          DW CH38
19F2 2F18       4928          DW MFT
19F4 4C1B       4929          DW CH39
19F6 5C18       4930          DW MFT2
19F8 FFFF       4931          DW ENDTBL
                4932
19FA 215372     4933 CDLEN:   LXI H,TDELAY
19FD C3091A     4934          JMP CDLEN1
1A00 215472     4935 CCSON:   LXI H,TCSON
1A03 C3091A     4936          JMP CDLEN1
1A06 215572     4937 CCSOF:   LXI H,TCSOFF
1A09 CD0619     4938 CDLEN1:  CALL MFTD4
1A0C C3AA19     4939          JMP MFTMN
                4940
1A0F CD8301     4941 MFTMNR:  CALL RSTPM2     ;RESET MACHINE TIMES
1A12 C3AA19     4942          JMP MFTMN
                4943
1A15 CD7225     4944 S7G0:    CALL CLSCRN
1A18 114036     4945          LXI D,S7F1
1A1B CD5B26     4946          CALL DISPLAY
1A1E 114D36     4947          LXI D,S7F2
1A21 C35B26     4948          JMP DISPLAY
                4949
1A24 111E30     4950 S7G2:    LXI D,S1EA2
1A27 CD5B26     4951          CALL DISPLAY
1A2A CD301A     4952          CALL S7G3
1A2D C3721A     4953          JMP S7G5        ;DISP ENV AND MACHINE TIMES
                4954
1A30 3E01       4955 S7G3:    MVI A,1
1A32 32CC76     4956          STA TABCTR
1A35 3E00       4957          MVI A,0
1A37 324A72     4958          STA STATION
1A3A CD3203     4959 S7G31:   CALL SETSTN
1A3D CD4B1A     4960          CALL S7G4
1A40 CD1E03     4961          CALL NXTSTN
1A43 C8         4962          RZ
1A44 21CC76     4963          LXI H,TABCTR
1A47 34         4964          INR M
1A48 C33A1A     4965          JMP S7G31
                4966
                4967 ;DISPLAY TIMES FOR ONE STATION
1A4B CD5E03     4968 S7G4:    CALL CNVISX     ;CONVERT INTERNAL STATION NO. TO EXTERNAL
1A4E 117636     4969          LXI D,S7F21
1A51 CD5B26     4970          CALL DISPLAY    ;DISPLAY STATION NO.
1A54 CD1703     4971          CALL NODVCK     ;CHECK IF PRESENT
1A57 C8         4972          RZ
1A58 2A4B72     4973          LHLD RAMPTR     ;POINTER TO STATION
1A5B 7E         4974 S7G41:   MOV A,M         ;FIRST BYTE IS FEED TIME
1A5C 110738     4975          LXI D,S7A1
1A5F CD5B26     4976          CALL DISPLAY
1A62 23         4977 S7G42:   INX H
1A63 7E         4978          MOV A,M         ;NEXT IS ENC ON TIME
1A64 110738     4979          LXI D,S7A1
```

```
1A67 CD5B26      4980          CALL DISPLAY
1A6A 23          4981 S7G43:   INX H
1A6B 7E          4982          MOV A,M
1A6C 110738      4983          LXI D,S7A1
1A6F C35B26      4984          JMP DISPLAY
                 4985
                 4986
1A72 3E01        4987 S7G5:    MVI A,1
1A74 32CF76      4988          STA XC
1A77 3E06        4989          MVI A,6
1A79 32D076      4990          STA YC
1A7C 3E07        4991          MVI A,7
1A7E CDAA1A      4992          CALL S7G6
1A81 3E01        4993          MVI A,1
1A83 32CF76      4994          STA XC
1A86 3E0D        4995          MVI A,13
1A88 32D076      4996          STA YC
1A8B 0601        4997          MVI B,1
1A8D 3E0E        4998          MVI A,14
1A8F CDD71A      4999          CALL S7G7       ;DISPLAY MACHINE TIMES
1A92 0622        5000          MVI B,34
1A94 0E08        5001          MVI C,8
1A96 CD7120      5002          CALL S3BOX
1A99 0E0C        5003          MVI C,12
1A9B CD7120      5004          CALL S3BOX
1A9E 11E336      5005          LXI D,S7F62
1AA1 CD5B26      5006          CALL DISPLAY
1AA4 110137      5007          LXI D,S7F63
1AA7 C35B26      5008          JMP DISPLAY
                 5009
1AAA F5          5010 S7G6:    PUSH PSW
1AAB 117B36      5011          LXI D,S7F3
1AAE CD5B26      5012          CALL DISPLAY
1AB1 114D36      5013          LXI D,S7F2
1AB4 CD5B26      5014          CALL DISPLAY
1AB7 118F36      5015          LXI D,S7F4
1ABA CD5B26      5016          CALL DISPLAY
1ABD 3E01        5017          MVI A,1
1ABF 32CC76      5018          STA TABCTR
1AC2 F1          5019          POP PSW
1AC3 32D076      5020          STA YC
1AC6 110C38      5021          LXI D,S7A2
1AC9 217076      5022          LXI H,EFDTIM    ;SETUP TO DISPLAY ENY TIMES
1ACC 7E          5023          MOV A,M
1ACD CD5B26      5024          CALL DISPLAY
1AD0 23          5025          INX H
1AD1 CD5B1A      5026          CALL S7G41
1AD4 C36A1A      5027          JMP S7G43       ;ALSO DISPLAY JAM TIMES
                 5028
1AD7 11AF36      5029 S7G7:    LXI D,S7F5
1ADA CD5B26      5030          CALL DISPLAY
1ADD 32D076      5031          STA YC
1AE0 78          5032          MOV A,B
1AE1 32CC76      5033          STA TABCTR
1AE4 111138      5034          LXI D,S7A3
1AE7 215372      5035          LXI H,TDELAY
1AEA 7E          5036          MOV A,M
1AEB CD5B26      5037          CALL DISPLAY
1AEE C3621A      5038          JMP S7G42       ;DISPLAY MACHINE TIMES
                 5039
                 5040
                 5041
                 5042
                 5043 ;---------------- SCREEN 3 -- MODIFY STATION PARAMETERS
```

```
                5044
1AF1 CDDA1F     5045 MSP0:   CALL S3G2
1AF4 CD3B26     5046 MSGCH:  CALL GCH1
                5047
1AF7 21011B     5048         LXI H,S3TAB     ;CHECK FOR VALID ENTRY
1AFA CD811E     5049         CALL FINDET
1AFD C2F41A     5050         JNZ MSGCH       ;JUMP IF NOT VALID
1B00 E9         5051         PCHL            ;GO TO ROUTINE
                5052
1B01 2F1B       5053 S3TAB:  DW CH31         ;TABLE OF VALID ENTRIES AND
1B03 871B       5054         DW MSP00        ;THEIR CORRESPONDING ROUTINES
1B05 341B       5055         DW CH32
1B07 C30B       5056         DW M3
1B09 391B       5057         DW CH33
1B0B C716       5058         DW SYSMN0       ;DIAGNOSTICS
1B0D 3D1B       5059         DW CH34
1B0F 8D1B       5060         DW RPC          ;RESET PIECE COUNT
1B11 401B       5061         DW CH35
1B13 9F1B       5062         DW MSP1         ;SELECT MODE
1B15 431B       5063         DW CH36
1B17 9A20       5064         DW RSS          ;REASSIGN STATIONS
1B19 461B       5065         DW CH37
1B1B 2D1C       5066         DW MSS          ;MODIFY A STATION
1B1D 491B       5067         DW CH38
1B1F 961B       5068         DW DST          ;ENCLOSURE STATUS
1B21 4C1B       5069         DW CH39
1B23 1520       5070         DW S3G3         ;DISPLAY STATUS
1B25 4F1B       5071 S3T1:   DW CH40
1B27 D11C       5072         DW MSP          ;BACK ONE
1B29 521B       5073         DW CH41
1B2B 0918       5074         DW RETMCN       ;EXIT
1B2D FFFF       5075         DW ENDTBL
                5076
                5077 ;VALID ENTRIES FOR ABOVE TABLE
1B2F 04         5078 CH31:   DB 4,0,1,10,11
1B30 00
1B31 01
1B32 0A
1B33 0B
1B34 04         5079 CH32:   DB 4,8,9,18,19
1B35 08
1B36 09
1B37 12
1B38 13
1B39 03         5080 CH33:   DB 3,37,38,39
1B3A 25
1B3B 26
1B3C 27
1B3D 02         5081 CH34:   DB 2,30,31
1B3E 1E
1B3F 1F
1B40 02         5082 CH35:   DB 2,32,33
1B41 20
1B42 21
1B43 02         5083 CH36:   DB 2,34,35
1B44 22
1B45 23
1B46 02         5084 CH37:   DB 2,50,51
1B47 32
1B48 33
1B49 02         5085 CH38:   DB 2,52,53
1B4A 34
1B4B 35
1B4C 02         5086 CH39:   DB 2,54,55
```

```
1B4D 36
1B4E 37
1B4F 02          5087 CH40:   DB 2,56,57
1B50 38
1B51 39
1B52 02          5088 CH41:   DB 2,58,59
1B53 3A
1B54 3B
1B55 03          5089 CH42:   DB 3,11,12,13
1B56 0B
1B57 0C
1B58 0D
1B59 03          5090 CH43:   DB 3,16,17,18
1B5A 10
1B5B 11
1B5C 12
1B5D 03          5091 CH44:   DB 3,31,32,33
1B5E 1F
1B5F 20
1B60 21
1B61 03          5092 CH45:   DB 3,36,37,38
1B62 24
1B63 25
1B64 26
1B65 02          5093 CH46:   DB 2,38,39
1B66 26
1B67 27
1B68 02          5094 CH47:   DB 2,36,37
1B69 24
1B6A 25
1B6B 02          5095 CH48:   DB 2,18,19
1B6C 12
1B6D 13
1B6E 02          5096 CH49:   DB 2,16,17
1B6F 10
1B70 11
1B71 02          5097 CH50:   DB 2,14,15
1B72 0E
1B73 0F
1B74 01          5098 CH52:   DB 1,34
1B75 22
1B76 01          5099 CH53:   DB 1,35
1B77 23
1B78 01          5100 CH54:   DB 1,32
1B79 20
1B7A 01          5101 CH55:   DB 1,33
1B7B 21
1B7C 04          5102 CH56:   DB 4,10,11,12,13
1B7D 0A
1B7E 0B
1B7F 0C
1B80 0D
1B81 02          5103 CH57:   DB 2,25,26
1B82 19
1B83 1A
1B84 02          5104 CH58:   DB 2,27,28
1B85 1B
1B86 1C
                 5105
                 5106
                 5107 ;SET SEQ START
1B87 CDAF0B      5108 MSP00:  CALL M2
1B8A C3F41A      5109         JMP MSGCH
                 5110
```

```
                5111
                5112 ;RESET PIECE COUNT
1B8D 210000     5113 RPC:    LXI H,0
1B90 220272     5114         SHLD PCOUNT
1B93 C3F41A     5115         JMP MSGCH
                5116
                5117 ;DISPLAY STATUS
1B96 CD4B0C     5118 DST:    CALL S1G5
1B99 CD4226     5119         CALL GCH1B
1B9C C3F11A     5120         JMP MSP0
                5121
1B9F CDE11B     5122 MSP1:   CALL MSP04
1BA2 117933     5123         LXI D,S3P10
1BA5 CD5B26     5124         CALL DISPLAY
1BA8 116833     5125         LXI D,S3P1
1BAB CD5B26     5126         CALL DISPLAY
1BAE CD3B26     5127 MSP02:  CALL GCH1
1BB1 21111C     5128         LXI H,MODTBL     ;CHECK FOR VALID ENTRY
1BB4 CD811E     5129         CALL FINDET
1BB7 C2D71B     5130         JNZ MSP03
1BBA 224872     5131         SHLD PRMADR
1BBD CD1001     5132         CALL SETPRM
1BC0 3E00       5133         MVI A,0
1BC2 324A72     5134         STA STATION
1BC5 CD3203     5135 MSP01:  CALL SETSTN
1BC8 CDFD1B     5136         CALL RSTPM3      ;RESET ALL PARAMETERS
1BCB CD1E03     5137         CALL NXTSTN
1BCE C2C51B     5138         JNZ MSP01
1BD1 CD4E02     5139         CALL RSTSEL
1BD4 C3CE00     5140         JMP BEG2
                5141
1BD7 21231C     5142 MSP03:  LXI H,S3TAB1
1BDA CD811E     5143         CALL FINDET      ;CHECK FOR EXIT
1BDD C2AE1B     5144         JNZ MSP02
1BE0 E9         5145         PCHL
                5146
1BE1 CD7225     5147 MSP04:  CALL CLSCRN
1BE4 0610       5148         MVI B,16
1BE6 0E04       5149         MVI C,4          ;DRAW 4 3X1 BOXES
1BE8 CD6520     5150         CALL X3BOX
1BEB 062E       5151         MVI B,46
1BED CD6520     5152         CALL X3BOX
1BF0 0E08       5153         MVI C,8
1BF2 CD6520     5154         CALL X3BOX
1BF5 0610       5155         MVI B,16
1BF7 CD6520     5156         CALL X3BOX
1BFA C36F1E     5157         JMP STDLN        ;AND BACK ONE AND EXIT BOXES
                5158
1BFD 2A4D72     5159 RSTPM3: LHLD PRMPTR
1C00 110A00     5160         LXI D,COPCNT     ;RESET ALL PARAMS EXCEPT TIMES
1C03 19         5161         DAD D
1C04 EB         5162         XCHG
1C05 2A4B72     5163         LHLD RAMPTR
1C08 010300     5164         LXI B,3
1C0B 09         5165         DAD B
1C0C 0E0E       5166         MVI C,PMTCNT-3
1C0E C31902     5167         JMP RSP01
                5168
1C11 551B       5169 MODTBL: DW CH42
1C13 0050       5170         DW CP1BEG
1C15 591B       5171         DW CH43
1C17 0058       5172         DW CP2BEG
1C19 5D1B       5173         DW CH44
1C1B 0060       5174         DW CP3BEG
```

```
1C1D 611B        5175          DW CH45
1C1F 0068        5176          DW CP4BEG
1C21 FFFF        5177          DW ENDTBL
1C23 491B        5178 S3TAB1:  DW CH38
1C25 F11A        5179          DW MSP0
1C27 4F1B        5180          DW CH40
1C29 0918        5181          DW RETMCN
1C2B FFFF        5182          DW ENDTBL
                 5183
                 5184
                 5185 ;------ MODIFY SINGLE STATION
1C2D CD051E      5186 MS5:     CALL GETSTN     ;GET STATION NO. FROM OPERATOR
1C30 C2F11A      5187          JNZ MSP0        ; <ESC> => PREVIOUS SCREEN
                 5188
1C33 CD1703      5189          CALL NODYCK     ;CHECK IF PRESENT
1C36 CA011C      5190          JZ MSP
1C39 CD3C20      5191 MSS1:    CALL S3G4       ;DISPLAY SINGLE STATION DATA
                 5192
1C3C 0622        5193          MVI B,34
1C3E 0E04        5194          MVI C,4
1C40 CD7120      5195          CALL S3BOX      ;DRAW BOX
1C43 0E08        5196          MVI C,8
1C45 CD7120      5197          CALL S3BOX
1C48 0E0C        5198          MVI C,12
1C4A CD7120      5199          CALL S3BOX
1C4D 113034      5200          LXI D,S3LAB1
1C50 CD5B26      5201          CALL DISPLAY
1C53 115634      5202          LXI D,S3LAB2
1C56 CD5B26      5203          CALL DISPLAY
1C59 117E34      5204          LXI D,S3LAB3
1C5C CD5B26      5205          CALL DISPLAY
1C5F 3E01        5206          MVI A,1
1C61 32CC76      5207          STA TABCTR
1C64 CD3B26      5208 MSS4:    CALL GCH1       ;GET INPUT
1C67 21B61C      5209          LXI H,MSSTB2
1C6A CD811E      5210          CALL FINDET
1C6D C2711C      5211          JNZ MSS5
1C70 E9          5212          PCHL
                 5213
1C71 47          5214 MSS5:    MOV B,A
1C72 2A4D72      5215          LHLD PRMPTR
1C75 7E          5216          MOV A,M         ;SCANNING FEEDER?
1C76 FE02        5217          CPI 2
1C78 C2641C      5218          JNZ MSS4        ;JUMP IF NOT
1C7B 78          5219          MOV A,B
1C7C 21A61C      5220          LXI H,MSSTB1
1C7F CD811E      5221          CALL FINDET
1C82 C2861C      5222          JNZ MSS6
1C85 E9          5223          PCHL
1C86 47          5224 MSS6:    MOV B,A
1C87 2A4D72      5225          LHLD PRMPTR
1C8A 0E0E        5226          MVI C,CPBRK
1C8C CDAC25      5227          CALL FETCH      ;SEE IF POSTAGE BREAK USED
1C8F A7          5228          ANA A
1C90 CA641C      5229          JZ MSS4
1C93 78          5230          MOV A,B
1C94 219E1C      5231          LXI H,MSSTB
1C97 CD811E      5232          CALL FINDET
1C9A C2641C      5233          JNZ MSS4
1C9D E9          5234          PCHL
                 5235
                 5236 ;ENTRY AND JUMP TABLE FOR MODIFY ROUTINES
1C9E 651B        5237 MSSTB:   DW CH46
1CA0 291E        5238          DW MODPBL
```

```
1CA2 681B      5239          DW CH47
1CA4 2E1E      5240          DW MODPBH
1CA6 421B      5241 MSSTB1:  DW CH36
1CA8 241E      5242          DW MODMM
1CAA 681B      5243          DW CH48
1CAC 1F1E      5244          DW MODFC
1CAE 6E1B      5245          DW CH49
1CB0 AB1D      5246          DW MODFS
1CB2 711B      5247          DW CH50
1CB4 621D      5248          DW MODLN
1CB6 521B      5249 MSSTB2:  DW CH41
1CB8 0918      5250          DW RETMCN
1CBA 4F1B      5251          DW CH40
1CBC 2D1C      5252          DW MSS
1CBE 4C1B      5253          DW CH39
1CC0 CB1C      5254          DW MSS3
1CC2 FFFF      5255          DW ENDTBL
               5256
               5257
1CC4 78        5258 MSS21:   MOV A,B
1CC5 2A4B72    5259 MSS2:    LHLD RAMPTR
1CC8 C31525    5260          JMP STORE
               5261
1CCB CDFD1B    5262 MSS3:    CALL RSTPM3
1CCE C3391C    5263          JMP MSS1
               5264
               5265 ;
               5266 ;
               5267 ;
               5268 ;ENTRY POINT FOR FEEDER ON/OFF SCREEN
               5269 ;
               5270 ;
1CD1 CD951F    5271 MSP:     CALL S3G
1CD4 CD251D    5272          CALL FONGT      ;GET KEY
1CD7 CAE41C    5273          JZ MODST        ;JUMP IF STATION ENTRY
1CDA 21FE1C    5274          LXI H,MSPTB1    ;CHECK FOR OTHER OPTIONS
1CDD CD911E    5275          CALL FINDET
1CE0 C2D41C    5276          JNZ MSP+3
1CE3 E9        5277          PCHL
1CE4 0E10      5278 MODST:   MVI C,ONSTAT
1CE6 CD251D    5279 MODST2:  CALL FONGT
1CE9 CAE61C    5280          JZ MODST2
1CEC 21FF1C    5281          LXI H,MSPTB     ;CHECK FOR OTHER OPTIONS
1CEF CD911E    5282          CALL FINDET
1CF2 C2E61C    5283          JNZ MODST2
1CF5 E9        5284          PCHL
               5285
1CF6 1F1D      5286 MSPTB    DW F50N         ;OPTION TABLE
1CF8 301D      5287          DW MODST3       ;ON BUTTON
1CFA 321D      5288          DW F50FF
1CFC 991D      5289          DW MODST5       ;OFF BUTTON
1CFE 151D      5290 MSPTB1:  DW EX5
1D00 0918      5291          DW RETMCN       ;EXIT
1D02 1A1D      5292          DW CHAN5
1D04 F11A      5293          DW MSP0         ;CHANGE SETUP
1D06 FFFF      5294          DW ENDTBL
               5295
1D08 0600      5296 MODST5:  MVI B,0
1D0A C30F1D    5297          JMP MODST3+2
1D0D 0601      5298 MODST3:  MVI B,1
1D0F CDC41C    5299          CALL MSS21
1D12 C3D41C    5300          JMP MSP+3
               5301
1D15 04        5302 EX5:     DB 4,48,49,58,59
```

```
1D16 30
1D17 31
1D18 3A
1D19 3B
1D1A 04          5303 CHAN5:  DB 4,40,41,50,51
1D1B 28
1D1C 29
1D1D 32
1D1E 33
1D1F 02          5304 F5ON:   DB 2,9,19
1D20 09
1D21 13
1D22 02          5305 F5OFF:  DB 2,8,10
1D23 08
1D24 0A
                 5306
                 5307
                 5308 ;ROUTINE TO GET FEEDER # FOR ON/OFF SCREEN
1D25 CD3B26      5309 FONGT:  CALL GCH1       ;GET KEY
1D28 11491D      5310         LXI D,FDVALS
1D2B CDBF1E      5311         CALL ENCHK      ;CHECK IF VALID #
1D2E C8          5312         RNZ
1D2F 78          5313         MOV A,B
1D30 3C          5314         INR A           ;CONVERT TO FEEDER #
1D31 1F          5315         RAR
1D32 47          5316         MOV B,A
1D33 3A4572      5317         LDA ENVSTN
1D36 3C          5318         INR A
1D37 B8          5319         CMP B
1D38 DA471D      5320         JC FONGT1       ;JUMP IF ERROR
1D3B 78          5321         MOV A,B
1D3C CD411F      5322         CALL CNVXSI
1D3F 324A72      5323         STA STATION
1D42 CD3203      5324         CALL SETSTN
1D45 AF          5325         XRA A
1D46 C9          5326         RET
1D47 3C          5327 FONGT1: INR A
1D48 C9          5328         RET
                 5329
1D49 18          5330 FDVALS: DB 24           ;# OF VALUES
1D4A 25          5331         DB 37,27,36,26,35,25
1D4B 1B
1D4C 24
1D4D 1A
1D4E 23
1D4F 19
1D50 22          5332         DB 34,24,33,23,32,22
1D51 18
1D52 21
1D53 17
1D54 20
1D55 16
1D56 11          5333         DB 17,7,16,6,15,5
1D57 07
1D58 10
1D59 06
1D5A 0F
1D5B 05
1D5C 0E          5334         DB 14,4,13,3,12,2
1D5D 04
1D5E 0D
1D5F 03
1D60 0C
1D61 02
```

```
                5335
                5336
1D62 CDE11B     5337 MODLN:  CALL MSP04      ;DRAW BOXES
1D65 11AD35     5338         LXI D,53F1      ;AND MESSAGES
1D68 CD5B26     5339         CALL DISPLAY
1D6B 11D035     5340         LXI D,53F2
1D6E CD5B26     5341         CALL DISPLAY
1D71 CD3B26     5342 MODLN1: CALL GCH1
1D74 21991D     5343         LXI H,MODLNT    ;CHECK IF ENTRY
1D77 CD811E     5344         CALL FINDET
1D7A C28F1D     5345         JNZ MODLN2      ;JUMP IF NOT
1D7D 7D         5346         MOV A,L         ;GET DESIRED SPACING
1D7E 2A4B72     5347         LHLD RAMPTR     ;SET NEW CONFIGURATION
1D81 0E0B       5348         MVI C,CURLW
1D83 CD1525     5349         CALL STORE
1D86 3A4A72     5350         LDA STATION
1D89 CD9B02     5351         CALL CONFIG     ;CONFIGURE IT
1D8C C3711D     5352         JMP MODLN1
                5353
                5354
1D8F 21FC1D     5355 MODLN2: LXI H,FSTB1     ;CHECK FOR BACK ONE OR EXIT
1D92 CD811E     5356         CALL FINDET
1D95 C2711D     5357         JNZ MODLN1
1D98 E9         5358         PCHL
                5359
1D99 551B       5360 MODLNT: DW CH42
1D9B 0000       5361         DW 0
1D9D 591B       5362         DW CH43
1D9F 0100       5363         DW 1
1DA1 5D1B       5364         DW CH44
1DA3 0200       5365         DW 2
1DA5 611B       5366         DW CH45
1DA7 0300       5367         DW 3
1DA9 FFFF       5368         DW ENDTBL
                5369
                5370
1DAB CD7225     5371 MODFS:  CALL CLSCRN
1DAE 060A       5372         MVI B,10
1DB0 0E03       5373         MVI C,3         ;DRAW BOXES
1DB2 CD6B20     5374         CALL X4BOX
1DB5 062E       5375         MVI B,46
1DB7 CD6B20     5376         CALL X4BOX
1DBA 0E07       5377         MVI C,7
1DBC CD6B20     5378         CALL X4BOX
1DBF 060A       5379         MVI B,10
1DC1 CD6B20     5380         CALL X4BOX
1DC4 CD6F1E     5381         CALL STDLN      ;AND BACK ONE AND EXIT
1DC7 119834     5382         LXI D,53FS
1DCA CD5B26     5383         CALL DISPLAY
1DCD 11EF34     5384         LXI D,53FS1
1DD0 CD5B26     5385         CALL DISPLAY
1DD3 CD3B26     5386 MODFS1: CALL GCH1       ;MODIFY FEED STOP METHOD
1DD6 21E01D     5387         LXI H,FSTBL
1DD9 CD811E     5388         CALL FINDET     ;CHECK ENTRY
1DDC C2D31D     5389         JNZ MODFS1
1DDF E9         5390         PCHL
                5391
                5392 ;ENTRY AND ROUTINE TABLE FOR FEED STOP SCREEN
1DE0 7C1B       5393 FSTBL:  DW CH56
1DE2 101E       5394         DW MODFS2       ;ENCV
1DE4 3D1B       5395         DW CH34
1DE6 151E       5396         DW MODFS3       ;ECV
1DE8 401B       5397         DW CH35
1DEA 151E       5398         DW MODFS3
```

```
1DEC 6E1B      5399          DW CH49
1DEE 1A1E      5400          DW MODFS4       ;CTOP
1DF0 6B1B      5401          DW CH48
1DF2 1A1E      5402          DW MODFS4
1DF4 681B      5403          DW CH47
1DF6 061E      5404          DW MODFS6       ;CTCD
1DF8 651B      5405          DW CH46
1DFA 061E      5406          DW MODFS6
1DFC 491B      5407 FSTB1:   DW CH38
1DFE 391C      5408          DW MSS1         ;BACK ONE
1E00 4F1B      5409          DW CH40
1E02 0918      5410          DW RETMCN       ;EXIT
1E04 FFFF      5411          DW ENDTBL
               5412
1E06 0603      5413 MODFS6:  MVI B,FSCDCT
1E08 0E08      5414 MODFS5:  MVI C,FDSTOP
1E0A CDC41C    5415          CALL MSS21
1E0D C3391C    5416          JMP MSS1
               5417
1E10 0600      5418 MODFS2:  MVI B,FSECNV
1E12 C3081E    5419          JMP MODFS5
               5420
1E15 0601      5421 MODFS3:  MVI B,FSECVR
1E17 C3081E    5422          JMP MODFS5
               5423
1E1A 0602      5424 MODFS4:  MVI B,FSOPCT
1E1C C3081E    5425          JMP MODFS5
               5426
               5427
1E1F 0E03      5428 MODFC:   MVI C,OPCNT
1E21 C3301E    5429          JMP MODALL
               5430
1E24 0E04      5431 MODMM:   MVI C,MMCNT
LOC  OBJ       LINE          SOURCE STATEMENT

1E26 C3301E    5432          JMP MODALL
               5433
1E29 0E06      5434 MODPBL:  MVI C,PBLOW
1E2B C3301E    5435          JMP MODALL
               5436
1E2E 0E07      5437 MODPBH:  MVI C,PBHIGH
1E30 C5        5438 MODALL:  PUSH B
1E31 CD411E    5439          CALL GDECM      ;GET ENTRY
1E34 112934    5440          LXI D,S3K1      ;SETUP FOR ENTRY
1E37 CDF128    5441          CALL KEYIN
1E3A C1        5442          POP B
1E3B CDC51C    5443          CALL MSS2
1E3E C3391C    5444          JMP MSS1
               5445
1E41 118532    5446 GDECM:   LXI D,S2C0
1E44 CD7225    5447 DNUM:    CALL CLSCRN
1E47 CD5B26    5448          CALL DISPLAY
1E4A CD561E    5449          CALL KEYDPY
1E4D CD621E    5450          CALL EXDISP
1E50 3E02      5451          MVI A,2
1E52 32D576    5452          STA KEYMOD
1E55 C9        5453          RET
               5454
               5455
1E56 112F31    5456 KEYDPY:  LXI D,SNUMB          ;DRAW BOXES
1E59 CD5B26    5457          CALL DISPLAY
1E5C 113631    5458          LXI D,SNUM           ;THEN NUMBERS
1E5F C35B26    5459          JMP DISPLAY
               5460
```

```
1E62 0622      EXDISP: MVI B,34          ;DRAW BOX FOR EXIT
1E64 0E0C              MVI C,12
1E66 CD5F20            CALL X2BOX
1E69 116431            LXI D,EXMES       ;AND MESSAGE
1E6C C35B26            JMP DISPLAY

                ;ANOTHER BACK ONE AND EXIT LINE
1E6F 0616       STDLN:  MVI B,22
1E71 0E0C              MVI C,12
1E73 CD5F20            CALL X2BOX
1E76 062E              MVI B,46
1E78 CD5F20            CALL X2BOX
1E7B 11CD32            LXI D,S3STD
1E7E C35B26            JMP DISPLAY

                ;ROUTINE TO CHECK A TABLE POINTING TO VALID DATA
                ;AND THEIR CORRESPONDING ROUTINES
                ;ON ENTRY, HL CONTAINS TABLE ADDRESS
                ;IF VALID ENTRY, ZERO RETURN WITH HL CONTAINING
                ;THE ROUTINE ADDRESS

1E81 47         FINDET: MOV B,A
1E82 5E                MOV E,M
1E83 23                INX H
1E84 56                MOV D,M           ;GET ENTRY ADDRESS
1E85 23                INX H
1E86 3EFF              MVI A,0FFH
1E88 BA                CMP D
1E89 CA9E1E            JZ FIND2          ;JUMP IF AT END
1E8C 78                MOV A,B
1E8D CDBF1E            CALL ENCHK        ;CHECK ENTRY
1E90 CA981E            JZ FIND1          ;JUMP IF FOUND
1E93 23                INX H
1E94 23                INX H
1E95 C3811E            JMP FINDET        ;CHECK NEXT
1E98 5E         FIND1:  MOV E,M           ;GET ADDRESS
1E99 23                INX H
1E9A 56                MOV D,M
1E9B EB                XCHG
1E9C AF                XRA A             ;ZERO RETURN
1E9D C9                RET
1E9E A7         FIND2:  ANA A             ;NONZERO RETURN
1E9F 78                MOV A,B
1EA0 C9                RET

                ;ROUTINE TO DRAW BACK ONE AND EXIT BOXES AND MESSAGE

1EA1 78         BBOXD:  MOV A,B
1EA2 32CF76            STA XC
1EA5 79                MOV A,C
1EA6 32D076            STA YC
1EA9 118A33            LXI D,S3P11
1EAC CD5B26            CALL DISPLAY      ;DRAW BOXES
1EAF 21CF76            LXI H,XC
1EB2 34                INR M
1EB3 34                INR M
1EB4 21D076            LXI H,YC
1EB7 35                DCR M
1EB8 35                DCR M
1EB9 119133            LXI D,S3P12       ;DISPLAY TEXT
1EBC C35B26            JMP DISPLAY
```

```
                5525
                5526
                5527 ;ROUTINE TO CHECK VALUE IN A AGAINST LIST
                5528 ;
                5529 ;  ON ENTRY, DE POINTS TO LIST
                5530 ;  FIRST BYTE IN LIST IS LENGTH OF LIST
                5531 ;  RETURNS ZERO FLAG IF FOUND WITH B CONTAINING
                5532 ;  POSITION OF MATCH IN LIST
1EBF EB         5533 ENCHK:  XCHG
1EC0 46         5534         MOV B,M          ;GET LENGTH
1EC1 23         5535 ENCH1:  INX H
1EC2 BE         5536         CMP M
1EC3 CACD1E     5537         JZ ENCH2         ;JUMP IF MATCH
1EC6 05         5538         DCR B
1EC7 C2C11E     5539         JNZ ENCH1
1ECA 04         5540         INR B            ;SET NONZERO FLAG
1ECB EB         5541         XCHG
1ECC C9         5542         RET
1ECD CD4526     5543 ENCH2:  CALL BELL
1ED0 67         5544         MOV H,A
1ED1 AF         5545         XRA A
1ED2 7C         5546         MOV A,H
1ED3 EB         5547         XCHG
1ED4 C9         5548         RET
                5549
                5550
                5551
                5552
                5553 ;-------- GETSTN = GET STATION NO.
                5554 ;
                5555 ;    INPUT: OPERATOR TYPES IN A STATION NO. IN EXTERNAL NOTATION
                5556 ;
                5557 ;    OUTPUT: [Z] = 1 IF ESCAPE KEY TYPED
                5558 ;            [Z] = 0 IF VALID STATION NO. TYPED
                5559 ;            [A] CONTAINS STATION NO. IN INTERNAL NOTATION
                5560
1ED5 CDBC1F     5561 GETSTN: CALL S3G01
1ED8 CD6F1E     5562         CALL STDLN
1EDB 060A       5563         MVI B,10
1EDD 0E02       5564         MVI C,2
1EDF CD5920     5565         CALL Y380X
1EE2 0640       5566         MVI B,64
1EE4 CD5920     5567         CALL Y380X
1EE7 110D34     5568         LXI D,S3P7
1EEA CD5B26     5569         CALL DISPLAY
1EED 111B34     5570         LXI D,S3P8
1EF0 CD5B26     5571         CALL DISPLAY
1EF3 113A23     5572         LXI D,S6FN
1EF6 CD5B26     5573         CALL DISPLAY
1EF9 CD251D     5574 GETS1:  CALL FONGT       ;GET ENTRY
1EFC CA091F     5575         JZ GETS2         ;JUMP IF #
1EFF 21211F     5576         LXI H,EXTBL
1F02 CD811E     5577         CALL FINDET      ;ELSE CHECK FOR BACK OR EXIT
1F05 C2F91E     5578         JNZ GETS1
1F08 E9         5579         PCHL
1F09 CD251D     5580 GETS2:  CALL FONGT
1F0C CA091F     5581         JZ GETS2         ;WAIT FOR NO #
1F0F 21191F     5582         LXI H,STTBL
1F12 CD811E     5583         CALL FINDET
1F15 C2091F     5584         JNZ GETS2
1F18 E9         5585         PCHL
                5586
                5587 ;ENTRY TABLE FOR STATION # ENTRY
1F19 281F       5588 STTBL:  DW CLVAL
```

```
1F1B F91E        5589          DW GETS1        ;NEW ENTRY
1F1D 2F1F        5590          DW ENVAL
1F1F 331F        5591          DW GETS3
1F21 491B        5592 EXTBL:   DW CH38
1F23 381F        5593          DW GETS4        ;BACK ONE
1F25 4F1B        5594          DW CH40
1F27 3C1F        5595          DW GETS5        ;EXIT
1F29 FFFF        5596          DW ENDTBL
                 5597
1F2B 03          5598 CLVAL:   DB 3,0,10,20
1F2C 00
1F2D 0A
1F2E 14
1F2F 03          5599 ENVAL:   DB 3,9,19,29
1F30 09
1F31 13
1F32 1D
                 5600
1F33 AF          5601 GETS3:   XRA A
1F34 3A4A72      5602          LDA STATION
1F37 C9          5603          RET
                 5604
1F38 3E01        5605 GETS4:   MVI A,1
1F3A A7          5606          ANA A
1F3B C9          5607          RET
                 5608
1F3C E1          5609 GETS5:   POP H           ;CLEAR STACK OF GETSTN CALL
1F3D C30918      5610          JMP RETMCN
1F40 C9          5611          RET
                 5612
                 5613
                 5614 ;------- CNVXSI = CONVERT EXTERNAL STATION NO. TO INTERNAL
                 5615 ;
                 5616 ;        INPUT:  [A] CONTAINS EXTERNAL NUMBER
                 5617 ;        OUTPUT: [A] CONTAINS INTERNAL NUMBER
                 5618
                 5619
1F41 47          5620 CNVXSI:  MOV B,A
1F42 CD3101      5621          CALL FDGET
1F45 3C          5622          INR A
1F46 90          5623          SUB B
1F47 C9          5624          RET
                 5625
                 5626
                 5627
1F48 CD0803      5628 MODST1:  CALL CHKSCF     ;EXIT IF NOT SCANNING FEEDER
1F4B C8          5629          RZ
                 5630
1F4C 2A4B72      5631          LHLD RAMPTR
1F4F 0E0B        5632          MVI C,CURLW     ; SET LINES/INCH
1F51 11F835      5633          LXI D,S3A0X1
1F54 CD8F1F      5634          CALL DPMTR
                 5635
1F57 0E08        5636          MVI C,FDSTOP    ;SET FEED STOP METHOD
1F59 111236      5637          LXI D,S3A0X2
1F5C CD8F1F      5638          CALL DPMTR
                 5639
1F5F 0E03        5640          MVI C,OPCNT     ;SET FEED COUNT
1F61 112C36      5641          LXI D,S3A0X3
1F64 CD8F1F      5642          CALL DPMTR
                 5643
1F67 0E04        5644          MVI C,MMCNT     ;SET MISMATCH COUNT
1F69 112C36      5645          LXI D,S3A0X3
1F6C CD8F1F      5646          CALL DPMTR
```

```
                5647
1F6F 2A4D72     5648        LHLD PRMPTR     ;CHECK FOR POSTAGE BREAK OPTION
1F72 0E0E       5649        MVI C,CPBRK
1F74 CD0C25     5650        CALL FETCH
                5651
1F77 113D30     5652        LXI D,S1A2X2
1F7A CD5B26     5653        CALL DISPLAY
                5654
1F7D A7         5655        ANA A
1F7E C8         5656        RZ
                5657
1F7F 2A4B72     5658        LHLD RAMPTR
1F82 0E06       5659        MVI C,PBLOW
1F84 112C36     5660        LXI D,S3A0X3
1F87 CD8F1F     5661        CALL DPMTR
                5662
1F8A 0E07       5663        MVI C,PBHIGH
1F8C 112C36     5664        LXI D,S3A0X3
                5665
                5666 ;---- DISPLAY A SINGLE PARAMETER
                5667
1F8F CD0C25     5668 DPMTR:  CALL FETCH
1F92 C35B26     5669        JMP DISPLAY
                5670
                5671
                5672 ;-------------------- SCREEN DISPLAY SUBROUTINES
                5673
                5674
                5675 ;------- DISPLAY GROUPS OF DATA ELEMENTS
                5676
                5677
1F95 CD9C1F     5678 S3G:    CALL S3G01
1F99 110733     5679        LXI D,S3P4
1F9B CD5B26     5680        CALL DISPLAY
1F9E 110E33     5681        LXI D,S3P41
1FA1 CD5B26     5682        CALL DISPLAY
1FA4 111533     5683        LXI D,S3P5
1FA7 CD5B26     5684        CALL DISPLAY
1FAA 11C42D     5685        LXI D,S1B11
1FAD CD5B26     5686        CALL DISPLAY
1FB0 110920     5687        LXI D,S1B31
1FB3 CD5B26     5688        CALL DISPLAY
1FB6 11F133     5689        LXI D,S3P6
1FB9 C35B26     5690        JMP DISPLAY
                5691
                5692
1FBC CD7225     5693 S3G01:  CALL CLSCRN
1FBF 11A433     5694        LXI D,S3P2
1FC2 CD5B26     5695        CALL DISPLAY    ;DISPLAY FEEDER ON/OFF SCREEN
1FC5 11AB33     5696        LXI D,S3P3
1FC8 C35B26     5697        JMP DISPLAY
                5698
                5699
                5700
1FCB CD7225     5701 S3G1:   CALL CLSCRN
1FCE 11EC2F     5702        LXI D,S1F2      ;FIELD LABELS
1FD1 CD5B26     5703        CALL DISPLAY
1FD4 114D35     5704        LXI D,S3F0
1FD7 C35B26     5705        JMP DISPLAY
1FDA CD7225     5706 S3G2:   CALL CLSCRN
1FDD 119532     5707        LXI D,S3B1      ;DISPLAY KEY OPERATOR SCREEN
1FE0 CD5B26     5708        CALL DISPLAY
1FE3 119C32     5709        LXI D,S3B2
1FE6 CD5B26     5710        CALL DISPLAY
```

```
1FE9 060A        5711          MVI B,10
1FEB 0E08        5712          MVI C,8
1FED CD7120      5713          CALL S3BOX
1FF0 0634        5714          MVI B,52
1FF2 0E08        5715          MVI C,8
1FF4 CD6520      5716          CALL X3BOX
1FF7 11B832      5717          LXI D,S3B5
1FFA CD5B26      5718          CALL DISPLAY
1FFD 11E032      5719          LXI D,S3P00
2000 CD5B26      5720          CALL DISPLAY
2003 11F432      5721          LXI D,S3P01
2006 CD5B26      5722          CALL DISPLAY
2009 110333      5723          LXI D,S3P02
200C CD5B26      5724          CALL DISPLAY
200F 113633      5725          LXI D,S3P03
2012 C35B26      5726          JMP DISPLAY
                 5727
                 5728
                 5729
2015 CDCB1F      5730 S3G3:    CALL S3G1
2018 CDBF0C      5731          CALL S1A2
201B CD7F20      5732          CALL S3A0
201E 0629        5733          MVI B,41
2020 0E06        5734          MVI C,6          ;DRAW BOXES
2022 CDA11E      5735          CALL BBOXD
2025 CD3B26      5736 S3G31:   CALL GCH1
2028 213220      5737          LXI H,S3G3T
202B CD811E      5738          CALL FINDET      ;CHECK FOR ENTRY
202E C22520      5739          JNZ S3G31
2031 E9          5740          PCHL
                 5741
2032 811B        5742 S3G3T:   DW CH57
2034 F11A        5743          DW MSP0
2036 841B        5744          DW CH58
2038 0918        5745          DW RETMCN
203A FFFF        5746          DW ENDTBL
                 5747
                 5748
                 5749
203C CDCB1F      5750 S3G4:    CALL S3G1
203F 3E01        5751          MVI A,1          ;DISPLAY PARAMS FOR SINGLE STATION
2041 32CC76      5752          STA TABCTR
2044 111E30      5753          LXI D,S1EA2
2047 CD5B26      5754          CALL DISPLAY
204A 3A4A72      5755          LDA  STATION
204D CDDA0C      5756          CALL S1DA2
                 5757
2050 11F335      5758          LXI D,S3EA0
2053 CD5B26      5759          CALL DISPLAY
2056 C3481F      5760          JMP MODST1
                 5761
                 5762
                 5763
                 5764 ;DRAW A Y3 BOX
2059 11C632      5765 Y3BOX:   LXI D,S3B7
205C C37420      5766          JMP S3BOX1
                 5767
                 5768 ;DRAW AN X2 BOX
205F 11BF32      5769 X2BOX:   LXI D,S3B6
2062 C37420      5770          JMP S3BOX1
                 5771
                 5772 ;DRAW AN X3Y1 BOX
2065 11AA32      5773 X3BOX:   LXI D,S3B4
2068 C37420      5774          JMP S3BOX1
```

```
                5775
                5776 ;DRAW AN X4Y1 BOX
206B 11B132     5777 X4BOX:  LXI D,S3B41
206E C37420     5778         JMP S3BOX1
                5779
                5780 ;DRAW 3 2X1 BOXES
2071 11A332     5781 S3BOX:  LXI D,S3B3
2074 78         5782 S3BOX1: MOV A,B
2075 32CF76     5783         STA XC
2078 79         5784         MOV A,C
2079 32D076     5785         STA YC
207C C35B26     5786         JMP DISPLAY
                5787
                5788
                5789 ;--------- DISPLAY PARAMETERS FOR ALL STATIONS
                5790
                5791
207F 3E01       5792 S3A0:   MVI A,1
2081 32CC76     5793         STA TABCTR
2084 3E00       5794         MVI A,0
2086 324A72     5795         STA STATION
                5796
2089 CD3203     5797 S3A00:  CALL SETSTN
208C CD481F     5798         CALL MODST1
208F CD1E03     5799         CALL NXTSTN
2092 C8         5800         RZ
                5801
2093 21CC76     5802         LXI H,TABCTR
2096 34         5803         INR M
2097 C38920     5804         JMP S3A00
                5805
                5806
                5807
                5808
                5809
                5810
                5811
                5812 ;=================================================================
                5813 ;
                5814 ;
                5815 ;                    * * * * SECTION 14     * * * *
                5816 ;
                5817 ;                     RE-ASSIGN STATION SELECTIONS
                5818 ;
                5819 ;=================================================================
                5820
                5821
                5822 ;BUT FIRST — A FEW WORDS OF EXPLANATION.  THE FIRST ELEMENT OF A PIECE OF
                5823 ;MAIL IS A CONTROL DOCUMENT WHICH ENTERS STATION 0 (THE BURSTER/FOLDER).
                5824 ;THE CONTROL DOCUMENT CONTAINS A DASH CODE WHICH SPECIFIES WHICH STATIONS
                5825 ;ARE TO CONTRIBUTE TO THIS PIECE OF MAIL AS IT PASSES DOWN THE LINE OF
                5826 ;STATIONS.
                5827 ;
                5828 ;IT IS SOMETIMES DESIRABLE TO MAKE THE DASH CODE SELECT AN ALTERNATIVE SET
                5829 ;OF STATIONS.  FOR EXAMPLE, IF THE DASH CODE CAN SELECT STATIONS 3,5, AND 7,
                5830 ;WE WOULD LIKE TO BE ABLE TO TELL THE SYSTEM TO SELECT STATIONS 4,6,AND 8
                5831 ;INSTEAD.  THUS A DASH CODE THAT NORMALLY SELECTS STATION 3, WILL NOW
                5832 ;SELECT STATION 4 INSTEAD. LIKEWISE, THE CODE THAT NORMALLY SELECTS STATION 5
                5833 ;WILL NOW SELECT STATION 6, ETC.
                5834
                5835 ;------ REASSIGN STATION SELECTIONS
209A CD5621     5836 RSS:    CALL S4G0       ;DISPLAY MENU
                5837
209D CD3826     5838 RSS0:   CALL GCH1
```

```
                5839
20A0 21AA20     5840        LXI H,REASTB
20A3 CD811E     5841        CALL FINDET
20A6 C29D20     5842        JNZ RSS0
20A9 E9         5843        PCHL
                5844
20AA 461B       5845 REASTB: DW CH37
20AC CB20       5846        DW GETVST
20AE 491B       5847        DW CH38         ;VALID ENTRY TABLE
20B0 F11A       5848        DW MSP0
20B2 4C1B       5849        DW CH39
20B4 0918       5850        DW RETMCN
20B6 FFFF       5851        DW ENDTBL
                5852
                5853
                5854 ;------ GET SELECTABLE STATION
20B8 112934     5855 GETSS:  LXI D,S3K1
20BB CDF128     5856        CALL KEYIN
20BE C0         5857        RNZ
20BF CD411F     5858        CALL CNVXSI
20C2 F8         5859        RM
20C3 324A72     5860        STA STATION
20C6 CD3203     5861        CALL SETSTN
20C9 AF         5862        XRA A
20CA C9         5863        RET
                5864
                5865
                5866
                5867
                5868 ;------- GET VALID STATION ASSIGNMENT FROM OPERATER
                5869 ; GETSS HAS LOCATED A STATION THAT IS REASSIGNABLE, THE OPERATOR MUST NOW
                5870 ; ASSIGN TO IT A STATION OF THE SAME TYPE THAT HAS NOT BEEN PREVIOUSLY
                5871 ;REASSIGNED.
                5872
                5873
                5874
20CB CD8820     5875 GETVST: CALL GETSS      ;GET STATION #
20CE C29A20     5876        JNZ RSS
20D1 2A4D72     5877        LHLD PRMPTR     ;GET DEVICE TYPE OF CURRENT STATION
20D4 0E00       5878        MVI C,DEVTYP
20D6 CD0C25     5879        CALL FETCH
20D9 57         5880        MOV D,A
20DA 3A4A72     5881        LDA STATION
20DD 5F         5882        MOV E,A
20DE D5         5883        PUSH D
20DF 2A4B72     5884        LHLD RAMPTR
20E2 0E10       5885        MVI C,ONSTAT    ;GET DEVICE STATUS
20E4 CD0C25     5886        CALL FETCH
20E7 47         5887        MOV B,A
20E8 C5         5888        PUSH B
                5889
20E9 CD8820     5890        CALL GETSS      ;GET NEW #
20EC C1         5891        POP B
20ED D1         5892        POP D
20EE C29A20     5893        JNZ RSS
20F1 2A4D72     5894        LHLD PRMPTR
20F4 0E00       5895        MVI C,DEVTYP
20F6 CD0C25     5896        CALL FETCH
20F9 BA         5897        CMP D
20FA C22E21     5898        JNZ GVST1       ;STATION TYPES DON'T MATCH, SO REJECT
                5899
20FD 0E10       5900        MVI C,ONSTAT
20FF 2A4B72     5901        LHLD RAMPTR
2102 CD0C25     5902        CALL FETCH      ;GET STATION STATUS
```

```
2105 57          5903          MOV D,A
2106 78          5904          MOV A,B
2107 CD1525      5905          CALL STORE      ;REVERSE STATUS OF STATIONS
                 5906
210A 219576      5907          LXI H,ASNTAB
210D 4B          5908          MOV C,E
210E 3A4A72      5909          LDA STATION
2111 CD1525      5910          CALL STORE      ;REASSIGN STATIONS
                 5911
2114 4F          5912          MOV C,A
2115 7B          5913          MOV A,E
2116 CD1525      5914          CALL STORE
                 5915
2119 7B          5916          MOV A,E
211A D5          5917          PUSH D
211B 324A72      5918          STA STATION
211E CD3203      5919          CALL SETSTN
2121 D1          5920          POP D           ;FINISH UPDATIN STATION STATUS
2122 2A4B72      5921          LHLD RAMPTR
2125 0E10        5922          MVI C,ONSTAT
2127 7A          5923          MOV A,D
2128 CD1525      5924          CALL STORE
212B C39A20      5925          JMP RSS
                 5926
212E 113721      5927 GVST1:   LXI D,S4T1
2131 CD8E2B      5928          CALL DPYERR     ;DISPLAY ERROR MESSAGE
2134 C39020      5929          JMP RSS0        ;TRY AGAIN
                 5930
2137 08          5931 S4T1:    DB 8,15
2138 0F
2139 00          5932          DB DPY,TEXT
213A 00
213B 53544154    5933          DB 'STATION TYPES DO NOT AGREE'
213F 494F4E20
2143 54595045
2147 5320444F
214B 204E4F54
214F 20414752
2153 4545
2155 FF          5934          DB ENDTXT
                 5935
                 5936
                 5937
                 5938
                 5939 ;------- SCREEN DISPLAY SUBROUTINES
2156 CD7225      5940 S4G0:    CALL CLSCRN
                 5941
2159 11EC2F      5942          LXI D,S1F2
215C CD5B26      5943          CALL DISPLAY
                 5944
215F CD7821      5945          CALL S4A0
2162 CD561E      5946          CALL KEYDPY
2165 0608        5947          MVI B,11
2167 0E0C        5948          MVI C,12
2169 CD7120      5949          CALL S3BOX
216C 113136      5950          LXI D,S4P0
216F CD5B26      5951          CALL DISPLAY
2172 119133      5952          LXI D,S3P12
2175 C35B26      5953          JMP DISPLAY
                 5954
                 5955
                 5956
2178 111E30      5957 S4A0:    LXI D,S1EA2
217B CD5B26      5958          CALL DISPLAY
```

```
                5959
217E 3E01       5960        MVI A,1
2180 32CC76     5961        STA TABCTR
2183 3E00       5962        MVI A,0
2185 324A72     5963        STA STATION
                5964
2188 CD3203     5965 S4A00: CALL SETSTN
218B CD1703     5966        CALL NODVCK
218E CA9721     5967        JZ S4A01
                5968
2191 3A4A72     5969        LDA STATION
2194 CDDA0C     5970        CALL S1DA2
2197 21CC76     5971 S4A01: LXI H,TABCTR
219A 34         5972        INR M
219B CD1E03     5973        CALL NXTSTN
219E C8         5974        RZ
219F C38821     5975        JMP S4A00
                5976
                5977
                5978
                5979
                5980
                5981 ;==========================================================
                5982 ;
                5983 ;
                5984 ;              * * * *    SECTION 15     * * * *
                5985 ;
                5986 ;                SCANNER CALIBRATION PROCEDURES
                5987 ;
                5988 ;
                5989 ;==========================================================
                5990
                5991
                5992
                5993
21A2 CD0D22     5994 CALIB: CALL SCST       ;GET FEEDER NUMBER
21A5 CA0422     5995        JZ CALIB3+3     ;EXIT IF NOT SCANNING FEEDER
21A8 0E04       5996        MVI C,SCRDLY
21AA CD1322     5997        CALL SCNOUT     ;ISSUE READ SPACING COMMANDS
21AD F5         5998        PUSH PSW        ;SAVE SPACING
21AE CD3D22     5999        CALL FDROFF     ;TURN OFF FEEDER
21B1 111638     6000        LXI D,S5A2
21B4 CD5B26     6001        CALL DISPLAY
21B7 F1         6002        POP PSW         ;NEW LINE SPACING
21B8 2A4B72     6003        LHLD RAMPTR
21BB 0E0C       6004        MVI C,LNWD1
21BD CD1525     6005        CALL STORE      ;SAVE IT
21C0 113238     6006        LXI D,S5A3
21C3 CD5B26     6007        CALL DISPLAY    ;AND DISPLAY IT
21C6 CD1922     6008        CALL CAL2       ;READ NEXT BYTE
21C9 4F         6009        MOV C,A
21CA CD1922     6010        CALL CAL2       ;AND DELAY HIGH BYTE
21CD 47         6011        MOV B,A
21CE 2A4B72     6012        LHLD RAMPTR
21D1 110900     6013        LXI D,SDELAY    ;SAVE DELAY TIME IN RAM
21D4 19         6014        DAD D
21D5 71         6015        MOV M,C
21D6 23         6016        INX H
21D7 70         6017        MOV M,B
21D8 113738     6018        LXI D,S5A4      ;DISPLAY DELAY VALUE
21DB CD5B26     6019        CALL DISPLAY
21DE CD9B02     6020        CALL CONFIG     ;RECONFIGURE SCANNER
21E1 C30122     6021        JMP CALIB3
                6022
```

```
21E4 CD0D22   6823 CALIB2: CALL SCST      ;GET FEEDER NUMBER
21E7 CAE616   6824         JZ SYSM1       ;JUMP IF NOT SCANNING FEEDER
21EA 0E10     6825         MVI C,SCDIAG
21EC CD1322   6826         CALL SCNOUT    ;OUTPUT COMMANDS
21EF A7       6827         ANA A          ;SET FLAGS
21F0 F5       6828         PUSH PSW
21F1 11DA37   6829         LXI D,S7F11
21F4 C45B26   6830         CNZ DISPLAY    ;EXECUTE IF FAILED
21F7 F1       6831         POP PSW
21F8 11ED37   6832         LXI D,S7F12
21FB CC5B26   6833         CZ DISPLAY
21FE CD3D22   6834         CALL FDROFF    ;TURN OFF DEVICE
2201 CD4226   6835 CALIB3: CALL GCH1B     ;WAIT FOR SCREEN
2204 CD7225   6836         CALL CLSCRN
2207 CD411E   6837         CALL GDECM
220A C3E616   6838         JMP SYSM1
              6839
2200 CDD51E   6840 SCST:   CALL GETSTN    ;GET SCANNER STATION
2210 C30303   6841         JMP CHKSCF     ;SEE IF SCANNING FEEDER
              6842
2213 CD3816   6843 SCNOUT: CALL WRSCMD    ;OUTPUT DIAG COMMAND
2216 CD2422   6844         CALL FDRON     ;START FEEDER
2219 CD5816   6845 CAL2:   CALL RSSTAT    ;WAIT FOR READY BIT
221C E604     6846         ANI RDYBIT
221E CA1922   6847         JZ CAL2
2221 C36116   6848         JMP RSDATA     ;READ 2 BYTES
              6849
2224 CDC908   6850 FDRON:  CALL XPTRST    ;RESET TRANSPORT
2227 CDE208   6851         CALL XPTDLY    ;PUT TRANSPORT IN DELAY
222A 3A4A72   6852         LDA STATION
222D CD7010   6853         CALL SCFON     ;SELECT FEEDER
2230 3A4A72   6854         LDA STATION
2233 CD0112   6855         CALL RAMST
2236 0E11     6856         MVI C,SFCMD    ;SETUP FEED COMMAND
2238 3E04     6857         MVI A,FCSTFD
223A C3DA11   6858         JMP ENS01      ;START FEED
              6859
223D 21E803   6860 FDROFF: LXI H,1000
2240 CDCF28   6861         CALL WAIT
2243 CDAD08   6862         CALL XPTOFF    ;TURN OFF TRANSPORT
2246 3A4A72   6863         LDA STATION
2249 CD7E10   6864         CALL SCFOFF    ;TURN OFF FEEDER
224C CD1A0E   6865         CALL FDRRT     ;RESET FEEDER
224F C39B02   6866         JMP CONFIG
              6867
              6868
              6869
              6870
              6871 ;==================================================================
              6872 ;
              6873 ;
              6874 ;            * * * *   DIAGNOSTICS     * * * *
              6875 ;
              6876 ;
              6877 ;==================================================================
              6878
              6879
              6880
              6881
2252 AF       6882 DIAG:   XRA A         ;CLEAR DIAGNOSTIC COMMAND
2253 32B776   6883         STA DGNCMD
2256 32B876   6884         STA MAINTR
              6885
2259 CDD51E   6886         CALL GETSTN    ;GET STATION
```

```
225C CA6B22   6087          JZ DIAG01
225F CDF10D   6088          CALL RSTFDR
2262 CD7225   6089          CALL CLSCRN
2265 CD411E   6090          CALL GDECM
2268 C3E616   6091          JMP SYSM1
226B CD0623   6092 DIAG01:  CALL S60A       ;ERASE CURRENT COMMAND AND STATUS
226E CD3B26   6093 DIAG0A:  CALL GCH1       ;GET STATION NUMBER
2271 32B376   6094          STA TEMP
2274 217E22   6095          LXI H,DIAGTB    ;CHECK FOR VALID ENTRY
2277 CD811E   6096          CALL FINDET
227A C26E22   6097          JNZ DIAG0A
227D E9       6098          PCHL
              6099
227E 461B     6100 DIAGTB:  DW CH37
2280 9822     6101          DW DIAG2        ;SET OUTPUT BITS
2282 401B     6102          DW CH35
2284 C122     6103          DW DIAG7        ;LOOK AT INPUT BITS
2286 741B     6104          DW CH52
2288 662C     6105          DW TEST         ;TRANSPORT TEST
228A 761B     6106          DW CH53
228C 6E22     6107          DW DIAG0A       ;TRANSPORT OFF
228E 491B     6108          DW CH38
2290 BB22     6109          DW DIAG9        ;BACK ONE
2292 4C1B     6110          DW CH39
2294 B522     6111          DW CLRDG        ;EXIT
2296 FFFF     6112          DW ENDTBL
              6113
2298 11B624   6114 DIAG2:   LXI D,S6A0      ;KEYIN DIAGNOSTIC COMMAND
229B 3AB776   6115          LDA DGNCMD
229E CDF128   6116          CALL KEYIN
22A1 32B776   6117          STA DGNCMD
              6118
22A4 CDAA22   6119          CALL DIAGST     ;SET DIAG MODE AND COMMAND
22A7 C36E22   6120          JMP DIAG0A
              6121
22AA 3AB776   6122 DIAGST:  LDA DGNCMD
22AD 0E80     6123          MVI C,FCDIAG    ;WRITE DIAGNOSTIC COMMAND TO FEEDER
22AF CD0716   6124          CALL WRFDATA
22B2 C34216   6125          JMP RDFDATA
              6126
              6127
              6128 ;--- RESET ALL STATIONS BEFORE BAILING OUT
22B5 CDF10D   6129 CLRDG:   CALL RSTFDR
22B8 C30918   6130          JMP RETMCN
              6131
              6132
22BB CDF10D   6133 DIAG9:   CALL RSTFDR
22BE C35222   6134          JMP DIAG
              6135
22C1 CD7225   6136 DIAG7:   CALL CLSCRN
22C4 11C123   6137          LXI D,S6F1
22C7 CD5B26   6138          CALL DISPLAY    ;DISPLAY INPUT DATA
22CA 062E     6139          MVI B,46
22CC 0E0C     6140          MVI C,12
22CE CDA11E   6141          CALL BBOXD
22D1 CDAA22   6142          CALL DIAGST     ;SET DIAG MODE
22D4 CD4216   6143          CALL RDFDATA    ;READ STATUS AND DISPLAY IT
22D7 47       6144 DIAG3:   MOV B,A
22D8 11BB24   6145          LXI D,S6A1
22DB CD5B26   6146          CALL DISPLAY
              6147
22DE DBED     6148 DIAG4:   IN 0EDH         ;SEE IF KEYBOARD COMMAND AVAILABLE
22E0 E602     6149          ANI 2
22E2 C2EF22   6150          JNZ DIAG8       ;IF YES,THEN GET NEXT COMMAND
```

```
                6151
22E5 CD4216     6152        CALL RDFDATA    ;READ STATUS AGAIN
22E8 B8         6153        CMP B
22E9 CADE22     6154        JZ DIAG4        ;NO CHANGE
22EC C3D722     6155        JMP DIAG3       ;REDISPLAY STATUS IF ANYTHING CHANGED
22EF CD3B26     6156 DIAG8: CALL GCH1
22F2 21FC22     6157        LXI H,DGT2
22F5 CD811E     6158        CALL FINDET
22F8 C2D722     6159        JNZ DIAG3
22FB E9         6160        PCHL
                6161
22FC 4F1B       6162 DGT2:  DW CH40
22FE 6B22       6163        DW DIAG01
2300 521B       6164        DW CH41
2302 B522       6165        DW CLRDG
2304 FFFF       6166        DW ENDTBL
                6167
                6168
                6169 ;------- DIAGNOSTIC SCREEN DISPLAYS
                6170
                6171 ;-- SCREEN FIXTURES
2306 CD7225     6172 S60A:  CALL CLSCRN
2309 115A23     6173        LXI D,S6F0      ;COMMAND FIELD NAMES
230C CD5B26     6174        CALL DISPLAY
                6175
230F 117D24     6176        LXI D,S6P01
2312 CD5B26     6177        CALL DISPLAY    ;DISPLAY SCREEN
2315 118F24     6178        LXI D,S6P02
2318 CD5B26     6179        CALL DISPLAY
231B 113A37     6180        LXI D,S7F71
231E CD5B26     6181        CALL DISPLAY
2321 119624     6182        LXI D,S6P03
2324 CD5B26     6183        CALL DISPLAY
2327 119D24     6184        LXI D,S6P04
232A CD5B26     6185        CALL DISPLAY
232D 117124     6186        LXI D,S6P0      ;MENU CHOICES
2330 CD5B26     6187        CALL DISPLAY
2333 0617       6188        MVI B,23
2335 0E0C       6189        MVI C,12
2337 C3A11E     6190        JMP BBOXD
                6191
                6192
                6193
                6194 ;------- DISPLAY ELEMENTS
                6195
233A 90         6196 S6FN:  DB  CENTER,1
233B 01
233C 00         6197        DB DPY,TEXT
233D 00
233E 2A2A2A20   6198        DB '*** ENTER FEEDER NUMBER ***'
2342 454E5445
2346 52204645
234A 45444552
234E 204E554D
2352 42455220
2356 2A2A2A
2359 FF         6199        DB ENDTXT
                6200
                6201
                6202 ;-- DIAGNOSTICS COMMANDS
235A 03         6203 S6F0:  DB 3,2
235B 02
235C 00         6204        DB DPY,TEXT
235D 00
```

```
235E 434C5554    6205        DB 'CLUTCH/BRAKE-1',XX
2362 43482F42
2366 52414B45
236A 2D31
236C 0D
236D 434C5554    6206        DB 'CLUTCH/BRAKE-2',XX
2371 43482F42
2375 52414B45
2379 2D32
237B 0D
237C 53504152    6207        DB 'SPARE',XX
2380 45
2381 0D
2382 5343414E    6208        DB 'SCAN START',XX
2386 20535441
238A 5254
238C 0D
238D 53504152    6209        DB 'SPARE',XX
2391 45
2392 0D
2393 4641554C    6210        DB 'FAULT LIGHT',XX
2397 54204C49
239B 474854
239E 0D
239F 414E5449    6211        DB 'ANTI CREEP SOLENOID',XX
23A3 20435245
23A7 45502053
23AB 4F4C454E
23AF 4F4944
23B2 0D
23B3 46454544    6212        DB 'FEEDER MOTOR',XX
23B7 4552204D
23BB 4F544F52
23BF 0D
23C0 FF          6213        DB ENDTXT
                 6214
                 6215 ;--- DIAGNOSTIC STATUS BITS
23C1 03          6216 S6F1:  DB 3,2
23C2 02
23C3 00          6217        DB DPY,TEXT
23C4 00
23C5 45584954    6218        DB 'EXIT PHOTOCELL',XX
23C9 2050484F
23CD 544F4345
23D1 4C4C
23D3 0D
23D4 454E5452    6219        DB 'ENTRANCE PHOTOCELL',XX
23D8 414E4345
23DC 2050484F
23E0 544F4345
23E4 4C4C
23E6 0D
23E7 5448524F    6220        DB 'THROAT OPENER/LEDGE FINGERS',XX
23EB 4154204F
23EF 50454E45
23F3 522F4C45
23F7 44474520
23FB 46494E47
23FF 455253
2402 0D
2403 53544F50    6221        DB 'STOP PHOTOCELL/SINGLE-MULTIPLE',XX
2407 2050484F
240B 544F4345
240F 4C4C2F53
```

```
2413 494E474C
2417 45204D55
241B 4C544950
241F 4C45
2421 80
2422 4A414020    6222        DB 'JAM WIRES/INTERLOCKS',XX
2426 57495245
242A 532F494E
242E 5445524C
2432 4F434B53
2436 80
2437 444F5542    6223        DB 'DOUBLE SWITCH/FOLD SWITCH',XX
243B 4C452053
243F 57495443
2443 482F464F
2447 4C442053
244B 57495443
244F 48
2450 80
2451 54485245    6224        DB 'THREAD SWITCH',XX
2455 41442053
2459 57495443
245D 48
245E 80
245F 54574F20    6225        DB 'TWO UP PHOTOCELL',XX
2463 55502050
2467 484F544F
246B 43454C4C
246F 80
2470 FF          6226        DB ENDTXT
                 6227
                 6228 ;—— MENU CHOICES
2471 80          6229 S6P0:  DB 13,13
2472 80
2473 00          6230        DB DPY,TEXT
2474 00
2475 4F4E        6231        DB 'ON',SKIP,6,'OFF'
2477 92
2478 86
2479 4F4646
247C FF          6232        DB ENDTXT
                 6233
247D 23          6234 S6P01: DB 35,7
247E 07
247F 00          6235        DB DPY,TEXT
2480 00
2481 52554E20    6236        DB 'RUN TRANSPORT'
2485 5452414E
2489 53504F52
248D 54
248E FF          6237        DB ENDLST
                 6238
248F 16          6239 S6P02: DB 22,8
2490 08
2491 00          6240        DB DPY,BOXES
2492 06
2493 01          6241        DB X2Y1,1,1
2494 01
2495 01
                 6242
2496 0A          6243 S6P03: DB 10,12
2497 0C
2498 00          6244        DB DPY,BOXES
2499 06
```

```
249A 00          6245        DB X1Y1,2,1
249B 02
249C 01
                 6246
249D 17          6247 S6P04:  DB 23,9
249E 09
249F 00          6248        DB DPY,TEXT
24A0 00
24A1 494E5055    6249        DB 'INPUT DEVIC',SKIP,13
24A5 54204445
24A9 564943
24AC 82
24AD 0D
24AE 4F4E        6250        DB 'ON',SKIP,6,'OFF'
24B0 82
24B1 06
24B2 4F4646
24B5 FF          6251        DB ENDLST
                 6252
                 6253 ;--- INPUT COMMAND BITS
24B6 00          6254 S6A0:   DB 0,2
24B7 02
24B8 01          6255        DB OVWRT,VBITS
24B9 05
24BA 09          6256        DB 9
                 6257
                 6258 ;--- OUTPUT STATUS BITS
24BB 00          6259 S6A1:   DB 0,2
24BC 02
24BD 00          6260        DB DPY,VBITS
24BE 05
24BF 08          6261        DB 8
                 6262
                 6263
                 6264
                 6265
                 6266
                 6267
                 6268
                 6269 ;==============================================================
                 6270 ;
                 6271 ;
                 6272 ;            * * * *    SECTION 17     * * * *
                 6273 ;
                 6274 ;        GENERAL PURPOSE USEFUL SUBROUTINES
                 6275 ;
                 6276 ;
                 6277 ;==============================================================
                 6278
                 6279
                 6280
                 6281 ;--------------------------------------------------------------
                 6282 ;
                 6283 ;     SUBRTN = UNIVERSAL SUBROUTINE CALLER
                 6284 ;
                 6285 ;          INPUT:  [HL] CONTAINS SUBROUTINE ADDRESS
                 6286 ;
                 6287 ;--------------------------------------------------------------
                 6288
                 6289
24C0 E9          6290 SUBRTN: PCHL
                 6291
                 6292 ;--------------------------------------------------------------
                 6293 ;
```

```
                6294 ;  CMDEHL = COMPARE [DE] AND [HL]
                6295 ;
                6296 ;    INPUT:  [DE] AND [HL] CONTAIN WORDS TO BE COMPARED
                6297 ;    OUTPUT: [Z]=0 IF EQUAL,  [Z]=1 IF UNEQUAL
                6298 ;
                6299 ;    REGISTERS USED:  [A]
                6300 ;
                6301 ;-----------------------------------------------------------
                6302
                6303 CMDEHL:
24C1 7A         6304        MOV A,D
24C2 BC         6305        CMP H
24C3 C0         6306        RNZ
24C4 7B         6307        MOV A,E
24C5 BD         6308        CMP L
24C6 C9         6309        RET
                6310
                6311
                6312
                6313
                6314 ;-----------------------------------------------------------
                6315 ;
                6316 ; ORDEHL = INCLUSIVE "OR" [DE] AND [HL]
                6317 ;
                6318 ;     INPUT: [DE] AND [HL]
                6319 ;     OUTPUT: [HL] HAS INCLUSIVE OR OF [DE] AND [HL]
                6320 ;
                6321 ;-----------------------------------------------------------
                6322
                6323 ORDEHL:
24C7 F5         6324        PUSH PSW
24C8 7A         6325        MOV A,D
24C9 B4         6326        ORA H
24CA 67         6327        MOV H,A
24CB 7B         6328        MOV A,E
24CC B5         6329        ORA L
24CD 6F         6330        MOV L,A
24CE F1         6331        POP PSW
24CF C9         6332        RET
                6333
                6334
                6335
                6336
                6337 ;-----------------------------------------------------------
                6338 ;
                6339 ;  SRHL = SHIFT RIGHT [HL]
                6340 ;
                6341 ;     INPUT:  [A] HAS NO. OF BITS TO SHIFT
                6342 ;             [HL] HAS 16 BIT WORD TO BE SHIFTED
                6343 ;
                6344 ;     OUTPUT: [HL] IS SHIFTED RIGHT BY AMOUNT SPECIFIED IN [A]
                6345 ;
                6346 ;-----------------------------------------------------------
                6347
                6348
24D0 3C         6349 SRHL:   INR A
24D1 3D         6350 SRHL0:  DCR A
24D2 C8         6351        RZ
                6352
24D3 F5         6353        PUSH PSW
24D4 37         6354        STC
24D5 3F         6355        CMC
24D6 7C         6356        MOV A,H
24D7 1F         6357        RAR
```

```
24D8 67        6358        MOV H,A
24D9 7D        6359        MOV A,L
24DA 1F        6360        RAR
24DB 6F        6361        MOV L,A
24DC F1        6362        POP PSW
24DD C3D124    6363        JMP SRHL0
               6364
               6365
               6366
               6367
               6368 ;-----------------------------------------------------
               6369 ;
               6370 ;  SLHL = SHIFT LEFT [HL]
               6371 ;
               6372 ;     INPUT:  [A] HAS NO. OF BIT POSITIONS TO SHIFT
               6373 ;             [HL] HAS WORD TO BE SHIFTED
               6374 ;
               6375 ;     OUTPUT: [HL] CONTENTS SHIFTED LEFT BY SPECIFIED AMOUNT
               6376 ;
               6377 ;-----------------------------------------------------
               6378
24E0 3C        6379 SLHL:   INR A
24E1 3D        6380 SL0:    DCR A
24E2 C8        6381         RZ
               6382
24E3 29        6383         DAD H
24E4 C3E124    6384         JMP SL0
               6385
               6386
               6387
               6388 ;-----------------------------------------------------
               6389 ;
               6390 ;       CHKBIT = CHECK BIT IN [A], BIT NUMBER IN [C]
               6391 ;
               6392 ;               OUTPUT: [Z] IF BIT=0
               6393 ;                       [NZ] IF BIT =1
               6394 ;
               6395 ;-----------------------------------------------------
               6396
24E7 C5        6397 CHKBIT: PUSH B
24E8 47        6398         MOV B,A
24E9 3E01      6399         MVI A,1
24EB 0C        6400         INR C
               6401
24EC 0D        6402 CKBIT0: DCR C
24ED CAF424    6403         JZ CKBIT1
24F0 07        6404         RLC
24F1 C3EC24    6405         JMP CKBIT0
               6406
24F4 A0        6407 CKBIT1: ANA B
24F5 C1        6408         POP B
24F6 C9        6409         RET
               6410
               6411
               6412
               6413
               6414
               6415
               6416 ;-----------------------------------------------------
               6417 ;
               6418 ;  FETCHPTR = FETCH POINTER WORD FROM TABLE
               6419 ;
               6420 ;     INPUT: [HL] CONTAINS TABLE ADDRESS
               6421 ;            [C] CONTAINS DISPLACEMENT FROM TABLE ORIGIN (IN BYTES)
```

```
                 ;
                 ;     OUTPUT: [HL] CONTAINS POINTER (16 BIT ADRESS) THAT WAS FETCHED
                 ;
                 ;-----------------------------------------------------------------
                 
                 FETCHPTR:
24F7 C5                  PUSH B
24F8 0600                MVI B,0
24FA 09                  DAD B
24FB 46                  MOV B,M
24FC 23                  INX H
24FD 66                  MOV H,M
24FE 68                  MOV L,B
24FF C1                  POP B
2500 C9                  RET
                 
                 
                 
                 
                 
                 ;-----------------------------------------------------------------
                 ;
                 ;  STOREPTR = STORE POINTER IN TABLE
                 ;
                 ;      INPUT:   [HL] CONTAINS TABLE ADDRESS
                 ;               [C]  CONTAINS DISPLACEMENT FROM TABLE ORIGIN (IN BYTES)
                 ;               [DE] CONTAINS POINTER TO BE STORED
                 ;
                 ;-----------------------------------------------------------------
                 
                 STOREPTR:
2501 C5                  PUSH B
2502 E5                  PUSH H
2503 0600                MVI B,0
2505 09                  DAD B
2506 73                  MOV M,E
2507 23                  INX H
2508 72                  MOV M,D
2509 E1                  POP H
250A C1                  POP B
250B C9                  RET
                 
                 
                 
                 
                 
                 ;-----------------------------------------------------------------
                 ;
                 ;  FETCH = FETCH 1 BYTE FROM TABLE
                 ;
                 ;       INPUT:  [HL] CONTAINS TABLE ORIGIN
                 ;               [C]  CONTAINS DISPLACEMENT FROM ORIGIN OF BYTE ADDRESS
                 ;
                 ;       OUTPUT: [A]  CONTAINS FETCHED BYTE
                 ;
                 ;-----------------------------------------------------------------
                 
                 FETCH:
250C C5                  PUSH B
250D E5                  PUSH H
250E 0600                MVI B,0
2510 09                  DAD B
2511 7E                  MOV A,M
2512 E1                  POP H
2513 C1                  POP B
```

```
2514 C9          6486        RET
                 6487
                 6488
                 6489
                 6490
                 6491 ;-----------------------------------------------------
                 6492 ;
                 6493 ;  STORE = STORE 1 BYTE IN TABLE
                 6494 ;
                 6495 ;      INPUT:  [HL] CONTAINS TABLE ADDRESS
                 6496 ;              [C] CONTAINS BYTE ADDRESS, AS DISPLACEMENT FROM TABLE ORG
                 6497 ;              [A] CONTAINS BYTE TO BE STORED
                 6498 ;
                 6499 ;-----------------------------------------------------
                 6500
2515 C5          6501 STORE:  PUSH B
2516 E5          6502         PUSH H
2517 0600        6503         MVI B,0
2519 09          6504         DAD B
251A 77          6505         MOV M,A
251B E1          6506         POP H
251C C1          6507         POP B
251D C9          6508         RET
                 6509
                 6510
                 6511
                 6512 ;-----------------------------------------------------
                 6513 ;
                 6514 ;       COPY = COPY A BLOCK OF WORDS
                 6515 ;
                 6516 ;         INPUT:   [DE] = SOURCE ADDRESS
                 6517 ;                  [HL] = DESTINATION ADDRESS
                 6518 ;                  [C]  = WORD COUNT
                 6519 ;
                 6520 ;-----------------------------------------------------
                 6521
                 6522
251E F5          6523 COPY:   PUSH PSW
251F D5          6524         PUSH D
2520 E5          6525         PUSH H
                 6526
2521 1A          6527 COPY0:  LDAX D
2522 77          6528         MOV M,A
2523 13          6529         INX D
2524 23          6530         INX H
2525 0D          6531         DCR C
2526 C22125      6532         JNZ COPY0
                 6533
2529 E1          6534         POP H
252A D1          6535         POP D
252B F1          6536         POP PSW
252C C9          6537         RET
                 6538
                 6539
                 6540
                 6541
                 6542 ;=====================================================
                 6543 ;
                 6544 ;    MULT = MULTIPLY
                 6545 ;
                 6546 ;       INPUT:  [H] CONTAINS OPERAND1
                 6547 ;               [E] CONTAINS OPERAND2
                 6548 ;
                 6549 ;       OUTPUT: [HL] CONTAINS 16 BIT RESULT
```

```
                ;
                ;==================================================================
                
252D 3E08       MULT:   MVI A,8
252F 2E00               MVI L,0
2531 55                 MOV D,L
                
2532 29         MULT1:  DAD H
2533 D23725             JNC MULT2
2536 19                 DAD D
                
2537 3D         MULT2:  DCR A
2538 C23225             JNZ MULT1
253B C9                 RET
                
                
                
                ;------------------------------------------------------------------
                ;
                ;       DIVIDE = DIVIDE A 16 BIT DIVIDEND BY A 16 BIT DIVISOR TO
                ;                PRODUCE A 16 BIT QUOTIENT AND A 16 BIT REMAINDER
                ;
                ;           INPUT: [DE] CONTAINS DIVIDEND
                ;                  [HL] CONTAINS DIVISOR
                ;
                ;           OUTPUT: [DE] CONTAINS RESULTS
                ;                   [HL] CONTAINS REMAINDER
                ;
                ;------------------------------------------------------------------
                
                
253C C5         DIVIDE: PUSH B
253D 22B576             SHLD TEMP1
2540 21B276             LXI H,BNUM
2543 3611               MVI M,11H
2545 010000             LXI B,0
2548 C5                 PUSH B
                
2549 7B         DIV0:   MOV A,E
254A 17                 RAL
254B 5F                 MOV E,A
                
254C 7A                 MOV A,D
254D 17                 RAL
254E 57                 MOV D,A
                
254F 35                 DCR M
2550 E1                 POP H
2551 CA7925             JZ DIV2
                
2554 3E00               MVI A,0
2556 CE00               ACI 0
2558 29                 DAD H
2559 44                 MOV B,H
255A 85                 ADD L
                
255B 2AB576             LHLD TEMP1
255E 95                 SUB L
255F 4F                 MOV C,A
2560 78                 MOV A,B
2561 9C                 SBB H
2562 47                 MOV B,A
2563 C5                 PUSH B
                
```

```
2564 D26925   6614          JNC DIV1
2567 09       6615          DAD B
2568 E3       6616          XTHL
              6617
2569 21B276   6618 DIV1:    LXI H,BNUM
256C 3F       6619          CMC
256D C24925   6620          JMP DIV0
              6621
2570 C1       6622 DIV2:    POP B
2571 C9       6623          RET
              6624
              6625
              6626
              6627
              6628
              6629 ;==========================================================
              6630 ;
              6631 ;
              6632 ;                  * * * *     SECTION 18    * * * *
              6633 ;
              6634 ;                       SCREEN AND KEYBOARD ROUTINES
              6635 ;
              6636 ;
              6637 ;==========================================================
              6638
              6639
              6640
              6641
              6642
              6643
              6644
              6645
              6646 ;--- CLEAR SCREEN
2572 3E1B     6647 CLSCRN: MVI A,1BH      ;CLEAR SCREEN COMMAND
2574 CD2526   6648          CALL DCH
2577 3E5B     6649          MVI A,5BH
2579 CD2526   6650          CALL DCH
257C 3E32     6651          MVI A,'2'
257E CD2526   6652          CALL DCH
2581 3E4A     6653          MVI A,'J'
2583 C32526   6654          JMP DCH
              6655
              6656
              6657
              6658 ;--- ERASE SPECIFIED SCREEN AREA
2586 0E03     6659 ERAS:   MVI C,DTYPE      ;FETCH NO. OF LINES TO ERASE
2588 CD0C25   6660          CALL FETCH
258B 5F       6661          MOV E,A
              6662
258C 0E04     6663          MVI C,DW1      ;FETCH NO OF CHARACTERS TO ERASE
258E CD0C25   6664          CALL FETCH
2591 FE80     6665          CPI EOL        ;ERASE TO END OF LINE
2593 CAAF25   6666          JZ ERS1
2596 57       6667          MOV D,A
2597 42       6668 ERS2:   MOV B,D
2598 3E20     6669          MVI A,' '
259A CD2526   6670 ERS0:   CALL DCH
259D 05       6671          DCR B
259E C29A25   6672          JNZ ERS0
25A1 1D       6673          DCR E
25A2 CACC25   6674          JZ ERS4
25A5 21D076   6675          LXI H,YC
25A8 34       6676          INR M
25A9 CDD225   6677          CALL SETCP
```

```
25AC C39725     6678          JMP ERS2
25AF 3E1B       6679 ERS1:    MVI A,1BH
25B1 CD2526     6680          CALL DCH
25B4 3E5B       6681          MVI A,5BH
25B6 CD2526     6682          CALL DCH
25B9 3E4B       6683          MVI A,'K'
25BB CD2526     6684          CALL DCH
                6685
25BE 1D         6686          DCR E          ;STEP TO NEXT LINE
25BF CACC25     6687          JZ ERS4
                6688
25C2 21D076     6689          LXI H,YC
25C5 34         6690          INR M
25C6 CD0225     6691          CALL SETCP     ;SET CURSOR POSITION
25C9 C3AF25     6692          JMP ERS1
                6693
25CC CDE52A     6694 ERS4:    CALL SETXY     ;AFTER ERASING, RESTORE CURSOR TO ITS ORIGINAL LOC.
25CF C36926     6695          JMP DPY0
                6696
                6697
                6698
                6699
                6700 ;---- SET CURSOR POSITION
25D2 D5         6701 SETCP:   PUSH D
25D3 3E1B       6702          MVI A,1BH      ;LEAD IN
25D5 CD2526     6703          CALL DCH
25D8 3E5B       6704          MVI A,5BH
25DA CD2526     6705          CALL DCH
25DD 3AD076     6706          LDA YC
25E0 E67F       6707          ANI 7FH
25E2 5F         6708          MOV E,A
25E3 1600       6709          MVI D,0
25E5 210A00     6710          LXI H,10
25E8 CD3C25     6711          CALL DIVIDE
25EB 7B         6712          MOV A,E
25EC A7         6713          ANA A
25ED CAF525     6714          JZ SETC1
25F0 C630       6715          ADI 30H
25F2 CD2526     6716          CALL DCH
25F5 7D         6717 SETC1:   MOV A,L
25F6 C630       6718          ADI 30H
25F8 CD2526     6719          CALL DCH
25FB 3E3B       6720          MVI A,';'
25FD CD2526     6721          CALL DCH
2600 3ACF76     6722          LDA XC
2603 E67F       6723          ANI 7FH
2605 5F         6724          MOV E,A
2606 1600       6725          MVI D,0
2608 210A00     6726          LXI H,10
260B CD3C25     6727          CALL DIVIDE
260E 7B         6728          MOV A,E
260F A7         6729          ANA A
2610 CA1826     6730          JZ SETC2
2613 C630       6731          ADI 30H
2615 CD2526     6732          CALL DCH
2618 7D         6733 SETC2:   MOV A,L
2619 C630       6734          ADI 30H
261B CD2526     6735          CALL DCH
261E 3E48       6736          MVI A,'H'
2620 CD2526     6737          CALL DCH
2623 D1         6738          POP D
2624 C9         6739          RET
                6740
                6741
```

```
                6742
                6743
                6744
                6745
                6746 ;---- DISPLAY 1 CHARACTER
                6747 ;-- [A] CONTAINS THE CHARACTER
                6748
2625 F5         6749 DCH:    PUSH PSW
                6750
2626 DBED       6751 DCH0:   IN 0EDH
2628 E601       6752         ANI 1B
262A CA2626     6753         JZ DCH0
                6754
262D F1         6755         POP PSW
262E D3EC       6756         OUT 0ECH
2630 C9         6757         RET
                6758
                6759
                6760
                6761
                6762
                6763 ;---- GET 1 CHARACTER FROM KEYBOARD
                6764 ;
                6765 ;    OUTPUT:  [Z]  IF NO CHARACTER AVAILABLE
                6766 ;
                6767 ;             [NZ] IF CHARACTER AVAILABLE
                6768 ;             [A]  HAS CHARACTER
                6769
                6770
2631 DBED       6771 GCH:    IN 0EDH
2633 E602       6772         ANI 2
2635 C8         6773         RZ
                6774
2636 DBEC       6775         IN 0ECH        ;GET CHARACTER AND STRIP PARITY BIT
2638 E67F       6776         ANI 7FH
263A C9         6777         RET
                6778
                6779
                6780
263B CD3126     6781 GCH1:   CALL GCH
263E CA3B26     6782         JZ GCH1
2641 C9         6783         RET
                6784
                6785
2642 CD3B26     6786 GCH1B:  CALL GCH1
2645 F5         6787 BELL:   PUSH PSW
2646 3E07       6788         MVI A,7
2648 CD2526     6789         CALL DCH
264B F1         6790         POP PSW
264C C9         6791         RET
                6792
                6793
                6794
                6795
                6796
                6797
                6798
                6799 ;------------ DEFINITIONS FOR DISPLAY/KEYBOARD HANDLER
                6800
                6801 ;---- DATA DISPLAY BLOCK DEFINITIONS
                6802
0000            6803 DX      EQU 0   ;X COORDINATE
0001            6804 DY      EQU 1   ;Y COORDINATE
0002            6805 DMODE   EQU 2   ;MODE
```

```
0003          6806 DTYPE   EQU 3   ;DATA TYPE
0004          6807 DW1     EQU 4   ; ADDITIONAL ARGUMENTS DEPENDING ON MODE AND TYPE
0005          6808 DW2     EQU 5
0006          6809 DW3     EQU 6
0007          6810 DW4     EQU 7
              6811
              6812
              6813 ;---- DATA DEFINITIONS FOR EACH OF THE ABOVE ITEMS
              6814
              6815 ;-- X COORDINATE
              6816
0080          6817 XCC     EQU 80H         ;USE CURRENT X COORDINATE
0090          6818 CENTER  EQU 90H         ;CENTER TEXT
00A0          6819 TABI    EQU 0A0H        ;TAB IMMEDIATE, BITS 0-3 CONTAIN TAB NO.
00B0          6820 TABC    EQU 0B0H        ;TAB VIA TAB COUNTER
              6821
              6822 ;-- Y COORDINATE
              6823
0080          6824 YCC     EQU 80H         ;USE CURRENT Y COORDINATE
0090          6825 YNXT    EQU 90H         ;NEXT LINE
              6826
              6827 ;-- MODE
              6828
0000          6829 DPY     EQU 0           ;DISPLAY ONLY
0001          6830 OVWRT   EQU 1           ;OVERWRITE
0002          6831 KBIN    EQU 2           ;KEYBOARD INPUT
0003          6832 ERASE   EQU 3           ;ERASE
              6833
              6834 ;-- TYPE
              6835
0000          6836 TEXT    EQU 0           ;SINGLE TEXT STRING
0001          6837 VTEXT   EQU 1           ;ARRAY OF TEXT STRINGS
0002          6838 DECIMAL EQU 2           ;DECIMAL - 8 BITS
0003          6839 XDEC    EQU 3           ;EXTENDED DECIMAL - 16 BITS
0004          6840 HEX     EQU 4           ;HEXADECIMAL
0005          6841 VBITS   EQU 5           ;VERTICAL BITS
0006          6842 BOXES   EQU 6           ;DRAW BOXES
              6843
              6844
              6845 ;BOX SIZE DEFINITIONS
              6846
0000          6847 X1Y1    EQU 0           ;SINGLE SIZE BOX
0001          6848 X2Y1    EQU 1           ;DOUBLE X SIZE, SINGLE Y
0002          6849 X3Y1    EQU 2
0004          6850 X1Y2    EQU 4
0005          6851 X2Y2    EQU 5
0006          6852 X3Y2    EQU 6
0008          6853 X1Y3    EQU 8
000A          6854 X3Y3    EQU 0AH
000C          6855 X1Y15   EQU 0CH
000F          6856 X4Y15   EQU 0FH
              6857
              6858 ;-- TEXT DEFINITIONS
              6859
00FF          6860 ENDTXT  EQU 0FFH
0000          6861 XX      EQU 00H         ;<RETURN>,ALSO DELIMITS ARRAY ELEMENTS
0080          6862 EOL     EQU 80H         ;END OF LINE FOR ERASE COMMAND
0081          6863 REP     EQU 81H         ;REPEAT CHAR COMMAND
0082          6864 SKIP    EQU 82H         ;SKIP POSITIONS COMMAND
              6865
              6866 ;-- TAB TABLE
              6867
264D 00       6868 TABTAB:        DB 0
264E 14       6869                DB 20
```

```
264F 19          6870              DB 25
2650 1E          6871              DB 30
2651 23          6872              DB 35
2652 28          6873              DB 40
2653 2D          6874              DB 45
2654 32          6875              DB 50
2655 37          6876              DB 55
2656 3C          6877              DB 60
2657 41          6878              DB 65
2658 46          6879              DB 70
2659 4B          6880              DB 75
265A FF          6881              DB ENDLST
                 6882
                 6883
                 6884
                 6885 ;-----------------------------------------------------------
                 6886 ;
                 6887 ;    DISPLAY = DISPLAY DATA ELEMENT
                 6888 ;
                 6889 ;      INPUT: [DE] => DATA ELEMENT
                 6890 ;             [A]     CONTAINS SINGLE BYTE DATA
                 6891 ;             [BC]    CONTAINS TWO BYTE OR HEX DATA
                 6892 ;
                 6893 ;-----------------------------------------------------------
                 6894
                 6895 DISPLAY:
265B F5          6896        PUSH PSW
265C C5          6897        PUSH B
265D E5          6898        PUSH H
265E 32D276      6899        STA DDATA
2661 C5          6900        PUSH B
2662 E1          6901        POP H
2663 22B376      6902        SHLD TEMP
2666 C36D26      6903        JMP DPY1
                 6904
2669 E1          6905 DPY0:  POP H   ; RETURN HERE
266A C1          6906        POP B
266B F1          6907        POP PSW
266C C9          6908        RET
                 6909
266D EB          6910 DPY1:  XCHG
266E 22CD76      6911        SHLD DPTR
2671 CDE52A      6912        CALL SETXY      ;SET CURSOR COORDINATES
                 6913
2674 0E02        6914        MVI C,DMODE     ;CHECK MODE
2676 CD0C25      6915        CALL FETCH      ;MUST BE DPY,OVWRT, OR ERASE
                 6916
2679 FE00        6917        CPI DPY
267B CA8826      6918        JZ DPY2
                 6919
267E FE01        6920        CPI OVWRT
2680 CA8826      6921        JZ DPY2
                 6922
2683 FE03        6923        CPI ERASE
2685 CA8625      6924        JZ  ERAS
2688 C36926      6925        JMP DPY0
                 6926
268B 0E03        6927 DPY2:  MVI C,DTYPE     ;CHECK DATA TYPE
268D CD0C25      6928        CALL FETCH
                 6929                        ;DISPATCH ON TYPE
2690 FE00        6930        CPI TEXT        ;STRAIGHT TEXT
2692 CA9227      6931        JZ DTEXT
                 6932
2695 FE01        6933        CPI VTEXT       ;SELECTED ITEM IN TEXT ARRAY
```

```
2697 CAE127     6934        JZ DVTEXT
                6935
269A FE02       6936        CPI DECIMAL     ;8 BIT DECIMAL
269C CA3328     6937        JZ DDEC
                6938
269F FE03       6939        CPI XDEC        ; 16 BIT DECIMAL
26A1 CA2C28     6940        JZ DXDEC
                6941
26A4 FE04       6942        CPI HEX         ;HEXADECIMAL
26A6 CA7628     6943        JZ DHEX
                6944
26A9 FE05       6945        CPI VBITS       ;VERTICAL BITS
26AB CABF28     6946        JZ DVBITS
                6947
26AE FE06       6948        CPI BOXES       ;DRAW BOXES
26B0 CAB626     6949        JZ DBOX
                6950
26B3 C36926     6951        JMP DPY0
                6952
                6953
                6954 ;DRAW BOXES
                6955
26B6 0633       6956 DBOX:  MVI B,'3'       ;SET GRAPHICS MODE
26B8 CD4F27     6957        CALL MODOT
26BB 2ACD76     6958        LHLD DPTR
26BE 110400     6959        LXI D,DW1
26C1 19         6960        DAD D           ;POINT AT BOX DATA
26C2 7E         6961        MOV A,M         ;GET BOX SIZE
26C3 32B376     6962        STA TEMP
26C6 23         6963        INX H
26C7 46         6964        MOV B,M         ;GET # OF BOXES IN COLUMN
26C8 50         6965        MOV D,B
26C9 23         6966        INX H
26CA 4E         6967        MOV C,M         ;GET # OF BOXES IN ROW
26CB 3E31       6968        MVI A,'1'       ;UPPER LEFT CORNER
26CD CD2526     6969        CALL DCH
26D0 CD5B27     6970 DBOX1: CALL OUTLNE     ;DRAW LINE
26D3 05         6971        DCR B
26D4 CADF26     6972        JZ DBOX2        ;JUMP IF LAST BOX
26D7 3E34       6973        MVI A,'4'
26D9 CD2526     6974        CALL DCH
26DC C3D026     6975        JMP DBOX1
26DF 42         6976 DBOX2: MOV B,D         ;RESET COUNT
26E0 3E30       6977        MVI A,'0'
26E2 CD2526     6978        CALL DCH
26E5 CD8627     6979        CALL NXTLNE     ;GO TO NEXT LINE
26E8 C5         6980 DBOX7: PUSH B
26E9 0E01       6981        MVI C,1
26EB 2AB376     6982        LDA TEMP        ;CHECK BOX SIZE
26EE E60C       6983        ANI 0CH
26F0 CA0327     6984        JZ DBOX3
26F3 0E02       6985        MVI C,2
26F5 FE0C       6986        CPI X1Y15
26F7 CA0327     6987        JZ DBOX3
26FA 0E03       6988        MVI C,3
26FC E608       6989        ANI 8
26FE CA0327     6990        JZ DBOX3
2701 0E05       6991        MVI C,5
2703 3E39       6992 DBOX3: MVI A,'9'
2705 CD2526     6993        CALL DCH
2708 CD8127     6994 DBOX4: CALL OUTLN4     ;OUTPUT BOX BODY
270B 3E39       6995        MVI A,'9'
270D CD2526     6996        CALL DCH
2710 05         6997        DCR B
```

```
2711 C20827      6998          JNZ DBOX4
2714 42          6999          MOV B,D
2715 CD8627      7000          CALL NXTLNE      ;NEXT LINE
2718 0D          7001          DCR C
2719 C20327      7002          JNZ DBOX3
271C C1          7003          POP B
271D 3E33        7004          MVI A,'3'        ;START BOX BOTTOM
271F CD2526      7005          CALL DCH
2722 CD5827      7006 DBOX5:   CALL OUTLNE      ;OUTPUT BOTTOM
2725 3E37        7007          MVI A,'7'
2727 05          7008          DCR B            ;CHECK IF LAST BOX
2728 C22D27      7009          JNZ DBOX6
272B 3E32        7010          MVI A,'2'
272D 04          7011 DBOX6:   INR B
272E CD2526      7012          CALL DCH
2731 05          7013          DCR B
2732 C22227      7014          JNZ DBOX5
2735 CD8627      7015          CALL NXTLNE
2738 42          7016          MOV B,D
2739 0D          7017          DCR C            ;CHECK # OF ROWS
273A C2E826      7018          JNZ DBOX7
273D 0632        7019          MVI B,'2'
273F CD4F27      7020          CALL MODOT       ;CHANGE BACK DISPLAY MODE
2742 C36926      7021          JMP DPY0
                 7022
2745 3E1B        7023 MODLD:   MVI A,ESC
2747 CD2526      7024          CALL DCH
274A 3E5B        7025          MVI A,'['        ;CHANGE MODE
274C C32526      7026          JMP DCH
                 7027
274F CD4527      7028 MODOT:   CALL MODLD
2752 78          7029          MOV A,B
2753 CD2526      7030          CALL DCH
2756 3E70        7031          MVI A,'P'
2758 C32526      7032          JMP DCH
                 7033
275B 3E34        7034 OUTLNE:  MVI A,'4'        ;SET REPEAT CHAR
275D F5          7035 OUTLN1:  PUSH PSW
275E 3AB376      7036          LDA TEMP         ;CHECK BOX SIZE
2761 1E05        7037          MVI E,5          ;REPEAT COUNT
2763 E603        7038          ANI 3
2765 CA7827      7039          JZ OUTLN2
2768 1E18        7040          MVI E,24
276A FE03        7041          CPI 3
276C CA7827      7042          JZ OUTLN2
276F 1E0B        7043          MVI E,11
2771 E602        7044          ANI 2
2773 CA7827      7045          JZ OUTLN2
2776 1E11        7046          MVI E,17
2778 F1          7047 OUTLN2:  POP PSW
2779 CD2526      7048 OUTLN3:  CALL DCH
277C 1D          7049          DCR E
277D C27927      7050          JNZ OUTLN3
2780 C9          7051          RET
                 7052
2781 3E20        7053 OUTLN4:  MVI A,' '        ;SET REPEAT CHAR
2783 C35D27      7054          JMP OUTLN1
                 7055
2786 C5          7056 NXTLNE:  PUSH B
2787 D5          7057          PUSH D
2788 21D076      7058          LXI H,YC         ;GO TO NEXT LINE
278B 34          7059          INR M
278C CDD225      7060          CALL SETCP
278F D1          7061          POP D
```

```
2790 C1          7062          POP B
2791 C9          7063          RET
                 7064
                 7065 ;---- DISPLAY STRAIGHT TEXT STRING
2792 2ACD76      7066 DTEXT:   LHLD DPTR
2795 110400      7067          LXI D,DW1
2798 19          7068          DAD D
                 7069
2799 7E          7070 DTEXT0:  MOV A,M
279A 23          7071          INX H
279B FE81        7072          CPI REP
279D CAB527      7073          JZ DPYR
27A0 FE82        7074          CPI SKIP
27A2 CAC327      7075          JZ DPYSK
27A5 FEFF        7076          CPI ENDTXT
27A7 CA6926      7077          JZ DPY0
                 7078
27AA FE0D        7079          CPI XX
27AC CAD227      7080          JZ DTEXT1
                 7081
27AF CD2526      7082          CALL DCH
27B2 C39927      7083          JMP DTEXT0
                 7084
27B5 46          7085 DPYR:    MOV B,M          ;GET REPEAT COUNT
27B6 23          7086          INX H
27B7 7E          7087          MOV A,M          ;GET REPEAT CHAR
27B8 23          7088          INX H
27B9 CD2526      7089 DPYR1:   CALL DCH
27BC 05          7090          DCR B
27BD C2B927      7091          JNZ DPYR1
27C0 C39927      7092          JMP DTEXT0
                 7093
27C3 7E          7094 DPYSK:   MOV A,M          ;GET SKIP COUNT
27C4 23          7095          INX H
27C5 E5          7096          PUSH H
27C6 21CF76      7097          LXI H,XC         ;ADD TO X COORDINATE
27C9 86          7098          ADD M
27CA 77          7099          MOV M,A
27CB CDD225      7100          CALL SETCP
27CE E1          7101          POP H
27CF C39927      7102          JMP DTEXT0
                 7103
27D2 E5          7104 DTEXT1:  PUSH H
27D3 CDFE2A      7105          CALL SETXC
27D6 21D076      7106          LXI H,YC
27D9 34          7107          INR M
27DA CDD225      7108          CALL SETCP
27DD E1          7109          POP H
27DE C39927      7110          JMP DTEXT0
                 7111
                 7112
                 7113
                 7114 ;---- DISPLAY SELECTED ITEM IN TEXT ARRAY
                 7115
27E1 3AD276      7116 DVTEXT:  LDA DDATA        ;ARG IS STRING NO.
27E4 4F          7117          MOV C,A
                 7118
27E5 2ACD76      7119          LHLD DPTR        ;SET [HL] => FIRST TEXT STRING
27E8 110500      7120          LXI D,DW2
27EB 19          7121          DAD D
27EC 0C          7122          INR C
27ED C3FC27      7123          JMP DVTXT1
                 7124
27F0 7E          7125 DVTXT0:  MOV A,M          ;MOVE  TO SELECTED STRING
```

```
27F1 23          7126          INX H
27F2 FEFF        7127          CPI ENDTXT
27F4 CA6926      7128          JZ DPY0
27F7 FE0D        7129          CPI XX
27F9 C2F027      7130          JNZ DVTXT0
                 7131
27FC 0D          7132 DVTXT1:  DCR C
27FD C2F027      7133          JNZ DVTXT0
2800 0600        7134          MVI B,0
                 7135
2802 7E          7136 DVTXT2:  MOV A,M        ;DISPLAY SELECTED STRING
2803 23          7137          INX H
2804 FE0D        7138          CPI XX
2806 CA1028      7139          JZ DVTXT3
2809 CD2526      7140          CALL DCH
280C 04          7141          INR B
280D C30228      7142          JMP DVTXT2
                 7143
2810 2ACD76      7144 DVTXT3:  LHLD DPTR      ;FETCH FIELD SIZE
2813 0E04        7145          MVI C,DW1
2815 CD0C25      7146          CALL FETCH
2818 90          7147          SUB B
2819 CA6926      7148          JZ DPY0
281C FA6926      7149          JM DPY0
281F 47          7150          MOV B,A
                 7151
2820 3E20        7152 DVTXT4:  MVI A,' '
2822 CD2526      7153          CALL DCH       ;CLEAR REMAINDER OF FIELD
2825 05          7154          DCR B
2826 C22028      7155          JNZ DVTXT4
2829 C36926      7156          JMP DPY0
                 7157
                 7158
                 7159
                 7160 ;---- DISPLAY DECIMAL NUMBER
282C 2A0376      7161 DXDEC:   LHLD TEMP      ; TWO BYTE NUMBER
282F EB          7162          XCHG
2830 C33928      7163          JMP DDEC0A
                 7164
                 7165
2833 3AD276      7166 DDEC:    LDA DDATA      ; 1 BYTE NUMBER
2836 5F          7167          MOV E,A
2837 1600        7168          MVI D,0
                 7169
2839 2ACD76      7170 DDEC0A:  LHLD DPTR      ;FETCH FIELD SIZE
283C 0E04        7171          MVI C,DW1
283E CD0C25      7172          CALL FETCH
2841 4F          7173          MOV C,A
2842 0600        7174          MVI B,0
                 7175
2844 21FF00      7176          LXI H,ENDLST
2847 E5          7177          PUSH H
                 7178
2848 210A00      7179 DDEC0:   LXI H,10       ;[DE] CONTAINS DIVIDEND, [HL] CONTAINS DIVISOR
284B CD3C25      7180          CALL DIVIDE
284E E5          7181          PUSH H         ;[DE] CONTAINS QUOTIENT, [HL] CONTAINS REMAINDER
284F 04          7182          INR B
                 7183
2850 7A          7184          MOV A,D        ;TEST FOR ZERO QUOTIENT
2851 B3          7185          ORA E
2852 C24828      7186          JNZ DDEC0
                 7187
2855 79          7188          MOV A,C        ;COMPUTE  LEADING SPACES
2856 90          7189          SUB B
```

```
2857 FA6728     7190          JM DDEC1
285A CA6728     7191          JZ DDEC1
285D 47         7192          MOV B,A
                7193
285E 3E20       7194 DDEC1A:  MVI A,' '        ;DISPLAY LEADING SPACES
2860 CD2526     7195          CALL DCH
2863 05         7196          DCR B
2864 C25E28     7197          JNZ DDEC1A
                7198
2867 E1         7199 DDEC1:   POP H
2868 7D         7200          MOV A,L
2869 FEFF       7201          CPI ENDLST
286B CA6926     7202          JZ DPY0
                7203
286E C630       7204          ADI 30H          ;CONVERT TO ASCII
2870 CD2526     7205          CALL DCH         ;DISPLAY CHARACTER
2873 C36728     7206          JMP DDEC1
                7207
                7208
                7209
                7210
                7211
                7212
                7213
                7214 ;---- DISPLAY HEXADECIMAL
2876 2AB376     7215 DHEX:    LHLD TEMP
2879 E5         7216          PUSH H
287A C1         7217          POP B
                7218
287B 2ACD76     7219          LHLD DPTR
287E 110400     7220          LXI D,DW1
2881 19         7221          DAD D            ; [HL] => DIGIT COUNT
                7222
2882 3E04       7223          MVI A,4
2884 96         7224          SUB M
2885 5F         7225          MOV E,A
2886 51         7226          MOV D,C
                7227
2887 78         7228          MOV A,B          ; [BC] CONTAINS UP TO 4 HEX DIGITS
2888 1D         7229          DCR E
2889 FC9E28     7230          CM DHEX0
                7231
                7232
288C 78         7233          MOV A,B
288D 1D         7234          DCR E
288E FCA228     7235          CM DHEX1
                7236
2891 7A         7237          MOV A,D
2892 1D         7238          DCR E
2893 FC9E28     7239          CM DHEX0
                7240
2896 7A         7241          MOV A,D
2897 1D         7242          DCR E
2898 FCA228     7243          CM DHEX1
                7244
289B C36926     7245          JMP DPY0
                7246
289E 0F         7247 DHEX0:   RRC
289F 0F         7248          RRC
28A0 0F         7249          RRC
28A1 0F         7250          RRC
                7251
28A2 E60F       7252 DHEX1:   ANI 0FH
28A4 4F         7253          MOV C,A
```

```
28A5 21AF28      7254          LXI H,HEXTAB
28A8 CD0C25      7255          CALL FETCH
28AB CD2526      7256          CALL DCH
28AE C9          7257          RET
                 7258
28AF 30313233    7259 HEXTAB: DB '0123456789ABCDEF'
28B3 34353637
28B7 38394142
28BB 43444546
                 7260
                 7261
                 7262
                 7263 ;-------- DISPLAY BITS IN BYTE VERTICALLY
28BF 2ACD76      7264 DVBITS: LHLD DPTR
28C2 0E04        7265          MVI C,DW1
28C4 CD0C25      7266          CALL FETCH
28C7 32D476      7267          STA FLDSIZ
                 7268
28CA 0601        7269          MVI B,1
28CC 0E00        7270          MVI C,0
                 7271
28CE 3AD276      7272 DVB0:   LDA DDATA
28D1 A0          7273          ANA B
28D2 3E30        7274          MVI A,'0'
28D4 CAD928      7275          JZ DVB1
28D7 3E31        7276          MVI A,'1'
28D9 CD2526      7277 DVB1:   CALL DCH
                 7278
28DC 3AD476      7279          LDA FLDSIZ
28DF 0C          7280          INR C
29E0 B9          7281          CMP C
28E1 CA6926      7282          JZ DPY0
                 7283
28E4 78          7284          MOV A,B
28E5 07          7285          RLC
28E6 47          7286          MOV B,A
                 7287
28E7 21D076      7288          LXI H,YC
28EA 34          7289          INR M
28EB CDD225      7290          CALL SETCP
28EE C3CE28      7291          JMP DVB0
                 7292
                 7293
                 7294
                 7295
                 7296 ;-----------------------------------------------------------------
                 7297 ;
                 7298 ;  KEYIN = KEYBOARD INPUT HANDLER
                 7299 ;
                 7300 ;      INPUT:   [DE] => DATA DISPLAY ELEMENT
                 7301 ;
                 7302 ;      OUTPUT:  [NZ]  -- IF <ESC> KEY TYPED
                 7303 ;               [Z]   -- IF NOT
                 7304 ;
                 7305 ;               [A] -- UNCHANGED IF DELIMITER TYPED, BUT NO DATA
                 7306 ;               [A] -- CONTAINS DATA IF ANY WAS TYPED IN
                 7307 ;
                 7308 ;-----------------------------------------------------------------
                 7309
                 7310
28F1 32D176      7311 KEYIN:  STA KDATA
28F4 F5          7312          PUSH PSW
28F5 E5          7313          PUSH H
28F6 C5          7314          PUSH B
```

```
28F7 EB          7315        XCHG
28F8 22CD76      7316        SHLD DPTR
28FB C31A29      7317        JMP K3
                 7318
                 7319 ;-- EXIT HERE IF <ESC> PRESSED
28FE C1          7320 K0:    POP B
28FF E1          7321        POP H
2900 F1          7322        POP PSW
2901 5F          7323        MOV E,A
2902 3EFF        7324        MVI A,0FFH
2904 B7          7325        ORA A
2905 7B          7326        MOV A,E
2906 C9          7327        RET
                 7328
                 7329 ;-- EXIT HERE IF DELIMITER TYPED, PRECEDED BY NO DATA
2907 C1          7330 K1:    POP B
2908 E1          7331        POP H
2909 F1          7332        POP PSW
290A 5F          7333        MOV E,A
290B 3E00        7334        MVI A,0
290D A7          7335        ANA A
290E 7B          7336        MOV A,E
290F C9          7337        RET
                 7338
                 7339 ;-- EXIT HERE IF DATA ENTERED
2910 C1          7340 K2:    POP B
2911 E1          7341        POP H
2912 F1          7342        POP PSW
2913 3E00        7343        MVI A,0
2915 A7          7344        ANA A
2916 2AD176      7345        LDA KDATA
2919 C9          7346        RET
                 7347
291A CDE52A      7348 K3:    CALL SETXY
291D 2ACD76      7349        LHLD DPTR
2920 0E03        7350        MVI C,DTYPE     ;FETCH DATA TYPE
2922 CD0C25      7351        CALL FETCH
2925 32D376      7352        STA KTYPE
                 7353
2928 0E04        7354        MVI C,DWL       ;FETCH FIELD SIZE (MAX CHARACTERS IN FIELD)
292A CD0C25      7355        CALL FETCH
292D 32D476      7356        STA FLDSIZ
2930 3E00        7357        MVI A,0
2932 32D676      7358        STA ZBIT
                 7359
2935 3AD376      7360        LDA KTYPE       ;SEE IF VERTICAL BIT DISPLAY
2938 FE05        7361        CPI VBITS
293A CAD529      7362        JZ KVBITS
                 7363
293D 0E02        7364        MVI C,DMODE     ;FETCH DISPLAY MODE
293F CD0C25      7365        CALL FETCH
                 7366
2942 FE02        7367        CPI KBIN        ;ENTER DATA INTO BLANK FIELD
2944 CA4F29      7368        JZ K5
2947 FE01        7369        CPI OVWRT
2949 CA5E29      7370        JZ K6           ;ENTER DATA OVERWRITING PREVIOUSLY DISPLAYED CONTENTS
294C C38729      7371        JMP K1          ;IGNORE UNRECOGNIZED MODES
                 7372
294F CDE52A      7373 K5:    CALL SETXY      ;DISPLAY BLANK FIELD
2952 3AD476      7374        LDA FLDSIZ
2955 CDF32A      7375        CALL BLANKS
2958 CD0225      7376        CALL SETCP      ;RESET CURSOR TO START OF FIELD
295B C36E29      7377        JMP K7
                 7378
```

```
295E CDE52A     K6:     CALL SETXY      ;POSITION CURSOR TO START OF FIELD
2961 3AD476             LDA FLDSIZ      ;PREPARE TO BLANK FIELD IN CASE OF OVERWRITE
2964 47                 MOV B,A
2965 3E01               MVI A,1
2967 B8                 CMP B
2968 CA6E29             JZ K7
296B 32D676             STA ZBIT

296E CD422A     K7:     CALL GETSTR     ;GET STRING INTO KBUF FROM KEYBOARD

2971 FE00               CPI 0           ;<ESC> KEY
2973 CAFE28             JZ K0

2976 FE01               CPI 1           ;DELIMITER BUT NO DATA
2978 CA0729             JZ K1

297B FE02               CPI 2           ;DATA FOLLOWED BY DELIMITER
297D CA8329             JZ K10
2980 C30729             JMP K1          ;-- SHOULD NEVER OCCUR


2983 3AD376     K10:    LDA KTYPE       ;INTERPRET INPUT STRING ACCORDING TO DATA TYPE

2986 FE02               CPI DECIMAL     ;DECIMAL
2988 CA8E29             JZ KDEC

2988 C30729             JMP K1          ;SHOULDN'T OCCUR


                ;-- GET DECIMAL NUMBER
298E 3E00       KDEC:   MVI A,0
2990 32D176             STA KDATA
2993 0E00               MVI C,0
2995 1E0A               MVI E,10

2997 21C776     KDEC0:  LXI H,KBUF
299A CD0C25             CALL FETCH
299D 0C                 INR C
299E FE0D               CPI XX
29A0 CAB529             JZ KDEC1
29A3 E60F               ANI 0FH
29A5 47                 MOV B,A

29A6 3AD176             LDA KDATA       ;KDATA*10+DIGIT=>KDATA
29A9 67                 MOV H,A
29AA CD2D25             CALL MULT
29AD 7D                 MOV A,L
29AE 90                 ADD B
29AF 32D176             STA KDATA
29B2 C39729             JMP KDEC0

29B5 2ACD76     KDEC1:  LHLD DPTR       ;CHECK IF NUMBER IS WITHIN PRESCRIBED LIMITS
29B8 0E05               MVI C,DW2
29BA CD0C25             CALL FETCH
29BD 47                 MOV B,A
29BE 3AD176             LDA KDATA       ;CHECK LOWER BOUND
29C1 90                 SUB B
29C2 FA252A             JM KERDPY

29C5 3AD176             LDA KDATA       ;CHECK UPPER BOUND
29C8 47                 MOV B,A
```

```
29C9 0E06        7443          MVI C,06H
29CB CD0C25      7444          CALL FETCH
29CE 90          7445          SUB B
29CF FA252A      7446          JM KERDPY
29D2 C31829      7447          JMP K2
                 7448
                 7449
                 7450
                 7451 ;------ KEYIN BITS VERTICALLY
29D5 0601        7452 KVBITS: MVI B,1
29D7 0E01        7453          MVI C,1
                 7454
29D9 3AB376      7455          LDA TEMP        ;FIRST CHAR ALREADY IN
29DC C3E229      7456          JMP KVB0+3
29DF CD3B26      7457 KVB0:    CALL GCH1
                 7458
29E2 FE33        7459          CPI 51          ;SET BIT TO 0
29E4 CAEF29      7460          JZ KVB1
                 7461
29E7 FE32        7462          CPI 50          ;SET BIT TO 1
29E9 CA012A      7463          JZ KVB2
                 7464
29EC C2DF29      7465          JNZ KVB0        ;ERROR -- ILLEGAL CHARACTER
                 7466
29EF CD4526      7467 KVB1:    CALL BELL
29F2 3E30        7468          MVI A,'0'
29F4 CD2526      7469          CALL DCH
29F7 78          7470          MOV A,B
29F8 2F          7471          CMA
29F9 57          7472          MOV D,A
29FA 3AD176      7473          LDA KDATA
29FD A2          7474          ANA D
29FE C3D02A      7475          JMP KVB3
                 7476
2A01 CD4526      7477 KVB2:    CALL BELL
2A04 3E31        7478          MVI A,'1'
2A06 CD2526      7479          CALL DCH
2A09 3AD176      7480          LDA KDATA
2A0C B0          7481          ORA B
2A0D 32D176      7482 KVB3:    STA KDATA
                 7483
2A10 3AD476      7484 KVB4:    LDA FLDSIZ      ;SEE IF ALL DONE
2A13 0C          7485          INR C
2A14 B9          7486          CMP C
2A15 CA1829      7487          JZ K2           ;ALL DONE
                 7488
2A18 78          7489          MOV A,B
2A19 07          7490          RLC
2A1A 47          7491          MOV B,A
                 7492
2A1B 21D076      7493          LXI H,YC
2A1E 34          7494          INR M
2A1F CDD225      7495          CALL SETCP
2A22 C3DF29      7496          JMP KVB0
                 7497
                 7498
                 7499
                 7500
                 7501
                 7502 ;--- KEYBOARD ERROR MESSAGE DISPLAY
                 7503
2A25 112E2A      7504 KERDPY: LXI D,KERTXT
2A28 CD8E2B      7505          CALL DPYERR
2A2B C31A29      7506          JMP K3
```

```
                7507
                7508
2A2E 08         7509 KERTXT: DB 8,15
2A2F 0F
2A30 00         7510         DB DPY,TEXT
2A31 00
2A32 16         7511         DB 22
2A33 4F555420   7512         DB 'OUT OF BOUNDS',XX
2A37 4F462042
2A3B 4F554E44
2A3F 53
2A40 0D
2A41 FF         7513         DB ENDTXT
                7514
                7515
                7516
                7517
                7518 ;-------- GET INPUT STRING FROM KEYBOARD
                7519
                7520 ;   OUTPUT:  [A] = 0    -- <ESC>
                7521 ;           [A] = 1    -- DELIMITER,BUT NO DATA
                7522 ;           [A] = 2    -- DATA AVAILABLE IN KBUF
                7523
2A42 0E00       7524 GETSTR: MVI C,0
                7525
2A44 21C776     7526 GS0:    LXI H,KBUF
2A47 3E0D       7527         MVI A,XX        ;DEFINE END OF STRING BUFFER
2A49 CD1525     7528         CALL STORE
                7529
2A4C CD3B26     7530 GS1:    CALL GCH1
                7531
2A4F FE36       7532         CPI 54          ;<ESC>
2A51 CA872A     7533         JZ GS2
2A54 FE37       7534         CPI 55
2A56 CA872A     7535         JZ GS2
2A59 FE3B       7536         CPI 59          ;<RETURN>
2A5B CA8D2A     7537         JZ GS3
2A5E FE39       7538         CPI 57          ;<RUBOUT>
2A60 CA9B2A     7539         JZ GS5
                7540
2A63 47         7541         MOV B,A         ;CHECK FOR BUFFER OVERFLOW
2A64 3E05       7542         MVI A,KBSIZE
2A66 B9         7543         CMP C
2A67 CAA92A     7544         JZ GS6
2A6A 78         7545         MOV A,B
2A6B 11BB2A     7546         LXI D,VDNUM     ;CHECK IF VALID
2A6E CDBF1E     7547         CALL ENCHK
2A71 C24C2A     7548         JNZ GS1
2A74 78         7549         MOV A,B
2A75 C62F       7550         ADI 47
                7551
2A77 CD1525     7552         CALL STORE
2A7A CD2526     7553         CALL DCH
2A7D CD4526     7554         CALL BELL
2A80 0C         7555         INR C
2A81 CDC62A     7556         CALL FIXDPY     ;CLEAR REMAINDER OF FIELD AFTER INITIAL CHARACTER
2A84 C3442A     7557         JMP GS0
                7558
                7559
2A87 CD4526     7560 GS2:    CALL BELL
2A8A 3E00       7561         MVI A,0
2A8C C9         7562         RET
                7563
2A8D CD4526     7564 GS3:    CALL BELL
```

```
2A90 79          7565        MOV A,C
2A91 A7          7566        ANA A
2A92 C2982A      7567        JNZ GS4
2A95 3E01        7568        MVI A,1
2A97 C9          7569        RET
                 7570
2A98 3E02        7571 GS4:   MVI A,2
2A9A C9          7572        RET
                 7573
2A9B CD4526      7574 GS5:   CALL BELL
2A9E 0D          7575        DCR C   ;DELETE CHARACTER IN BUFFER
2A9F F2A42A      7576        JP GS5A
2AA2 0E00        7577        MVI C,0
2AA4 3E0D        7578 GS5A:  MVI A,XX
2AA6 CD1525      7579        CALL STORE
                 7580
2AA9 3E08        7581 GS6:   MVI A,08H      ;DELETE CHARACTER ON SCREEN
2AAB CD2526      7582        CALL DCH
2AAE 3E20        7583        MVI A,' '
2AB0 CD2526      7584        CALL DCH
2AB3 3E08        7585        MVI A,08H
2AB5 CD2526      7586        CALL DCH
2AB8 C34C2A      7587        JMP GS1
                 7588
2ABB 0A          7589 YDNUM: DB 10
2ABC 27          7590        DB 39,38,37,29,28,27
2ABD 26
2ABE 25
2ABF 1D
2AC0 1C
2AC1 1B
2AC2 09          7591        DB 9,8,7,58
2AC3 08
2AC4 07
2AC5 3A
                 7592
                 7593
                 7594
                 7595
                 7596
                 7597
                 7598
                 7599 ;AFTER FIRST CHARACTER IS TYPED, CLEAR THE REMAINDER OF THE FIELD TO BLANKS
                 7600
2AC6 3E01        7601 FIXDPY: MVI A,1       ;OPERATES ONLY AFTER INITIAL CHARACTER TYPED
2AC8 B9          7602        CMP C
2AC9 C0          7603        RNZ
                 7604
2ACA 3AD676      7605        LDA ZBIT       ;AND IF ZBIT=1
2ACD B9          7606        CMP C
2ACE C0          7607        RNZ
2ACF 3E00        7608        MVI A,0
2AD1 32D676      7609        STA ZBIT
                 7610
2AD4 3A0476      7611        LDA FLDSIZ     ;WRITE BLANK FIELD
2AD7 3D          7612        DCR A
2AD8 C8          7613        RZ
2AD9 F8          7614        RM
2ADA CDF32A      7615        CALL BLANKS
                 7616
2ADD 21CF76      7617        LXI H,XC       ;RESET CURSOR POSTION
2AE0 34          7618        INR M
2AE1 CD0225      7619        CALL SETCP
2AE4 C9          7620        RET
```

```
                7621
                7622
                7623
                7624
                7625 ;---------- CURSOR POSITIONING SUBROUTINES
                7626
                7627 ;--- SET CURSOR POSITION
2AE5 E5         7628 SETXY:  PUSH H
2AE6 C5         7629         PUSH B
                7630
2AE7 CDFE2A     7631         CALL SETXC
2AEA CD622B     7632         CALL SETYC
2AED CDD225     7633         CALL SETCP
                7634
2AF0 C1         7635         POP B
2AF1 E1         7636         POP H
2AF2 C9         7637         RET
                7638
                7639
                7640
                7641
                7642 ;--- INDICATE BLANK FIELD WITH UNDERSCORES
                7643
2AF3 47         7644 BLANKS: MOV B,A
2AF4 3E5F       7645 BLNK0:  MVI A,05FH      ; A 5FH IS A ASCII UNDERSCORE
2AF6 CD2526     7646         CALL DCH
2AF9 05         7647         DCR B
2AFA C2F42A     7648         JNZ BLNK0
2AFD C9         7649         RET
                7650
                7651
                7652
                7653 ;--- SET X COORDINATE
2AFE 2ACD76     7654 SETXC:  LHLD DPTR
2B01 0E00       7655         MVI C,DX
2B03 CD0C25     7656         CALL FETCH
2B06 5F         7657         MOV E,A
2B07 E680       7658         ANI 80H
2B09 C2112B     7659         JNZ SETX2
                7660
2B0C 7B         7661         MOV A,E
2B0D 32CF76     7662 SETX0:  STA XC
2B10 C9         7663 SETX1:  RET
                7664
2B11 7B         7665 SETX2:  MOV A,E         ;DISPATCH ON CODE SPECIFYING X COORDINATE
2B12 E6F0       7666         ANI 0F0H
                7667
2B14 FE80       7668         CPI XCC         ;USE CURRENT XCOORD.
2B16 CA102B     7669         JZ SETX1
                7670
2B19 FE90       7671         CPI CENTER      ;CENTER TEXT
2B1B CA2B2B     7672         JZ SETX3
                7673
2B1E FEB0       7674         CPI TABC        ;USE TAB SPECIFIED BY TABCTR
2B20 CA4F2B     7675         JZ SETX4
                7676
2B23 FEA0       7677         CPI TABI        ;TAB IMMEDIATE USING TAB STOP IN BITS 0-3
2B25 CA552B     7678         JZ SETX5
2B28 C3102B     7679         JMP SETX1
                7680
                7681
                7682
                7683 ;-- CENTER TEXT
2B2B 2ACD76     7684 SETX3:  LHLD DPTR
```

```
2B2E 0E03        7685          MVI C,DTYPE
2B30 CD0C25      7686          CALL FETCH
2B33 0C          7687          INR C
2B34 FE00        7688          CPI TEXT
2B36 C2102B      7689          JNZ SETX1
2B39 1E00        7690          MVI E,0
2B3B CD0C25      7691 SETX30:  CALL FETCH
2B3E FEFF        7692          CPI ENDTXT
2B40 CA482B      7693          JZ SETX31
2B43 0C          7694          INR C
2B44 1C          7695          INR E
2B45 C33B2B      7696          JMP SETX30
                 7697
2B48 3E50        7698 SETX31:  MVI A,80
2B4A 93          7699          SUB E
2B4B 0F          7700          RRC
2B4C C3002B      7701          JMP SETX0
                 7702
                 7703
                 7704 ;— TAB VIA TABCTR
2B4F 2ACC76      7705 SETX4:   LDA TABCTR
2B52 C3582B      7706          JMP SETX5A
                 7707
                 7708 ;— TAB IMMEDIATE
2B55 7B          7709 SETX5:   MOV A,E
2B56 E60F        7710          ANI 0FH
                 7711
2B58 4F          7712 SETX5A:  MOV C,A
2B59 214D26      7713          LXI H,TABTAB
2B5C CD0C25      7714          CALL FETCH
2B5F C3002B      7715          JMP SETX0
                 7716
                 7717
                 7718
                 7719 ;————————————  SET Y COORDINATE
2B62 C5          7720 SETYC:   PUSH B
2B63 E5          7721          PUSH H
                 7722
2B64 2ACD76      7723          LHLD DPTR
2B67 0E01        7724          MVI C,DY
2B69 CD0C25      7725          CALL FETCH
                 7726
2B6C 5F          7727          MOV E,A
2B6D E680        7728          ANI 80H
2B6F C2792B      7729          JNZ SETY2
2B72 7B          7730          MOV A,E
                 7731
2B73 32D076      7732 SETY0:   STA YC
2B76 E1          7733 SETY1:   POP H
2B77 C1          7734          POP B
2B78 C9          7735          RET
                 7736
                 7737
                 7738
2B79 7B          7739 SETY2:   MOV A,E          ;USE CURRENT Y COORD.
2B7A FE30        7740          CPI YCC
2B7C CA762B      7741          JZ SETY1
                 7742
2B7F FE90        7743          CPI YNXT         ;STEP TO NEXT LINE
2B81 CA872B      7744          JZ SETY3
2B84 C3762B      7745          JMP SETY1
                 7746
2B87 21D076      7747 SETY3:   LXI H,YC
2B8A 34          7748          INR M
```

```
2B88 C3742B      7749        JMP SETP1
                 7750
                 7751
                 7752
                 7753
                 7754
                 7755
                 7756
                 7757 ;DISPLAY ERROR MESSAGE FOR 2 SECONDS
2B8B 2ACD76      7758 DPYERR: LHLD DPTR
2B91 E5          7759        PUSH H
2B92 D5          7760        PUSH D
2B93 F5          7761        PUSH PSW
                 7762
2B94 11AD2B      7763        LXI D,EMSG0
2B97 CD5B26      7764        CALL DISPLAY
2B9A F1          7765        POP PSW
2B9B D1          7766        POP D
2B9C CD5B26      7767        CALL DISPLAY
                 7768
2B9F CD4226      7769 DPYER0: CALL GCH1B
                 7770
2BA2 11CA2B      7771        LXI D,ERRXX
2BA5 CD5B26      7772        CALL DISPLAY
                 7773
2BA8 E1          7774        POP H
2BA9 22CD76      7775        SHLD DPTR
2BAC C9          7776        RET
                 7777
                 7778
                 7779
2BAD 00          7780 EMSG0:  DB 0,15,DPY,TEXT
2BAE 0F
2BAF 00
2BB0 00
2BB1 4552524F    7781        DB 'ERROR:',REP,31,' ','-- TOUCH SCREEN'
2BB5 523A
2BB7 81
2BB8 1F
2BB9 20
2BBA 2D2D2054
2BBE 4F554348
2BC2 20534352
2BC6 45454E
2BC9 FF          7782        DB ENDTXT
                 7783
                 7784
2BCA 00          7785 ERRXX:  DB 0,15
2BCB 0F
2BCC 03          7786        DB ERASE
2BCD 01          7787        DB 1,EOL
2BCE 80
                 7788
                 7789
                 7790
                 7791 ;----- TIME DELAY -- [HL] HAS NO. OF MILLESONDS
                 7792 WAIT:
2BCF 7D          7793        MOV A,L
2BD0 B4          7794        ORA H
2BD1 C8          7795        RZ
                 7796
2BD2 3E8C        7797        MVI A,140
2BD4 3D          7798 WAIT0:  DCR A
2BD5 C2D42B      7799        JNZ WAIT0       ;SAID TO BE 1 MILLESECOND
```

```
                7800
2BD8 2B         7801        DCX H
2BD9 C3CF2B     7802        JMP WAIT
                7803
                7804
                7805
                7806 ;ROUTINE TO DISPLAY A DASH CODE
                7807 ;ON ENTRY, A CONTAINS THE STATION #
                7808 ;B CONTAINS THE STARTING X COORDINATE
                7809 ;HL CONTAINS OFFSET FROM RAMPTR TO DESIRED DATA
                7810
2BDC E5         7811 DPYSC:  PUSH H
2BDD C5         7812        PUSH B
2BDE CD3203     7813        CALL SETSTN
2BE1 2A4D72     7814        LHLD PRMPTR
2BE4 0E24       7815        MVI C,CHNCNT    ;GET CHANNEL COUNT
2BE6 CD0C25     7816        CALL FETCH
2BE9 5F         7817        MOV E,A
2BEA 0E26       7818        MVI C,SCNCNT    ;GET SCAN ZONE COUNTS
2BEC CD0C25     7819        CALL FETCH
2BEF A7         7820        ANA A
2BF0 C2F62B     7821        JNZ DMAP6
2BF3 C1         7822        POP B
2BF4 E1         7823        POP H
2BF5 C9         7824        RET
2BF6 57         7825 DMAP6:  MOV D,A
2BF7 C1         7826        POP B           ;GET START COORDINATE
2BF8 C5         7827        PUSH B
2BF9 78         7828        MOV A,B
2BFA 3C         7829        INR A
2BFB 3C         7830        INR A
2BFC 32CF76     7831        STA XC
2BFF 3E06       7832        MVI A,6
2C01 32D076     7833        STA YC
2C04 CDD225     7834        CALL SETCP      ;SET INITIAL CURSOR POSITION
2C07 7B         7835        MOV A,E
2C08 C630       7836        ADI 30H
2C0A CD2526     7837 DMAP1:  CALL DCH        ;OUTPUT CHANNEL LABELS
2C0D 47         7838        MOV B,A
2C0E 3E20       7839        MVI A,' '
2C10 CD2526     7840        CALL DCH
2C13 78         7841        MOV A,B
2C14 3D         7842        DCR A
2C15 FE30       7843        CPI 30H
2C17 C20A2C     7844        JNZ DMAP1
2C1A C1         7845        POP B
2C1B 78         7846        MOV A,B
2C1C 32CF76     7847        STA XC
2C1F 2A4B72     7848        LHLD RAMPTR
2C22 C1         7849        POP B           ;OFFSET TO SCANNER DATA
2C23 09         7850        DAD B
2C24 22B376     7851        SHLD TEMP       ;SAVE BUFFER START
2C27 21D076     7852 DMAP2:  LXI H,YC        ;NOW DISPLAY ZONE AND VALUES
2C2A 34         7853        INR M
2C2B CDD225     7854        CALL SETCP
2C2E 15         7855        DCR D
2C2F 7A         7856        MOV A,D
2C30 C630       7857        ADI 30H
2C32 CD2526     7858        CALL DCH
2C35 3E20       7859        MVI A,' '
2C37 CD2526     7860        CALL DCH
2C3A 2AB376     7861        LHLD TEMP       ;SCANNER DATA START
2C3D 4A         7862        MOV C,D
2C3E 09         7863        DAD B
```

```
2C3F 43          7864          MOV B,E        ;GET VALUE
2C40 AF          7865          XRA A
2C41 37          7866          STC
2C42 17          7867 DMAP3:   RAL
2C43 05          7868          DCR B
2C44 C2422C      7869          JNZ DMAP3
2C47 43          7870          MOV B,E
2C48 F5          7871 DMAP4:   PUSH PSW       ;SAVE CHANNEL MASK
2C49 A6          7872          ANA M
2C4A 3E58        7873          MVI A,'X'
2C4C C2512C      7874          JNZ DMAP5
2C4F 3E20        7875          MVI A,' '
2C51 CD2526      7876 DMAP5:   CALL DCH
2C54 3E20        7877          MVI A,' '
2C56 CD2526      7878          CALL DCH
2C59 F1          7879          POP PSW
2C5A 0F          7880          RRC
2C5B 05          7881          DCR B
2C5C C2482C      7882          JNZ DMAP4
2C5F 7A          7883          MOV A,D
2C60 A7          7884          ANA A
2C61 C2272C      7885          JNZ DMAP2
2C64 3C          7886          INR A          ;SET NON-ZERO RETURN
2C65 C9          7887          RET
                 7888
                 7889
                 7890
                 7891
                 7892 ;-----------------------------------------------------------
                 7893 ;-----------------------------------------------------------
                 7894
                 7895
                 7896 ;---------------- TRANSPORT TEST
                 7897
2C66 CD8A08      7898 TEST:    CALL XPTON     ;TURN ON TRANSPORT
                 7899
2C69 3AD776      7900 TEST1:   LDA CLKTME
2C6C 11862C      7901          LXI D,TXT2
2C6F CD5B26      7902          CALL DISPLAY
                 7903
2C72 CD3126      7904          CALL GCH       ;STRIKE ANY KEY TO HALT
2C75 CA692C      7905          JZ TEST1
2C78 FE23        7906          CPI 35
2C7A C2692C      7907          JNZ TEST1
2C7D CD4526      7908          CALL BELL
                 7909
2C80 CDAD08      7910          CALL XPTOFF    ;TURN OFF TRANSPORT
2C83 C36E22      7911          JMP DIAG0A
                 7912
                 7913
                 7914
LOC  OBJ         LINE        SOURCE STATEMENT

2C86 28          7915 TXT2:    DB 40,2
2C87 02
2C88 00          7916          DB DPY,DECIMAL
2C89 02
2C8A 03          7917          DB 3,0,99
2C8B 00
2C8C 63
                 7918
                 7919
                 7920
                 7921
```

```
                 ;==================================================================
                 ;
                 ;                    * * *  FIXED ADDRESS TABLES * * *
                 ;
                 ;
                 ;==================================================================
                 
                 
                 
                 ;------- POINTERS TO STATION CONTROL BLOCKS
2C8D 5672        RAMTAB: DW SCB0
2C8F 9C72                DW SCB1
2C91 E272                DW SCB2
2C93 2873                DW SCB3
2C95 6E73                DW SCB4
2C97 B473                DW SCB5
2C99 FA73                DW SCB6
2C9B 4074                DW SCB7
2C9D 8674                DW SCB8
2C9F CC74                DW SCB9
2CA1 1275                DW SCB10
2CA3 5875                DW SCB11
2CA5 9E75                DW SCB12
2CA7 E475                DW SCB13
2CA9 2A76                DW SCB14
                 
                 
                 ;----------------- POINTERS TO PARAMETER BLOCKS IN C-PROM
2CAB 0005        DVTB:   DW PBENV        ;PARAMETER BLOCK, ENVELOPE FEEDER
2CAD 3001                DW PBF1         ;PARAMETER BLOCK, FEEDER 1
2CAF 9001                DW PBF2         ; .. ETC. ..
2CB1 E001                DW PBF3
2CB3 4002                DW PBF4
2CB5 9002                DW PBF5
2CB7 F002                DW PBF6
2CB9 4003                DW PBF7
2CBB A003                DW PBF8
2CBD F003                DW PBF9
2CBF 5004                DW PBF10
2CC1 A004                DW PBF11
2CC3 0C00                DW PBF0         ;CONTROL DOC. FEEDER
2CC5 0C05                DW MTRPOS       ;ACCESSORY
                 
                 
                 
                 
                 ;------------ MEMORY MAPPED I/O TABLE
                 
2CC7 0081        MMIOTB: DW 8100H        ;ENVELOPE FEEDER -- DATA
2CC9 1081        MMIOT1  DW 8110H        ;    "      "    -- CMD/STATUS
2CCB 0082                DW 8200H        ; N/A
2CCD 1082                DW 8210H        ; N/A
                 
2CCF 0181                DW 8101H        ;FEEDER NO. 1 -- DATA
2CD1 1181                DW 8111H        ;    "         -- CMD/STATUS
2CD3 0182                DW 8201H        ;SCANNER NO. 1 -- DATA
2CD5 1182                DW 8211H        ;    "         -- CMD/STATUS
                 
2CD7 0281                DW 8102H        ;FEEDER NO. 2
2CD9 1281                DW 8112H
2CDB 0282                DW 8202H
2CDD 1282                DW 8212H
                 
```

```
2CDF 0381        DW 8103H        ;FEEDER NO. 3
2CE1 1381        DW 8113H
2CE3 0382        DW 8203H
2CE5 1382        DW 8213H

2CE7 0481        DW 8104H        ;FEEDER NO. 4
2CE9 1481        DW 8114H
2CEB 0482        DW 8204H
2CED 1482        DW 8214H

2CEF 0581        DW 8105H        ;FEEDER NO. 5
2CF1 1581        DW 8115H
2CF3 0582        DW 8205H
2CF5 1582        DW 8215H

2CF7 0681        DW 8106H        ;FEEDER NO. 6
2CF9 1681        DW 8116H
2CFB 0682        DW 8206H
2CFD 1682        DW 8216H

2CFF 0781        DW 8107H        ;FEEDER NO. 7
2D01 1781        DW 8117H
2D03 0782        DW 8207H
2D05 1782        DW 8217H

2D07 0881        DW 8108H        ;FEEDER NO. 8
2D09 1881        DW 8118H
2D0B 0882        DW 8208H
2D0D 1882        DW 8218H

2D0F 0981        DW 8109H        ;FEEDER NO. 9
2D11 1981        DW 8119H
2D13 0982        DW 8209H
2D15 1982        DW 8219H

2D17 0181        DW 8101H        ;FEEDER NO. 10
2D19 1A81        DW 811AH
2D1B 0A82        DW 820AH
2D1D 1A82        DW 821AH

2D1F 0B81        DW 810BH        ;FEEDER NO. 11
2D21 1B81        DW 811BH
2D23 0B82        DW 820BH
2D25 1B82        DW 821BH

2D27 0C81        DW 810CH        ;FEEDER NO. 12
2D29 1C81        DW 811CH
2D2B 0C82        DW 820CH
2D2D 1C82        DW 821CH

2D2F 0084        ACDATA: DW 8400H        ;ACCESSORY
2D31 1084        ACCMND: DW 8410H
2D33 0082        DW 8200H        ;N/A
2D35 1082        DW 8210H        ;N/A

                 ;---------------  DEFINITIONS FOR ERROR TABLE

0080             HB EQU 80H      ;HALT TRANSPORT
0020             FB EQU 20H      ;FEEDER ERROR
0010             RB EQU 10H      ;RESET FEEDER

                 ;---------------  ERROR TABLE
```

```
                8050 ERRTAB:
                8051
                8052 ------- FEEDER ERRORS
                8053
0000            8054 ERRJAM  EQU 0                  ;JAM — ERROR NUMBER
2D37 B1         8055         DB      HB+FB+RB+1             ;    — ERROR CONTROL CODE
2D38 00         8056         DB      0                      ;    — ACCESSORY CODE
2D39 01         8057         DB      L1                     ;    — MESSAGE NUMBERS FOR DISPLAY
2D3A 01
                8058
0001            8059 ERRDBL  EQU 1                  ;DOUBLE
2D3B B2         8060         DB      HB+FB+RB+2
2D3C 1E         8061         DB      ACDBL
2D3D 01         8062         DB      L2
2D3E 02
                8063
0002            8064 ERRFTF  EQU 2                  ;FAIL TO FEED
2D3F B2         8065         DB      HB+FB+RB+2
2D40 20         8066         DB      ACFTF
2D41 01         8067         DB      L3
2D42 03
                8068
0003            8069 ERRLTF  EQU 3                  ;LATE FEED
2D43 B2         8070         DB      HB+FB+RB+2
2D44 22         8071         DB      ACLTF
2D45 01         8072         DB      L4
2D46 04
                8073
                8074 ;---------- 4                   ;THROAT OPENER/LEDGE FINGERS
2D47 B1         8075         DB      HB+FB+RB+1
2D48 00         8076         DB      0
2D49 01         8077         DB      L5
2D4A 05
                8078
                8079 ;---------- 5          ;SPARE
2D4B B1         8080         DB      HB+FB+RB+1
2D4C 00         8081         DB      0
2D4D 01         8082         DB      L6
2D4E 06
                8083
                8084 ;---------- 6          ;THREAD SW
2D4F B1         8085         DB      HB+FB+RB+1
2D50 00         8086         DB      0
2D51 01         8087         DB      L7
2D52 07
                8088
                8089 ;---------- 7          ;TWO UP
2D53 B1         8090         DB      HB+FB+RB+1
2D54 00         8091         DB      0
2D55 01         8092         DB      L8
2D56 08
                8093
0008            8094 ERRFNR  EQU 8          ;FEEDER NOT READY
2D57 B1         8095         DB      HB+FB+RB+1
2D58 00         8096         DB      0
2D59 01         8097         DB      L9
2D5A 09
                8098
                8099 ;------------- SCANNER ERRORS
0009            8100 ERRBMK  EQU 9          ;BENCHMARK ERROR
2D5B B1         8101         DB      HB+FB+1
2D5C 00         8102         DB      0
2D5D 01         8103         DB      L10
2D5E 0A
```

```
                8104
000A            8105 ERRSAF  EQU 10          ;SAFETY MISSING
2D5F A1         8106         DB      HB+FB+1
2D60 00         8107         DB      0
2D61 01         8108         DB      1,11
2D62 0B
                8109
000B            8110 ERRMCH  EQU 11          ;MISMATCH
2D63 22         8111         DB      FB+2
2D64 18         8112         DB      ACMDE
2D65 01         8113         DB      1,12
2D66 0C
                8114
                8115 ;------------ FEED COUNT ERRORS
                8116
000C            8117 ERRCVF  EQU 12          ;COUNT VERIFY
2D67 22         8118         DB      FB+2
2D68 16         8119         DB      ACCVE
2D69 01         8120         DB      1,13
2D6A 0D
                8121
000D            8122 ERRCOV  EQU 13          ;FEED COUNT OVERFLOW
2D6B A1         8123         DB      HB+FB+1
2D6C 00         8124         DB      0
2D6D 01         8125         DB      1,14
2D6E 0E
                8126
000E            8127 ERRFCT  EQU 14          ;FEED COUNT ERROR
2D6F A1         8128         DB      HB+FB+1
2D70 00         8129         DB      0
2D71 01         8130         DB      1,15
2D72 0F
                8131
                8132 ;--------- TRANSPORT HALT CONDITIONS
                8133
000F            8134 ERRTNR  EQU 15          ; TRANSPORT NOT READY
2D73 A0         8135         DB      HB+FB
2D74 00         8136         DB      0
2D75 01         8137         DB      1,19
2D76 13
                8138
0010            8139 HLTACL  EQU 16          ;ALL CLEAR
2D77 90         8140         DB      HB
2D78 00         8141         DB      0
2D79 02         8142         DB      2,0
2D7A 00
                8143
0011            8144 HLTSSM  EQU 17          ;SINGLE STEP MODE
2D7B 90         8145         DB      HB
2D7C 00         8146         DB      0
2D7D 03         8147         DB      3,0
2D7E 00
                8148
0012            8149 HLTKBD  EQU 18          ;KEYBOARD HALT REQUEST
2D7F 90         8150         DB      HB
2D80 00         8151         DB      0
2D81 04         8152         DB      4,0
2D82 00
                8153
0013            8154 HLTEHS  EQU 19          ;EMERGENCY HALT SWITCH
2D83 90         8155         DB      HB
2D84 00         8156         DB      0
2D85 05         8157         DB      5,0
2D86 00
```

```
                8158
0014            8159 HLTPB1  EQU 20          ;LOWER POSTAGE BREAK
2D87 22         8160         DB FB+2
2D88 1A         8161         DB ACBRK1
2D89 01         8162         DB 1,16
2D8A 10
                8163
0015            8164 HLTPB2  EQU 21          ;UPPER POSTAGE BREAK
2D8B 22         8165         DB FB+2
2D8C 1C         8166         DB ACBRK2
2D8D 01         8167         DB 1,17
2D8E 11
                8168
0016            8169 ERRACC  EQU 22          ;ACCESSORY JAM
2D8F 98         8170         DB HB+RB+FB
2D90 00         8171         DB 0
2D91 01         8172         DB 1,18
2D92 12
                8173
0017            8174 HLTDCD  EQU 23          ;DASH CODE HALT
2D93 A0         8175         DB HB+FB
2D94 00         8176         DB 0
2D95 01         8177         DB 1,20
2D96 14
                8178
                8179
                8180
                8181
                8182 ;=================================================================
                8183 ;
                8184 ;                        * * * SCREEN DISPLAY ELEMENTS * * *
                8185 ;
                8186 ;
                8187 ;=================================================================
                8188
                8189 ;==================  SCREEN 0 = MAIN MENU
                8190
                8191
                8192
                8193
                8194
                8195
                8196
                8197
                8198 ;=================== SCREEN 1= HALT SCREEN
                8199
                8200
                8201
                8202
                8203 ;--- MENU PROMPT
2D97 18         8204 S1P0:   DB 16,12
2D98 0C
2D99 00         8205         DB DPY,TEXT
2D9A 00
2D9B 204F4E45   8206         DB ' ONE',SKIP,22,'CHANGE',SKIP,21
2D9F 82
2DA0 16
2DA1 4348414E
2DA5 4745
2DA7 92
2DA8 15
2DA9 53544152   8207         DB 'START',XX
2DAD 54
2DAE 80
```

```
2DAF 4359434C    8208          DB 'CYCLE',SKIP,22,'SET-UP'
2DB3 45
2DB4 82
2DB5 16
2DB6 5345542D
2DBA 5550
2DBC FF          8209          DB ENDTXT
                 8210
                 8211
                 8212 ;BOXES FOR SCREEN 1
2DBD 0A          8213 S1B1:    DB 10,8
2DBE 08
2DBF 00          8214          DB DPY.BOXES
2DC0 06
2DC1 0A          8215          DB X3Y3,1,1
2DC2 01
2DC3 01
                 8216
2DC4 0A          8217 S1B11:   DB 10,10
2DC5 0A
2DC6 00          8218          DB DPY.BOXES
2DC7 06
2DC8 05          8219          DB X2Y2,1,1
2DC9 01
2DCA 01
                 8220
2DCB 22          8221 S1B2:    DB 34,10
2DCC 0A
2DCD 00          8222          DB DPY.BOXES
2DCE 06
2DCF 05          8223          DB X2Y2,1,1
2DD0 01
2DD1 01
                 8224
2DD2 35          8225 S1B3:    DB 53,8
2DD3 08
2DD4 00          8226          DB DPY.BOXES
2DD5 06
2DD6 0A          8227          DB X3Y3,1,1
2DD7 01
2DD8 01
                 8228
2DD9 3C          8229 S1B31:   DB 60,10
2DDA 0A
2DDB 00          8230          DB DPY.BOXES
2DDC 06
2DDD 05          8231          DB X2Y2,1,1
2DDE 01
2DDF 01
                 8232
                 8233
2DE0 0E          8234 S1REM:   DB 14,16
2DE1 10
2DE2 00          8235          DB DPY.TEXT
LOC  OBJ         LINE        SOURCE STATEMENT

2DE3 00
2DE4 1B          8236          DB 1BH,5BH,'5',6DH
2DE5 5B
2DE6 35
2DE7 6D
2DE8 3C534552    8237          DB '<SERVICE REMINDER> PLEASE CALL YOUR LOCAL BRANCH'
2DEC 56494345
2DF0 2052454D
```

```
2DF4 494E4445
2DF8 523E2050
2DFC 4C454153
2E00 45204341
2E04 4C4C2059
2E08 4F555220
2E0C 4C4F4341
2E10 4C204252
2E14 414E4348
2E18 1B          8238        DB 1BH,5BH,'0',6DH
2E19 5B
2E1A 30
2E1B 6D
2E1C FF          8239        DB ENDTXT
                 8240
                 8241
                 8242
                 8243
2E1D 90          8244 S1P1:  DB CENTER,15
2E1E 0F
2E1F 00          8245        DB DPY,TEXT
2E20 00
2E21 544F5543    8246        DB 'TOUCH SCREEN TO HALT'
2E25 48205343
2E29 5245454E
2E2D 20544F20
2E31 48414C54
2E35 FF          8247        DB ENDTXT
                 8248
                 8249
                 8250
                 8251
2E36 00          8252 S1T4:  DB 0,2
2E37 02
2E38 00          8253        DB DPY,TEXT
2E39 00
2E3A 1B          8254        DB 1BH,5BH,'5',6DH
2E3B 5B
2E3C 35
2E3D 6D
2E3E 81          8255        DB REP,78,'*',1BH,5BH,6DH
2E3F 4E
2E40 2A
2E41 1B
2E42 5B
2E43 6D
2E44 0D          8256        DB XX,XX,XX,XX
2E45 0D
2E46 0D
2E47 0D
2E48 1B          8257        DB 1BH,5BH,'5',6DH
2E49 5B
2E4A 35
2E4B 6D
2E4C 81          8258        DB REP,78,'*',1BH,5BH,6DH
2E4D 4E
2E4E 2A
2E4F 1B
2E50 5B
2E51 6D
2E52 FF          8259        DB ENDTXT
                 8260
2E53 00          8261 S1T5:  DB 0,4
2E54 04
```

```
2E55 00          8262          DB DPY,TEXT
2E56 00
2E57 20202020    8263          DB '       FEEDER    - ',ENDTXT
2E5B 20202046
2E5F 45454445
2E63 52202020
2E67 202D20
2E6A FF
2E6B 00          8264 SET2X:   DB 0,0
2E6C 00
2E6D 00          8265          DB DPY,TEXT
2E6E 00
2E6F 1B          8266          DB 1BH,5BH,'1',70H
2E70 5B
2E71 31
2E72 70
2E73 1B          8267          DB 1BH,5BH,'1',6DH
2E74 5B
2E75 31
2E76 6D
2E77 FF          8268          DB ENDTXT
                 8269
2E78 00          8270 END2X:   DB 0,0
2E79 00
2E7A 00          8271          DB DPY,TEXT
2E7B 00
2E7C 1B          8272          DB 1BH,5BH,6DH
2E7D 5B
2E7E 6D
2E7F 1B          8273          DB 1BH,5BH,70H
2E80 5B
2E81 70
2E82 FF          8274          DB ENDTXT
                 8275
                 8276
                 8277
2E83 00          8278 S1EERR:  DB 0,2
2E84 02
2E85 03          8279          DB ERASE,5,EOL
2E86 05
2E87 00
                 8280
2E88 0A          8281 S1ET1:   DB 10,8
2E89 08
2E8A 03          8282          DB ERASE,1,EOL
2E8B 01
2E8C 00
                 8283
2E8D 0A          8284 S1EP1:   DB 10,14
2E8E 0E
2E8F 03          8285          DB ERASE,1,EOL
2E90 01
2E91 00
                 8286
                 8287
                 8288
                 8289 ;---------- ARRAY 0 - MACHINE STATE
                 8290
                 8291 ;--- FIELD NAMES
                 8292
2E92 3C          8293 S1F0:    DB 60,1
2E93 01
2E94 00          8294          DB DPY,TEXT
2E95 00
```

```
2E96 434F554E    8295        DB 'COUNT:',XX
2E9A 543A
2E9C 00
2E9D FF          8296        DB ENDTXT
                 8297
                 8298
                 8299
                 8300
                 8301 ;---- ARRAY ELEMENTS
                 8302
                 8303
                 8304 ;-- COUNT
2E9E 44          8305 S1A0X2: DB 68,1
2E9F 01
2EA0 00          8306        DB DPY,XDEC
2EA1 03
2EA2 05          8307        DB 5
                 8308
                 8309
                 8310
                 8311
                 8312 ;---------------- ERROR SCREEN DISPLAY ELEMENTS
                 8313
                 8314
                 8315
                 8316 ;-- OFFENDING STATION
2EA3 0F          8317 S1A1X1: DB 15,4
2EA4 04
2EA5 00          8318        DB DPY,DECIMAL
2EA6 02
2EA7 02          8319        DB 2
                 8320
                 8321 ;-- ERROR:
2EA8 14          8322 S1A1X2: DB 20,4
2EA9 04
2EAA 00          8323        DB DPY,VTEXT
2EAB 01
2EAC 14          8324        DB 20
                 8325
2EAD 20202020    8326        DB '    ',XX
2EB1 20
2EB2 00
2EB3 4A414D2F    8327        DB 'JAM/INTERLOCK',XX
2EB7 494E5445
2EBB 524C4F43
2EBF 4B
2EC0 00
2EC1 444F5542    8328        DB 'DOUBLE',XX
2EC5 4C45
2EC7 00
2EC8 4641494C    8329        DB 'FAIL TO FEED',XX
2ECC 20544F20
2ED0 46454544
2ED4 00
2ED5 4C415445    8330        DB 'LATE FEED',XX
2ED9 20464545
2EDD 44
2EDE 00
                 8331
2EDF 5448524F    8332        DB 'THROAT OPENER',XX
2EE3 4154204F
2EE7 50454E45
2EEB 52
2EEC 00
```

```
2EED 42495420    8333        DB 'BIT 5  (SPARE)',XX
2EF1 35202028
2EF5 53504152
2EF9 4529
2EFB 0D
2EFC 54495245    8334        DB 'THREAD SWITCH',XX
2F00 41442053
2F04 57495443
2F08 48
2F09 0D
2F0A 54574F20    8335        DB 'TWO UP',XX
2F0E 5550
2F10 0D
2F11 46454544    8336        DB 'FEEDER NOT READY',XX
2F15 4552204E
2F19 4F542052
2F1D 45414459
2F21 0D
                 8337
2F22 42454E43    8338        DB 'BENCH MARK',XX
2F26 48204D41
2F2A 524B
2F2C 0D
2F2D 53414645    8339        DB 'SAFETY',XX
2F31 5459
2F33 0D
2F34 4D415443    8340        DB 'MATCH CODE',XX
2F38 4820434F
2F3C 4445
2F3E 0D
2F3F 434F554E    8341        DB 'COUNT VERIFY',XX
2F43 54205645
2F47 52494659
2F4B 0D
                 8342
2F4C 4F564552    8343        DB 'OVERCOUNT',XX
2F50 434F554E
2F54 54
2F55 0D
2F56 46454544    8344        DB 'FEED COUNT',XX
2F5A 20434F55
2F5E 4E54
2F60 0D
2F61 4C4F5745    8345        DB 'LOWER POSTAGE BREAK',XX
2F65 5220504F
2F69 53544147
2F6D 45204252
2F71 45414B
2F74 0D
2F75 55505045    8346        DB 'UPPER POSTAGE BREAK',XX
2F79 5220504F
2F7D 53544147
2F81 45204252
2F85 45414B
2F88 0D
2F89 41434345    8347        DB 'ACCESSORY JAM',XX
2F8D 53534F52
2F91 59204A41
2F95 4D
2F96 0D
2F97 5452414E    8348        DB 'TRANSPORT NOT READY',XX
2F9B 53504F52
2F9F 54204E4F
2FA3 54205245
```

```
2FA7 414459
2FAA 0D
2FAB 44415348    8349          DB 'DASH CODE HALT',XX
2FAF 20434F44
2FB3 45204841
2FB7 4C54
2FB9 0D
2FBA FF          8350          DB ENDTXT
                 8351
                 8352
2FBB 28          8353 S1A1X3:  DB 40,4
2FBC 04
2FBD 00          8354          DB DPY,TEXT
2FBE 00
2FBF 53484F55    8355          DB 'SHOULD BE        WAS'
2FC3 4C442042
2FC7 45202020
2FCB 20202020
2FCF 20205741
2FD3 53
2FD4 FF          8356          DB ENDLST
                 8357
2FD5 32          8358 S1A1X4:  DB 50,4
2FD6 04
2FD7 00          8359          DB DPY,DECIMAL
2FD8 02
2FD9 03          8360          DB 3
                 8361
2FDA 42          8362 S1A1X5:  DB 66,4
2FDB 04
2FDC 00          8363          DB DPY,DECIMAL
2FDD 02
2FDE 03          8364          DB 3
                 8365
                 8366
2FDF 29          8367 S1A1X6:  DB 41,4
2FE0 04
2FE1 00          8368          DB DPY,TEXT
2FE2 00
2FE3 504F5349    8369          DB 'POSITION'
2FE7 54494F4E
2FEB FF          8370          DB ENDLST
                 8371
                 8372
                 8373
                 8374 ;------------  ARRAY 2 -  STATION STATUS
                 8375
                 8376 ;---- FIELD NAMES
2FEC 00          8377 S1F2:    DB 0,1,DPY,TEXT
2FED 01
2FEE 00
2FEF 00
2FF0 53544154    8378          DB 'STATION:',XX
2FF4 494F4E3A
2FF8 0D
2FF9 54595045    8379          DB 'TYPE:',XX
2FFD 3A
2FFE 0D
2FFF 52454C45    8380          DB 'SELECTABLE:',XX
3003 43544142
3007 4C453A
300A 0D
300B 53544154    8381          DB 'STATUS:',XX
300F 55533A
```

```
3012 0D
3013 41535349    8382          DB 'ASSIGNED:',XX
3017 474E4544
301B 3A
301C 0D
301D FF          8383          DB ENDTXT
                 8384
                 8385
301E A1          8386 S1EA2:   DB TABI+1,3
301F 03
3020 03          8387          DB ERASE,5,EOL
3021 05
3022 80
                 8388
                 8389
                 8390
                 8391
                 8392
                 8393 ;---- ARRAY ELEMENTS
                 8394
                 8395 ;-- STATION
3023 B0          8396 S1A2X0:  DB TABC,1       ;TABC MEANS USE TAB STOP INDICATED BY TABCTR
3024 01
3025 00          8397          DB DPY,DECIMAL
3026 02
3027 04          8398          DB 4
                 8399
                 8400 ;-- TYPE
3028 B0          8401 S1A2X1:  DB TABC,VNXT
3029 90
302A 00          8402          DB DPY,VTEXT
302B 01
302C 04          8403          DB 4
302D 20434446    8404          DB ' CDF',XX
3031 0D
3032 20534446    8405          DB ' SDF',XX
3036 0D
3037 204D4446    8406          DB ' MDF',XX
303B 0D
303C FF          8407          DB ENDTXT
                 8408
                 8409 ;-- SELECTABLE
303D B0          8410 S1A2X2:  DB TABC,VNXT
303E 90
303F 00          8411          DB DPY,VTEXT
3040 01
3041 04          8412          DB 4
3042 20204E4F    8413          DB '  NO',XX
3046 0D
3047 20594553    8414          DB ' YES',XX
3048 0D
304C FF          8415          DB ENDTXT
                 8416
                 8417 ;-- STATUS -- FOR SELECTABLE STATIONS
304D B0          8418 S1A2X3:  DB TABC,VNXT
304E 90
304F 01          8419          DB DYWRT,VTEXT
3050 01
3051 04          8420          DB 4
3052 204F4646    8421          DB ' OFF',XX
3056 0D
3057 20204F4E    8422          DB '  ON',XX
305B 0D
305C 2053454C    8423          DB ' SEL',XX
```

```
3060 00
3061 FF          8424          DB ENDTXT
                 8425
                 8426 ;-- ASSIGNED
3062 B0          8427 S1A2X4:  DB TABC,YNXT
3063 90
3064 00          8428          DB DPY,DECIMAL
3065 02
3066 04          8429          DB 4
                 8430
                 8431
                 8432
                 8433 ;------------ ARRAY 3
                 8434
                 8435 ;---- FIELD NAMES
3067 00          8436 S1F3:    DB 0,6
3068 06
3069 00          8437          DB DPY,TEXT
306A 00
306B 2D2D2D2D    8438          DB '---- STATION STATUS',XX
306F 20535441
3073 54494F4E
3077 20535441
307B 545553
307E 00
307F 454E4142    8439          DB 'ENABLED:',XX
3083 4C45443A
3087 00
3088 53454C45    8440          DB 'SELECTED:',XX
308C 43544544
3090 3A
3091 00
3092 46454544    8441          DB 'FEED COUNT:',XX
3096 20434F55
309A 4E543A
309D 00
309E 4D415443    8442          DB 'MATCH CODE:',XX
30A2 4820434F
30A6 44453A
30A9 00
30AA FF          8443          DB ENDTXT
                 8444
                 8445
                 8446 ;---- ERASE DATA
30AB A1          8447 S1EA3:   DB TABI+1,6
30AC 06
30AD 03          8448          DB ERASE,4,EOL
30AE 04
30AF 80
                 8449
                 8450
                 8451 ;---- ELEMENT DEFINITIONS
                 8452
                 8453 ;-- ENABLED
3080 B0          8454 S1A3X0:  DB TABC,7
3081 07
3082 00          8455          DB DPY,VTEXT
3083 01
3084 04          8456          DB 4
3085 20202020    8457          DB '    ',XX
3089 00
308A 2020202A    8458          DB '   *',XX
308E 00
308F FF          8459          DB ENDTXT
```

```
                8460
                8461 ;— SELECTED
30C0 B0         8462 S1A3X1: DB TABC,YNXT
30C1 90
30C2 00         8463         DB DPY,VTEXT
30C3 01
30C4 04         8464         DB 4
30C5 20202020   8465         DB '    ',XX
30C9 0D
30CA 2020202A   8466         DB '   *',XX
30CE 0D
30CF FF         8467         DB ENDTXT
                8468
                8469
                8470 ;— MATCH CODE
30D0 B0         8471 S1A3X3: DB TABC,YNXT
30D1 90
30D2 00         8472         DB DPY,HEX
30D3 04
30D4 04         8473         DB 4            ;2 HEX DIGITS
                8474
                8475
                8476
                8477 ;————————————— ARRAY 4
                8478
                8479 ;—— FIELD NAMES
30D5 00         8480 S1F4:   DB 0,11
30D6 0B
30D7 00         8481         DB DPY,TEXT
30D8 00
30D9 2D2D2D2D   8482         DB '——— PIECE STATUS',XX
30DD 2D2D2050
30E1 49454345
30E5 20535441
30E9 545553
30EC 0D
30ED 4552524F   8483         DB 'ERROR:',XX
30F1 523A
30F3 0D
30F4 46454544   8484         DB 'FEED COUNT:',XX
30F8 20434F55
30FC 4E543A
30FF 0D
3100 4D415443   8485         DB 'MATCH CODE:',XX
3104 4820434F
3108 44453A
310B 0D
310C 46454544   8486         DB 'FEED SELECT:',XX
3110 2053454C
3114 4543543A
3118 0D
3119 41434345   8487         DB 'ACCESSORY:',XX
311D 53534F52
3121 593A
3123 0D
3124 FF         8488         DB ENDTXT
                8489
                8490
3125 A1         8491 S1EA4:  DB TABI+1,11
3126 0B
3127 03         8492         DB ERASE,5,EOL
3128 05
3129 00
                8493
```

```
                8494
                8495
                8496 ;------ ELEMENT DEFINITIONS
                8497
                8498 ;-- ERROR
312A B0         8499 S1A4X0: DB TABC,12
312B 0C
312C 00         8500         DB DPY,DECIMAL
312D 02
312E 04         8501         DB 4
                8502
                8503
                8504 ;=============== SCREEN 2 = SYSTEM MAINTENANCE
                8505
                8506
                8507
312F 35         8508 SNUMB:  DB 53,2
3130 02
3131 00         8509         DB DPY,BOXES
3132 06
3133 0C         8510         DB X1Y15,3,4
3134 03
3135 04
                8511
3136 38         8512 SNUM:   DB 56,4
3137 04
3138 00         8513         DB DPY,TEXT
3139 00
313A 31         8514         DB '1',SKIP,6,'2',SKIP,6
313B 82
313C 06
313D 32
313E 82
313F 06
3140 33         8515         DB '3',XX,XX,XX
3141 00
3142 00
3143 00
3144 34         8516         DB '4',SKIP,6,'5',SKIP,6
3145 82
3146 06
3147 35
3148 82
3149 06
314A 36         8517         DB '6',XX,XX,XX
314B 00
314C 00
314D 00
314E 37         8518         DB '7',SKIP,6,'8',SKIP,6
314F 82
3150 06
3151 38
3152 82
3153 06
3154 39         8519         DB '9',XX,XX,XX
3155 00
3156 00
3157 00
3158 43         8520         DB 'C',SKIP,6,'0',SKIP,4
3159 82
315A 06
315B 30
315C 82
315D 04
```

```
315E 454E5445    8521          DB 'ENTER'
3162 52
3163 FF          8522          DB ENDTXT
                 8523
3164 26          8524 EXMES:   DB 38,13
3165 0D
3166 00          8525          DB DPY,TEXT
3167 00
3168 45584954    8526          DB 'EXIT'
316C FF          8527          DB ENDLST
                 8528
                 8529 ;------- MENU
316D 08          8530 S2P0:    DB 8,1
316E 01
316F 00          8531          DB DPY,TEXT
3170 00
3171 454E5445    8532          DB 'ENTER A CHOICE',XX,XX
3175 52204120
3179 43484F49
317D 4345
317F 0D
3180 0D
3181 312E2045    8533          DB '1. EXAMINE/MODIFY TIMING PROCESS',XX
3185 58414D49
3189 4E452F4D
318D 4F444946
3191 59205449
3195 4D494E47
3199 2050524F
319D 43455353
31A1 0D
31A2 322E2046    8534          DB '2. FEEDER DIAGNOSTICS',XX
31A6 45454445
31AA 52204449
31AE 41474E4F
31B2 53544943
31B6 53
31B7 0D
31B8 332E2053    8535          DB '3. SHOW STATUS',XX
31BC 484F5720
31C0 53544154
31C4 5553
31C6 0D
31C7 342E2056    8536          DB '4. VERIFY ENCODER',XX
31CB 45524946
31CF 5920454E
31D3 434F4445
31D7 52
31D8 0D
31D9 352E2053    8537          DB '5. SCANNER DIAGNOSTICS',XX
31DD 43414E4E
31E1 45522044
31E5 4941474E
31E9 4F535449
31ED 4353
31EF 0D
31F0 362E2044    8538          DB '6. DISPLAY LAST DASH CODE',XX
31F4 4953504C
31F8 4159204C
31FC 41535420
3200 44415348
3204 20434F44
3208 45
3209 0D
```

```
320A 372E2041    8539          DB '7. ACCESSORY DIAGNOSTICS'
320E 43434553
3212 534F5259
3216 20444941
321A 474E4F53
321E 54494353
3222 FF          8540          DB ENDTXT
                 8541
                 8542
3223 10          8543 S2BOX:   DB 16,2
3224 02
3225 00          8544          DB DPY,BOXES
3226 06
3227 00          8545          DB X1Y1,8,2
3228 08
3229 02
                 8546
322A 19          8547 S2AC1:   DB 25,9
322B 09
322C 00          8548          DB DPY,TEXT
322D 00
322E 494E5055    8549          DB 'INPUT',SKIP,25,'OUTPUT'
3232 54
3233 82
3234 19
3235 4F555450
3239 5554
323B FF          8550          DB ENDLST
                 8551
323C 13          8552 S2AC2:   DB 19,3
323D 03
323E 00          8553          DB DPY,TEXT
323F 00
3240 31          8554          DB '1',SKIP,6,'2',SKIP,6
3241 82
3242 06
3243 32
3244 82
3245 06
3246 33          8555          DB '3',SKIP,6,'4',SKIP,6
3247 82
3248 06
3249 34
324A 82
324B 06
324C 35          8556          DB '5',SKIP,6,'6',SKIP,6
324D 82
324E 06
324F 36
3250 82
3251 06
3252 37          8557          DB '7',SKIP,6,'8'
3253 82
3254 06
3255 38
3256 FF          8558          DB ENDLST
                 8559
3257 13          8560 S2AC21:  DB 19,5
3258 05
3259 00          8561          DB DPY,TEXT
325A 00
325B 39          8562          DB '9',SKIP,6,'10',SKIP,6
325C 82
325D 06
```

```
325E 3130
3260 82
3261 06
3262 3131        8563        DB '11',SKIP,6,'12',SKIP,6
3264 82
3265 06
3266 3132
3268 82
3269 06
326A 3133        8564        DB '13',SKIP,6,'14',SKIP,6
326C 82
326D 06
326E 3134
3270 82
3271 06
3272 3135        8565        DB '15',SKIP,6,'16'
3274 82
3275 06
3276 3136
3278 FF          8566        DB ENDLST
                 8567
3279 1C          8568 S2AC3:  DB 28,9
327A 09
327B 00          8569        DB DPY,TEXT
327C 00
327D 4F4E        8570        DB 'ON',SKIP,23,'OFF'
327F 82
3280 17
3281 4F4646
3284 FF          8571        DB ENDLST
                 8572
3285 0A          8573 S2C0:   DB 10,4
3286 04
3287 00          8574        DB DPY,TEXT
3288 00
3289 454E5445    8575        DB 'ENTER VALUE'
328D 52205641
3291 4C5545
3294 FF          8576        DB ENDTXT
                 8577
                 8578
                 8579
                 8580 ;================  SCREEN 3 = EXAMINE/MODIFY STATION PARAMETERS
                 8581
                 8582
                 8583
                 8584
                 8585 ;------- MENU
3295 0A          8586 S3B1:   DB 10,2
3296 02
3297 00          8587        DB DPY,BOXES
3298 06
3299 05          8588        DB X2Y2,1,1
329A 01
329B 01
                 8589
329C 3A          8590 S3B2:   DB 58,2
329D 02
LOC  OBJ         LINE       SOURCE STATEMENT

329E 00          8591        DB DPY,BOXES
329F 06
32A0 05          8592        DB X2Y2,1,1
```

```
32A1 01
32A2 01
                8593
32A3 00         8594 S3B3:   DB XCC,YCC
32A4 00
32A5 00         8595         DB DPY,BOXES
32A6 06
32A7 01         8596         DB X2Y1,3,1
32A8 03
32A9 01
                8597
32AA 00         8598 S3B4:   DB XCC,YCC
32AB 00
32AC 00         8599         DB DPY,BOXES
32AD 06
32AE 02         8600         DB X3Y1,1,1
32AF 01
32B0 01
                8601
32B1 00         8602 S3B41:  DB XCC,YCC
32B2 00
32B3 00         8603         DB DPY,BOXES
32B4 06
32B5 0F         8604         DB X4Y15,1,1
32B6 01
32B7 01
                8605
32B8 0A         8606 S3B5:   DB 10,12
32B9 0C
32BA 00         8607         DB DPY,BOXES
32BB 06
32BC 01         8608         DB X2Y1,5,1
32BD 05
32BE 01
                8609
32BF 00         8610 S3B6:   DB XCC,YCC
32C0 00
32C1 00         8611         DB DPY,BOXES
32C2 06
32C3 01         8612         DB X2Y1,1,1
32C4 01
32C5 01
                8613
32C6 00         8614 S3B7:   DB XCC,YCC
32C7 00
32C8 00         8615         DB DPY,BOXES
32C9 06
32CA 08         8616         DB X1Y3,1,1
32CB 01
32CC 01
                8617
32CD 18         8618 S3STD:  DB 24,13
32CE 0D
32CF 00         8619         DB DPY,TEXT
32D0 00
32D1 42414348   8620         DB 'BACK ONE',SKIP,26,'EXIT'
32D5 204F4E45
32D9 82
32DA 1A
32DB 45584954
32DF FF         8621         DB ENDLST
                8622
32E0 0C         8623 S3P00:  DB 12,4
32E1 04
```

```
32E2 00          8624          DB DPY,TEXT
32E3 00
32E4 53455155    8625          DB 'SEQUENCE',XX
32E8 454E4345
32EC 0D
32ED 20535441    8626          DB ' START'
32F1 5254
32F3 FF          8627          DB ENDTXT
                 8628
32F4 3F          8629 S3P01:   DB 63,4
32F5 04
32F6 00          8630          DB DPY,TEXT
32F7 00
32F8 434C4541    8631          DB 'CLEAR',XX
32FC 52
32FD 0D
32FE 4445434B    8632          DB 'DECK'
3302 FF          8633          DB ENDLST
                 8634
3303 0B          8635 S3P02:   DB 11,9
3304 09
3305 00          8636          DB DPY,TEXT
3306 00
3307 52455345    8637          DB 'RESET COUNT',SKIP,12
330B 5420434F
330F 554E54
3312 82
3313 0C
3314 52455345    8638          DB 'RESET MODE',SKIP,13
3318 54204D4F
331C 4445
331E 82
331F 0D
3320 52454153    8639          DB 'REASSIGN',SKIP,19
3324 5349474E
3328 82
3329 13
332A 44494147    8640          DB 'DIAGNOSITCS'
332E 4E4F5349
3332 544353
3335 FF          8641          DB ENDLST
                 8642
3336 0C          8643 S3P03:   DB 12,13
3337 0D
3338 00          8644          DB DPY,TEXT
3339 00
333A 204D4F44    8645          DB ' MODIFY',SKIP,12
333E 494659
3341 82
3342 0C
3343 454E434C    8646          DB 'ENCL STAT',SKIP,12
3347 20535441
334B 54
334C 82
334D 0C
334E 4D414348    8647          DB 'MACH CONF',SKIP,12
3352 20434F4E
3356 46
3357 82
3358 0C
3359 4241434B    8648          DB 'BACK ONE',SKIP,14
335D 204F4E45
3361 82
3362 0E
```

```
3363 45584954    8649          DB 'EXIT'
3367 FF          8650          DB ENDLST
                 8651
3368 16          8652 S3P1:    DB 22,5
3369 05
336A 00          8653          DB DPY,TEXT
336B 00
336C 4D4F4445    8654          DB 'MODE1',SKIP,30
3370 31
3371 82
3372 1E
3373 4D4F4445    8655          DB 'MODE2'
3377 32
3378 FF          8656          DB ENDLST
                 8657
3379 16          8658 S3P10:   DB 22,9
337A 09
337B 00          8659          DB DPY,TEXT
337C 00
337D 4D4F4445    8660          DB 'MODE3',SKIP,30
3381 33
3382 82
3383 1E
3384 4D4F4445    8661          DB 'MODE4'
3388 34
3389 FF          8662          DB ENDTXT
                 8663
338A 80          8664 S3P11:   DB XCC,YCC
338B 80
338C 00          8665          DB DPY,BOXES
338D 06
338E 01          8666          DB X2Y1,2,1
338F 02
3390 01
                 8667
3391 80          8668 S3P12:   DB XCC,YCC
3392 80
3393 00          8669          DB DPY,TEXT
3394 00
3395 42414348    8670          DB 'BACK ONE',SKIP,14,'EXIT'
3399 204F4E45
339D 82
339E 0E
339F 45584954
33A3 FF          8671          DB ENDLST
                 8672
33A4 17          8673 S3P2:    DB 23,2
33A5 02
33A6 00          8674          DB DPY,BOXES
33A7 06
33A8 04          8675          DB X1Y2,6,2
33A9 06
33AA 02
                 8676
33AB 1A          8677 S3P3:    DB 26,4
33AC 04
33AD 00          8678          DB DPY,TEXT
33AE 00
33AF 31          8679          DB '1',SKIP,6,'2',SKIP,6
33B0 82
33B1 06
33B2 32
33B3 82
```

```
33B4 06
33B5 33          8680          DB '3',SKIP,6,'4',SKIP,6
33B6 82
33B7 06
33B8 34
33B9 82
33BA 06
33BB 35          8681          DB '5',SKIP,6,'6',XX,XX
33BC 82
33BD 06
33BE 36
33BF 0D
33C0 0D
33C1 0D          8682          DB XX,XX
33C2 0D
33C3 37          8683          DB '7',SKIP,6,'8',SKIP,6
33C4 82
33C5 06
33C6 38
33C7 82
33C8 06
33C9 39          8684          DB '9',SKIP,6,'10',SKIP,6
33CA 82
33CB 06
33CC 3130
33CE 82
33CF 06
33D0 3131        8685          DB '11',SKIP,6,'12'
33D2 82
33D3 06
33D4 3132
33D6 FF          8686          DB ENDLST
                 8687
33D7 0B          8688 S3P4:    DB 11,2
33D8 02
33D9 00          8689          DB DPY,BOXES
33DA 06
33DB 04          8690          DB X1Y2,1,1
33DC 01
33DD 01
                 8691
33DE 40          8692 S3P41:   DB 64,2
33DF 02
33E0 00          8693          DB DPY,BOXES
33E1 06
33E2 04          8694          DB X1Y2,1,1
33E3 01
33E4 01
                 8695
33E5 0D          8696 S3P5:    DB 13,4
33E6 04
33E7 00          8697          DB DPY,TEXT
33E8 00
33E9 4F4646      8698          DB 'OFF',SKIP,54,'ON'
33EC 82
33ED 36
33EE 4F4E
33F0 FF          8699          DB ENDLST
                 8700
33F1 0C          8701 S3P6:    DB 12,12
33F2 0C
33F3 00          8702          DB DPY,TEXT
33F4 00
33F5 20434841    8703          DB ' CHANGE',SKIP,52,'EXIT',XX
```

```
33F9 4E4745
33FC 82
33FD 34
33FE 45584954
3402 00
3403 46554E43    8704          DB 'FUNCTIONS',ENDLST
3407 54494F4E
340B 53
340C FF
                 8705
                 8706
340D 0C          8707 S3P7:    DB 12,3
340E 03
340F 00          8708          DB DPY,TEXT
3410 00
3411 43          8709          DB 'C',XX
3412 00
3413 4C          8710          DB 'L',XX
3414 00
3415 45          8711          DB 'E',XX
3416 00
3417 41          8712          DB 'A',XX
3418 00
3419 52          8713          DB 'R'
341A FF          8714          DB ENDLST
                 8715
                 8716
341B 42          8717 S3P8:    DB 66,3
341C 03
341D 00          8718          DB DPY,TEXT
341E 00
341F 45          8719          DB 'E',XX
3420 00
3421 4E          8720          DB 'N',XX
3422 00
3423 54          8721          DB 'T',XX
3424 00
3425 45          8722          DB 'E',XX
3426 00
3427 52          8723          DB 'R'
3428 FF          8724          DB ENDLST
                 8725
                 8726
                 8727
                 8728
                 8729
3429 3E          8730 S3K1:    DB 62,15
342A 0F
342B 02          8731          DB KBIN,DECIMAL
342C 02
342D 02          8732          DB 2,1,99
342E 01
342F 63
                 8733
                 8734
3430 23          8735 S3LAB1:  DB 35,5
3431 05
3432 00          8736          DB DPY,TEXT
3433 00
3434 4C494E45    8737          DB 'LINE SPACE',SKIP,13
3438 20535041
343C 4345
343E 82
343F 00
```

```
3440 46454544    8738          DB 'FEED STOP',SKIP,11
3444 2053544F
3448 50
3449 82
344A 0B
344B 46454544    8739          DB 'FEED COUNT'
344F 20434F55
3453 4E54
3455 FF          8740          DB ENDLST
                 8741
3456 23          8742 S3LAB2:  DB 35,9
3457 09
3458 00          8743          DB DPY,TEXT
3459 00
345A 4D4D5443    8744          DB 'MMTCH COUNT',SKIP,12
345E 4820434F
3462 554E54
3465 82
3466 0C
3467 504F5354    8745          DB 'POST BK HI',SKIP,12
346B 20424B20
346F 4849
3471 82
3472 0C
3473 504F5354    8746          DB 'POST BK LO'
3477 20424B20
347B 4C4F
347D FF          8747          DB ENDLST
                 8748
347E 26          8749 S3LAB3:  DB 38,13
347F 0D
3480 00          8750          DB DPY,TEXT
3481 00
3482 52455345    8751          DB 'RESET',SKIP,11
3486 54
3487 82
3488 0B
3489 4241434B    8752          DB 'BACK ONE',SKIP,14
348D 204F4E45
3491 82
3492 0E
3493 45584954    8753          DB 'EXIT'
3497 FF          8754          DB ENDLST
                 8755
                 8756
3498 0B          8757 S3FS:    DB 11,4
3499 04
349A 00          8758          DB DPY,TEXT
349B 00
349C 45434E56    8759          DB 'ECNV: END OF COLLATION',XX
34A0 3A20454E
34A4 44204F46
34A8 20434F4C
34AC 4C415449
34B0 4F4E
34B2 0D
34B3 81          8760          DB REP,7,' ','NO VERIFICATION',XX,XX
34B4 07
34B5 20
34B6 4E4F2056
34BA 45524946
34BE 49434154
34C2 494F4E
```

```
34C5 00
34C6 00
34C7 00          8761        DB XX,'ECVR: END OF COLLATION',XX
34C8 45435652
34CC 3A20454E
34D0 44204F46
34D4 20434F4C
34D8 4C415449
34DC 4F4E
34DE 00
34DF 81          8762        DB REP,7,' ','VERIFICATION'
34E0 07
34E1 20
34E2 56455249
34E6 46494341
34EA 54494F4E
34EE FF          8763        DB ENDLST
                 8764
34EF 2F          8765 S3F51: DB 47,4
34F0 04
34F1 00          8766        DB DPY,TEXT
34F2 00
34F3 43544F50    8767        DB 'CTOP: STOP ON FEED COUNT',XX
34F7 3A205354
34FB 4F50204F
34FF 4E204645
3503 45442043
3507 4F554E54
3508 00
350C 81          8768        DB REP,7,' ','SET BY OPERATOR',XX,XX
350D 07
350E 20
350F 53455420
3513 4259204F
3517 50455241
351B 544F52
351E 00
351F 00
3520 00          8769        DB XX,'CTCD: STOP ON FEED COUNT',XX
3521 43544344
3525 3A205354
3529 4F50204F
352D 4E204645
3531 45442043
3535 4F554E54
3539 00
353A 81          8770        DB REP,7,' ','SET BY CTRL DOC'
353B 07
353C 20
353D 53455420
3541 42592043
3545 54524C20
3549 444F43
354C FF          8771        DB ENDLST
                 8772
                 8773
                 8774
                 8775
                 8776 ;---------------- ARRAY 0 - PARAMETERS THAT CAN BE MODIFIED
                 8777
                 8778 ;-------- FIELD NAMES
                 8779
354D 00          8780 S3F0:  DB 0,9
354E 09
```

```
354F 00          8781        DB DPY,TEXT
3550 00
3551 4C494E45    8782        DB 'LINE SPACING:',XX
3555 20535041
3559 43494E47
355D 3A
355E 0D
355F 46454544    8783        DB 'FEED STOP:',XX
3563 2053544F
3567 503A
3569 0D
356A 46454544    8784        DB 'FEED COUNT:',XX
356E 20434F55
3572 4E543A
3575 0D
3576 4D49534D    8785        DB 'MISMATCH COUNT:',XX
357A 41544348
357E 20434F55
3582 4E543A
3585 0D
3586 504F5354    8786        DB 'POSTAGE BREAK:',XX
358A 41474520
358E 42524541
3592 4B3A
3594 0D
3595 4C4F5720    8787        DB 'LOW BREAK:',XX
3599 42524541
359D 4B3A
359F 0D
35A0 48494748    8788        DB 'HIGH BREAK:',XX
35A4 20425245
35A8 414B3A
35AB 0D
35AC FF          8789        DB ENDTXT
                 8790
                 8791
                 8792
                 8793 ;LINE SPACING SCREEN
35AD 13          8794 S3F1:  DB 19,5
35AE 05
35AF 00          8795        DB DPY,TEXT
35B0 00
35B1 4C494E45    8796        DB 'LINE SPACING 1',SKIP,30
35B5 20535041
35B9 43494E47
35BD 2031
35BF 82
35C0 1E
35C1 4C494E45    8797        DB 'LINE SPACING 2'
35C5 20535041
35C9 43494E47
35CD 2032
35CF FF          8798        DB ENDLST
                 8799
35D0 13          8800 S3F2:  DB 19,9
35D1 09
35D2 00          8801        DB DPY,TEXT
35D3 00
35D4 4C494E45    8802        DB 'LINE SPACING 3',SKIP,30
35D8 20535041
35DC 43494E47
35E0 2033
35E2 82
35E3 1E
```

```
35E4 4C494E45   8803        DB 'LINE SPACING 4'
35E8 20535041
35EC 43494E47
35F0 2034
35F2 FF         8804        DB ENDLST
                8805
                8806
                8807
                8808 ;-------- ERASE DATA
35F3 A1         8809 S3EA0:  DB TABI+1,9
35F4 09
35F5 03         8810        DB ERASE,8,EOL
35F6 08
35F7 80
                8811
                8812
                8813
                8814
                8815 ;-------- ELEMENT DEFINITIONS
                8816
                8817 ;-- LINES/INCH
35F8 B0         8818 S3A0X1: DB TABC,9
35F9 09
35FA 01         8819        DB OVWRT,VTEXT
35FB 01
35FC 04         8820        DB 4
35FD 20202031   8821        DB '  1',XX
3601 0D
3602 20202032   8822        DB '  2',XX
3606 0D
3607 20202033   8823        DB '  3',XX
3608 0D
360C 20202034   8824        DB '  4',XX
3610 0D
3611 FF         8825        DB ENDTXT
                8826
                8827 ;-- FEED STOP METHOD
3612 B0         8828 S3A0X2: DB TABC,YNXT
3613 90
3614 01         8829        DB OVWRT,VTEXT
3615 01
3616 04         8830        DB 4
3617 45434E56   8831        DB 'ECNV',XX          ;END OF COLLATION - NO VERIFICATION
361B 0D
361C 45435652   8832        DB 'ECVR',XX          ;END OF COLLATION - VERIFICATION
3620 0D
3621 43544F50   8833        DB 'CTOP',XX          ;STOP ON FEED COUNT SET BY OPERATOR
3625 0D
3626 43544344   8834        DB 'CTCD',XX          ;STOP ON FEED COUNT SET BY CONTROL DOC
362A 0D
362B FF         8835        DB ENDTXT
                8836
                8837
                8838 ;-- FEED COUNT
362C B0         8839 S3A0X3: DB TABC,YNXT
362D 90
362E 00         8840        DB DPY,DECIMAL
362F 02
3630 04         8841        DB 4
                8842
                8843
                8844
                8845 ;================  SCREEN 4 = REASSIGN STATION SELECTIONS
                8846
```

```
                8847
                8848
                8849 ;———————— MENU
3631 0D         8850 S4P0:   DB 13,13
3632 0D
3633 00         8851         DB DPY,TEXT
3634 00
3635 52454153   8852         DB 'REASSIGN',SKIP,12
3639 5349474E
363D 82
363E 0C
363F FF         8853         DB ENDTXT
                8854
                8855
3640 00         8856 S7F1:   DB 0,1,DPY,TEXT
3641 01
3642 00
3643 00
3644 53544154   8857         DB 'STATION:'
3648 494F4E3A
364C FF         8858         DB ENDLST
                8859
364D 00         8860 S7F2:   DB 0,YNXT,DPY,TEXT
364E 90
364F 00
3650 00
3651 46454544   8861         DB 'FEED TIME',XX
3655 2054494D
3659 45
365A 0D
365B 454E4320   8862         DB 'ENC ON SENSE',XX
365F 4F4E2053
3663 454E5345
3667 0D
3668 454E4320   8863         DB 'ENC OFF SENSE'
366C 4F464620
3670 53454E53
3674 45
3675 FF         8864         DB ENDLST
                8865
3676 B0         8866 S7F21:  DB TABC,1
3677 01
3678 00         8867         DB DPY,DECIMAL
3679 02
367A 02         8868         DB 2
                8869
367B 80         8870 S7F3:   DB XCC,YCC,DPY,TEXT
367C 80
367D 00
367E 00
367F 454E5645   8871         DB 'ENVELOPE FEEDER'
3683 4C4F5045
3687 20464545
368B 444552
368E FF         8872         DB ENDLST
                8873
368F 00         8874 S7F4:   DB 0,YNXT,DPY,TEXT
3690 90
3691 00
3692 00
3693 4A414D20   8875         DB 'JAM SENSE ON',XX
3697 53454E53
369B 45204F4E
369F 0D
```

```
36A0 4A414D20    8876          DB 'JAM SENSE OFF',XX
36A4 53454E53
36A8 45204F46
36AC 46
36AD 0D
36AE FF          8877          DB ENDLST
                 8878
36AF 00          8879 S7F5:    DB XCC,YCC,DPY,TEXT
36B0 00
36B1 00
36B2 00
36B3 54494D49    8880          DB 'TIMING',XX
36B7 4E47
36B9 0D
36BA 44454C41    8881          DB 'DELAY TIME',XX
36BE 59205449
36C2 4D45
36C4 0D
36C5 4359434C    8882          DB 'CYCLE STOP ON',XX
36C9 45205354
36CD 4F50204F
36D1 4E
36D2 0D
36D3 4359434C    8883          DB 'CYCLE STOP OFF',XX
36D7 45205354
36DB 4F50204F
36DF 4646
36E1 0D
36E2 FF          8884          DB ENDLST
                 8885
36E3 23          8886 S7F62:   DB 35,9
36E4 09
36E5 00          8887          DB DPY,TEXT
36E6 00
36E7 53544154    8888          DB 'STATION',SKIP,11
36EB 494F4E
36EE 82
36EF 0B
36F0 454E5620    8889          DB 'ENV FEED',SKIP,12
36F4 46454544
36F8 82
36F9 0C
36FA 54494D49    8890          DB 'TIMING'
36FE 4E47
3700 FF          8891          DB ENDLST
                 8892
3701 26          8893 S7F63:   DB 38,13
3702 0D
3703 00          8894          DB DPY,TEXT
3704 00
3705 52455345    8895          DB 'RESET',SKIP,10
3709 54
370A 82
370B 0A
370C 4241434B    8896          DB 'BACK ONE',SKIP,12
3710 204F4E45
3714 82
3715 0C
3716 45584954    8897          DB 'EXIT'
371A FF          8898          DB ENDLST
                 8899
371B 0C          8900 S7F7:    DB 12,13
371C 0D
371D 00          8901          DB DPY,TEXT
```

```
371E 00
371F 44454C41    8902        DB 'DELAY TIME',SKIP,13
3723 59205449
3727 4D45
3729 82
372A 0D
372B 4241434B    8903        DB 'BACK ONE',SKIP,14
372F 204F4E45
3733 82
3734 0E
3735 45584954    8904        DB 'EXIT'
3739 FF          8905        DB ENDLST
                 8906
373A 23          8907 S7F71: DB 35,8
373B 08
373C 00          8908        DB DPY,BOXES
373D 06
373E 00          8909        DB X1Y1,2,1
373F 02
3740 01
                 8910
3741 24          8911 S7F72: DB 36,7
3742 07
3743 00          8912        DB DPY,TEXT
3744 00
3745 4359434C    8913        DB 'CYCLE STOP',XX,XX
3749 45205354
374D 4F50
374F 0D
3750 0D
3751 204F4E      8914        DB ' ON',SKIP,6,'OFF'
3754 82
3755 06
3756 4F4646
3759 FF          8915        DB ENDLST
                 8916
375A 0E          8917 S7F8:  DB 14,9
375B 09
375C 00          8918        DB DPY,TEXT
375D 00
375E 454E4320    8919        DB 'ENC ON',SKIP,12
3762 4F4E
3764 82
3765 0C
3766 454E4320    8920        DB 'ENC OFF',SKIP,10
376A 4F4646
376D 82
376E 0A
376F 46454544    8921        DB 'FEED TIME'
3773 2054494D
3777 45
3778 FF          8922        DB ENDLST
                 8923
3779 0E          8924 S7F81: DB 14,13
377A 0D
377B 00          8925        DB DPY,TEXT
377C 00
377D 52455345    8926        DB 'RESET',SKIP,11
3781 54
3782 82
3783 0B
3784 FF          8927        DB ENDLST
                 8928
3785 0D          8929 S7F9:  DB 13,13
```

```
3786 0D
3787 00          8930          DB DPY,TEXT
3788 00
3789 52455345    8931          DB 'RESET',SKIP,10
378D 54
378E 82
378F 0A
3790 FF          8932          DB ENDLST
                 8933
3791 18          8934 S7F91:   DB 24,7
3792 07
3793 00          8935          DB DPY,TEXT
3794 00
3795 454E434C    8936          DB 'ENCLOSURE    JAM SENSE'
3799 4F535552
379D 45202020
37A1 204A414D
37A5 2053454E
37A9 5345
37AB FF          8937          DB ENDLST
                 8938
37AC 0A          8939 S7F92:   DB 10,8
37AD 08
37AE 00          8940          DB DPY,BOXES
37AF 06
37B0 01          8941          DB X2Y1,1,1
37B1 01
37B2 01
                 8942
37B3 16          8943 S7F93:   DB 22,8
37B4 08
37B5 00          8944          DB DPY,BOXES
37B6 06
37B7 00          8945          DB X1Y1,4,1
37B8 04
37B9 01
                 8946
37BA 0C          8947 S7F94:   DB 12,9
37BB 09
37BC 00          8948          DB DPY,TEXT
37BD 00
37BE 46454544    8949          DB 'FEED TIME',SKIP,12
37C2 2054494D
37C6 45
37C7 92
37C8 0C
37C9 4F4E        8950          DB 'ON',SKIP,6
37CB 82
37CC 06
37CD 4F4646      8951          DB 'OFF',SKIP,6
37D0 82
37D1 06
37D2 4F4E        8952          DB 'ON',SKIP,6
37D4 82
37D5 06
37D6 4F4646      8953          DB 'OFF'
37D9 FF          8954          DB ENDLST
                 8955
37DA 0A          8956 S7F11:   DB 10,10
37DB 0A
37DC 00          8957          DB DPY,TEXT
37DD 00
37DE 454E434F    8958          DB 'ENCODER FAILED'
```

```
37E2 44455220
37E6 4641494C
37EA 4544
37EC FF          8959          DB ENDLST
                 8960
37ED 0A          8961 S7F12:   DB 10,10
37EE 0A
37EF 00          8962          DB DPY,TEXT
37F0 00
37F1 454E434F    8963          DB 'ENCODER PASSED'
37F5 44455220
37F9 50415353
37FD 4544
37FF FF          8964          DB ENDLST
                 8965
3800 3E          8966 S7K0:    DB 62,15
3801 0F
3802 02          8967          DB KBIN,DECIMAL
3803 02
3804 02          8968          DB 2,0,99
3805 00
3806 63
                 8969
3807 B0          8970 S7A1:    DB TABC,YNXT
3808 90
3809 00          8971          DB DPY,DECIMAL
380A 02
380B 02          8972          DB 2
                 8973
380C B0          8974 S7A2:    DB TABC,YCC
380D 80
380E 00          8975          DB DPY,DECIMAL
380F 02
3810 02          8976          DB 2
                 8977
3811 B0          8978 S7A3:    DB TABC,YCC
3812 80
3813 00          8979          DB DPY,DECIMAL
3814 02
3815 02          8980          DB 2
                 8981
                 8982
                 8983
                 8984
                 8985
                 8986 ;==================================== SCREEN 5 = CALIBRATE SCANNERS
                 8987
3816 0B          8988 S5A2:    DB 11,10
3817 0A
3818 00          8989          DB DPY,TEXT
3819 00
381A 4C494E45    8990          DB 'LINE SPACING =',XX
381E 20535041
3822 43494E47
3826 203D
3828 0D
3829 0D          8991          DB XX
382A 44454C41    8992          DB 'DELAY =',ENDLST
382E 59203D
3831 FF
                 8993
3832 1A          8994 S5A3:    DB 26,10
3833 0A
3834 00          8995          DB DPY,DECIMAL
```

```
3835 02
3836 02          8996        DB 2
                 8997
3837 13          8998 S5A4:  DB 19,12
3838 0C
3839 00          8999        DB DPY,XDEC
383A 03
383B 03          9000        DB 3
                 9001
                 9002
                 9003 END
```

PUBLIC SYMBOLS

EXTERNAL SYMBOLS

USER SYMBOLS

| | | | | | | | | | | | | | | | |
|---|---|---|---|---|---|---|---|---|---|---|---|---|---|---|---|
| ACBRK1 | A 001A | ACBRK2 | A 001C | ACCDG | A 1729 | ACCDG1 | A 1735 | ACCDG2 | A 17CC | ACCMND | A 2D31 | ACCON | A 0008 | | |
| ACCVE | A 0016 | ACDATA | A 2D2F | ACDBL | A 001E | ACENT1 | A 17AD | ACENT2 | A 17B5 | ACENTB | A 1742 | ACFDTM | A 0F9C | | |
| ACFTF | A 0020 | ACJTM | A 0040 | ACLTF | A 0022 | ACMCE | A 0018 | ACODE | A 76A5 | ACODE1 | A 76A6 | ACOFF1 | A 17C8 | | |
| ACON1 | A 17BF | ACON11 | A 17C2 | ACOUT | A 0E82 | ACOUT1 | A 0E83 | ACSCN | A 1757 | ACSCOD | A 001E | ACSET | A 110C | | |
| ACSET1 | A 11A6 | ACSET5 | A 1196 | ACSORY | A 0004 | ACSSTK | A 001F | ACSSTN | A 7246 | ACSTGT | A 17DC | ACVLS | A 17E9 | | |
| ADDTSK | A 0FA9 | ADVREC | A 0608 | AR0 | A 0618 | AR1 | A 066A | AR2 | A 066C | AR3 | A 064D | AR4 | A 0642 | | |
| AR5 | A 0651 | ASET | A 0E8E | ASNTAB | A 7695 | AT0 | A 0FC5 | AT1 | A 0FD1 | AT2 | A 0FEA | AT3 | A 1009 | | |
| BATOUT | A 0193 | BBOXD | A 1EA1 | BCDTAB | A 151C | BCHMRK | A 002E | BEG1 | A 00E7 | BEG2 | A 00CE | BEGIN | A 0060 | | |
| BELL | A 2645 | BINTAB | A 1524 | BLANKS | A 2AF3 | BLNK0 | A 2AF4 | BMEBIT | A 0010 | BNUM | A 76B2 | BOXES | A 0006 | | |
| CAL2 | A 2219 | CALIB | A 21A2 | CALIB2 | A 21E4 | CALIB3 | A 2201 | CCSOF | A 1A06 | CCSON | A 1A00 | CDCNT | A 0020 | | |
| CDLEN | A 19FA | CDLEN1 | A 1A09 | CENTER | A 0090 | CFDSTP | A 0014 | CFDTIM | A 0004 | CH31 | A 1B2F | CH32 | A 1B34 | | |
| CH33 | A 1B39 | CH34 | A 1B3D | CH35 | A 1B40 | CH36 | A 1B43 | CH37 | A 1B46 | CH38 | A 1B49 | CH39 | A 1B4C | | |
| CH40 | A 1B4F | CH41 | A 1B52 | CH42 | A 1B55 | CH43 | A 1B59 | CH44 | A 1B5D | CH45 | A 1B61 | CH46 | A 1B65 | | |
| CH47 | A 1B68 | CH48 | A 1B6B | CH49 | A 1B6E | CH50 | A 1B71 | CH52 | A 1B74 | CH53 | A 1B76 | CH54 | A 1B78 | | |
| CH55 | A 1B7A | CH56 | A 1B7C | CH57 | A 1B81 | CH58 | A 1B84 | CHAN5 | A 1D1A | CHK0 | A 0314 | CHKBIT | A 24E7 | | |
| CHKCNT | A 07BD | CHKCT0 | A 07C2 | CHKCT1 | A 07CB | CHKCT2 | A 07D2 | CHKCT3 | A 07E4 | CHKM1 | A 078A | CHKMCH | A 1540 | | |
| CHKMCN | A 0776 | CHKON | A 1211 | CHKPBK | A 0858 | CHKSAF | A 12C8 | CHKSCF | A 0308 | CHKSF0 | A 12E0 | CHKSF1 | A 12F6 | | |
| CHKSF2 | A 1204 | CHKWRD | A 76AF | CHNCNT | A 0024 | CKBIT0 | A 24EC | CKBIT1 | A 24F4 | CKCDCT | A 082D | CKCTAB | A 0816 | | |
| CKM0 | A 1565 | CKM1 | A 1583 | CKM2 | A 1589 | CKMCN0 | A 07A8 | CKOPCT | A 0845 | CKOVCT | A 081E | CLKTME | A 76D7 | | |
| CLRAC | A 17D4 | CLRDG | A 22B5 | CLRER0 | A 09D4 | CLRERR | A 09A5 | CLSCRN | A 2572 | CLVAL | A 1F2B | CMD51 | A 0037 | | |
| CMDEHL | A 24C1 | CMMCNT | A 000C | CNFG0 | A 02ED | CNL2 | A 02E2 | CNTBIT | A 0020 | CNTER1 | A 0854 | CNTERR | A 0851 | | |
| CNTVAL | A 76A8 | CNVBCD | A 150F | CNVISX | A 035E | CNVSX1 | A 0368 | CNVSX2 | A 036A | CNVTIM | A 16BE | CNVXSI | A 1F41 | | |
| CONFIG | A 029B | COPCNT | A 000A | COPY | A 251E | COPY0 | A 2521 | COUNT | A 76B1 | CP1BEG | A 5000 | CP2BEG | A 5800 | | |
| CP3BEG | A 6000 | CP4BEG | A 6800 | CPB1 | A 0879 | CPBHI | A 0012 | CPBLOW | A 0010 | CPBRK | A 000E | CPT0 | A 101B | | |
| CPYTSK | A 1016 | CSEBIT | A 0010 | CURERR | A 0017 | CURLN | A 000B | CYCTIM | A 76DC | DBLBIT | A 0002 | DBOX | A 26B6 | | |
| DBOX1 | A 26D0 | DBOX2 | A 26DF | DBOX3 | A 2703 | DBOX4 | A 2708 | DBOX5 | A 2722 | DBOX6 | A 272D | DBOX7 | A 26E8 | | |
| DCH | A 2625 | DCH0 | A 2626 | DCOD | A 1813 | DCOD1 | A 1829 | DDATA | A 76D2 | DDEC | A 2833 | DDEC0 | A 2848 | | |
| DDEC0A | A 2839 | DDEC1 | A 2867 | DDEC1A | A 285E | DECIMA | A 0002 | DELAY1 | A 002A | DELAY2 | A 002C | DEVTAB | A 7675 | | |
| DEVTYP | A 0000 | DFLBIT | A 0004 | DFLMAP | A 00A6 | DFLP05 | A 0512 | DGNCMD | A 76B7 | DGT2 | A 22FC | DHEX | A 2876 | | |
| DHEX0 | A 289E | DHEX1 | A 28A2 | DIAG | A 2252 | DIAG01 | A 226B | DIAG0A | A 226E | DIAG2 | A 2298 | DIAG3 | A 22D7 | | |
| DIAG4 | A 22DE | DIAG7 | A 22C1 | DIAG8 | A 22EF | DIAG9 | A 22B8 | DIAGST | A 22AA | DIAGTB | A 227E | DISPLA | A 265B | | |
| DIV0 | A 2549 | DIV1 | A 2569 | DIV2 | A 2570 | DIVIDE | A 253C | DLYTIM | A 76DA | DMAP1 | A 2C0A | DMAP2 | A 2C27 | | |
| DMAP3 | A 2C42 | DMAP4 | A 2C48 | DMAP5 | A 2C51 | DMAP6 | A 2BF6 | DMODE | A 0002 | DNUM | A 1E44 | DPMTR | A 1F8F | | |
| DPTR | A 76CD | DPY | A 0000 | DPY0 | A 2669 | DPY1 | A 266D | DPY2 | A 2688 | DPYER0 | A 2B9F | DPYERR | A 2B8E | | |
| DPYR | A 27B5 | DPYR1 | A 27B9 | DPYSC | A 2BDC | DPYSK | A 27C3 | DST | A 1B96 | DSTAT | A 17FA | DSTAT1 | A 1800 | | |
| DTASK | A 0508 | DTEXT | A 2792 | DTEXT0 | A 2799 | DTEXT1 | A 27D2 | DTYPE | A 0003 | DVB0 | A 28CE | DVB1 | A 28D9 | | |
| DVBITS | A 288F | DVTB | A 2CAB | DVTEXT | A 27E1 | DVTXT0 | A 27F0 | DVTXT1 | A 27FC | DVTXT2 | A 2802 | DVTXT3 | A 2810 | | |
| DVTXT4 | A 2820 | DW1 | A 0004 | DW2 | A 0005 | DW3 | A 0006 | DW4 | A 0007 | DX | A 0000 | DXDEC | A 282C | | |
| DY | A 0001 | EF0 | A 0F5A | EFBEG | A 7206 | EFDTIM | A 7670 | EFEND | A 7236 | EFESOF | A 7672 | EFESON | A 7671 | | |
| EFJSOF | A 7674 | EFJSON | A 7673 | EFLAST | A 7238 | EFPTR | A 723A | EHBIT | A 0080 | EHCHK | A 08D7 | EMCH0 | A 0573 | | |
| EMCH1 | A 0578 | EMCH2 | A 058F | EMHCHK | A 0567 | EMSG0 | A 2BAD | ENABIT | A 7244 | ENCH1 | A 1EC1 | ENCH2 | A 1ECD | | |
| ENCHK | A 1EBF | END2X | A 2E78 | ENDLST | A 00FF | ENDTBL | A FFFF | ENDTXT | A 00FF | ENEFC | A 198F | ENEOC | A 1989 | | |
| ENFC | A 1983 | ENFC1 | A 199E | ENJFC | A 1998 | ENJOC | A 1995 | ENS01 | A 11CA | ENS02 | A 11CE | ENSOFF | A 11B2 | | |

| | | | | | | | | | | | | | |
|---|---|---|---|---|---|---|---|---|---|---|---|---|---|
| ENSON | A | 11BF | ENSTAT | A | 001A | ENVAL | A | 1F2F | ENVFDR | A | 0003 | ENVSTN | A 7245 |
| EOI | A | 0020 | EOL | A | 0080 | ERAS | A | 2586 | ERASE | A | 0003 | ERRACC | A 0016 |
| ERRCOV | A | 000D | ERRCVF | A | 000C | ERRCW0 | A | 723C | ERRCW1 | A | 723D | ERRDBL | A 0001 |
| ERRFNR | A | 0008 | ERRFTF | A | 0002 | ERRJAM | A | 0000 | ERRLTF | A | 0003 | ERRMCH | A 000B |
| ERRS4 | A | 095A | ERRSAF | A | 000A | ERRSET | A | 08F8 | ERRST1 | A | 0944 | ERRST2 | A 0972 |
| ERRSTK | A | 7240 | ERRSTN | A | 7205 | ERRTAB | A | 2D37 | ERRTNR | A | 000F | ERRXX | A 2BCA |
| ERS2 | A | 2597 | ERS4 | A | 25CC | ERSTAT | A | 001B | ESC | A | 001B | ESTAT | A 7250 |
| EXMES | A | 3164 | EXTBL | A | 1F21 | F50FF | A | 1D22 | F50N | A | 1D1F | FA00 | A 076E |
| FA11 | A | 076B | FB | A | 0020 | FB0 | A | 15B3 | FB1 | A | 15B8 | FBSIZE | A 0058 |
| FCESON | A | 0010 | FCHBIT | A | 1599 | FCHEDR | A | 098A | FCHER1 | A | 0B3A | FCHERR | A 0B18 |
| FCJSOF | A | 00F7 | FCJSON | A | 0008 | FCPTR | A | 76C1 | FCRDCT | A | 0020 | FCRSET | A 0001 |
| FCSTFD | A | 0004 | FCWRCT | A | 0040 | FDABIT | A | 0012 | FDACTR | A | 7247 | FDCMD | A 76B9 |
| FDERR | A | 76B8 | FDESET | A | 09FF | FDGET | A | 0131 | FDPTR | A | 76BF | FDRCNT | A 0006 |
| FDRRT | A | 0E1A | FDSTAT | A | 76BA | FDSTOP | A | 0008 | FDTIME | A | 0000 | FDTTB | A 18D5 |
| FEEDMP | A | 000E | FETCH | A | 250C | FETCHP | A | 24F7 | FIND1 | A | 1E98 | FIND2 | A 1E9E |
| FLDSIZ | A | 76D4 | FONGT | A | 1D25 | FONGT1 | A | 1D47 | FSCDCT | A | 0003 | FSCODE | A 001C |
| FSOPCT | A | 0002 | FSTB1 | A | 1DFC | FSTBL | A | 1DE0 | FTFBIT | A | 0004 | G1BIT | A 13A9 |
| G2S2T0 | A | 16D8 | GCH | A | 2631 | GCH1 | A | 263B | GCH1B | A | 2642 | GDECM | A 1E41 |
| GETS2 | A | 1F09 | GETS3 | A | 1F33 | GETS4 | A | 1F38 | GETS5 | A | 1F3C | GETS5 | A 2088 |
| GETTIM | A | 0F3E | GETVST | A | 20CB | GS0 | A | 2A44 | GS1 | A | 2A4C | GS2 | A 2A87 |
| GS5 | A | 2A9B | GS5A | A | 2AA4 | GS6 | A | 2AA9 | GTACER | A | 0978 | GVST1 | A 212E |
| HEXTAB | A | 28AF | HLTACL | A | 0010 | HLTBIT | A | 7241 | HLTCOD | A | 723E | HLTDCD | A 0017 |
| HLTPB1 | A | 0014 | HLTPB2 | A | 0015 | HLTSSM | A | 0011 | ICW1 | A | 0056 | ICW2 | A 0000 |
| INBIT | A | 0002 | INIACS | A | 0E62 | INICYC | A | 05FF | INIENV | A | 0E52 | INIERR | A 08E7 |
| INISCB | A | 0E2A | INISCF | A | 1090 | INISCN | A | 0286 | INISTF | A | 108C | INIT2 | A 0E33 |
| INTSK0 | A | 06C1 | INTSK1 | A | 06D6 | INTSK2 | A | 074D | INTSK3 | A | 075B | INTSK4 | A 06F5 |
| INTSRV | A | 1676 | INTSV0 | A | 1686 | INTSV1 | A | 169D | INTSV2 | A | 16A1 | INTSV3 | A 16B5 |
| INVEC2 | A | 0048 | INVEC3 | A | 004C | INVEC4 | A | 0050 | INVEC5 | A | 0054 | INVEC6 | A 0058 |
| JMSOFF | A | 11F0 | JMSON | A | 11DF | JMWDS | A | 053C | K0 | A | 28FE | K1 | A 2907 |
| K3 | A | 291A | K5 | A | 294F | K6 | A | 295E | K7 | A | 296E | KBHCH1 | A 05AB |
| KBIN | A | 0002 | KBSIZE | A | 0005 | KBUF | A | 76C7 | KDATA | A | 76D1 | KDEC | A 298E |
| KERDPY | A | 2A25 | KERTXT | A | 2A2E | KEYDPY | A | 1E56 | KEYIN | A | 28F1 | KEYMOD | A 76D5 |
| KVB1 | A | 29EF | KVB2 | A | 2A01 | KVB3 | A | 2A0D | KVB4 | A | 2A10 | KVBITS | A 29D5 |
| LINWD3 | A | 003E | LINWD4 | A | 0040 | LNWD1 | A | 000C | LNWD2 | A | 0000 | LNWD3 | A 000E |
| LODAC1 | A | 147D | LODAC2 | A | 1482 | LODAC3 | A | 1439 | LODACS | A | 140C | LODCN0 | A 14D1 |
| LODCN3 | A | 1508 | LODCNT | A | 149D | LODREC | A | 1313 | LODSC0 | A | 134F | LODSCD | A 133E |
| LSB | A | 12AA | LSB1 | A | 12BC | LTFBIT | A | 0008 | M1 | A | 0BA2 | M1A | A 0BA9 |
| M3A | A | 0BD1 | M4 | A | 0BDA | M5 | A | 0BDF | M6 | A | 0BE4 | M60 | A 0BF2 |
| MAINTR | A | 76B8 | MAPS | A | 0064 | MCHBIT | A | 0056 | MCHCOD | A | 002B | MCHMAP | A 0000 |
| MFENC2 | A | 18F9 | MFENO | A | 18FF | MFFT | A | 18EF | MFT | A | 182F | MFT1 | A 1835 |
| MFTD4 | A | 1906 | MFTEN | A | 1916 | MFTEN2 | A | 1954 | MFTENR | A | 19A4 | MFTFD | A 188D |
| MFTFDR | A | 1910 | MFTMN | A | 19AA | MFTMN1 | A | 19D7 | MFTMNR | A | 1A0F | MFTTBL | A 1842 |
| MKRBIT | A | 0002 | MMCNT | A | 0004 | MMCTR | A | 0014 | MMIOT1 | A | 2CC9 | MMIOTB | A 2CC7 |
| MOD51 | A | 004E | MODALL | A | 1E30 | MODFC | A | 1E1F | MODFS | A | 1DAB | MODFS1 | A 1DD3 |
| MODFS4 | A | 1E1A | MODFS5 | A | 1E08 | MODFS6 | A | 1E06 | MODLD | A | 2745 | MODLN | A 1D62 |
| MODLNT | A | 1D99 | MODMM | A | 1E24 | MODOT | A | 274F | MODPBH | A | 1E2E | MODPBL | A 1E29 |
| MODST2 | A | 1CE6 | MODST3 | A | 1D0D | MODST5 | A | 1D08 | MODTBL | A | 1C11 | MPSIZE | A 0004 |
| MSP | A | 1CD1 | MSP0 | A | 1AF1 | MSP00 | A | 1B87 | MSP01 | A | 1BC5 | MSP02 | A 1BAE |
| MSP1 | A | 1B9F | MSPTB | A | 1CF6 | MSPTB1 | A | 1CFE | MSS | A | 1C2D | MSS1 | A 1C39 |
| MSS3 | A | 1CCB | MSS4 | A | 1C64 | MSS5 | A | 1C71 | MSS6 | A | 1C86 | MSSTB | A 1C9E |
| MSTATE | A | 7201 | MT2BIT | A | 0010 | MT2POS | A | 050E | MTOF0 | A | 053E | MTOF1 | A 054D |
| MTRMAP | A | 0096 | MTRPOS | A | 050C | MTRSN0 | A | 051D | MTRSN1 | A | 0533 | MTRSOF | A 0539 |
| MULT | A | 252D | MULT1 | A | 2532 | MULT2 | A | 2537 | NEWSEL | A | 7693 | NODEV | A 0000 |
| NXTST0 | A | 0321 | NXTSTA | A | 032C | NXTSTN | A | 031E | OFF | A | 0000 | OLDSEL | A 7691 |
| ONSTAT | A | 0010 | OPCNT | A | 0003 | ORDEHL | A | 24C7 | OSTAT | A | 724F | OUTAC1 | A 178B |
| OUTACC | A | 176B | OUTBIT | A | 0001 | OUTLN1 | A | 275D | OUTLN2 | A | 2778 | OUTLN3 | A 2779 |
| OUTWDS | A | 052A | OVWRT | A | 0001 | P1 | A | 76A9 | P2 | A | 76AB | P3 | A 76AD |
| PBF1 | A | 0138 | PBF10 | A | 0450 | PBF11 | A | 04A8 | PBF2 | A | 0190 | PBF3 | A 01E8 |
| PBF6 | A | 02F0 | PBF7 | A | 0348 | PBF8 | A | 03A0 | PBF9 | A | 03F8 | PBHIGH | A 0007 |
| PCOUNT | A | 7202 | PF0 | A | 05BE | PF1 | A | 05C4 | PF2 | A | 05E6 | PFETCH | A 76DD |
| POLCSH | A | 055C | POLFDR | A | 05B7 | POLHLT | A | 0554 | POLSC0 | A | 1221 | POLSCN | A 121B |
| PORTXP | A | 00E7 | PPBEG | A | 0000 | PRMADR | A | 7248 | PRMPTR | A | 724D | PRT053 | A 00DC |
| PRTD51 | A | 00EC | PRTXPI | A | 00E5 | PRTXPO | A | 00E4 | PSTAT | A | 7252 | PSTBRK | A 0005 |
| PSTORE | A | 76DF | RAMBEG | A | 7000 | RAMPTR | A | 724B | RAMST | A | 1201 | RAMTAB | A 2C8D |
| RB | A | 0010 | RCVCOD | A | 7243 | | | | | | | | |

| | | | | | | | | | | | | | | | |
|---|---|---|---|---|---|---|---|---|---|---|---|---|---|---|---|
| RDFDAT | A | 1642 | RDYBIT | A | 0004 | REASTB | A | 20AA | RECCNT | A | 002C | RECOV1 | A | 0A3D | RECOV2 | A | 0A40 | RECOV3 | A | 0A5E |
| RECOV4 | A | 0A65 | RECOV5 | A | 0A7E | RECOV7 | A | 0A98 | RECOV9 | A | 0AAC | RECOVR | A | 0A15 | RECOVX | A | 0A61 | RECV10 | A | 0AB5 |
| RECV11 | A | 0ACC | RECV12 | A | 0AD5 | RECV13 | A | 0AED | RECV14 | A | 0B0F | RECV15 | A | 0AF3 | RECV41 | A | 0A76 | REP | A | 0081 |
| RESET | A | 013E | RETMCN | A | 1809 | RFD1 | A | 1645 | RFSTAT | A | 15E4 | RMA | A | 0388 | RMA0 | A | 0393 | RMB | A | 03B4 |
| RMB0 | A | 03BC | RMB1 | A | 03C4 | RMB11 | A | 03CE | RMB12 | A | 03D9 | RMB2 | A | 03E4 | RMC | A | 03F2 | RMC0 | A | 0400 |
| RMC1 | A | 041F | RMC2 | A | 0427 | RMD | A | 0434 | RMD0 | A | 043B | RMD1 | A | 0441 | RMD2 | A | 044A | RMD3 | A | 046E |
| RMD4 | A | 045E | RMD41 | A | 046B | RME | A | 0479 | RME0 | A | 0484 | RME1 | A | 048C | RME2 | A | 0495 | RMF | A | 04A2 |
| RMF0 | A | 04A8 | RMF1 | A | 04AE | RMF2 | A | 04B5 | RMF3 | A | 04CF | RMF4 | A | 04D2 | RMF5 | A | 04E0 | RMODE | A | 7200 |
| RMX | A | 04F0 | RMX1 | A | 04FA | RPC | A | 1B8D | RSD0 | A | 1665 | RSDATA | A | 1661 | RSF0 | A | 15F7 | RSF1 | A | 15FC |
| RSL0 | A | 0253 | RSL1 | A | 027D | RSL2 | A | 0269 | RSL3 | A | 026B | RSP | A | 020C | RSP0 | A | 0244 | RSP01 | A | 0219 |
| RSS | A | 209A | RSS0 | A | 209D | RSSTAT | A | 1658 | RST1 | A | 1888 | RSTFD0 | A | 0DF6 | RSTFD1 | A | 0E15 | RSTFDR | A | 0DF1 |
| RSTPM0 | A | 0161 | RSTPM1 | A | 0173 | RSTPM2 | A | 0183 | RSTPM3 | A | 1BFD | RSTPMT | A | 015C | RSTSEL | A | 024E | RSTT1 | A | 1873 |
| RSTTIM | A | 186E | RUNMC0 | A | 0382 | RUNMC1 | A | 03A9 | RUNMCN | A | 03A3 | RUNTS0 | A | 069A | RUNTS1 | A | 06AF | RUNTSK | A | 0691 |
| S1A00 | A | 0C69 | S1A0X2 | A | 2E9E | S1A1 | A | 0C74 | S1A1X1 | A | 2EA3 | S1A1X2 | A | 2EA8 | S1A1X3 | A | 2FB8 | S1A1X4 | A | 2FD5 |
| S1A1X5 | A | 2FDA | S1A1X6 | A | 2FDF | S1A2 | A | 0CBF | S1A20 | A | 0CC9 | S1A2X0 | A | 3023 | S1A2X1 | A | 3028 | S1A2X2 | A | 303D |
| S1A2X3 | A | 304D | S1A2X4 | A | 3062 | S1A3 | A | 0D19 | S1A30 | A | 0D23 | S1A3X0 | A | 3080 | S1A3X1 | A | 30C0 | S1A3X3 | A | 30D0 |
| S1A4 | A | 0D76 | S1A40 | A | 0D92 | S1A41 | A | 0D8C | S1A4X0 | A | 312A | S1B1 | A | 2DB0 | S1B11 | A | 2DC4 | S1B2 | A | 2DCB |
| S1B3 | A | 2DD2 | S1B31 | A | 2DD9 | S1DA1 | A | 0C99 | S1DA2 | A | 0CDA | S1DA3 | A | 0D34 | S1DA4 | A | 0DA3 | S1EA2 | A | 301E |
| S1EA3 | A | 30AB | S1EA4 | A | 3125 | S1EERR | A | 2E83 | S1EP1 | A | 2E8D | S1ET1 | A | 2E88 | S1F0 | A | 2E92 | S1F2 | A | 2FEC |
| S1F3 | A | 3067 | S1F4 | A | 3005 | S1G0 | A | 0C01 | S1G1 | A | 0C10 | S1G2 | A | 0C3F | S1G4 | A | 0C45 | S1G5 | A | 0C4B |
| S1P0 | A | 2D97 | S1P1 | A | 2E1D | S1REM | A | 2DE0 | S1T4 | A | 2E36 | S1T5 | A | 2E53 | S2AC1 | A | 322A | S2AC2 | A | 323C |
| S2AC21 | A | 3257 | S2AC3 | A | 3279 | S2BOX | A | 3223 | S2C0 | A | 3285 | S2P0 | A | 316D | S3A0 | A | 207F | S3A00 | A | 2089 |
| S3A0X1 | A | 35F8 | S3A0X2 | A | 3612 | S3A0X3 | A | 362C | S3B1 | A | 3295 | S3B2 | A | 329C | S3B3 | A | 32A3 | S3B4 | A | 32AA |
| S3B41 | A | 32B1 | S3B5 | A | 32B8 | S3B6 | A | 32BF | S3B7 | A | 32C6 | S3BOX | A | 2071 | S3BOX1 | A | 2074 | S3EA0 | A | 35F3 |
| S3F0 | A | 354D | S3F1 | A | 35A0 | S3F2 | A | 35D0 | S3F5 | A | 3498 | S3FS1 | A | 34EF | S3G | A | 1F95 | S3G01 | A | 1FBC |
| S3G1 | A | 1FCB | S3G2 | A | 1FDA | S3G3 | A | 2015 | S3G31 | A | 2025 | S3G3T | A | 2032 | S3G4 | A | 203C | S3K1 | A | 3429 |
| S3LAB1 | A | 3438 | S3LAB2 | A | 3456 | S3LAB3 | A | 347E | S3P00 | A | 32E0 | S3P01 | A | 32F4 | S3P02 | A | 3303 | S3P03 | A | 3336 |
| S3P1 | A | 3368 | S3P10 | A | 3379 | S3P11 | A | 338A | S3P12 | A | 3391 | S3P2 | A | 33A4 | S3P3 | A | 33AB | S3P4 | A | 33D7 |
| S3P41 | A | 33DE | S3P5 | A | 33E5 | S3P6 | A | 33F1 | S3P7 | A | 3400 | S3P8 | A | 341B | S3STD | A | 32CD | S3T1 | A | 1B25 |
| S3TAB | A | 1B01 | S3TAB1 | A | 1C23 | S4A0 | A | 2178 | S4A00 | A | 2188 | S4A01 | A | 2197 | S4G0 | A | 2156 | S4P0 | A | 3631 |
| S4T1 | A | 2137 | S5A2 | A | 3816 | S5A3 | A | 3832 | S5A4 | A | 3837 | S60A | A | 2306 | S6A0 | A | 24B6 | S6A1 | A | 24B8 |
| S6F0 | A | 235A | S6F1 | A | 23C1 | S6FN | A | 233A | S6P0 | A | 2471 | S6P01 | A | 247D | S6P02 | A | 248F | S6P03 | A | 2496 |
| S6P04 | A | 249D | S7A1 | A | 3807 | S7A2 | A | 380C | S7A3 | A | 3811 | S7F1 | A | 3640 | S7F11 | A | 37DA | S7F12 | A | 37ED |
| S7F2 | A | 364D | S7F21 | A | 3676 | S7F3 | A | 367B | S7F4 | A | 368F | S7F5 | A | 36AF | S7F62 | A | 36E3 | S7F63 | A | 3701 |
| S7F7 | A | 371B | S7F71 | A | 373A | S7F72 | A | 3741 | S7F8 | A | 375A | S7F81 | A | 3779 | S7F9 | A | 3785 | S7F91 | A | 3791 |
| S7F92 | A | 37AC | S7F93 | A | 37B3 | S7F94 | A | 37BA | S7G0 | A | 1A15 | S7G2 | A | 1A24 | S7G3 | A | 1A30 | S7G31 | A | 1A3A |
| S7G4 | A | 1A4B | S7G41 | A | 1A5B | S7G42 | A | 1A62 | S7G43 | A | 1A6A | S7G5 | A | 1A72 | S7G6 | A | 1AAA | S7G7 | A | 1AD7 |
| S7K0 | A | 3800 | SCABIT | A | 0013 | SCACSR | A | 0F8A | SCAN | A | 1239 | SCAN1 | A | 127C | SCAN2 | A | 127F | SCAN3 | A | 1287 |
| SCAN4 | A | 1298 | SCAN5 | A | 129D | SCAN6 | A | 12A2 | SCAN7 | A | 12A4 | SCANX | A | 1295 | SCB | A | 0046 | SCB0 | A | 7256 |
| SCB1 | A | 729C | SCB10 | A | 7512 | SCB11 | A | 7558 | SCB12 | A | 759E | SCB13 | A | 75E4 | SCB14 | A | 762A | SCB2 | A | 72E2 |
| SCB3 | A | 7328 | SCB4 | A | 736E | SCB5 | A | 73B4 | SCB6 | A | 73FA | SCB7 | A | 7440 | SCB8 | A | 7486 | SCB9 | A | 74CC |
| SCCNFG | A | 0002 | SCDFDR | A | 0EC0 | SCDHLT | A | 0F9D | SCDIAG | A | 0010 | SCENVF | A | 0F48 | SCF0 | A | 0EED | SCF1 | A | 0F05 |
| SCF2 | A | 0F08 | SCF3 | A | 0F0B | SCF4 | A | 0F1F | SCF5 | A | 0F22 | SCFDR | A | 0002 | SCFOFF | A | 107E | SCFON | A | 1070 |
| SCNBUF | A | 0039 | SCNCMD | A | 76BD | SCNCNT | A | 0026 | SCNCOD | A | 0030 | SCNDAT | A | 002C | SCNOUT | A | 2213 | SCPTR | A | 76C5 |
| SCRDLY | A | 0004 | SCRSET | A | 0001 | SCST | A | 220D | SCSTAT | A | 76BE | SDELAY | A | 0009 | SDPTR | A | 76C3 | SELABL | A | 0002 |
| SELCHK | A | 1060 | SET2X | A | 2E6B | SETAC | A | 1494 | SETC1 | A | 25F5 | SETC2 | A | 2618 | SETCDC | A | 1024 | SETCP | A | 25D2 |
| SETCT0 | A | 1046 | SETIOP | A | 036F | SETOPC | A | 103B | SETPRM | A | 0110 | SETSTN | A | 0332 | SETX0 | A | 2B0D | SETX1 | A | 2B10 |
| SETX2 | A | 2B11 | SETX3 | A | 2B2B | SETX30 | A | 2B3B | SETX31 | A | 2B48 | SETX4 | A | 2B4F | SETX5 | A | 2B55 | SETX5A | A | 2B58 |
| SETXC | A | 2AFE | SETXY | A | 2AE5 | SETY0 | A | 2B73 | SETY1 | A | 2B76 | SETY2 | A | 2B79 | SETY3 | A | 2B87 | SETYC | A | 2B62 |
| SFBIT1 | A | 0042 | SFBIT2 | A | 004C | SFCMD | A | 0011 | SFDCNT | A | 0015 | SFMAP1 | A | 0044 | SFMAP2 | A | 004E | SKIP | A | 0082 |
| SL0 | A | 24E1 | SLHL | A | 24E0 | SLPOS | A | 0514 | SLRBIT | A | 0001 | SLRMAP | A | 009E | SLSTAT | A | 0002 | SM0 | A | 16EC |
| SMCODE | A | 0016 | SNUM | A | 3136 | SNUMB | A | 312F | SRHL | A | 24D0 | SRHL0 | A | 24D1 | SSTAT | A | 7251 | STAK | A | 7200 |
| STATIO | A | 724A | STDLN | A | 1E6F | STEFD1 | A | 1101 | STEFD2 | A | 10F3 | STEFD3 | A | 10FA | STEFD4 | A | 10DB | STEFDR | A | 1089 |
| STFDR | A | 0001 | STKABT | A | 0010 | STKAP | A | 0516 | STKBBT | A | 0020 | STKBP | A | 0518 | STKCBT | A | 0040 | STKCP | A | 051A |
| STKMAP | A | 00AA | STKMSK | A | 0007 | STKPOS | A | 051C | STORE | A | 2515 | STOREP | A | 2501 | STPMAP | A | 0092 | STPTIM | A | 76D8 |
| STRTT | A | 0893 | STTBL | A | 1F19 | STUPCK | A | 089D | SUBRTN | A | 24C0 | SYSM1 | A | 16E6 | SYSMN0 | A | 16C7 | SYSMNT | A | 16CA |
| SYST1 | A | 171B | SYST2 | A | 171D | SYST3 | A | 171F | SYST4 | A | 1721 | SYST5 | A | 1723 | SYST6 | A | 1725 | SYST7 | A | 1727 |
| SYSTBL | A | 16F9 | T0 | A | 76D8 | TABC | A | 00B0 | TABCTR | A | 76CC | TABI | A | 00A0 | TABTAB | A | 264D | TCSOFF | A | 7255 |
| TCSON | A | 7254 | TDELAY | A | 7253 | TEMP | A | 76B3 | TEMP1 | A | 76B5 | TESOFF | A | 0002 | TESON | A | 0001 | TEST | A | 2C66 |
| TEST1 | A | 2C69 | TEXT | A | 0000 | TIME | A | 76D9 | TIMTAB | A | 0000 | TINIT | A | 00F3 | TSK0 | A | 0EAB | TSKBIT | A | 76ED |
| TSKPTR | A | 76E5 | TSKSCD | A | 0E9B | TSKSTN | A | 76E4 | TSKTAB | A | 76EE | TSKTME | A | 76E3 | TSOFF | A | 0008 | TSON | A | 0006 |
| TSTK | A | 000A | TTEND | A | 76E9 | TTLIM | A | 76EB | TTPTR | A | 76E7 | TTSIZE | A | 01B8 | TXT2 | A | 2C86 | USEBCD | A | 0002 |
| VARCNT | A | 000A | VBITS | A | 0005 | VDNUM | A | 2A88 | VSTK | A | 0008 | VTEXT | A | 0001 | WAIT | A | 2BCF | WAIT0 | A | 2BD4 |

```
WESB   A 02F8   WESB0  A 02FC   WFC0   A 15D0   WFD0   A 1616   WFD1   A 1625   WRFCMD A 15C1   WRFDAT A 1607
WRSCMD A 1638   X1Y1   A 0000   X1Y15  A 000C   X1Y2   A 0004   X1Y3   A 0008   X2BOX  A 205F   X2Y1   A 0001
X2Y2   A 0005   X3BOX  A 2065   X3Y1   A 0002   X3Y2   A 0006   X3Y3   A 000A   X4BOX  A 206B   X4Y15  A 000F
XC     A 76CF   XCC    A 0080   XDEC   A 0003   XLTSEL A 13D1   XMC    A 0B56   XMC1   A 0B6B   XMCT   A 087B
XMCX   A 08AB   XOFF   A 08D2   XON    A 08B6   XONO   A 08BF   XPTCNO A 08A4   XPTCTN A 089F   XPTDLY A 08E2
XPTMM  A 08DD   XPTOFF A 08AD   XPTON  A 088A   XPTONO A 0896   XPTRST A 08C8   XPTX   A 08D4   XS0    A 13D9
XS1    A 1401   XX     A 000D   Y3BOX  A 2059   YC     A 76D0   YCC    A 0000   YNXT   A 0090   ZBIT   A 76D6
ZONCNT A 0028

ASSEMBLY COMPLETE,  NO ERRORS
```

ACCESSORY INTERFACE CIRCUIT FOR UNIVERSAL

MULTI-STATION DOCUMENT INSERTER

APPENDIX B

Accessory Interface Circuit Program

```
LOC  OBJ        LINE        SOURCE STATEMENT

                  1 $INCLUDE(NOTICE)
               =  2 ;       @@@@
```

```
                 32 ;**                          R5---IS USED FOR TEMPORARY STORAGE    **
                 33 ;**                          R6---IS USED FOR TEMPORARY STORAGE    **
                 34 ;**                          R7---IS USED TO STORE THE VALUE OF THE**
                 35 ;**                               R0  POINTER DURING INTERUPTS     **
                 36 ;**                 BANK 1                                         **
                 37 ;**                          R0---IS USED AS A POINTER FOR JAM     **
                 38 ;**                               WORD RAM                         **
                 39 ;**                          R1---IS A POINTER USED DURING INTERUPT**
                 40 ;**                          R2---IS A COMBINED STATUS REGISTER(#1)**
                 41 ;**                               AND COMMAND REGISTER             **
                 42 ;**                          R3---TEMP STORAGE DURING INTERUPTS    **
                 43 ;**                               FOR THE ACCUMULATOR              **
                 44 ;**                          R4---IS A STATUS REGISTER (#2)        **
                 45 ;**                          R5---TEMP STORAGE DURING INTERUPTS    **
                 46 ;**                          R6---TEMP. STORAGE FOR DBB DURING     **
                 47 ;**                               INTERUPTS                        **
                 48 ;**                          R7---TEMP STORAGE DURING INTERUPTS    **
                 49 ;*****************************************************************
                 50 ;*****************************************************************
                 51 $EJECT
                 52 ;
0020             53 OTPT0   EQU    32
0021             54 OTPT1   EQU    33
0022             55 OTPT2   EQU    34
0023             56 OTPT3   EQU    35
0024             57 OTPT4   EQU    36
0025             58 OTPT5   EQU    37
0026             59 OTPT6   EQU    38
0027             60 OTPT7   EQU    39
0028             61 OTPT8   EQU    40
0029             62 OTPT9   EQU    41
002A             63 OTPT10  EQU    42
002B             64 OTPT11  EQU    43
002C             65 OTPT12  EQU    44
002D             66 OTPT13  EQU    45
002E             67 OTPT14  EQU    46
002F             68 OTPT15  EQU    47
                 69 $EJECT
0030             70 JMWOD1  EQU    48
0031             71 JMWOD2  EQU    49
0032             72 JMWOD3  EQU    50
0033             73 JMWOD4  EQU    51
0034             74 JMWOD5  EQU    52
0035             75 JMWOD6  EQU    53
0036             76 JMWOD7  EQU    54
0037             77 JMWOD8  EQU    55
                 78
0038             79 TABLE1  EQU    56
                 80
0058             81 TABLE2  EQU    88
                 82
007F             83 VPS     EQU    127
                 84 $EJECT
                 85
0000 0410        86 RSTVEC. JMP    RINIT          ;GO INITIALIZE
0003             87         ORG    03H
                 88
0003 15          89 IBFVEC. DIS    I              ;DISABLE INTERUPT
0004 6409        90         JMP    IBFEND         ;GO TO INTERUPT ROUTINE
0010             91         ORG    10H
0010 B838        92 RINIT.  MOV    R0,#TABLE1     ;INITIATE POINTER R0.
0012 B958        93         MOV    R1,#TABLE2     ;INITIATE POINTER R1
0014 2300        94 GOAGEN. MOV    A,#00H         ;GET A ZERO COUNT
0016 A0          95         MOV    @R0,A          ;CLEAR RAM REG
```

```
0017 A1          96          MOV     @R1,A          ;CLEAR RAM REG
0018 F8          97          MOV     A,R0           ;GET LOCATION
0019 D358        98          XRL     A,#TABLE2      ;CHECK TO SEE IF LAST ONE IS CLEARED
001B C621        99          JZ      ENDCLR         ;IF ZERO ITS FINISHED
001D 18         100          INC     R0             ;
001E 19         101          INC     R1             ;
001F 0414       102          JMP     GOAGEN         ;GO REPEAT FOR THE NXT RAM LOCATION
0021 B838       103 ENDCLR:  MOV     R0,#TABLE1     ;REINITIATE R0
0023 B958       104          MOV     R1,#TABLE2     ;REINITIATE R1
0025 D5         105          SEL     RB1            ;
0026 BA01       106          MOV     R2,#01H        ;INITIATE STATUS #1 REG
0028 BC00       107          MOV     R4,#00H        ;CLEAR STATUS #2 REGISTER
002A 2363       108          MOV     A,#63H         ;
002C 39         109          OUTL    P1,A           ;INIT. PORT 1 (VPS OFF AND ZD OFF & 3TIER)
002D 2310       110          MOV     A,#10H         ;
002F 3A         111          OUTL    P2,A           ;INITIATE PORT 2
0030 3C         112          MOVD    P4,A           ;RESET PORT 4 OUTPUTS
0031 3D         113          MOVD    P5,A           ;RESET PORT 5 OUTPUTS
0032 3E         114          MOVD    P6,A           ;RESET PORT 6 OUTPUTS
0033 3F         115          MOVD    P7,A           ;RESET PORT 7 OUTPUTS
0034 05         116          EN      I              ;ENABLE INTERUPT
                117 $EJECT
0035 D5         118 NXTONE:  SEL     RB1            ;
0036 FA         119          MOV     A,R2           ;GET STATUS WORD #1
0037 F2C3       120          JB7     DIAGIN         ;GO TO INPUT DIAGNOSTICS
0039 92C5       121          JB4     DIAGOT         ;GO TO OUTPUT DIAGNOSTICS
003B C5         122          SEL     RB0            ;
003C 18         123          INC     R0             ;INCREMENT TO THE NEXT RAM LOCATION
003D 19         124          INC     R1             ;INCREMENT TO THE NEXT RAM LOCATION
003E 2358       125          MOV     A,#TABLE2      ;GET MAX R0 COUNT
0040 D8         126          XRL     A,R0           ;SEE IF R0 = 32+17(OVER LAST LOCATION)
0041 9647       127          JNZ     OK             ;IF NOT THAN RESUME
0043 B838       128          MOV     R0,#TABLE1     ;RESET POINTER FOR TABLE 1
0045 B958       129          MOV     R1,#TABLE2     ;RESET POINTER FOR TABLE 2
0047 F0         130 OK:      MOV     A,@R0          ;GET R0
0048 AA         131          MOV     R2,A           ;STORE DATA IN RAM LOC R0 IF ANY
0049 D5         132 JMCHEK:  SEL     RB1            ;
004A FA         133          MOV     A,R2           ;GET STATUS #1
004B 37         134          CPL     A              ;FLIP IT
004C 12A4       135          JB0     DONE10         ;IF JIP(RESET BIT LOW) EXIT
004E FC         136          MOV     A,R4           ;GET STATUS 2
004F 925A       137          JB4     DOJAM          ;IF BIT 4 DATA JUST REC DO JAM CHECK
0051 C5         138          SEL     RB0            ;
0052 F8         139          MOV     A,R0           ;GET THE POSITION OF THE TABLE 1 POINTER
0053 D357       140          XRL     A,#57H         ;SEE IT ITS AT MAX LOCATION
0055 D5         141          SEL     RB1            ;
0056 96A4       142          JNZ     DONE10         ;IT'S NOT AT MAX COUNT, NO JAM CHECK
0058 046E       143          JMP     ALLJAM         ;ITS AT MAX COUNT,TIME FOR ALL JAM CHECKS
                144 $EJECT
005A FC         145 DOJAM:   MOV     A,R4           ;GET STATUS
005B 53AF       146          ANL     A,#0AFH        ;RESET CK1 JIP  AND DATA REC
005D AC         147          MOV     R4,A           ;STORE IT BACK
005E 8C         148          MOVD    A,P4           ;GET CLOCK 1
005F 5302       149          ANL     A,#02H         ;MASK CLOCK 1
0061 C66E       150          JZ      ALLJAM         ;IF ZERO GO LOOK FOR OTHER JAM COMPARISONS
0063 FC         151          MOV     A,R4           ;GET STATUS
0064 4340       152          ORL     A,#40H         ;SET CK1 JAM IN PROCESS
0066 AC         153          MOV     R4,A           ;RESTORE
0067 2340       154          MOV     A,#40H         ;GET JAM FLAG
0069 90         155          MOV     STS,A          ;MOVE IT TO THE STATUS REG
006A 2301       156          MOV     A,#01H         ;SET JAM AT CK 1 CODE
006C 049D       157          JMP     KILL1          ;GO SEND IT
006E B830       158 ALLJAM:  MOV     R0,#JMWOD1     ;INITIATE JAM WORD POINTER
0070 FA         159 REZOOM:  MOV     A,R2           ;GET STATUS
```

```
0071 37          160          CPL    A            ;FLIP IT
0072 12A4        161          JB0    DONE10       ;EXIT JIP
0074 997F        162          ANL    P1,#7FH      ;TURN JAM RELAY ON
0076 FC          163          MOV    A,R4         ;GET STATUS
0077 53B0        164          ANL    A,#0B0H      ;CLEAR JIP POSITION AND JIP @ POS #1
0079 AC          165          MOV    R4,A         ;RE STORE IT
007A F0          166          MOV    A,@R0        ;GET JAM WORD
007B C6A4        167          JZ     DONE10       ;IF 0, NO MORE JAM COMPARISONS
007D 530F        168          ANL    A,#0FH       ;MASK OF LSB CLOCK CODE
007F 7459        169          CALL   SETBIT       ;GO DECODE IT
0081 5440        170          CALL   LOOKPC       ;CHECK THE STATUS OF THAT CLOCK
0083 D5          171          SEL    RB1          ;
0084 C6B9        172          JZ     NOJAM        ;IF ZERO THERE IS NO JAM
0086 F0          173          MOV    A,@R0        ;GET JAM WORD
0087 47          174          SWAP   A            ;FLIP IT
0088 530F        175          ANL    A,#0FH       ;MASK OF MSB CLOCK CODE
008A 7459        176          CALL   SETBIT       ;DECODE IT
008C 5440        177          CALL   LOOKPC       ;CHECK THE STATUS OF THAT CLOCK
008E D5          178          SEL    RB1          ;
008F C6B9        179          JZ     NOJAM        ;IF BOTH CLOCKS ARE BLOCKED THERE IS A JAM
0091 F0          180          MOV    A,@R0        ;GET THE PRESENTLY USED JAM WORD
0092 53F0        181          ANL    A,#0F0H      ;MASK THE MSB CLOCK(SMALLER ONE)
0094 47          182          SWAP   A            ;MOVE IT TO THE LSB
0095 4C          183          ORL    A,R4         ;STORE IT IN THE LSB OF STATUS 2 REG
0096 AC          184          MOV    R4,A         ;DONE!!!!
0097 2340        185          MOV    A,#40H       ;IF JAM OUTPUT TO STATUS IMMED JAM BIT
0099 90          186          MOV    STS,A        ;DO IT
009A F0          187          MOV    A,@R0        ;GET THE LOCATION OF THE JAM, CLOCK LOCATION
009B 530F        188          ANL    A,#0FH       ;MASK THE SECOND CLOCK
                 189 $EJECT
009D 02          190 KILL1:   OUT    DBB,A        ;OUTPUT IT TO THE SUPERVISOR
009E FA          191          MOV    A,R2         ;GET STATUS REGISTER
009F 53FE        192          ANL    A,#0FEH      ;SET B0=0(JAM RELAY OFF BECAUSE OF JAM)
00A1 AA          193          MOV    R2,A         ;RE STORE
00A2 8980        194          ORL    P1,#80H      ;SET RELAY OFF
00A4 B87F        195 DONE10:  MOV    R0,#VPS      ;GET LOCATION OF VPS WORD
00A6 F0          196          MOV    A,@R0        ;GET VPS WORD
00A7 7459        197          CALL   SETBIT       ;DECODE IT
00A9 5440        198          CALL   LOOKPC       ;CHECK ITS STATUS
00AB C6B1        199          JZ     OFFVPS       ;IF ZERO TURN OFF VPS
00AD 99FD        200          ANL    P1,#0FDH     ;TURN ON VPS
00AF 04B3        201          JMP    DONE15       ;RESUME NEXT FUNCTION
00B1 8982        202 OFFVPS:  ORL    P1,#02H      ;TURN OFF VPS
00B3 C5          203 DONE15:  SEL    RB0          ;
00B4 FA          204          MOV    A,R2         ;LOOK AT RAM LOCATION DATA
00B5 C635        205          JZ     NXTONE       ;
00B7 04D5        206          JMP    CKDCOD       ;IF NO GO PROCESS
                 207
                 208
                 209
                 210
00B9 18          211 NOJAM:   INC    R0           ;INCREMENT THE POINTER
00BA F8          212          MOV    A,R0         ;GET THE POINTER VALUE
00BB D338        213          XRL    A,#TABLE1    ;SEE IF THE POINTER HAS GONE OVER MAX COUNT
00BD C6A4        214          JZ     DONE10       ;IF MAX COUNT EXIT, ITS DONE CHECKING JAMS
00BF 0470        215          JMP    REZOOM       ;IF NOT OVERCOUNT, CHECK NEXT JAM COMPARISON
                 216 $EJECT
                 217
00C1 24EF        218 DECNT1:  JMP    DECNT        ;THIS IS JUST TO FACILITATE A GLOBAL JUMP
00C3 24B8        219 DIAGIN:  JMP    DIAGI1       ;SAME AS ABOVE
00C5 24DA        220 DIAGOT:  JMP    DIAGO1       ;DITTO
00C7 242D        221 OUTIT1:  JMP    OUTIT        ;SAME AS ABOVE
00C9 241C        222 JAMIN1:  JMP    JAMIN        ;DITTO
00D5             223          ORG    0D5H
```

```
00D5 C5        CKDCOD: SEL   RB0      ;SELECT REGISTER BANK 0
00D6 F1                MOV   A,@R1    ;GET R1
00D7 53F0              ANL   A,#0F0H  ;MASK THE ORIGONAL CLOCK COUNT
00D9 47                SWAP  A        ;SWAP TO LSB
00DA AE                MOV   R6,A     ;STORE IT
00DB F1                MOV   A,@R1    ;GET R1
00DC 530F              ANL   A,#0FH   ;AND ACCUM.WITH LSB MASK
00DE C6C7              JZ    OUTIT1   ;IF 0 GO RIGHT TO OUTPUT ROUTINES
00E0 37                CPL   A        ;IF NOT 0 COMPLIMENT THE ACCUMULATOR
00E1 0302              ADD   A,#2H    ;ADD 1 TO GET A 2'S COMPLIMENT+1 ADJ.
00E3 6E                ADD   A,R6     ;THE ADD R6 (MSB-LSB+1 OF @R1)
00E4 AE                MOV   R6,A     ;STORE THE RESULT
00E5 D5                SEL   RB1      ;
00E6 FC                MOV   A,R4     ;GET STATUS REG
00E7 D2C9              JB6   JAMIN1   ;IF BIT 1(CK1 J.I.P.)SEE LOOKING FOR CK 1
00E9 C5        REZUME: SEL   RB0      ;
00EA F0                MOV   A,@R0    ;GET PRESENT RAM LOCATION
00EB 92F4              JB4   STLBLK   ;IF B4, CLOCK STILL BLOCKED ,ABORT
00ED FE                MOV   A,R6     ;IF B4=0 PROCEED ,CLOCK NOT BLOCKED
00EE 7459              CALL  SETBIT   ;GO TO SUB ROUTINE TO DECODE BINARY CODE
00F0 5440              CALL  LOOKPC   ;GO LOOK FOR SELECTED CLOCK
00F2 96C1              JNZ   DECNT1   ;IF CLOCK=1 DECREMENT CLOCK COUNT
               $EJECT
00F4 FE        STLBLK: MOV   A,R6     ;GET PREVIOUS CLICK LOCATION
00F5 03FF              ADD   A,#0FFH  ;SUBTRACT 1
00F7 AE                MOV   R6,A     ;STORE IT
00F8 C635              JZ    NXTONE   ;IF CK-1=0 DON'T BOTHER
00FA 7459              CALL  SETBIT   ;GO DECODE CK-1
00FC 5440              CALL  LOOKPC   ;GO LOOK FOR CLOCK-1
00FE AC                MOV   R4,A     ;STORE THE RESULT
00FF C609              JZ    CLRIT    ;IF 0 GO LOOK TO SEE IF @R0 B4 IS SET
0101 F0                MOV   A,@R0    ;GET R0
0102 9213              JB4   NOCLR    ;IF PC=1 AND BIT 4 IS SET EXIT!
0104 FC                MOV   A,R4     ;GET LOOKPC RESULTS
0105 9615              JNZ   ERACIT   ;IF CK-1 OCCURS KILL ALL DATA
0107 0435              JMP   NXTONE   ;EXIT NO CLOCKS
0109 D5        CLRIT:  SEL   RB1      ;
010A FA                MOV   A,R2     ;GET STATUS REG 1
010B 37                CPL   A        ;
010C 1224              JB0   MAYCLR   ;IF JIP SEE IF JAMS AT THIS CLOCK IN PROC.
010E C5        DOITT:  SEL   RB0      ;
010F F0                MOV   A,@R0    ;GET R0
0110 53EF              ANL   A,#0EFH  ;RESET CLOCK HIGH BIT(B4)
0112 A0                MOV   @R0,A    ;STORE IT BACK
0113 0435      NOCLR:  JMP   NXTONE   ;EXIT
               $EJECT
               ;<<
```

```
0127 C5          287          SEL    RB0          ;
0128 DE          288          XRL    A,R6         ;COMPARE JAM CLOCK TO PRESENT CLOCK
0129 C613        289          JZ     NOCLR        ;IF THEY COMPARE DON'T CLEAR BIT 4
012B 240E        290          JMP    DOITT        ;IF THEY DON'T COMPARE PROCEED
                 291
012D F0          292 OUTIT:   MOV    A,@R0        ;GET R0, OUTPUT TYPE
012E F234        293          JB7    WT           ;MOS,MAILING MACHINE,3 TIER,NO SEAL
0130 D240        294          JB6    ZIPDEF       ;ZIP DEFLECTOR
0132 B2F8        295          JB5    EJMARK       ;EDGE MARKER ALIAS ZIP MARK
                 296
0134 D23C        297 WT:      JB6    TIERC1       ;GO TO 3 TIER LEVEL C PROGRAM
0136 B23A        298          JB5    TIERB1       ;GO TO 3 TIER LEVEL B PROGRAM
0138 247A        299          JMP    WIPPIT       ;THIS IS A JUMP TABLE
                 300
013A 4416        301 TIERB1:  JMP    TIERB        ;SAME AS BELOW
013C 441C        302 TIERC1:  JMP    TIERC        ;THIS IS TO FACILITATE A GLOBAL JUMP
013E 04E9        303 REZUM1:  JMP    REZUME       ;DITTO
                 304 $EJECT
                 305
                 306
                 307 ;<<
```

```
0178 244B        GETOUT: JMP     GTOUT          ;THIS IS JUST TO FACILITATE A GLOBAL JUMP
                 $EJECT
                 ;<<
```

```
01C2 47          415          SWAP   A              ;SWAP TO THE MSB
01C3 AC          416          MOV    R4,A           ;STORE IT
01C4 8E          417          MOVD   A,P6           ;GET INPUTS 8 THRU 11
01C5 4C          418          ORL    A,R4           ;COMBINE INPUTS 12-15 WITH 8-11
01C6 02          419          OUT    DBB,A          ;SEND IM TO S.V.
01C7 86C7        420 NUTYET.  JOBF   NUTYET         ;DID THE SUPERVISOR TAKE IT YET
01C9 D5          421          SEL    RB1            ;
01CA FA          422          MOV    A,R2           ;GET STATUS WORD #1
01CB 32CF        423          JB1    UNDO           ;IF RESET BIT EXIT...
01CD 24B8        424          JMP    DIAGI1         ;IF NOT DO IT AGAIN
                 425 $EJECT
01CF 536D        426 UNDO     ANL    A,#06DH        ;CLEAR RESET ,DIAGNOSTIC OUT OR IN
01D1 AA          427          MOV    R2,A           ;STORE IT
01D2 2300        428          MOV    A,#00H         ;RESET MASK
01D4 3C          429          MOVD   P4,A           ;RESET PORT
01D5 3D          430          MOVD   P5,A           ;RESET PORT
01D6 3E          431          MOVD   P6,A           ;RESET PORT
01D7 3F          432          MOVD   P7,A           ;RESET PORT
01D8 0435        433          JMP    NXTONE         ;EXIT
                 434
                 435
                 436 $EJECT
                 437
                 438 ;;;;;;OOOO
```

```
01FE A0          478          MOV    @R0,A          ;RESTORE WITHOUT B4 SET
01FF 530F        479          ANL    A,#0FH         ;MASK OUTPUT CODE
0201 7459        480          CALL   SETBIT         ;DECODE IT
0203 7400        481          CALL   OUTPUT         ;TURN EDGEMARKER ON
0205 F1          482 SONOIM   MOV    A,@R1          ;GET CLOCK  CODE
0206 47          483          SWAP   A              ;SWAP MSB TO LSB(LSB=0)
0207 7459        484          CALL   SETBIT         ;DECODE CLOCK
0209 5440        485          CALL   LOOKPC         ;CHECK THE STATUS OF THE MMTRP
020B 9614        486          JNZ    EXITTT         ;IF MMTRP IS HIGH (ON) EXIT
020D F0          487          MOV    A,@R0          ;GET OUTPUT PORT CODE
020E 7459        488          CALL   SETBIT         ;DECODE IT
0210 5400        489          CALL   OUTOFF         ;GO TURN THE EDGEMARKER OFF
0212 2415        490          JMP    ERACIT         ;EXIT AND ERACE DATA IN @R1&R0
0214 0435        491 EXITTT:  JMP    NXTONE         ;EXIT
                 492 $EJECT
                 493
                 494 ;<<
```

```
0256 9287          JB4     PORT5        ;JUMP ON BIT 4 TO LOOK FOR CLOCK 4
0258 BC02          MOV     R4,#2H       ;PORT 5,1 MASK
025A B287          JB5     PORT5        ;JUMP ON BIT 5 TO LOOK FOR CLOCK 5
025C BC04          MOV     R4,#4H       ;PORT 5,2 MASK
025E D287          JB6     PORT5        ;JUMP ON BIT 6 TO LOOK FOR CLOCK 6
0260 BC08          MOV     R4,#8H       ;PORT 5,3 MASK
0262 F287          JB7     PORT5        ;JUMP ON BIT 7 TO LOOK FOR CLOCK 7
0264 BC01          BIGWON: MOV     R4,#1H       ;PORT 6,0 MASK
0266 128A          JB0     PORT6        ;JUMP ON BIT 0 TO LOOK FOR CLOCK 8
0268 BC02          MOV     R4,#2H       ;PORT 6,1 MASK
026A 328A          JB1     PORT6        ;JUMP ON BIT 1 TO LOOK FOR CLOCK 9
026C BC06          MOV     R4,#6H       ;PORT 6,2 MASK
026E 528A          JB2     PORT6        ;JUMP ON BIT 2 TO LOOK FOR CLOCK 10
0270 BC08          MOV     R4,#8H       ;PORT 6,3 MASK
0272 728A          JB3     PORT6        ;JUMP ON BIT 3 TO LOOK FOR CLOCK 11
0274 BC01          MOV     R4,#1H       ;PORT 7,0 MASK
0276 928D          JB4     PORT7        ;JUMP ON BIT 4 TO LOOK FOR CLOCK 12
0278 BC02          MOV     R4,#2H       ;PORT 7,1 MASK
027A B28D          JB5     PORT7        ;JUMP ON BIT 5 TO LOOK FOR CLOCK 13
027C BC04          MOV     R4,#4H       ;PORT 7,2 MASK
027E D28D          JB6     PORT7        ;JUMP ON BIT 6 TO LOOK FOR CLOCK 14
0280 BC08          MOV     R4,#8H       ;PORT 7,3 MASK
0282 F28D          JB7     PORT7        ;JUMP ON BIT 7 TO LOOK FOR CLOCK 15
                   $EJECT
0284 0C            PORT4:  MOVD    A,P4         ;GET INPUTS ON PORT 4
0285 5C            ANL     A,R4         ;MASK SELECTED INPUT
0286 93            RETR                 ;RETURN TO MAIN PROGRAM
0287 0D            PORT5:  MOVD    A,P5         ;GET INPUTS ON PORT 5
0288 5C            ANL     A,R4         ;MASK SELECTED INPUTS
0289 93            RETR                 ;RETURN TO MAIN PROGRAM
028A 0E            PORT6:  MOVD    A,P6         ;GET INPUTS ON PORT 6
028B 5C            ANL     A,R4         ;MASK SELECTED INPUTS
028C 93            RETR                 ;RETURN TO MAIN PROGRAM
028D 0F            PORT7:  MOVD    A,P7         ;GET INPUTS ON PORT 7
028E 5C            ANL     A,R4         ;MASK SELECTED INPUTS
028F 93            RETR                 ;RETURN TO MAIN PROGRAM
                   $EJECT

                   ;<<
```

```
02BC BCFB        606          MOV     R4,#0FBH        ;PORT 6,2 MASK
02BE 52DA        607          JB2     PRT6            ;JUMP ON BIT 2 TO OFF OUTPUT 11
02C0 BC07        608          MOV     R4,#07H         ;PORT 6,3 MASK
02C2 72DA        609          JB3     PRT6            ;JUMP ON BIT 3 TO OFF OUTPUT 12
02C4 BCFE        610          MOV     R4,#0FEH        ;PORT 7,0 MASK
02C6 92DD        611          JB4     PRT7            ;JUMP ON BIT 4 TO OFF OUTPUT 13
02C8 BCFD        612          MOV     R4,#0FDH        ;PORT 7,1 MASK
02CA B2DD        613          JB5     PRT7            ;JUMP ON BIT 5 TO OFF OUTPUT 14
02CC BCFB        614          MOV     R4,#0FBH        ;PORT 7,2 MASK
02CE D2DD        615          JB6     PRT7            ;JUMP ON BIT 6 TO OFF OUTPUT 15
02D0 BC07        616          MOV     R4,#07H         ;PORT 7,3 MASK
02D2 F2DD        617          JB7     PRT7            ;JUMP ON BIT 7 TO OFF OUTPUT 16
                 618 $EJECT
02D4 FC          619 PRT4:    MOV     A,R4            ;GET MASK SELECTED
02D5 9C          620          ANLD    P4,A            ;TURN OFF SELECTED OUTPUT PORT
02D6 93          621          RETR                    ;EXIT
02D7 FC          622 PRT5     MOV     A,R4            ;GET MASK SELECTED
02D8 9D          623          ANLD    P5,A            ;TURN OFF SELECTED OUTPUT PORT
02D9 93          624          RETR                    ;EXIT
02DA FC          625 PRT6:    MOV     A,R4            ;GET MASK SELECTED
02DB 9E          626          ANLD    P6,A            ;TURN OFF SELECTED OUTPUT PORT
02DC 93          627          RETR                    ;EXIT
02DD FC          628 PRT7:    MOV     A,R4            ;GET MASK SELECTED
02DE 9F          629          ANLD    P7,A            ;TURN OFF SELECTED OUTPUT PORT
02DF 93          630          RETR                    ;EXIT
                 631 $EJECT
                 632 ;>>>
```

```
033E 0240        670          JB6     PERT7          ;JUMP ON BIT 14 TO OUTPUT 15
0340 BC08        671          MOV     R4,#8H         ;OUTPUT MASK PORT 7.3
0342 F240        672          JB7     PERT7          ;JUMP ON BIT 15 TO OUTPUT 16
0344 FC          673 PERT4    MOV     A,R4           ;GET OUTPUT PORT MASK
0345 8C          674          ORLD    P4,A           ;OUTPUT PORT HIGH
0346 93          675          RETR                   ;EXIT
0347 FC          676 PERT5    MOV     A,R4           ;GET OUTPUT PORT MASK
0348 8D          677          ORLD    P5,A           ;OUTPUT PORT HIGH
0349 93          678          RETR                   ;EXIT
034A FC          679 PERT6    MOV     A,R4           ;GET OUTPUT PORT MASK
034B 8E          680          ORLD    P6,A           ;OUTPUT PORT HIGH
034C 93          681          RETR                   ;EXIT
034D FC          682 PERT7    MOV     A,R4           ;GET OUTPUT PORT MASK
034E 8F          683          ORLD    P7,A           ;OUTPUT PORT HIGH
034F 93          684          RETR                   ;EXIT
                 685 $EJECT
                 686 ;;;
```

```
0372 530F        734          ANL    A,#0FH        ;MASK CLOCK COUNT CODE
0374 A5          735          MOV    R5,A          ;STORE IT IN R5
0375 47          736          SWAP   A             ;SWAP MSB AND LSB
0376 45          737          ORL    A,R5          ;NOW MAKE CLOCK COUNT = LSB AND MSB
0378 D5          738          SEL    RB0           ;
0379 A1          739          MOV    @R1,A         ;STORE IT IN RAM
037A D5          740          SEL    RB1           ;
037B FE          741          MOV    A,R6          ;GET DBB
037C 5F          742          ANL    A,R7          ;CLEAR INPUT.INFO BIT
037D AE          743          MOV    R6,A          ;STORE DBB BACK
037E C5          744          SEL    RB0           ;
037F 64EF        745          JMP    RELOOK        ;GO SEE IF THERE'S ANY MORE INFORMATION
                 746 $EJECT
                 747
0381 5289        748 JMWORD   JB2    INITON        ;INITIALIZATION ALREADY DONE
0383 4304        749          ORL    A,#04H        ;SET INITIALIZED BIT
0385 AA          750          MOV    R2,A          ;STORE STATUS REG
0386 B9C0        751          MOV    R1,#JMWOD1    ;INITIALIZE POINTER TO RAM LOC 48D
0388 FE          752 INITON   MOV    A,R6          ;GET DBB, JAM WORD
0389 C694        753          JZ     NOMORE        ;IF ONE COMES IN ZERO,ITS THE END
038B A1          754          MOV    @R1,A         ;STORE IT TO RAM
038C 19          755          INC    R1            ;INCREMENT THE POINTER
038D F9          756          MOV    A,R1          ;GET THE VALUE OF THE POINTER
038E D229        757          XRL    A,#TABLE1     ;IS THE POINTER OVER THE MAX VALUE
0390 C694        758          JZ     NOMORE        ;IF SO GO RESTORE STATUS REG
0392 6450        759          JMP    DONEE         ;EXIT
0394 FA          760 NOMORE   MOV    A,R2          ;GET STATUS
0395 53BB        761          ANL    A,#0BBH       ;CLEAR STATUS BITS FOR INIT AND JM WRD
0397 AA          762          MOV    R2,A          ;RE STORE IT
0399 6450        763          JMP    DONEE         ;EXIT
                 764 $EJECT
039A 52A1        765 OUTWRD   JB2    NOINIT        ;IF BIT 2, WE'VE ALREADY INITIALIZED
039C 4304        766          ORL    A,#04H        ;SET INITIALIZATION BITS
039E AA          767          MOV    R2,A          ;STORE IT
039F B910        768          MOV    R1,#OTPT0     ;SET INITIAL POINTER STARTING POINT
03A1 FE          769 NOINIT   MOV    A,R6          ;GET DBB, OUTPUT WORD
03A2 C6A0        770          JZ     THELST        ;IF = 0  NO MORE OUTPUT WORDS
03A4 A1          771          MOV    @R1,A         ;STORE THE OUTPUT WORD
03A5 19          772          INC    R1            ;INCREMENT THE POINTER
03A6 F9          773          MOV    A,R1          ;GET THE VALUE OF THE POINTER
03A7 D330        774          XRL    A,#JMWOD1     ;SEE IF THE POINTER IS ABOVE MAX VALUE
03A9 C6A0        775          JZ     THELST        ;IT IS
03AB 6450        776          JMP    DONEE         ;EXIT
03AD FA          777 THELST   MOV    A,R2          ;GET STATUS REGISTER
03AE 53F3        778          ANL    A,#0F3H       ;RESET INIT AND OUT WORD BITS
03B0 AA          779          MOV    R2,A          ;STORE IT
03B1 C9          780          DEC    R1            ;DECREMENT THE POINTER TO THE LAST ENTRY
03B2 F1          781          MOV    A,@R1         ;GET THE LAST OUTWORD
03B3 530F        782          ANL    A,#0FH        ;MASK OFF THE CLOCK CODE
03B5 B97F        783          MOV    R1,#VPS       ;SET THE POINTER TO THE LOCATION OF VPS
03B7 A1          784          MOV    @R1,A         ;STORE THE CLOCK CODE THERE
03B8 6450        785          JMP    DONEE         ;EXIT
                 786 $EJECT
                 787
03C9             788          ORG    3C9H
03C9 D5          789 IBFEND   SEL    RB1           ;SELECT REGISTER BANK 1
03CA AB          790          MOV    R3,A          ;STORE THE ACCUMULATOR TEMPORARILY
03CB C5          791          SEL    RB0           ;
03CC F8          792          MOV    A,R0          ;GET PRESENT RAM LOCATION OF R0
03CD AF          793          MOV    R7,A          ;NOW STORE THE VALUE
03CE F9          794          MOV    A,R1          ;GET PRESENT RAM LOCATION OF R1
03CF AB          795          MOV    R3,A          ;NOW STORE THE VALUE
03D0 D5          796          SEL    RB1           ;
03D1 22          797 ENTER    IN     A,DBB         ;INPUT THE DATA BUS
```

```
03D2 AE          798          MOV    R6,A          ;STORE DBB
03D3 76D7        799          JF1    COMAND        ;IF FLAG ONE IS SET - IT'S A COMMAND
03D5 64E1        800          JMP    DATA          ;IF NOT SET ITS DATA
03D7 4A          801 COMAND:  ORL    A,R2          ;COMBINE OLD AND NEW COMMAND BITS
03D8 AA          802          MOV    R2,A          ;STORE IT BACK TO R1
03D9 37          803          CPL    A             ;FLIP IT(STATUS)
03DA 12DF        804          JB0    SKIPIT        ;IF NO RESET JAM COMAND SKIP THIS
03DC 2300        805          MOV    A,#00H        ;RESET STATUS WORD OUTPUT JAM
03DE 90          806          MOV    STS,A         ;DO IT
03DF 6450        807 SKIPIT:  JMP    DONE6         ;GO FINISH UP AND EXIT
03E1 FA          808 DATA     MOV    A,R2          ;GET STATUS REGISTER
03E2 D281        809          JB6    JMWORD        ;IF B6, THEN THIS IS A JAM WORD
03E4 729A        810          JB3    OUTWRD        ;IF BIT 3 THIS IS AN OUT WORD
03E6 F250        811          JB7    DONE6         ;EXIT IF IN DIAGNOSTICS
03E8 9250        812          JB4    DONE6         ;SAME AS ABOVE
03EA C5          813          SEL    RB0           ;
03EB B838        814          MOV    R0,#TABLE1    ;INITIATE THE POINTER
03ED B958        815          MOV    R1,#TABLE2    ;INITIATE THE POINTER
                 816 $EJECT
03EF F0          817 RELOOK:  MOV    A,@R0         ;SEE IF THERE'S ANYTHING IN THIS LOCATION
03F0 C6FD        818          JZ     GOTONE        ;IF ZERO ITS EMPTY
03F2 18          819          INC    R0            ;INCREMENT THE POINTER
03F3 19          820          INC    R1            ;INCREMENT THE OTHER POINTER
03F4 F8          821          MOV    A,R0          ;GET THE VALUE OF THE POINTER
03F5 D258        822          XRL    A,#TABLE2     ;COMPARE IT WITH THE INITIAL VALUE OF TABLE1
03F7 96EF        823          JNZ    RELOOK        ;GO LOOK AT THE NEXT RAM LOCATION
03F9 D5          824          SEL    RB1           ;
03FA FE          825          MOV    A,R6          ;GET DBB
03FB 96FB        826 HERE     JNZ    HERE          ;IF MORE INFO AN NO MORE ROOM WAIT HERE FOREVER
03FD D5          827 GOTONE   SEL    RB1           ;
03FE FC          828          MOV    A,R4          ;GET STATUS REG #2
03FF B219        829          JB5    MSB           ;IF BIT5=1 THIS IS S-15
0401 FE          830          MOV    A,R6          ;GET DBB
0402 122F        831          JB0    ORT0          ;A INPUT TO PORT 0 OUTPUT
0404 3227        832          JB1    ORT1          ;A INPUT TO PORT 1 OUTPUT
0406 523F        833          JB2    ORT2          ;A INPUT TO PORT 2 OUTPUT
0408 7247        834          JB3    ORT3          ;A INPUT TO PORT 3 OUTPUT
040A 924F        835          JB4    ORT4          ;A INPUT TO PORT 4 OUTPUT
040C B257        836          JB5    ORT5          ;A INPUT TO PORT 5 OUTPUT
040E D25F        837          JB6    ORT6          ;A INPUT TO PORT 6 OUTPUT
0410 F267        838          JB7    ORT7          ;A INPUT TO PORT 7 OUTPUT
0412 FC          839          MOV    A,R4          ;GET STATUS REG #2
0413 43B0        840          ORL    A,#0B0H       ;SET NEXT MSB AND DATA RECIEVED BITS
0415 AC          841          MOV    R4,A          ;STORE IT
0416 6450        842          JMP    DONE6         ;RESTORE AND EXIT
0418 FE          843 MSB:     MOV    A,R6          ;GET DBB
0419 126F        844          JB0    ORT8          ;A INPUT TO PORT 8 OUTPUT
041B 3277        845          JB1    ORT9          ;A INPUT TO PORT 9 OUTPUT
041D 527F        846          JB2    ORT10         ;A INPUT TO PORT 10 OUTPUT
041F 7287        847          JB3    ORT11         ;A INPUT TO PORT 11 OUTPUT
0421 928F        848          JB4    ORT12         ;A INPUT TO PORT 12 OUTPUT
0423 B297        849          JB5    ORT13         ;A INPUT TO PORT 13 OUTPUT
0425 D29F        850          JB6    ORT14         ;A INPUT TO PORT 14 OUTPUT
0427 F2A7        851          JB7    ORT15         ;A INPUT TO PORT 15 OUTPUT
0429 FC          852          MOV    A,R4          ;GET STATUS REG
042A 53DF        853          ANL    A,#0DFH       ;UN SET MSB MASK TO LSB
042C AC          854          MOV    R4,A          ;STORE IT
042D 6450        855          JMP    DONE6         ;RESTORE AND EXIT
                 856 $EJECT
042F B920        857 ORT0     MOV    R1,#OTPT0     ;GET OUTPUT 0 DESCRIPTION
0431 BD00        858          MOV    R5,#00H       ;GET OUTPUT PORT NUMBER
0433 BFFE        859          MOV    R7,#0FEH      ;GET CLEAR B0 MASK
0435 6456        860          JMP    SETRAM        ;GO STORE OUTPUT 0 TO RAM
0437 B921        861 ORT1     MOV    R1,#OTPT1     ;GET OUTPUT 1 DESCRIPTION
```

```
0439 BD01          862          MOV    R5,#01H        ;GET OUTPUT PORT NUMBER
043B BFFD          863          MOV    R7,#0FDH       ;CLEAR B1 MASK
043D 646B          864          JMP    SETRAM         ;GO STORE OUTPUT 1 TO RAM
043F B922          865 ORT2     MOV    R1,#OTPT2      ;GET OUTPUT 2 DESCRIPTION
0441 BD02          866          MOV    R5,#02H        ;GET OUTPUT PORT NUMBER
0443 BFFB          867          MOV    R7,#0FBH       ;CLEAR B2 MASK
0445 646B          868          JMP    SETRAM         ;GO STORE OUTPUT 2 TO RAM
0447 B923          869 ORT3     MOV    R1,#OTPT3      ;GET OUTPUT 3 DESCRIPTION
0449 BD03          870          MOV    R5,#03H        ;GET PORT NUMBER
044B BFF7          871          MOV    R7,#0F7H       ;CLEAR B3 MASK
044D 646B          872          JMP    SETRAM         ;GO STORE OUTPUT 3 TO RAM
044F B924          873 ORT4     MOV    R1,#OTPT4      ;GET OUTPUT 4 DESCRIPTION
0451 BD04          874          MOV    R5,#04H        ;GET PORT NUMBER
0453 BFEF          875          MOV    R7,#0EFH       ;CLEAR BIT 4 MASK
0455 646B          876          JMP    SETRAM         ;GO STORE OUTPUT 4 TO RAM
0457 B925          877 ORT5     MOV    R1,#OTPT5      ;GET OUTPUT 5 DESCRIPTION
0459 BD05          878          MOV    R5,#05H        ;GET PORT NUMBER
045B BFDF          879          MOV    R7,#0DFH       ;CLEAR BIT 5 MASK
045D 646B          880          JMP    SETRAM         ;GO STORE OUTPUT 5 TO RAM
045F B926          881 ORT6     MOV    R1,#OTPT6      ;GET OUTPUT 6 DESCRIPTION
0461 BD06          882          MOV    R5,#06H        ;GET PORT NUMBER
0463 BFBF          883          MOV    R7,#0BFH       ;CLEAR BIT 6 MASK
0465 646B          884          JMP    SETRAM         ;GO STORE OUTPUT 6 TO RAM
0467 B927          885 ORT7     MOV    R1,#OTPT7      ;GET OUTPUT 7 DESCRIPTION
0469 BD07          886          MOV    R5,#07H        ;GET PORT NUMBER
046B BF7F          887          MOV    R7,#7FH        ;CLEAR BIT 7 MASK
046D 646B          888          JMP    SETRAM         ;GO STORE OUTPUT 7 TO RAM
046F B928          889 ORT8:    MOV    R1,#OTPT8      ;GET OUTPUT 8 DESCRIPTION
0471 BD08          890          MOV    R5,#08H        ;GET PORT NUMBER
0473 BFFE          891          MOV    R7,#0FEH       ;CLEAR BIT 0 MASK
0475 646B          892          JMP    SETRAM         ;GO STORE OUTPUT 8 TO RAM
0477 B929          893 ORT9:    MOV    R1,#OTPT9      ;GET OUTPUT 9 DESCRIPTION
0479 BD09          894          MOV    R5,#09H        ;GET PORT NUMBER
047B BFFD          895          MOV    R7,#0FDH       ;CLEAR BIT 1 MASK
047D 646B          896          JMP    SETRAM         ;GO STORE OUTPUT 9 TO RAM
047F B92A          897 ORT10:   MOV    R1,#OTPT10     ;GET OUTPUT 10 DESCRIPTION
0481 BD0A          898          MOV    R5,#0AH        ;GET PORT NUMBER
0483 BFFB          899          MOV    R7,#0FBH       ;CLEAR BIT 2 MASK
0485 646B          900          JMP    SETRAM         ;GO STORE OUTPUT 10 TO RAM
                   901 $EJECT
0487 B92B          902 ORT11:   MOV    R1,#OTPT11     ;GET OUTPUT 11 DESCRIPTION
0489 BD0B          903          MOV    R5,#0BH        ;GET PORT NUMBER
048B BFF7          904          MOV    R7,#0F7H       ;CLEAR BIT 3 MASK
048D 646B          905          JMP    SETRAM         ;GO STORE OUTPUT 11 TO RAM
048F B92C          906 ORT12:   MOV    R1,#OTPT12     ;GET OUTPUT 12 DESCRIPTION
0491 BD0C          907          MOV    R5,#0CH        ;GET PORT NUMBER
0493 BFEF          908          MOV    R7,#0EFH       ;CLEAR BIT 4 MASK
0495 646B          909          JMP    SETRAM         ;GO STORE OUTPUT 12 TO RAM
0497 B92D          910 ORT13:   MOV    R1,#OTPT13     ;GET OUTPUT 13 DESCRIPTION
0499 BD0D          911          MOV    R5,#0DH        ;GET  PORT NUMBER
049B BFDF          912          MOV    R7,#0DFH       ;CLEAR BIT 5 MASK
049D 646B          913          JMP    SETRAM         ;GO STORE OUTPUT 13 TO RAM
049F B92E          914 ORT14    MOV    R1,#OTPT14     ;GET OUTPUT 14 DESCRIPTION
04A1 BD0E          915          MOV    R5,#0EH        ;GET PORT NUMBER
04A3 BF0B          916          MOV    R7,#0BH        ;CLEAR BIT 6 MASK
04A5 646B          917          JMP    SETRAM         ;GO STORE OOUTPUT 14 TO RAM
04A7 B92F          918 ORT15    MOV    R1,#OTPT15     ;GET OUTPUT 15 DESCRIPTION
04A9 BD0F          919          MOV    R5,#0FH        ;GET PORT NUMBER
04AB BF7F          920          MOV    R7,#7FH        ;CLEAR BIT 7 MASK
04AD 646B          921          JMP    SETRAM         ;GO STORE OUTPUT 15 TO RAM
                   922
                   923 END
```

```
USER SYMBOLS
ALLJAM 006E   BGONE  0324   BIGONE 02B4   BIGWON 0264   CHKT0  0167   CKDATA 01B2   CKDCOD 0005   CLOCK5 0220
CLRIT  0109   COMAND 03D7   CONTIN 0196   CONTNU 0234   DATA   03E1   DECNT  01EF   DECNT1 00C1   DESIZ  0191
DIAGI1 01B8   DIAGIN 00C3   DIAG01 01DA   DIAGOT 00C5   DOITT  010E   DOJAM  005A   DONE10 00A4   DONE15 00B3
DONE6  0350   EJMARK 01F8   ENDCLR 0021   ENTER  03D1   ERRCIT 0115   EXITTT 0214   FINISH 0360   FRSTIM 01FC
GETOUT 0178   GOAGEN 0014   GOON   0363   GOTONE 03FD   GTOUT  014B   HERE   03FB   IBFEND 03C9   IBFVEC 0003
INITDN 0388   JAMIN  011C   JAMIN1 00C9   JMCHEK 0049   JMWOD1 0030   JMWOD2 0031   JMWOD3 0032   JMWOD4 0033
JMWOD5 0034   JMWOD6 0035   JMWOD7 0036   JMWOD8 0037   JMWORD 0381   KILL1  009D   LOOKPC 0240   MRYCLR 0124
MSB    0418   NOCLOK 01A6   NOCLR  0113   NOINIT 03A1   NOJAM  0089   NOMORE 0394   NOTYET 01BF   NUTYET 01C7
NXTONE 0035   OFFIT  019C   OFFYPS 00B1   OFTIME 023A   OK     0047   ONIT   01E3   ORT0   042F   ORT1   0437
ORT10  047F   ORT11  0487   ORT12  048F   ORT13  0497   ORT14  049F   ORT15  04A7   ORT2   043F   ORT3   0447
ORT4   044F   ORT5   0457   ORT6   045F   ORT7   0467   ORT8   046F   ORT9   0477   OTPT0  0020   OTPT1  0021
OTPT10 002A   OTPT11 002B   OTPT12 002C   OTPT13 002D   OTPT14 002E   OTPT15 002F   OTPT2  0022   OTPT3  0023
OTPT4  0024   OTPT5  0025   OTPT6  0026   OTPT7  0027   OTPT8  0028   OTPT9  0029   OUTIT  012D   OUTIT1 00C7
OUTOFF 0290   OUTPUT 0300   OUTWRD 039A   PAYDAY 01E9   PERT4  0344   PERT5  0347   PERT6  034A   PERT7  034D
PORT4  0284   PORT5  0287   PORT6  028A   PORT7  028D   PRT4   02D4   PRT5   02D7   PRT6   02DA   PRT7   02DD
RELOOK 03EF   REZOOM 0070   REZUM1 013E   REZUME 00E9   RINIT  0010   RSTVEC 0000   SCNDIM 0205   SETBIG 0368
SETBIT 0359   SETRAM 036B   SKIPIT 03DF   STILPC 022F   STLBLK 00F4   TABLE1 0038   TABLE2 0058   THELST 03AD
THENO  0357   THRYET 014D   TIERB  0216   TIERB1 013A   TIERC  021C   TIERC1 013C   UNDO   01CF   VPS    007F
WIPPIT 017A   WT     0134   ZIPDEF 0140

ASSEMBLY COMPLETE,   NO ERRORS
```

What is claimed is:

1. A method for interfacing with envelope handling accessories for a universal multi-station document inserter for performing predetermined functions with envelopes having documents inserted therein by the multi-station document inserter, comprising the steps of:

providing an accessory interface microcomputer;

arranging accessories responsive to output signals from the accessory interface microcomputer in an array;

providing envelope sensing means in the array for providing clock signals to the accessory interface microcomputer;

storing data words in the accessory interface microcomputer, certain of the data words indicating particular combinations of signals from said envelope sensing means for detecting envelope jams and other data words indicating the type of accessory, its output location, clock data relating to the particular accessory, and indicating the accessories to be actuated by an envelope entering the array;

storing envelope handling programs in the accessory interface microcomputer; and actuating the accessories of the accessory array under control of the accessory interface microcomputer in accordance with the data words stored therein in response to clock signals from the envelope sensing means.

2. The method recited in claim 1, including the steps of:

providing a supervisory control circuit including a microcomputer having certain of said data words stored therein for the accessories of the accessory array;

transmitting the data words to a RAM of the accessory interface microcomputer for use with envelope handling programs stored in the accessory interface microcomputer.

3. The method recited in claim 2, including the steps of:

loading data words corresponding to particular combinations of signals from envelope sensing means for indicating envelope jams, the type of accessory, its output location and clock data into the RAM of the accessory interface microcomputer upon power up of the inserter;

loading other data words indicating the accessories to be actuated by an envelope entering the array prior to the envelope entering the array.

4. The method recited in claim 3 including the step of:

providing clock input signals to the accessory interface microcomputer from the envelope sensing means in response to envelopes moving past the envelope sensing means.

5. The method recited in claim 4 including the step of:

decrementing the clock data stores in the RAM of the accessory interface microcomputer in response to the clock input signals from the envelope sensing means.

6. The method recited in claim 5, including the step of:

providing external timing signals to the accessory interface microcomputer for a zip code deflector accessory.

7. The method recited in claim 2, including the step of:

providing a transfer acknowledge signal from the accessory interface microcomputer to the supervisory control microcomputer upon receipt of data and commands therefrom by the accessory interface microcomputer.

8. The method recited in claim 1, including the step of:

electrically coupling port expander means to the accessory interface microcomputer to expand its input and output ports.

9. The method recited in claim 1, including the step of:

providing a transport system for the accessory array;

electrically coupling some of the output ports of the accessory interface microcomputer with the transport system for movement of envelopes along the array in response to output signals from the accessory interface microcomputer.

10. A method for interfacing with envelope handling accessories for a universal multi-station document inserter for performing predetermined functions with envelopes having documents inserted therein by the multi-station document inserter, comprising the steps of:

providing an accessory interface microcomputer;

arranging accessories responsive to output signals from the accessory interface microcomputer in an array;

providing envelope sensing means in the array for providing clock signals to the accessory interface microcomputer;

storing envelope handling programs in the accessory interface microcomputer;

providing a supervisory control circuit including a microcomputer having data words stored therein for the accessories of the accessory array;

transmitting the data words from the supervisory control circut to a RAM in the accessory interface microcomputer for use with the envelope handling programs stored in the accessory interface microcomputer, certain of said data words corresponding to particular combinations of envelope sensing means signals for indicating envelope jams, the type of accessory, its output location and clock data into the RAM of the accessory interface computer upon power up of the inserter, others of said data words indicating the accessories to be actuated by an envelope entering the array prior to the envelope entering the accessory array;

providing a transport system for the accessory array;

providing clock input signals to the accessory interface microcomputer from the envelope sensing means in response to envelopes moving past the envelope sensing means;

actuating the various accessories of the accessory array under control of the accessory interface microcomputer in accordance with the data words stored therein in response to the clock signals from the envelope sensing means;

decrementing the clock data stored in the RAM of the accessory interface microcomputer in response to the clock input signals from the envelope sensing means; and providing a transfer acknowledge signal from the accessory interface microcomputer to the supervisory control microcomputer upon receipt of data and commands therefrom by the accessory interface microcomputer.

11. The method recited in claim 10, including the step of:

electrically coupling some of the output ports of the accessory interface microcomputer with the transport system for movement of envelopes along the array in response to output signals from the accessory interface microcomputer.

12. Apparatus for interfacing with envelope handling accessories for a universal multi-station document inserter for performing predetermined functions with envelopes having documents inserted therein by the multi-station document inserter, comprising:

an accessory interface microcomputer for storing data and accessory interface programs;

envelope handling accessories arranged in an array;

means for electrically connecting certain output ports of said accessory interface microcomputer to said envelope handling accessories;

envelope sensing means associated with at least some of said envelope handling accessories for providing clock signals to the accessory interface microcomputer;

means for loading data into said accessory interface microcomputer prior to an envelope entering said array;

said programs stored in said accessory interface microcomputer being operative for actuating said envelope handling accessories in a sequence which is determined in response to the data loaded therein.

13. The apparatus recited in claim 12, including:

supervisory control circuit means including a microcomputer having data words stored therein for the envelope handling accessories;

and wherein said means for loading data comprises means for loading data words from said supervisory control circuit means into said accessory interface microcomputer for use with the envelope handling programs stored in said accessory interface microcomputer.

14. The apparatus recited in claim 13, wherein:

said loading means loads certain of said data words corresponding to particular combinations of envelope sensing means signals for indicating envelope jams, the type of accessory, its output location and clock data into said interface accessory microcomputer upon power up of said inserter.

15. The apparatus recited in claim 14, wherein:

said loading means loads other data words indicating the accessories to be actuated by an envelope entering the accessory array prior to the envelope entering said accessory array.

16. The apparatus recited in claim 15, wherein:

said envelope sensing means provide clock input signals to said interface accessory microcomputer in response to the detection of the presence of an envelope.

17. The apparatus recited in claim 16, including:

means for decrementing the clock data stored in said accessory interface microcomputer in response to clock input signals from said envelope sensing means.

18. The apparatus recited in claim 17, including:

a zip deflector accessory;

external timing means for providing external timing signals to said interface accessory microcomputer for said zip deflector accessory.

19. The apparatus recited in claim 13, including:

transfer acknowledge signal means for communication with said supervisory control microcomputer to acknowledge the receipt of data and commands therefrom.

20. The apparatus recited in claim 12, including:

port expander means electrically coupled to said accessory interface microcomputer to expand its input and output ports.

21. The apparatus recited in claim 12, including:

a transport system for moving envelopes along said array to the desired accessory;

means for electrically coupling said output ports of said accessory interface microcomputer with said transport system for moving envelopes along said array in response to output signals from said accessory interface microcomputer; and said envelope handling accessories being actuable in a predetermined sequence in response to the data loaded in said accessory interface microcomputer as the envelopes move along the array.

22. Apparatus for interfacing with envelope handling accessories for universal multi-station document inserter for performing predetermined functions with envelopes having documents inserted therein by the multi-station document inserter, comprising:

an accessory interface microcomputer for storing data and accessory interface programs;

envelope handling accessories arranged in an array;

means for electrically connecting certain output ports of said accessory interface microcomputer to said envelope handling accessories;

envelope sensing means associated with at least some of said envelope handling accessories for providing clock signals to the accessory interface microcomputer;

said programs stored in said accessory interface microcomputer being operative for actuating said envelope handling accessories in the proper sequence in response to data loaded therein as the envelopes move along said array;

supervisory control circuit means including a microcomputer having data words stored therein for the envelope handling accessories;

means for loading the data words from the supervisory control circuit microcomputer into a RAM of said accessory interface microcomputer for use with the envelope handling programs stored in said accessory interface microcomputer;

said loading means loads data words corresponding to particular combinations of envelope sensing means signals, the location, type and clocks of said envelope handling accessories into said RAM of said interface accessory microcomputer upon power up of said inserter;

said loading means loads other data words indicating the accessories to be actuated by an envelope entering said array into said RAM prior to the envelope entering the accessory array;

said envelope sensing means being operative to provide clock input signals to said interface accessory microcomputer in response to the detection of the presence of an envelope;

means for decrementing the clock data stored in said RAM of said accessory interface microcomputer in response to clock input signals from said envelope sensing means; and transfer acknowledge signals means connected to said accessory interface microcomputer for communication with said supervisory control microcomputer to acknowledge the receipt of data and commands therefrom.

23. The apparatus recited in claim 22, including:

a transport system for moving envelopes along the accessory array to the desired accessory;

means for electrically coupling said output ports of said accessory interface microcomputer with said transport system for moving envelopes along the array in response to output signals from said accessory interface microcomputer.

24. The apparatus recited in claim 22, including:

data address means for specifying a unique data address for said accessory interface microcomputer.

25. The apparatus recited in claim 22, including:

a zip deflector accessory;

external timing means for providing external timing signals to said interface accessory microcomputer for said zip deflector accessory.

* * * * *